US010076173B1

(12) United States Patent
Kaidi et al.

(10) Patent No.: US 10,076,173 B1
(45) Date of Patent: Sep. 18, 2018

(54) EMBEDDED MEMBER NAIL CLIPPER

(71) Applicants: Alexandre Rachid Kaidi, Napa, CA (US); Hamid Reza Shamsapour, San Rafael, CA (US); Risto Aadolf Rinne, Jr., Nicasio, CA (US)

(72) Inventors: Alexandre Rachid Kaidi, Napa, CA (US); Hamid Reza Shamsapour, San Rafael, CA (US); Risto Aadolf Rinne, Jr., Nicasio, CA (US)

( * ) Notice: Subject to any disclaimer, the term of this patent is extended or adjusted under 35 U.S.C. 154(b) by 580 days.

(21) Appl. No.: 14/544,135

(22) Filed: Nov. 28, 2014

(51) Int. Cl.
*A45D 29/02* (2006.01)

(52) U.S. Cl.
CPC ..... *A45D 29/02* (2013.01)

(58) Field of Classification Search
CPC ..... A45D 29/02
See application file for complete search history.

(56) References Cited

U.S. PATENT DOCUMENTS 1,394,727 A * 10/1921 Gronbech ..... A45D 29/02 30/28
2,540,782 A * 2/1951 Vang Hansen ..... A45D 29/02 131/248
2,799,923 A * 7/1957 Haruzo ..... A45D 29/023 30/124
3,013,334 A * 12/1961 Bassett ..... A45D 29/023 30/28
3,031,753 A * 5/1962 Pocoski ..... A45D 29/023 30/28
3,031,754 A * 5/1962 Pocoski ..... A45D 29/023 30/28
3,189,996 A * 6/1965 Casey, Jr. ..... A45D 29/02 24/698.1
3,744,131 A * 7/1973 Manes ..... A45D 29/023 30/28
3,986,257 A * 10/1976 Kiura ..... A45D 29/023 132/73
4,031,181 A * 6/1977 Schaefer ..... A63B 49/08 264/135
4,130,937 A * 12/1978 Kim ..... A45D 29/023 30/28
4,402,407 A * 9/1983 Maly ..... A61L 2/26 206/363

(Continued)

*Primary Examiner* — Sean Michalski
(74) *Attorney, Agent, or Firm* — Risto A. Rinne

(57) ABSTRACT

An apparatus for cutting nails includes single and dual blade embodiments with a frame formed primarily of plastic that includes upper and lower frame members. Numerous variations of a reinforcing member are disclosed. The reinforcing member is embedded in or attached to at least one of the frame members so that a portion, thereof, is preferably disposed in vertical alignment with a force that is applied to at least one of the frame members during use to reduce a magnitude of shear experienced and to also improve an ability to withstand shear. Optional integrally-formed sidewalls provide a container for capturing clippings and also reinforce the frame member thereby reducing flexing while also increasing its ability to withstand shear. Other disclosed innovations include improvements to the lever and blade, automatically file the nail, enhance safety and function, allow customization, improve aesthetics, and lower cost. Numerous other significant improvements are also disclosed.

52 Claims, 76 Drawing Sheets

(56) References Cited

U.S. PATENT DOCUMENTS 4,458,459 A * 7/1984 Irrgang ..... B60J 10/16 52/204.597
4,550,496 A * 11/1985 Reinicke ..... A45D 29/023 132/75.5
4,614,031 A * 9/1986 Chen ..... A45D 29/023 132/75.5
4,640,011 A * 2/1987 Gamble ..... A45D 29/023 132/73.5
4,648,415 A * 3/1987 Yuan ..... A45D 29/023 132/73
4,847,994 A * 7/1989 Dunn, Jr. ..... A45D 29/02 132/73
5,185,980 A * 2/1993 Rydberg ..... B02C 17/225 296/39.2
5,195,544 A * 3/1993 Campagna ..... A45D 29/023 132/73.5
5,533,262 A * 7/1996 Clark ..... A61D 1/005 30/242
5,622,191 A * 4/1997 McMullen, Jr. ..... A45D 29/02 132/73
5,702,120 A * 12/1997 Malofsky ..... B62B 7/00 280/642
5,983,498 A * 11/1999 Lieberman ..... A45D 29/023 132/75.5
6,009,880 A * 1/2000 Weidlich ..... A45D 29/023 132/73
6,088,919 A * 7/2000 Gilman ..... A45D 29/023 132/75.5
6,220,251 B1 * 4/2001 Jeong ..... A45D 29/04 132/73.5
6,523,545 B2 * 2/2003 Rende ..... A45D 29/023 132/75.5
6,553,592 B2 * 4/2003 Yang ..... A45D 29/02 30/28
6,557,259 B1 * 5/2003 Nguyen ..... A45D 29/02 132/75.5
6,560,874 B1 * 5/2003 DeMezzo ..... A45D 29/02 132/73.5
6,904,683 B2 * 6/2005 Shinoda ..... A45D 29/02 132/75.5
6,941,657 B2 * 9/2005 Choi ..... A45D 29/02 132/75.5
6,976,310 B1 * 12/2005 Sim ..... A45D 29/023 132/75.5
7,000,321 B1 * 2/2006 Rodgers ..... A01K 13/00 119/600
7,003,882 B2 * 2/2006 Sakai ..... A45D 29/02 30/26
7,020,964 B2 * 4/2006 Han ..... A45D 29/02 132/75.5
7,210,230 B2 * 5/2007 Wurzel ..... A45D 29/02 30/146
7,222,427 B1 * 5/2007 Kaidi ..... A45D 29/023 132/75.5
7,234,238 B2 * 6/2007 Wong ..... A45D 29/02 132/75.5
7,263,775 B2 * 9/2007 Moulton, III ..... A01K 13/00 119/600
D554,289 S * 10/2007 Johnson ..... D28/60
7,913,391 B1 * 3/2011 Eul ..... A45D 29/02 132/75.5
D639,510 S * 6/2011 Farris ..... D28/60
7,954,242 B1 * 6/2011 Brizan ..... A45D 29/02 132/75.5
8,082,668 B2 * 12/2011 Samson ..... A45D 29/02 132/75.5
8,096,053 B2 * 1/2012 Wong ..... A45D 29/02 30/125
8,496,013 B2 * 7/2013 McCourtney ..... A45D 29/023 132/73.5
8,640,319 B2 * 2/2014 McMullen, Jr. ..... A45D 29/023 132/75.5
8,683,700 B1 * 4/2014 Kaidi ..... A45D 29/02 30/175
8,863,758 B1 * 10/2014 Walenciak ..... A45D 29/02 132/73.5
8,984,754 B1 * 3/2015 Kaidi ..... A45D 29/02 30/28

* cited by examiner

EMBEDDED MEMBER NAIL CLIPPER

This utility patent application is a continuation-in-part of the following utility patent applications: Ser. No. 13/385,701, entitled "Nail Clipper with Opposing Parallel Blades" that was filed on Mar. 1, 2012; Ser. No. 13/999,344, entitled "Nail Clipper" that was filed on Feb. 11, 2014; Ser. No. 11/305,561, entitled "Nail Clipper with Blade-Insert" that was filed on Dec. 15, 2005, currently under appeal, and wherein this application is a continuation-in-part of the following design patent applications: Ser. No. 29/474,498, entitled "Dual Blade Nail Clipper" that was filed on Oct. 8, 2014; Ser. No. 29/474,499, entitled "Dual Blade Nail Clipper" that was filed on Oct. 8, 2014; Ser. No. 29/474,504, entitled "Dual Blade Nail Clipper" that was filed on Oct. 8, 2014; Ser. No. 29/474,500, entitled "Single Blade Nail Clipper" that was filed on Oct. 8, 2014; Ser. No. 29/474,501, entitled "Single Blade Nail Clipper" that was filed on Oct. 8, 2014; Ser. No. 29/474,502, entitled "Single Blade Nail Clipper" that was filed on Oct. 8, 2014; Ser. No. 29/474,364, entitled "Dual Blade Nail Clipper" that was filed on Aug. 20, 2014; Ser. No. 29/474,365, entitled "Single Blade Nail Clipper" that was filed on Aug. 20, 2014, and wherein this utility patent application claims the benefit of the date of priority of each of the respective above-identified utility and design patent applications, and wherein the entire content of each of above-identified earlier-filed utility and design patent applications is included herein by way of reference.

RESERVATION OF RIGHTS

A portion of the disclosure of this patent document contains material which is subject to intellectual property rights such as but not limited to copyright, trademark, and/or trade dress protection. The owners have no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention, in general, relates to personal grooming devices and, more particularly, to toenail or fingernail clippers.

As used herein, "nail clipper" includes either or both a toenail clipper and/or a fingernail clipper. Prior art versions of nail clippers are generally well known. The term "nail", as used hereinafter, refers to either a' fingernail or to a toenail or to both a fingernail and a toenail.

The current invention covers two generic types of nail cutting devices (i.e., nail clippers). The first type includes two (i.e., dual) parallel opposing blades where cutting edges of each of the blades face each other and are disposed parallel to each other at all times. This type of device cuts the nail across a portion of the width of the nail simultaneously on both the top and bottom of the nail, with the two simultaneous cuts intersecting (or nearly intersecting) proximate a middle of the nail. The current invention includes improvement to dual parallel opposing blade nail clippers.

The second type includes only one cutting blade that includes a cutting edge that abuts an opposing planar surface along the length of the cutting edge when the nail clipper is disposed in a closed position. The cutting edge of the cutting blade is parallel to the planar surface at all times. This type of device cuts the nail on one side of the nail simultaneously across a portion of the width of the nail, with the cut beginning at the top of the nail and extending downward until the nail is severed. The current invention improves single blade nail clippers of the type that include a cutting edge which abuts a planar surface in the closed position.

Both the first and second type of nail clipper are of a parallel cut class (or type) of nail clipper because for either class (or type) a parallel cut is occurring simultaneously across a portion of a width of the nail. This is different than a scissor-cut, as described below, where a cut is occurring at a point and not across a line of cut. The line of cut for the first and second type of nail clipper includes that portion of the width of the nail that is being severed. Accordingly, the current invention improves parallel cut types of nail clippers.

Reference is often made in this document to "dual parallel opposing blade types of nail clippers" or to "prior art dual parallel opposing blade types of nail clippers." Dual parallel opposing blade types of nail clippers, in general, provide certain benefits that are not available with other types of nail clippers, such as scissor-cut types of nail clippers. The current invention also provides several new and very important benefits that are not available with any of the prior art dual parallel opposing blade types of nail clippers. These important benefits are described herein.

As used herein, dual parallel opposing blade types of nail clippers include an upper cutting blade attached to an upper frame member and a lower cutting blade attached to a lower frame member. The upper blade includes an upper cutting edge and the lower blade includes a lower cutting edge.

Dual parallel opposing blade types of nail clippers include an open position in which the upper and lower cutting edges are disposed apart from each other and are parallel with respect to each other. Dual parallel opposing blade types of nail clippers also include a closed position in which the upper and lower cutting edges are also parallel with respect to each other. In the closed position, the upper and lower cutting edges are disposed closer to each other in the closed position than in the open position. It is preferable for the upper and lower cutting edges to abut each other in the closed position, however, they may be slightly offset and thereby disposed adjacent to each other in the closed position. The drawings and descriptions provided, herein, show the cutting edges for the dual parallel opposing blade embodiments of the invention as abutting one-another, however, they may be modified to include a slight offset, if desired.

Certain newer prior art dual parallel opposing blade types of nail clipper presently include plastic coverings that extend over portions of the prior art steel frame nail clippers. While this approach may provide a novel color or a different feel it also increases weight because the added plastic can only increase the weight of the already heavy prior art nail clipper. It is not generally desirable to increase the weight of any nail clipper as this makes transportation of the nail clipper more difficult to accomplish. It is desirable to decrease the weight of a nail clipper and to do so at reasonable cost. For example other metals, such as titanium, could conceivably be used to modify prior art steel frame nail clippers and make them lighter; however, doing so would also incur a severe cost increase.

Therefore, there is a need for a lighter and preferably less-expensive similar type of nail clipper. Applying a plastic coating to existing steel frame nail clippers fails to satisfy this objective.

Additionally, prior art dual parallel opposing blade types of nail clippers also include a considerable amount of metal (i.e., steel) that has been machined, or stamped or otherwise formed and assembled together. This is considerably more expensive than plastic, as far as raw material costs are concerned and also as far as fabrication cost is concerned. However, little change has occurred because the mechanical stresses arising during use have precluded the practical durable use of a plastic body in any type of nail clipper that includes cutting of at least a portion of the width of the nail using a blade that is substantially parallel with respect to the plane of the nail. Simultaneously cutting across the width or portion of the width of the nail requires considerable force to accomplish, as the nail is hard and resists cutting considerably more than would occur if using a scissor-type of nail clipper.

Prior art dual parallel opposing blade types of nail clippers apply the cutting force to the upper and lower steel frame members, which must transfer that force through the steel frame members to the blades at the front of each of the steel frame members. A resistance to cutting the nail results in the application of a resistive force being applied (by the nail) to each of the blades. The resistive force is in an opposite direction as compared to the direction of cutting force that is applied to each of the steel frame members. Opposing direction forces applied to the same member result in shear, or shear force, being experienced by the member. Therefore, each of the steel frame members experience shear during cutting of the nail. If the frame members of prior art dual opposing parallel blade types of nail clippers were not made of steel but were instead made of a softer material they would eventually either break or bend. The reason prior art dual parallel opposing blade types of nail clippers have maintained the use of sufficiently high-grade steel for the fabrication of their frame members is because steel is strong enough to withstand the shear force and to resist bending in response to these forces.

It is impossible to avoid the occurrence of these forces during use with dual parallel opposing blade types of nail clippers. However, there remains a long-standing need to improve the design of dual parallel opposing blade types of nail clippers so that materials other than steel can be used to form the upper and lower frame members. In particular, there remains a long-standing need to improve the design of dual parallel opposing blade types of nail clippers so that the upper and lower frame members can be formed of a polymer (plastic) or other non-metallic material.

Similar opposing forces are also experienced by the single blade nail clipper of the type that includes a cutting edge which abuts a planar surface. Therefore, the frame members of the single blade nail clipper also experience shear. Accordingly, similar needs, as described herein for dual parallel opposing blade types of nail clippers, also apply to the single blade nail clipper of the type that includes a cutting edge which abuts a planar surface. Therefore, the benefits provided by the current invention apply to dual parallel opposing blade types of nail clippers and also to the single blade nail clippers of the type that include a cutting edge which abuts a planar surface along the length of the cutting edge.

A parallel cutting blade or pair of parallel opposing cutting blades is substantially different than a scissor-type of cutting action that cuts the nail at a point (as opposed to along a line across a width of the nail.) During use when cutting with a scissor-type of cut, a point of cutting moves across the width of the nail as the scissor-cut progresses. Because the scissor-type of nail clipper is always severing the nail at a point and not along a line, it experiences lower operating forces during cutting and only the smallest fraction of mechanical stress or shear force as compared to what is experienced by a nail clipper that uses a cutting blade that is parallel to the plane of the nail and which simultaneously severs a portion of the width of the nail. Considerably less stress is experienced with the scissor-cut than occurs with a cutting blade that is generally parallel with respect to the plane of the nail. Accordingly, a scissor-cut type of nail clipper that includes a steel blade and plastic body is known. See U.S. Pat. No. 4,819,673 to McMullen, Jr.

However, the scissor-cut has certain substantial disadvantages that occur when attempting to cut a nail as compared to a parallel type of cutting action. When cutting a nail with a scissor-cut type of nail clipper it is necessary to supply a significant force constantly urging the nail toward the scissor blades and urging the scissor blades toward the nail. This is because the closing of the angled scissor blades during cutting also always applies a force against the nail that tends to urge the nail away from the blades at the point of cutting. The user must compensate for this force with an opposing force urging the nail and the scissor blades toward each other until the cut is completed.

If, during a cutting of the nail with a scissors-type of nail clipper, the user slips there is risk that the fleshy part of the finger or toe can be urged into contact with the scissor blades, cutting the finger or toe. Also, because cutting is occurring at a point (and not along a line) there is danger of removing more of the nail than desired. When a parallel type of cutting of the nail occurs the user is able to better judge the depth of cut, although prior art types of nail clippers also have some risk of removing more or less of the nail than desired.

Additionally, the user of a scissor-type of nail clipper must constantly change the position of the nail clipper relative to the nail during cutting to follow the contour of the nail in order to obtain the desired curvature. Alternately, numerous smaller cuts can be made. Either approach increases the time required to cut each nail. Also, the overall cut may not provide the desired contour of the finished nail.

By way of contrast, after initial placement no additional force is required by the user to maintain a nail in position with respect to the cutting blades of the dual parallel opposing blade type of nail clipper or with respect to the single blade nail clipper of the type that includes a cutting edge which abuts a planar surface. As the cut begins, the parallel opposing cutting blades or the single blade immediately begins to cut into, and thereby, clamp and secure the nail in position relative to the opposing blade or relative to the planar surface.

There is also much less risk of injury with a parallel cutting blade type of nail clipper. It is also faster. Additionally, the parallel cutting blade or blades can include a curvature, if desired, that approximates a desired finished contour of the nail, thereby eliminating the need for numerous additional small cuts. The use of a curved dual parallel opposing blade type of nail clipper can lessen or even eliminate the need for filing of the nail after cutting. It is also easier to control the depth of cut (i.e., how much nail material is removed) with certain examples of a dual parallel opposing blade type of nail clipper using novel depth-limiting improvements, as described, herein. These depth-limiting improvements also apply to certain single parallel cutting blade versions of the invention.

The prior art parallel cut type of nail clippers include a pair of parallel opposing steel blades that are integrally formed with opposing steel upper and lower frame members. The steel blades may be detachable with respect to the frame members. See FIG. 3 of U.S. Pat. No. 6,941,657, to Choi et al, that issued on Sep. 13, 2005. A ridge that is provided in a steel center post (rod) engages with a steel pivoting lever and, together, are used to supply a force sufficient to urge the opposing frame members (and the dual parallel opposing blades) toward one-another sufficient to sever the nail along a width of the nail that is disposed between the opposing blades.

For the above described structural reasons, the body, opposing blades, lever, and post of the prior art dual parallel opposing blade devices are all made from metal, such as steel. The prior art dual parallel opposing blade nail clippers include an upper and lower half of the body, with each half of the body including one blade portion that includes a cutting edge and with each blade portion disposed generally on a plane that is at an angle with respect to a remainder of the body. Each of the upper and lower halves of the body is generally disposed on a more horizontal plane and each of the blade portions is generally disposed on a more vertical plane. The two halves of the body are joined together during manufacture, taking care to ensure that the cutting edges of the blades are in alignment with respect to each other.

The machining of the opposing two halves of the body, bending the opposing halves to form the blades at nearly a right angle with respect to a remainder of the upper and lower frame members, and ensuring that the opposing blades align with one another and that the blades will abut against one another when the prior art nail clipper is disposed in a closed position (after finishing a cut) is difficult and, therefore, adds to the cost of manufacture. Also, fastening together the opposing sides (i.e., the upper and lower frame members) of the body, as well as the cost of the steel and the large amount of steel that is used, together, further contribute to increasing the relatively high cost of these prior art types of dual parallel opposing blade types of nail clippers.

The second type of device that includes a single blade with a cutting edge that abuts an opposing planar surface along the length of the cutting edge when the nail clipper is disposed in a closed position is believed to be novel.

Accordingly, there is a need for an embedded member single blade or an embedded member dual blade nail clipper that makes a parallel cut which is inexpensive to manufacture. There is a need for an embedded member single blade or an embedded member dual blade nail clipper that makes a parallel cut which includes at least one embedded member that is in vertical alignment with a cutting force that is applied to a front portion of an upper frame member and/or a front portion of a lower frame member, wherein the embedded member is disposed in the front portion of the frame member, and wherein the embedded member is able to sufficiently stiffen a front portion of the upper frame member and/or a front portion of the lower frame member of the nail clipper sufficient to withstand a cutting force that is applied to either of the frame members. There is a need for an embedded member single blade or an embedded member dual blade nail clipper that lessens the adverse effects of shear sufficient to permit the use of plastic or other non-metallic materials in the frame members. There is a need for an embedded member single blade or an embedded member dual blade nail clipper that is able to decrease a magnitude of shear force experienced by an upper frame member or by a lower frame member or by both the upper frame member and the lower frame member during cutting of the nail. There is also a need for a disposable parallel cutting blade class (i.e., either an embedded member single blade or an embedded member dual blade type) of nail clipper that is inexpensive to manufacture.

If sufficiently inexpensive, such a nail clipper could be given away or offered to guests at finer hotels or it could be sold at a lower cost than currently available prior art parallel cut types of nail clippers. There is need for a nail clipper that can meet any of these needs and which also has at least one parallel cutting blade that is able to sever a nail across at least a portion of the width of the nail that is disposed under the cutting blade and above the planar surface or between the cutting blades during use.

There is also a need to include, as desired, advertising on a nail clipper. There is also a need to provide a lighter-weight type of nail clipper.

A need with prior art types of dual parallel opposing blade types of nail clippers is to ensure that the cutting edges of the blades abut (or very nearly abut) against each other when the nail clipper is urged into the fully closed position. An offset between the prior art blades could make cutting difficult to accomplish. An offset between the cutting edges could also result in an uneven cut and a resulting ragged edge of the cut nail. Accordingly, there is a need to more inexpensively or easily align opposing cutting blades of a dual parallel opposing blade type of nail clipper. Similarly, there is also a need to provide a parallel cutting blade type of nail clipper that allows for alignment between a pair of opposing cutting edges of opposing blades during manufacture at low cost.

It is also desirable to provide as many of these benefits as possible while forming the blades out of steel or any other desired suitable material, such as a ceramic or composite material, and forming the body out of a plastic, polymer, nylon, synthetic or other non-metallic type of a material that is different than the material used to form the blade, in which the structural part of the body that experiences the cutting forces and which holds the blades in position relative to each-other, is not formed of a steel or of a metal. While steel is a desirable material to use in the manufacture of the blades for many versions of the current invention, it is desirable and an object of the invention, to form the greater portion of the upper and the lower frame members of a dissimilar material as compared to the blades.

It is also desirable and an object that plastic (or any preferred polymer, nylon, or other synthetic material) be employed as the dissimilar material that is used to form the upper and lower members of the current nail clipper, and that the dissimilar material also be used to secure each of the blades thereto with cutting edges of the blades facing one another.

It is further desirable and an object that a horizontal portion of the blades are embedded in the plastic (i.e., in the dissimilar and non-metallic) material that is used to form the upper and lower members of the nail clipper. As used herein, the term "embedded" includes partial embedding as well as "surround, full or complete" embedding. Partial embedding, as used herein, refers to where only a portion of the horizontal portion of the blade is surrounded by the plastic (dissimilar) material in which the plastic (dissimilar) material does not extend fully around any portion of the blade. Surround, full or complete embedding, as used herein, refers to where at least a portion of the horizontal portion of the blade is encased, surrounded, or covered with the plastic (dissimilar) material.

It is an even further desirable and important object that the horizontal portion of the blades that is embedded in the plastic (dissimilar material) is extended sufficiently far into the plastic (dissimilar material) to effectively reinforce the plastic in the area where the greatest stress and strain is experienced during use and to also transfer cutting forces to the cutting edges of the blades while helping to prevent damage from occurring to the plastic (i.e., dissimilar) material that is used to form the upper and lower members of the nail clipper.

It is preferred that the blade(s) include as an improvement the horizontal portion, and that each horizontal portion extend sufficiently far into the upper and lower frame members so as to ensure that the horizontal portion of the blade (for single blade versions) or the horizontal portion of the blades (for dual blade versions) is/are in vertical alignment with the forces that are applied to the upper and lower frame members during cutting. As described herein, this (i.e., the embedded horizontal portions) increase stiffness and strength of the upper and lower frame members in this critical area. The embedded horizontal portions help to ensure that the upper and lower frame members, which can now be fabricated from low cost plastic, are able to withstand a greater magnitude of shear force (than without the embedded horizontal portions) and this improvement also helps to lessen the magnitude of shear force that is experienced by the upper and lower frame members by converting a portion of the shear force into a compressive force that is experienced by the upper and lower frame members, thereby decreasing the magnitude of shear force experienced by the upper and lower frame members.

After having had benefit of the teachings, herein, it is possible to include a discreet embedded member within the upper and lower frame members where the discreet embedded member extends sufficiently far into the frame members to ensure that a portion of the discreet embedded member(s) is/are in vertical alignment with the forces applied to the frame members during use (i.e., cutting). Use of the discreet embedded member(s) can be used instead of the embedded horizontal portions providing that the blade (for single blade versions) or the blades (for dual opposing blade versions) is otherwise secured to the plastic (non-metallic) frame members. While use of the horizontal portion of the improved blade(s) is/are preferred as the inventive embedded member, the use of the discreet embedded member(s), as disclosed and described herein, is also possible and anticipated.

Past, current and future advances in 3D printing, injection and other molding technologies are anticipated to be used to form the plastic (dissimilar material) body of the current invention (i.e., the upper and lower frame members). The body could be molded as an integral one-piece component with the dual opposing blades attached thereto during a desired step of manufacturing. This, if accomplished, would eliminate the need for precisely controlling tolerances as have historically been necessary during the manufacture of prior art steel frame types of dual opposing blade nail clippers.

It is desirable to use plastic (i.e., polymer or other non-metallic material) to form the upper and lower frame members of the body of the current nail clipper and include the cutting blades in the body during molding or manufacture of the nail clipper.

Although a one-piece polymer structure is disclosed as one possible preferred embodiment, if desired, identical (or nearly so) discreet polymer upper and lower frame members could be provided that are inverted with respect to each other and then later joined (secured) together by any preferred means. By controlling position during joining or by trimming a distal end to control the overall length of the polymer upper and lower frame members to match one-another prior to joining the upper and lower frame members together, positioning of the opposing cutting edges of the blades to ensure that they abut one-another in the closed position can be precisely, easily and inexpensively controlled during manufacture.

Other advances in molding technology are anticipated to be used, as desired, for manufacture of the current invention or to modify it, as may later be desired. For example, it may be desirable to form the body out of two or more different types of polymer (or other non-metallic) material. This approach could be optimally applied to provide the necessary structural rigidity and also a particular desired texture or feel to the nail clipper during use. For example, a sufficiently strong and rigid type of plastic could be used to form the structural portion of the body that experiences the stress and strain (i.e., forces) during cutting while a more elastic material could also be used (for example, injected) at a distal end of the nail clipper (i.e., maximally away from the cutting blades) proximate where an upper portion of the body and a lower portion of the body connect together or are fastened together. The more elastic material could also function as an elastomeric wedge, as disclosed in currently pending application Ser. No. 13/385,701, entitled, "Nail Clipper with Opposing Parallel Blades," that was filed on Mar. 1, 2012, to supply a greater force that helps urge the upper portion away from the lower portion, thereby providing space for inserting a portion of a nail, there-between.

As mentioned previously, this connection could be accomplished by molding the upper and lower portions as an integral one-piece assembly. Alternately as mentioned above, the upper and lower portions could be molded as individual component parts and later joined together, such as by fusion welding, sonic welding, adhesive, banding, clamping or by any other preferred means such as the use of a desired type of fastener. One preferred means of securing discreet upper and lower frame members together is described, herein.

If the body (where "body" and "frame" are used interchangeably herein) were formed out of two or more different types of material, differences between the color of the materials could be advantageously used to provide a desired aesthetic appearance, accent, or injected to provide a surface with a different texture (i.e., coefficient of friction) or a different contour (either a raised or recessed surface), or to provide desired markings, such as letters, numbers, symbols, a logo, etc. These enhancements, though not described in detail, are anticipated by the present disclosure.

When compared to all-steel prior art dual parallel opposing blade types of nail clippers the current design enhancements provide many significant benefits not previously available. These benefits encompass structural, aesthetic, cost of manufacture, ease of manufacture, safety, storage, lower weight, decreased use of steel, use of plastic or other non-metallic material to form the upper and lower frame members, functionality improvements, and enhanced ease of use advantages.

It is desirable also to include, as preferred for certain versions of the invention, a structure for containing nail fragments that break off during cutting. If the body is molded it then also becomes possible to include sidewalls that are molded to the frame members and which help create a structure that is able to contain cut nail fragments.

It is also desirable to include, as preferred for certain versions of the invention, an inventive safety bumper that helps ensure that only a desired amount of the nail is removed and which further lessens the possibility of personal injury during use.

Also, because prior art nail clippers include so much metal, they are often detected during airport security screening which can then result in the searching of personal sundries that would not otherwise be so scrutinized. They may even be confiscated as a potentially dangerous weapon, which of course is a debatable assessment, but if confiscated it leaves the person without a nail clipper when they reach their destination. It is desirable to include sufficiently little metal with a nail clipper so that it does not generally register as a potential threat during airport security screening procedures. Minimizing the amount of metal (i.e., steel) that is included in an embedded member single blade or in an embedded member dual blade parallel cut type of nail clipper is an object of the present invention.

The machining of a cutting edge into the opposing blades of a prior art type of dual parallel opposing blade type of nail clipper is relatively expensive to accomplish. Additionally, the aligning of the cutting edges so they abut against each other or are otherwise sufficiently close to each other in the closed position increases the difficulty and cost of manufacture of prior art nail clippers. It is an object of the invention to provide an improved blade that can be embedded in a plastic (or other non-metallic) upper frame member of an embedded member single blade parallel cut nail clipper or additionally embedded in a plastic (or other non-metallic) lower frame member of an embedded member dual blade parallel cut nail clipper. It is an object that the improved blades lower the cost of manufacture. For the embedded member dual parallel opposing blade nail clipper it is also a further object to provide a desired degree of alignment between the cutting edges of the opposing blades at lower cost.

There are two additional long-standing problems common with all prior art dual parallel opposing blade types of nail clippers that occurs as a type of a lever that cooperates with a center rod is depressed. The lever can always rotate around a center longitudinal axis of the center rod that passes through the frame of the nail clipper. This rotation is useful under certain conditions because it allows the nail clipper to be intentionally urged into a more compact rest (i.e., a storage or transit) position. However, when actually cutting a nail, considerable force is applied to the lever. If as increasing force is applied, the lever unintentionally rotates around the center longitudinal axis of the center rod, the direction of force that is being applied to the nail clipper can suddenly change. This can cause the nail clipper to become dislodged from its position of cooperation with the nail. The cutting edge(s) of the blade(s) can accidently be urged, with sudden and considerable force, against a fleshy part of the finger, possibly cutting the finger. Therefore, there is a need to prevent inadvertent rotation of the lever of the nail clipper around the longitudinal axis of the center rod during cutting of the nail. This is true for embedded member single blade parallel cut versions and embedded member dual blade parallel cut versions of the nail clipper. There is a similar need to be able to prevent the lever from similarly rotating when the nail clipper is disposed in the rest or transit position. Inadvertent rotation around the longitudinal axis of the center rod can urge the nail clipper out of the rest or transit position increasing its bulk, which is undesirable. No effective prior solution exists for either of these long-standing problems.

Therefore, a parallel cutting type of nail clipper that provides any of the benefits discussed herein, is especially desirable.

Accordingly, there exists today a need for an embedded member nail clipper that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such an apparatus would be most useful and is especially desirable.

2. Description of Prior Art

Nail clippers are, in general, known. For example, the following patent documents describe various types of these devices, some of which may have some degree of relevance to the invention. Other patent documents listed below may not have any significant relevance to the invention. The inclusion of these patent documents is not an admission that their teachings anticipate any aspect of the invention. Rather, their inclusion is intended to present a broad and diversified understanding regarding the current state of the art appertaining to either the field of the invention or possibly to other related or even distal fields of invention.

U.S. Pat. No. 8,683,700 to Kaidi, et al., that issued on Apr. 1, 2014;

U.S. Pat. No. 7,222,427 to Kaidi, et al., that issued on May 29, 2007;

U.S. Pat. No. 7,024,774 to Novellie, et al., that issued on Apr. 11, 2006;

U.S. Pat. No. 7,020,964 to Han, et al., that issued on Apr. 4, 2006;

U.S. Pat. No. 6,941,657 to Choi, et al., that issued on Sep. 13, 2005;

U.S. Pat. No. 6,606,794 to Rieser, that issued on Aug. 19, 2003;

U.S. Pat. No. 6,088,919 to Gilman, that issued on Jul. 18, 2000;

U.S. Pat. No. 5,983,498 to Lieberman, et al., that issued on Nov. 16, 1999;

U.S. Pat. No. 5,964,033 to Wolf, that issued on Oct. 12, 1999;

U.S. Pat. No. 5,634,275 to Pine, that issued on Jun. 3, 1997;

U.S. Pat. No. 5,488,772 to Dababneh, et al., that issued on Feb. 6, 1996;

U.S. Pat. No. 5,331,739 to Basangy, that issued on Jul. 26, 1994;

U.S. Pat. No. 5,195,544 to Campagna, that issued on Mar. 23, 1993;

U.S. Pat. No. 4,847,994 to Dunn, Jr., that issued on. Jul. 18, 1989;

U.S. Pat. No. 4,819,673 to McMullen, Jr., that issued on Apr. 11, 1989;

U.S. Pat. No. 4,776,090 to Grassi, that issued on Oct. 11, 1988;

U.S. Pat. No. 4,731,927 to Wilson, that issued on Mar. 22, 1988;

U.S. Pat. No. 4,614,031 to Chen, that issued on Sep. 30, 1986;

U.S. Pat. No. 4,550,496 to Reinicke, that issued on Nov. 5, 1985;

U.S. Pat. No. 4,519,134 to Bumbera, that issued on May 28, 1985;

U.S. Pat. No. 4,341,015 to Young, that issued on Jul. 27, 1982;

U.S. Pat. No. 4,130,937 to Kim, that issued on Dec. 26, 1978;

U.S. Pat. No. 3,997,966 to Sartore, that issued on Dec. 21, 1976;

U.S. Pat. No. 3,914,866 to Applegate, that issued on Oct. 28, 1975; and

U.S. Pat. No. 796,389 to Wright, that issued on Aug. 1, 1905.

And including U.S. Patent Application Publications:

U.S. Patent Application Publication No. 2009/0211098 to Childs, II, that published on Aug. 27, 2009;

U.S. Patent Application Publication No. 2004/0098861 to Novellie, et al., that published on May 27, 2004; and U.S. Patent Application Publication No. 2004/0148779 to Choi, et al., that published on Aug. 5, 2004.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an embedded member nail clipper with a pair of parallel opposing cutting blades (i.e., dual blades).

It is an important object of the present invention to provide an embedded member nail clipper with a single parallel cutting blade (i.e., single blade) that abuts a parallel planar surface when the nail clipper is disposed in a closed position.

It is a further object of the invention to provide an embedded member nail clipper with a substantially plastic or non-metallic frame that includes an upper and a lower frame member and at least one parallel cutting blade wherein the blade includes a horizontal portion which is at least partially embedded in one of the frame members, and wherein the horizontal portion extends sufficiently far into the frame member to ensure that a portion of the horizontal portion is in vertical alignment with a force that is applied to the frame member during cutting of a nail.

Another object of the invention is to provide an embedded member nail clipper with a single parallel cutting blade or with dual parallel opposing cutting blades that includes a container for capturing one or more nail clippings after cutting of a nail by the nail clipper has occurred, thereby preventing an unwanted discharge of the nail clipping(s) into a surrounding area proximate the nail clipper.

It is a first continuing object of the invention to provide an embedded member nail clipper with a single parallel cutting blade or with dual parallel opposing cutting blades that increases strength or stiffness of at least one frame member.

It is a second continuing object of the invention to provide an embedded member nail clipper with a single parallel cutting blade or with dual parallel opposing cutting blades that increases an ability of at least one frame member to withstand a shear force proximate the blade or blades.

It is a third continuing object of the invention to provide an embedded member nail clipper with a single parallel cutting blade or with dual parallel opposing cutting blades that decreases a magnitude of shear force that is experienced by at least one frame member.

It is a fourth continuing object of the invention to provide an embedded member nail clipper with a single parallel cutting blade or with dual parallel opposing cutting blades that is able to convert a portion of a shear force applied to a frame member to a compressive force that is experienced by the frame member.

It is a fifth continuing object of the invention to provide an embedded member nail clipper with a single parallel cutting blade or with dual parallel opposing cutting blades that includes a pair of spaced-apart sidewalls which are attached either as integral extensions of a lower frame member or as integral extensions of an upper frame member or as integral extensions of the lower frame member and the upper frame member, and wherein the sidewalls cooperate with a remainder of the nail clipper to provide a container for the capture of one or more nail clippings.

It is a sixth continuing object of the invention to provide an improvement to a blade for use in an embedded member nail clipper with a single parallel cutting blade or in a dual parallel opposing cutting blade nail clipper wherein the improvement includes a modified blade, and wherein the modified blade includes a cutting blade portion that is disposed on a first generally vertical plane and a horizontal portion that is disposed on a second generally horizontal plane, wherein the horizontal portion is attached to or formed integral with the cutting blade portion, and wherein at least a portion of the horizontal portion is disposed within a frame member an amount sufficient to extend both forward and rearward with respect to a vertical line where a cutting force is applied to the frame member during a cutting of a nail.

It is a seventh continuing object of the invention to provide an improvement to an embedded member nail clipper with a single parallel cutting blade or with dual parallel opposing cutting blades that includes an upper frame member and a lower frame member wherein the upper frame member and the lower frame member are formed substantially of a plastic or other non-metallic material and wherein the blade or blades are formed of steel or of a desired metal or of another material that is different than the material used to form the upper and lower frame members.

It is an eighth continuing object of the invention to provide an improvement to an embedded member nail clipper with a single parallel cutting blade or with dual parallel opposing cutting blades that includes a one-piece frame that includes an upper frame member and a lower frame member, and wherein at least one of the frame members includes an embedded member or a horizontal portion of a blade embedded therein that extends under a vertical line where a cutting force is applied to the at least one of the frame members during cutting of a nail.

It is a ninth continuing object of the invention to provide an improvement to an embedded member nail clipper with a single parallel cutting blade or with dual parallel opposing cutting blades that includes a two-piece frame that includes an upper frame member and a lower frame member wherein a rear of the upper frame member is secured to a rear of the lower frame member, and wherein at least one of the frame members includes an embedded member or a horizontal portion of a modified blade embedded therein that extends under a vertical line where a cutting force is applied to the at least one of the frame members during cutting of a nail.

It is a tenth continuing object of the invention to provide an improvement to an embedded member nail clipper with a single parallel cutting blade or with dual parallel opposing cutting blades that includes a two-piece frame that includes an upper frame member and a lower frame member wherein a rear of the upper frame member is secured to a rear of the lower frame member by a clip or other fastener, and wherein at least one of the frame members includes an embedded member or a horizontal portion of a modified blade embedded therein that extends under a vertical line where a cutting force is applied to the at least one of the frame members during cutting of a nail.

It is an eleventh continuing object of the invention to provide an improvement to an embedded member nail clipper with a single parallel cutting blade or with dual parallel opposing cutting blades that includes a frame that includes an upper frame member and a lower frame member formed of a plastic or other non-metallic material, and wherein during cutting of a nail at least one of the frame members is able to flex an amount sufficient to permit the nail clipper to be urged into a closed position.

It is a twelfth continuing object of the invention to provide an improvement to an embedded member nail clipper with a single parallel cutting blade or with dual parallel opposing cutting blades that includes a frame that includes an upper frame member and a lower frame member formed of a plastic or other non-metallic material, and wherein either the upper frame member or the lower frame member includes a pair of upright container sidewalls that are formed integral with the frame member, and wherein during cutting of a nail the frame member that does not include the pair of container sidewalls is able to flex an amount sufficient to permit the nail clipper to be urged into a closed position, and wherein the frame member that includes the pair of container sidewalls is stiffer and does not flex as much as the frame member that does not include the pair of container sidewalls.

It is a thirteenth continuing object of the invention to provide an improvement to an embedded member nail clipper with a single parallel cutting blade or with dual parallel opposing cutting blades that includes a frame that includes an upper frame member and a lower frame member formed of a plastic or other non-metallic material, and wherein during cutting of a nail both of the frame members are able to flex a similar amount that is sufficient to permit the nail clipper to be urged into a closed position.

It is a fourteenth continuing object of the invention to provide an improvement to an embedded member nail clipper with a single parallel cutting blade or with dual parallel opposing cutting blades that includes a center rod and a lever cooperatively attached to the center rod, wherein the improvement includes a two-piece center rod.

It is a fifteenth continuing object of the invention to provide an improvement to an embedded member nail clipper with a single parallel cutting blade or with dual parallel opposing cutting blades that includes a lever cooperatively attached to a center rod, wherein the improvement includes an embedded member disposed in the lever, wherein the lever is formed substantially of a plastic or other non-metallic material, and wherein the embedded member is formed of a different material than a remainder of the lever is formed of, and wherein the embedded member increases stiffness or strength or both stiffness and strength of at least a portion of the lever.

It is a sixteenth continuing object of the invention to provide an improvement to an embedded member nail clipper with a single parallel cutting blade or with dual parallel opposing cutting blades that includes an upper frame member and a lower frame member and an embedded member disposed in a front portion of at least one of the frame members, wherein the embedded member is in vertical alignment with a cutting force that is applied to the at least one of the frame members.

It is a seventeenth continuing object of the invention to provide an improvement to an embedded member nail clipper with a single parallel cutting blade or with dual parallel opposing cutting blades that includes an upper frame member and a lower frame member and an embedded member disposed in a front portion of at least one of the frame members, wherein at least one of the frame members includes a safety bumper that limits an amount of a nail that can be severed by the nail clipper.

It is an eighteenth continuing object of the invention to provide an improvement to an embedded member nail clipper with a single parallel cutting blade or with dual parallel opposing cutting blades that includes an upper frame member and a lower frame member and wherein the blade or the blades include a modified blade with a horizontal portion attached thereto, and wherein at least a portion of the horizontal portion is embedded in a front portion of at least one of the frame members, and wherein the modified blade includes a cutting edge that extends along a straight line.

It is a nineteenth continuing object of the invention to provide an improvement to an embedded member nail clipper with a single parallel cutting blade or with dual parallel opposing cutting blades that includes an upper frame member and a lower frame member and wherein the blade or the blades include a modified blade with a horizontal portion attached thereto, and wherein at least a portion of the horizontal portion is embedded in a front portion of at least one of the frame members, and wherein the modified blade includes a cutting edge that extends along a curved line.

It is a twentieth continuing object of the invention to provide an improvement to an embedded member nail clipper with a single parallel cutting blade or with dual parallel opposing cutting blades that includes an upper frame member and a lower frame member and wherein a rear of the upper frame member and a rear of the lower frame member are attached as integral components to a rear wall of the nail clipper.

It is a twenty-first continuing object of the invention to provide improvement to an embedded member nail clipper with a single parallel cutting blade or with dual parallel opposing cutting blades that includes an upper frame member and a lower frame member and which includes a pair of spaced-apart sidewalls that are attached either as integral extensions of the lower frame member or as integral extensions of the upper frame member, and wherein a rear of the upper frame member and a rear of the lower frame member and a rear of the sidewalls are attached as integral components to a rear wall of the nail clipper.

It is a twenty-second continuing object of the invention to provide an improvement to an embedded member nail clipper with a single parallel cutting blade or with dual parallel opposing cutting blades that includes an upper frame member and a lower frame member and an embedded member disposed in a front portion of at least one of the frame members, and a lever that is cooperatively attached to a center rod, and wherein a fulcrum of the lever is used to supply a cutting force to the upper frame member or to the lower frame member or to both the upper frame member and the lower frame member during cutting of a nail.

It is a twenty-third continuing object of the invention to provide an improvement to an embedded member nail clipper with a single parallel cutting blade or with dual parallel opposing cutting blades that includes an upper frame member and a lower frame member and which includes a pair of spaced-apart sidewalls that are attached either as integral extensions of the lower frame member or as integral extensions of the upper frame member, and an axially pivoting lever that is pivotally attached to each of the sidewalls, wherein the axially pivoting lever is able to pivot about an axis that passes through the sidewalls.

It is a twenty-fourth continuing object of the invention to provide an improvement to an embedded member nail clipper with a single parallel cutting blade or with dual parallel opposing cutting blades that includes an upper frame member and a lower frame member that are substantially formed of a plastic or other non-metallic material, and wherein either the upper frame member or the lower frame member or both the upper frame member and the lower frame member includes an accessory selected from the group consisting of a magnifying lens, a solar panel, a computer chip, an on-off switch, a save button, a battery, an assembly of electronic components, an assembly of electronic image capture technology components, one or more LED lights, a laser light, a display screen, interconnecting wiring, a logo, a molded image, a molded desired shape, a molded resemblance of a wheel or plurality of wheels, a molded resemblance of an automobile, a molded resemblance of a person, caricature or an object, and a written message.

It is a twenty-fifth continuing object of the invention to provide an improvement to an embedded member nail clipper with a single parallel cutting blade or with dual parallel opposing cutting blades that includes an upper frame member and a lower frame member and a lever that is substantially formed of a plastic or other non-metallic material, and wherein the lever includes an accessory selected from the group consisting of a magnifying lens, a solar panel, a computer chip, an on-off switch, a save button, a battery, an assembly of electronic components, an assembly of electronic image capture technology components, a display screen, one or more LED lights, a laser light, interconnecting wiring, a logo, a molded image, a molded desired shape, a molded resemblance of a wheel or plurality of wheels, a molded resemblance of an automobile, a molded resemblance of a person, caricature or an object, and a written message.

It is a twenty-sixth continuing object of the invention to provide an improvement to an embedded member nail clipper with a single parallel cutting blade or with dual parallel opposing cutting blades that includes an upper frame member and a lower frame member and a pair of spaced-apart sidewalls that are attached to the lower frame member and a lever, and wherein when the nail clipper is disposed in an open position and the lever is disposed in longitudinal alignment with respect to a center longitudinal axis of the upper and lower frame members and wherein when the lever is urged in a downward direction or in an upward direction a portion of the lever is secured by the sidewalls in longitudinal alignment with respect to the center longitudinal axis of the upper and lower frame members.

It is a twenty-seventh continuing object of the invention to provide an improvement to an embedded member nail clipper with a single parallel cutting blade or with dual parallel opposing cutting blades that includes an upper frame member and a lower frame member and a pair of spaced-apart sidewalls that are attached to the lower frame member which are molded as an integral component part of the nail clipper and which, together with a rear wall and a remainder of the nail clipper, form a container that is useful for capturing one or more nail clippings after cutting of the nail by the nail clipper has occurred.

It is a twenty-eighth continuing object of the invention to provide an improvement to an embedded member nail clipper with a single parallel cutting blade or with dual parallel opposing cutting blades that includes an upper frame member and a lower frame member and an embedded member disposed in a front portion of at least one of the frame members, that includes any desired type of a one-piece center rod or any desired type of a two-piece center rod, and wherein the one-piece center rod or the two-piece center rod is formed of any desired material including a plastic or other non-metallic material.

It is a twenty-ninth continuing object of the invention to provide an embedded member nail clipper with a single parallel cutting blade or with dual parallel opposing cutting blades that includes a substantially planar and generally rectangular-shaped member that is embedded in a forward portion of an upper frame member or in a forward portion of a lower frame member or in a forward portion of both the upper frame member and the lower frame member of the nail clipper wherein the member is useful in increasing strength and/or stiffness of the frame member it is embedded in, and wherein the member reduces a deleterious effect of shear force applied to the forward portion of the upper frame member or applied to the forward portion of the lower frame member.

It is a thirtieth continuing object of the invention to provide an embedded member nail clipper with a single parallel cutting blade or with dual parallel opposing cutting blades that includes a rest position which is useful for storage or transport of the nail clipper, and wherein the nail clipper can be disposed into or out of the rest position, as desired.

It is a thirty-first continuing object of the invention to provide an embedded member nail clipper with a single parallel cutting blade or with dual parallel opposing cutting blades and a lever, and wherein the nail clipper includes a rest position which is useful for storage or transport of the nail clipper, and wherein when the nail clipper is disposed in the rest position, the lever is maintained in longitudinal alignment with respect to a frame (i.e., a body) of the nail clipper.

It is a thirty-second continuing object of the invention to provide an embedded member nail clipper with a single parallel cutting blade or with dual parallel opposing cutting blades and a lever, and wherein when the nail clipper is being urged from an open position into a closed position, the nail clipper improves safety for a user by maintaining the lever in longitudinal alignment with respect to a frame (i.e., a body) of the nail clipper as force is being applied to the lever to urge the nail clipper into the closed position.

It is a thirty-third continuing object of the invention to provide an embedded member nail clipper with a single parallel cutting blade or with dual parallel opposing cutting blades that includes a nail recess which increases an available space for insertion of a nail into the nail clipper for cutting.

It is a thirty-fourth continuing object of the invention to provide an embedded member nail clipper with a single parallel cutting blade or with dual parallel opposing cutting blades that includes a pair of spaced-apart nail recesses that are each disposed in one of a pair of spaced-apart sidewalls, wherein the nail recesses increase an available space for insertion of a nail into the nail clipper for cutting.

It is a thirty-fifth continuing object of the invention to provide an embedded member nail clipper with a single parallel cutting blade or with dual parallel opposing cutting blades that includes means for preventing an upper member and a lower member of the nail clipper from being excessively urged toward one-another during use.

It is a thirty-sixth continuing object of the invention to provide an embedded member nail clipper with a single parallel cutting blade or with dual parallel opposing cutting blades that includes one or more plastic platforms or ledges as means for preventing an upper member and a lower member of the nail clipper from being excessively urged toward one-another during use.

It is a thirty-seventh continuing object of the invention to provide an embedded member nail clipper with a single parallel cutting blade or with dual parallel opposing cutting blades that includes means for retaining a horizontal portion of the cutting blades in a desired position with respect to an upper frame member or with respect to a lower frame member or both the upper frame member and the lower frame member of the nail clipper.

It is a thirty-eighth continuing object of the invention to provide an embedded member nail clipper with a single parallel cutting blade or with dual parallel opposing cutting blades that includes one or more securing holes in a horizontal portion of one or both of the cutting blades, wherein the securing holes are at least partially filled with a material that a frame (i.e., a body) of the nail clipper is formed of, and wherein the securing holes help maintain the cutting blade or blades in position with respect to the frame.

It is a thirty-ninth continuing object of the invention to provide an embedded member nail clipper with a single parallel cutting blade or with dual parallel opposing cutting blades that includes one or more side indentations in a horizontal portion of one or both of the cutting blades, wherein the side indentations are at least partially filled with a material that a frame (i.e., a body) of the nail clipper is formed of, and wherein the side indentations help maintain the cutting blade or blades in position with respect to the frame.

It is a fortieth continuing object of the invention to provide an embedded member nail clipper with a single parallel cutting blade or with dual parallel opposing cutting blades that includes a center hole through a horizontal portion of one or both of the cutting blades, wherein a center rod that passes through the center hole helps to maintain the cutting blade or blades in position with respect to the body.

It is a forty-first continuing object of the invention to provide an embedded member nail clipper with a single parallel cutting blade or with dual parallel opposing cutting blades that includes a lever for applying a sufficient force to urge an upper member and a lower member of the nail clipper toward one-another, wherein the lever includes a fulcrum, and wherein the fulcrum applies a portion of the force to an upper surface of the upper member, and wherein a horizontal portion of a first upper blade is embedded in the upper member, and wherein the horizontal portion of the upper blade that is embedded in the upper member is disposed under the fulcrum of the lever, and wherein a compressive force is applied to the upper surface of the upper member by the fulcrum of the lever, and wherein a portion of the compressive force is transferred through a portion of the upper member to the upper blade.

It is a forty-second continuing object of the invention to provide an embedded member nail clipper with a single parallel cutting blade or with dual parallel opposing cutting blades that includes means for urging an upper frame member of a frame downward during a cutting of a nail and includes means for preventing a lower frame member of the frame from being urged downward away from the upper frame member during the cutting of the nail.

It is a forty-third continuing object of the invention to provide an embedded member nail clipper with a single parallel cutting blade or with dual parallel opposing cutting blades that includes means for urging an upper frame member of a frame downward toward a lower frame member during a cutting of a nail and includes means for urging the lower frame member upward toward the upper frame member during the cutting of the nail.

It is a forty-fourth continuing object of the invention to provide an embedded member nail clipper with a single parallel cutting blade or with dual parallel opposing cutting blades that includes an upper frame member and a lower frame member and an embedded member disposed in the upper frame member or in the lower frame member or in both the upper frame member and in the lower frame member and a center rod with an upper and a lower end, and wherein the lower end of the center rod includes an enlarged head or an enlarged portion that applies a force in an upward direction to the lower frame member during use.

It is a forty-fifth continuing object of the invention to provide an embedded member nail clipper with a single parallel cutting blade or with dual parallel opposing cutting blades that includes an upper frame member and a lower frame member and a center rod with an upper end and a lower end, and wherein the lower end of the center rod is formed (i.e., molded) integral with the lower frame member.

It is a forty-sixth continuing object of the invention to provide an embedded member nail clipper with a single parallel cutting blade or with dual parallel opposing cutting blades that includes an upper blade which includes a horizontal portion that is disposed in a recess provided in a bottom front portion of an upper frame member of the nail clipper and/or which includes a lower blade that includes a horizontal portion that is disposed in a recess provided in a top front portion of a lower frame member of the nail clipper, wherein the horizontal portions include one or more securing holes, and wherein the securing holes are at least partially filled with a plastic or other non-metallic material that the upper frame member and the lower frame member of the nail clipper are formed of and wherein a portion of the material that the frame members are formed of preferably extends through the securing holes and beyond an outside surface of each of the blades an amount sufficient to form one or more enlarged caps or crowns, and wherein the enlarged caps include a diameter that is larger than a diameter of the securing holes, and wherein the enlarged caps help to maintain the upper blade and/or the lower blade in position with respect to the upper frame member and/or the lower frame member.

It is a forty-seventh continuing object of the invention to provide an embedded member nail clipper with a single parallel cutting blade or with dual parallel opposing cutting blades that includes a center rod that passes through a body of the nail clipper and a lever, wherein the lever is operatively connected to the center rod, wherein the lever and the center rod can be rotated at least 180-degrees around a center longitudinal axis of the center rod.

It is a forty-eighth continuing object of the invention to provide an embedded member nail clipper with a single parallel cutting blade or with dual parallel opposing cutting blades that is disposable.

It is a forty-ninth continuing object of the invention to provide an embedded member nail clipper with a single parallel cutting blade or with dual parallel opposing cutting blades that includes a body (i.e., a frame) that is primarily made of a plastic, nylon, or polymer.

It is a fiftieth continuing object of the invention to provide an embedded member nail clipper with a single parallel cutting blade or with dual parallel opposing cutting blades wherein the blade(s) include(s) a horizontal blade portion and a descending blade portion, wherein a plane of the descending blade portion is disposed at an angle with respect to a plane of the horizontal blade portion, wherein the blade(s) is(are) formed of a continuous member of steel or other metal or of a ceramic or other sufficiently hard material, wherein the blade(s) is(are) formed of a different material than a frame (or a body) of the nail clipper, and wherein an end of the descending blade portion that is maximally disposed away from the horizontal blade portion includes a cutting edge.

It is a fifty-first continuing object of the invention to provide an embedded member nail clipper with a single parallel cutting blade or with dual parallel opposing cutting blades that includes an upper blade that includes a horizontal portion that is molded into a forward upper portion of a plastic frame and which provides sufficient strength and reinforcement to the forward upper portion of the plastic frame to bear and distribute the force and stress experienced during a cutting of a nail.

It is a fifty-second continuing object of the invention to provide an embedded member nail clipper with a single parallel cutting blade or with dual parallel opposing cutting blades that includes a lower blade that includes a horizontal portion that is molded into a forward lower portion of a plastic frame and which provides sufficient strength and reinforcement to the forward lower portion of the plastic frame to bear and distribute the force and stress experienced during a cutting of a nail.

It is a fifty-third continuing object of the invention to provide an embedded member nail clipper with a single parallel cutting blade or with dual parallel opposing cutting blades that includes a plastic body, and wherein during use a downward force is applied to an upper frame member of the plastic body and a simultaneous upward force is applied to a lower frame member of the plastic body, and wherein a horizontal portion of an upper blade that is attached to the upper frame member minimizes a likelihood of damage occurring to the upper frame member, and wherein a horizontal portion of a lower blade, if included, that is attached to the lower frame member minimizes a likelihood of damage occurring to the lower frame member.

It is a fifty-fourth continuing object of the invention to provide an embedded member nail clipper with a single parallel cutting blade or with dual parallel opposing cutting blades that includes a plastic body, and wherein during use a downward force is applied to an upper frame member of the plastic body and a simultaneous upward force is applied to a lower frame member of the plastic body, and wherein a horizontal portion of an upper blade that is attached to the upper frame member minimizes a likelihood of damage occurring to the upper frame member, and wherein a horizontal portion of a lower blade, if included, that is attached to the lower frame member minimizes a likelihood of damage occurring to the lower frame member, and wherein the horizontal portions provide sufficient strength to permit the use of lesser grades of plastic in the manufacture of the plastic body.

It is a fifty-fifth continuing object of the invention to provide an embedded member nail clipper with a single parallel cutting blade or with dual parallel opposing cutting blades that includes a plastic body, and wherein during use a downward force is applied to an upper frame member of the plastic body and a simultaneous upward force is applied to a lower frame member of the plastic body, and wherein an optional horizontal planar member that is embedded in the upper frame member minimizes a likelihood of damage occurring to the upper frame member, and wherein an optional horizontal planar member that is embedded in the lower frame member minimizes a likelihood of damage occurring to the lower frame member, and wherein the horizontal members provide sufficient strength to permit the use of lesser grades of plastic in the manufacture of the plastic body.

It is a fifty-sixth continuing object of the invention to provide an embedded member nail clipper with dual parallel opposing cutting blades that includes an upper blade that is attached or molded to a forward upper portion of a plastic frame and wherein a horizontal portion of the upper blade provides sufficient strength and reinforcement to the forward upper portion of the plastic frame to bear and distribute the force and stress applied to and experienced by the forward upper portion of the frame during a cutting of a nail, and which includes a lower blade that is attached or molded to a forward lower portion of the plastic frame and wherein a horizontal portion of the lower blade provides sufficient strength and reinforcement to the forward lower portion of the plastic frame to bear and distribute the force and stress applied to and experienced by the forward lower portion of the frame during the cutting of the nail.

It is a fifty-seventh continuing object of the invention to provide an embedded member nail clipper with a single parallel cutting blade or with dual parallel opposing cutting blades that includes a plastic frame that is available in a desired color, shape or texture.

It is a fifty-eighth continuing object of the invention to provide an embedded member nail clipper with a single parallel cutting blade or with dual parallel opposing cutting blades that is lightweight.

It is a fifty-ninth continuing object of the invention to provide an embedded member nail clipper with a single parallel cutting blade or with dual parallel opposing cutting blades that includes a blade portion that is formed of a metallic, ceramic or other suitable material and wherein a body of the nail clipper is not formed of the same material that is used to form the cutting blades.

It is a sixtieth continuing object of the invention to provide an embedded member nail clipper with a single parallel cutting blade or with dual parallel opposing cutting blades that includes an upper blade that is attached to an upper frame member of the nail clipper wherein a fingernail or a toenail that is disposed under the upper blade is severed simultaneously along a longitudinal length of the fingernail or the toenail starting along an upper surface of the fingernail or the toenail and extending downward into the fingernail or the toenail.

It is a sixty-first continuing object of the invention to provide an embedded member nail clipper with a single parallel cutting blade or with dual parallel opposing cutting blades wherein at least one of the cutting blades is made of a metal and is attached to an upper frame member of the nail clipper and wherein the upper frame member is made of a plastic, polymer or other non-metallic material, and wherein a lower frame member is made of a plastic, polymer or other non-metallic material, and wherein the upper blade includes a horizontal portion that is embedded into an end of the upper frame portion of the nail clipper, and wherein the horizontal portion of the upper blade provides significantly increased strength to the upper frame portion, and wherein the upper frame portion and the lower frame portion maintain alignment of the upper blade with respect to the lower frame member.

It is a sixty-second continuing object of the invention to provide an embedded member nail clipper with a single parallel cutting blade or with dual parallel opposing cutting blades that includes means for maintaining a longitudinal axis of a lever of the nail clipper in parallel longitudinal alignment with respect to a longitudinal axis of a frame of the nail clipper as a user begins depressing the lever and urging the nail clipper from an open position into a closed position during a cutting of a nail and for maintaining parallel longitudinal alignment of the lever for the duration of the cutting of the nail and until the lever is again returned to the open position.

It is a sixty-third continuing object of the invention to provide an embedded member nail clipper with a single parallel cutting blade or with dual parallel opposing cutting blades that includes a lever that includes a fulcrum, and wherein when the fulcrum is urged below an upper surface of a spaced-apart pair of sidewalls that are attached to a lower frame member of the nail clipper as a user begins depressing the lever during a cutting of the nail, a portion of the fulcrum that is disposed below the upper surface of the sidewalls maintains a longitudinal axis of the lever in parallel longitudinal alignment with respect to a longitudinal axis of the lower frame member for the duration of the cutting of the nail and until the lever is returned to its pre-cutting and a sufficiently raised position in which the fulcrum is again disposed above the upper surface of the sidewalls.

It is a sixty-fourth continuing object of the invention to provide an embedded member nail clipper with a single parallel cutting blade or with dual parallel opposing cutting blades that helps to prevent injury from occurring to a user of the nail clipper that could otherwise be caused during a cutting of a nail by a sudden and unexpected pivoting of a lever about a center longitudinal axis of a center rod to which the lever is attached which, if the unexpected pivoting were to occur, might otherwise cause the nail clipper to be suddenly and unintentionally urged away from a safe cutting position with respect to the nail and to unintentionally contact an undesired part of the user possibly causing injury to the user.

It is a sixty-fifth continuing object of the invention to provide an improvement to an embedded member nail clipper with a single parallel cutting blade or with dual parallel opposing cutting blades that includes a lever cooperatively attached to a center rod, wherein the improvement includes a pin embedded in a lower portion of the lever, wherein the lever is formed substantially of a plastic or other non-metallic material, and wherein the embedded pin is able to engage with the center rod.

It is a sixty-sixth continuing object of the invention to provide an improvement to an embedded member nail clipper with a single parallel cutting blade or with dual parallel opposing cutting blades that includes an upper horizontal discreet member having any preferred cross-sectional shape that is embedded in a front portion of an upper frame member of the nail clipper, and wherein the upper horizontal discreet member includes an overall longitudinal length that is at least long enough to ensure that a portion of the upper horizontal discreet member is disposed in vertical alignment with respect to a cutting force that is applied to the upper frame member during a cutting of a nail.

It is a sixty-seventh continuing object of the invention to provide an improvement to an embedded member nail clipper with a single parallel cutting blade or with dual parallel opposing cutting blades that includes a lower horizontal discreet member having any preferred cross-sectional shape that is embedded in a front portion of a lower frame member of the nail clipper, and wherein the lower horizontal discreet member includes an overall longitudinal length that is at least long enough to ensure that a portion of the lower horizontal discreet member is disposed in vertical alignment with respect to a cutting force that is applied to the lower frame member during a cutting of a nail.

It is a sixty-eighth continuing object of the invention to provide an improvement to an embedded member nail clipper with a single parallel cutting blade or with dual parallel opposing cutting blades that includes a pair of opposing container sidewalls that are integrally attached to a frame member and which extend vertically from the frame member, wherein the container sidewalls strengthen or stiffen the frame member sufficient to increase a resistance of the frame member to flexing in a vertical direction.

It is a sixty-ninth continuing object of the invention to provide an improvement to an embedded member nail clipper with a single parallel cutting blade or with dual parallel opposing cutting blades that includes a pair of opposing container sidewalls that are integrally attached to a lower frame member and extend above a top of an upper frame member when the nail clipper is disposed in a rest position.

It is a seventieth continuing object of the invention to provide an improvement to an embedded member nail clipper with a single parallel cutting blade or with dual parallel opposing cutting blades that includes a pair of opposing container sidewalls that are integrally attached to a lower frame member and extend above a top of an upper frame member an amount sufficient to conceal at least a portion of a lever of the nail clipper when the nail clipper is disposed in a rest position and is viewed from the side.

It is a seventy-first continuing object of the invention to provide a cutting blade for a nail clipper that makes a parallel cut simultaneously across a portion of a nail wherein the cutting blade that automatically files the nail during cutting of the nail.

It is a seventy-second continuing object of the invention to provide a file or other abrasive surface on an outside surface of a cutting blade of a nail clipper.

It is a seventy-third continuing object of the invention to provide a safer cutting blade for a nail clipper that helps prevent cutting flesh at the edges of the cutting blade.

It is a seventy-fourth continuing object of the invention to provide an improvement to a nail clipper that makes a parallel cut simultaneously across a portion of a nail wherein the improvement includes a cutting blade that includes a curvature that is customized to correspond with a desired finish curvature of a cut nail.

It is a seventy-fifth continuing object of the invention to provide a nail clipper that includes a curvature of a cutting edge of a cutting blade that is selected by a purchaser of the nail clipper.

It is a seventy-sixth continuing object of the invention to provide a system for customizing a nail clipper to allow a purchaser to choose a desired nail clipper body and to choose a desired curvature of a cutting blade and to optionally provide a name of a nearby store that has a comparable nail clipper available for sale.

It is a seventy-seventh continuing object of the invention to provide a system for customizing a nail clipper that includes an application software for use on a mobile computing platform wherein the application software is able to obtain an image of a nail curvature for remote processing and selection of a desired curvature of a cutting blade or wherein the application software is able to determine and select the desired curvature of the cutting blade on the mobile computing platform.

It is a seventy-eighth continuing object of the invention to provide a system for customizing the cutting of nails that includes more than one nail clipper wherein each nail clipper includes a different curvature of each cutting blade, wherein the curvature of each cutting blade is selected to correspond with a preference of a user.

Briefly, an embedded member nail clipper that is constructed in accordance with the principles of the present invention has a main body or frame consisting of a plastic or other non-metallic material, such as any desired polymer, nylon or formed of any preferred non-metallic material or combination of non-metallic materials. The nail clipper includes at least one blade that makes a parallel cut simultaneously across a portion of a top of a nail. A single blade version of the invention includes an upper blade attached to an upper frame member that makes a parallel cut simultaneously across a portion of the top of the nail. For the single blade version (only) the lower frame member includes a planar surface attached, thereto. An upper blade cutting edge of the upper blade makes contact with (i.e., abuts) the planar surface along the longitudinal length of the upper blade cutting edge when the single blade version is disposed in the closed position. For certain single blade versions the planar surface is formed of the same material used for the lower frame member. For certain other single blade versions an optional hardened planar insert is attached to the lower frame member and disposed under the upper blade cutting edge. When included, the hardened planar insert provides the planar surface that the upper blade cutting edge contacts when the single blade nail clipper is disposed in the closed position. For the single blade version of the invention the upper blade cutting edge is always parallel with respect to a plane of the planar surface regardless of the position of the single blade version of the invention. The upper blade includes a horizontal portion having any preferred cross-sectional shape or overall length that is formed integrally with a remaining portion of the upper blade. An optional lower blade, for use with a dual parallel opposing blade version of the invention, as further described below and in the detailed description, is similarly or identically constructed as compared to the upper blade. The lower blade can also include any modification(s) described herein for the upper blade or vice-versa. As much as possible of the horizontal portion is embedded in a front portion of the frame member. A planar shape is generally preferred for the horizontal portion. Cylindrical and other cross-sectional shapes for the horizontal portion of the upper blade and the lower blade are also possible and are described, herein. The horizontal portion of the upper blade extends into the upper frame member sufficiently far to ensure that a cutting force that is applied to the upper frame member during cutting of the nail is disposed in vertical alignment with at least a portion of the horizontal portion of the upper blade. The horizontal portion of the upper blade and the horizontal portion of the lower blade are disposed on a horizontal plane. The horizontal plane is parallel with respect to the front portion of the upper frame member for the upper blade, and is parallel with respect to a front portion of the lower frame member for the lower blade. The remaining portion of the upper blade includes the upper blade cutting edge and is generally disposed along a first vertical plane that is disposed at an angle with respect to the horizontal plane of the horizontal portion of the upper blade. The remaining portion of the upper blade is vertical or nearly vertical. A remaining portion of the lower blade that includes a lower blade cutting edge is generally disposed along a second vertical plane which is disposed at an angle with respect to the horizontal plane of the horizontal portion of the lower blade. The remaining portion of the lower blade is vertical or nearly vertical. The first vertical plane and the second vertical plane are the same only when the first and second vertical planes are both vertical. Otherwise, a slight desired angular offset occurs between the first vertical plane and the second vertical plane, however both the first and second vertical planes are generally disposed in a more vertical orientation than is the horizontal plane of the horizontal portion of the first blade or the horizontal portion of the second blade. According to a first general modification that is applied to the upper blade of the single blade version or to the upper blade of a dual parallel opposing blade version, a shortened modified upper blade (i.e., that includes a shortened horizontal portion) or which includes a wrap-around upper blade can be included that does not necessarily extend sufficiently far into the upper frame member to ensure that a portion of the shortened modified upper blade or a portion of a wrap-around portion of the wrap-around upper blade is disposed in vertical alignment with respect to the downward cutting force that is applied to the upper frame member, providing that an upper horizontal discreet member having any preferred cross-sectional shape or overall length is embedded in the front portion of the upper frame member and providing that the upper horizontal discreet member extends sufficiently far into the upper frame member to ensure that the cutting force that is applied to the upper frame member is disposed in vertical alignment with at least a portion of the upper horizontal discreet member. The lower blade may include a similar horizontal portion. The horizontal portion of the lower blade includes any preferred cross-sectional shape or overall length and is formed integrally with the remaining portion of the lower blade. The dual parallel opposing blade version of the invention includes the lower blade. For the dual parallel opposing blade version, as much as possible of the horizontal portion of the lower blade is also embedded in the front portion of the lower frame member. The horizontal portion of the lower blade is formed integrally with respect to the remaining portion of the lower blade. With the dual parallel opposing blade version the lower frame member does not include the planar surface. The lower blade cutting edge is opposed to the upper blade cutting edge of the upper blade. Therefore, the lower blade is inverted (i.e., rotated 180 degrees about a center longitudinal axis of its horizontal portion) with respect to the upper blade. When the dual parallel opposing blade version is disposed in the closed position the upper blade cutting edge preferably contacts (i.e., abuts) the lower blade cutting edge along a longitudinal length of the cutting edges. The upper blade cutting edge and the lower blade cutting edge are always parallel with respect to each other regardless of which position that the dual parallel opposing blade version of the nail clipper is disposed in. Alternately, the upper blade cutting edge and the lower blade cutting edge may include a slight overlap with respect to each other when the dual parallel opposing blade version is disposed in the closed position. The dual parallel opposing blade version makes a parallel cut simultaneously across the top and across a bottom of a portion of the nail. The horizontal portion of the lower blade may optionally extend into the lower frame member sufficiently far to ensure that an opposing cutting force that is applied to the lower frame member during cutting of the nail is disposed in vertical alignment with at least a portion of the horizontal portion of the lower blade. According to a second general modification that is applied to the lower blade of the dual parallel opposing blade version, a shortened modified lower blade (i.e., that includes a shortened horizontal portion) or which includes a wrap-around lower blade can be included that does not necessarily extend sufficiently far into the lower frame member to ensure that a portion of the shortened horizontal portion of the shortened modified lower blade or a portion of a wrap-around portion of the wrap-around lower blade is disposed in vertical alignment with respect to the opposing cutting force, providing that a lower horizontal discreet member having any preferred cross-sectional shape or overall length is embedded in the front portion of the lower frame member or providing that one or more vertically extending sidewalls are attached to the lower frame member or providing that reinforcing strands or fibers are embedded in the polymer of the lower frame member. According to one general form of the invention, the frame, when viewed from the side, somewhat resembles an elongated "U-shape" in appearance. Alternately for another general form of the invention when similarly viewed from the side, the frame may include a generally "V-shape". Other preferred shapes are also possible. For certain preferred embodiments the frame is formed (typically molded) as a one-piece assembly. For other preferred embodiments, the upper frame member and the lower frame member of the frame are formed as separate component parts and, during manufacture, are secured together by any preferred means. For the single blade version of the invention the nail clipper includes an open position in which the nail can be inserted under the upper blade cutting edge of the upper blade and above the planar surface. For the dual parallel opposing blade version of the invention the nail can be inserted under the upper blade cutting edge of the upper blade and above the lower blade cutting edge of the lower blade when the nail clipper is disposed in the open position. An included lever is depressed which causes the upper blade cutting edge of the single blade version or the opposing upper blade and lower blade cutting edges of the dual parallel opposing blade version to sever the nail and dispose either version of the nail clipper into the closed position. The nail clipper also preferably includes a rest position in which a longitudinal axis of the lever of the nail clipper is disposed in parallel longitudinal alignment with respect to a longitudinal axis of the nail clipper and where a longitudinal length of the lever is disposed substantially adjacent to a top or bottom surface of the nail clipper. Means are optionally provided for preventing the lever from pivoting around a center longitudinal axis of a center rod that the lever is operatively connected to during a cutting of the nail. The lever includes a fulcrum or edge which, during use, bears down upon an upper surface of the upper frame member to apply the first downward force to the upper frame member. During a cutting of the nail, according to a preferred embodiment that includes a pair of elevated vertical sidewalls attached to the lower frame member, the fulcrum of the lever urges the upper surface of the upper frame member below an upper edge of the two opposing vertical sidewalls of the lower frame member. When, during the cutting of the nail, the upper surface of the upper frame member is urged below the upper edge of the vertical sidewalls, a portion of the lever is also then disposed below the upper edge of the vertical sidewalls. This maintains the longitudinal axis of the lever in parallel alignment with respect to a longitudinal axis of the nail clipper for the duration of the cutting of the nail, which helps prevent injury to the user. The two opposing vertical sidewalls stiffen the lower frame member, to which they are preferably attached as molded extensions of the lower frame member. The vertical sidewalls, in combination with a remainder of the nail clipper, form a container for capturing nail clippings that are severed from the user's nail. The container, in this manner provides three simultaneous benefits; first by a capturing of nail clippings, second by maintaining the longitudinal axis of the lever in parallel alignment with the longitudinal axis of the frame (i.e., main body) of the nail clipper and third by reinforcing the lower frame member an amount sufficient to increase its ability to withstand the stress and shear force during cutting. The lever is preferably made from a sufficiently strong and rigid plastic, although any desired material may be used to form the pivoting lever. The lever may include any preferred size, shape or ornamental design. As desired, a reinforcing member is disclosed that can be molded or embedded into the lever to increase its strength. If desired, the invention can be adapted for use with a prior-art type of lever. During use, the fulcrum applies the first downward force in a downward direction to the upper surface of the upper frame member which urges the upper frame member in a downward direction. During use, a portion of the fulcrum becomes disposed below the upper edges of the two opposing vertical sidewalls of the lower frame member. The fulcrum, and therefore the entire lever, is prevented from side to side movement as would occur if the lever were able to continue rotation around the center longitudinal axis of the center rod. At the same time as the fulcrum is urged in a downward direction, a U-shaped recessed area of the lever is proportionally raised above the upper surface of the upper frame member which, in turn, applies the second opposing force in an opposite second or upward direction as compared to the first force. A pin passes through openings provided in the U-shaped recessed area of the lever that is located at a lower, front end of the lever. The pin also passes through an opening provided in an upper end of the center rod. When the lever is depressed the pin applies the second opposing upward force to the center rod. The second opposing force, in turn, is attempting to urge the center rod in an upward direction at the same time the fulcrum is urging the upper frame member in a downward direction. A lower or bottom end of the center rod preferably includes an enlarged head that applies at least a portion of the second upward force to a bottom surface of the lower frame member. If desired, the lower end of the center rod can be attached to the lower frame member to transfer the second opposing upward force to the lover frame member by any preferred means, including the use of a lower pin connecting the lower end of the center rod to the lower frame member or by molding the center rod as an integral upward extension of the lower frame member. The second upward force prevents the lower frame member from being urged further downward and away from the upper frame member during cutting of the nail. If the vertical sidewalls are attached to the lower frame member, the lower frame member will not be as flexible as the upper frame member. Therefore, the upper frame member will experience the greater degree of flexing during cutting of the nail. For certain embodiments, the upper frame member and the lower frame member are similarly flexible. If they are similarly flexible both the upper frame member and the lower frame member will experience a similar amount of flexing during use. Gradually urging the distal end of the lever downward progressively urges the upper frame member and the lower frame member toward each other until the nail clipper is disposed in the closed position, at which time the portion of the nail that was disposed under the upper blade cutting edge (and, if included above the lower blade cutting edge) has been severed to provide the nail clipping that has been captured in the container, if the container is included. Because the vertical sidewalls are optional, the container can be omitted for certain versions of the invention (either single or dual blade versions) by omitting the vertical sidewalls. The embedded horizontal portion of the upper blade provides structural reinforcement to the front end of the upper frame member of the frame. During application of the first downward force the horizontal portion of the upper blade helps to transfer a portion of the first downward force to the upper blade by compression rather than by shear force. This reduces a magnitude of shear that is experienced by the front portion of the upper frame member and allows for cutting of the nail without causing damage to the plastic (or non-metallic material) of the upper frame member. This, in turn, allows the use of less durable and less expensive polymers for construction of the upper frame member. If included, the upper horizontal discreet member similarly provides structural reinforcement and increased ability to withstand shear to the front end of the upper frame member of the frame and the upper horizontal discreet member similarly helps to transfer a portion of the first downward force to the upper blade by compression rather than by shear. Similarly, the bottom end of the center rod that applies the second force to the lower frame member preferably contacts the bottom surface of the lower frame member at a location below a portion of the horizontal portion of the lower blade that is embedded into the front end of the lower frame member. The horizontal portion of the lower blade provides structural reinforcement and increased ability to withstand shear to the front end of the lower portion of the frame. During application of the second upward force (for dual parallel opposing blade versions of the invention) the horizontal portion of the lower blade helps to transfer a portion of the second force by compression to the lower blade rather than by shear force. This reduces shear that is experienced by the front portion of the lower frame member and allows for cutting of the nail without causing damage to the plastic (or non-metallic material) of the lower frame member. This, in turn, allows the use of less durable and less expensive polymers for construction of the lower frame member. If included, the lower horizontal discreet member similarly provides structural reinforcement to the front end of the lower frame member of the frame and the lower horizontal discreet member similarly helps to transfer a portion of the second upward force to the lower blade by compression rather than by shear. The embedded reinforcing strands or fibers provide similar benefit. Therefore, the embedded horizontal portions of the upper and lower blades or the upper and lower horizontal discreet members or the reinforcing strands or fibers allow the frame (i.e., the upper frame member and the lower frame member) of the nail clipper to be made mostly from plastic or other desired non-metallic material and to withstand the considerable forces that are experienced by the upper and lower frame members when a parallel cut of the nail occurs across a length of the cutting edge (or cutting edges) of the blade (or blades). Accordingly, the disclosed structures provide a stronger, more durable and also a less expensive nail clipper. Additionally, the use of various or multiple colored or textured polymers allow for greater variation in visual appearance as well as considerable design options for enhancing aesthetic appeal, safety, and ease of use of the nail clipper. Numerous modifications, safety improvements to the blade, an ability to file a nail as it is being cut and other optional novel component parts are described, herein along with the benefits provided. The nail clipping, at the moment of it being severed from a remaining portion of the nail, is rapidly urged away from the nail. The nail clipping is preferably captured between the vertical sidewalls and by a remainder structure of the nail clipper that together form the container. This is preferred as the nail clipping is not ejected from the nail clipper and scattered in the vicinity of the user. When the user wishes to remove the accumulated nail clippings from the container, the user inverts the nail clipper over a waste basket with the nail clipper disposed in the open position and the blade(s) facing downward. The user then vertically shakes the nail clipper until the nail clippings have been ejected through the space between the cutting edges and downward into the waste basket. If desired, an additional amount of a plastic, a spring or other elastomeric material may be included where desired to provide additional force to help urge the nail clipper from the closed position into the open position or to provide a different feel or appearance. The cutting edges of the blades can be straight or they can include a curvature, as desired. Any preferred cross-sectional profile can be included for the cutting edges. Other possible variations for the nail clipper are described including a method for customization. As desired and briefly mentioned above, the frame of the nail clipper can be molded to include a one-piece construction for the upper and lower frame members. Alternately, the frame can be molded to include two pieces, with a first piece forming the upper frame member and a second piece forming the lower frame member. If the nail clipper includes a two-piece frame, a distal end of the first piece is secured to a distal end of the second piece by any preferred means, including the use of a fastener or a retaining clip, or by any other preferred means, such as by fusing or welding or by the use of an adhesive or combination, thereof. Certain versions of the invention that include an axially pivoting lever that can be used in place of the type of lever that cooperates with the center rod are shown and described.

DETAILED DESCRIPTION OF THE INVENTION

Figure 1:
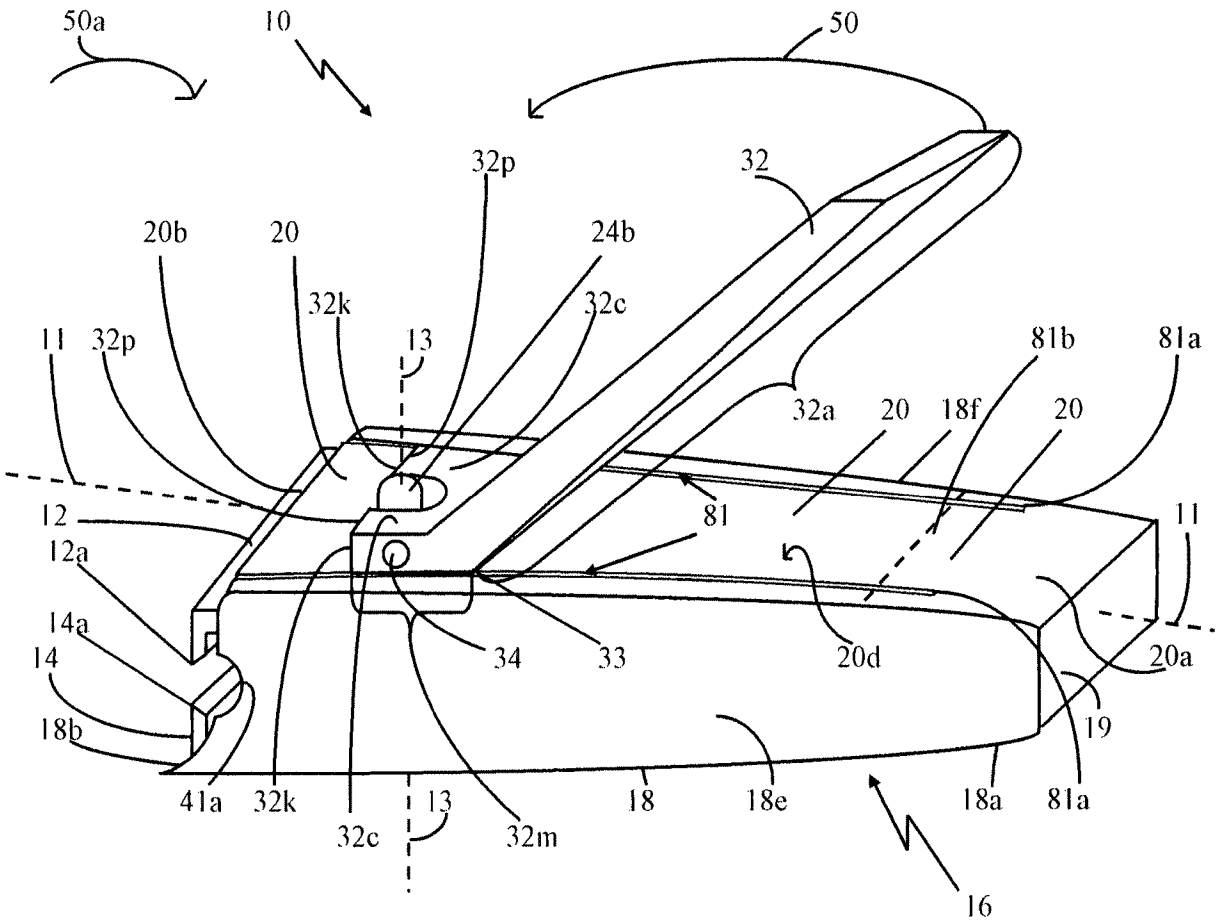
FIG. 1 is a view in perspective of a dual parallel opposing blade embedded member nail clipper.

Referring on occasion to all of the FIGURE drawings and now, in particular to FIGS. 1-10, 29 and 36 is shown a dual parallel opposing blade embedded member nail clipper, identified in general by the reference numeral 10, and hereinafter referred to as "the nail clipper 10". FIGS. 11-17, 22, 24, and 25 provide enlarged detail views of certain of the component parts of the nail clipper 10 or optional component parts for possible use with the nail clipper 10. The remaining drawing FIGURES teach modifications for possible use with the nail clipper 10. Any of the teachings or improvements as disclosed herein can be selectively combined in any desired manner to produce alternative embodiments of the invention.

FIGS. 18-21, 26-28 and 30-35 illustrate alternate embodiments consistent with the teachings herein that reflect a sampling of possible modifications which are possible for the nail clipper 10.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

Certain examples are shown in the above-identified FIGURES and are described in greater detail below. In describing these examples, identical reference numerals are used where appropriate to identify common elements.

A number of embodiments are shown and described herein for illustrative purposes only and should not be construed as intending to limit the scope or range of possible alternative embodiments of the present invention.

The nail clipper 10 includes an upper blade 12 and an opposing lower blade 14. The upper blade 12 is attached to a front end 20*b* of an upper frame member 20 and the lower blade 14 is attached to a front end 18*b* of a lower frame member 18. The upper blade 12 includes an upper cutting edge 12*a* and the lower blade 14 includes a lower cutting edge 14*a*.

Figure 2:
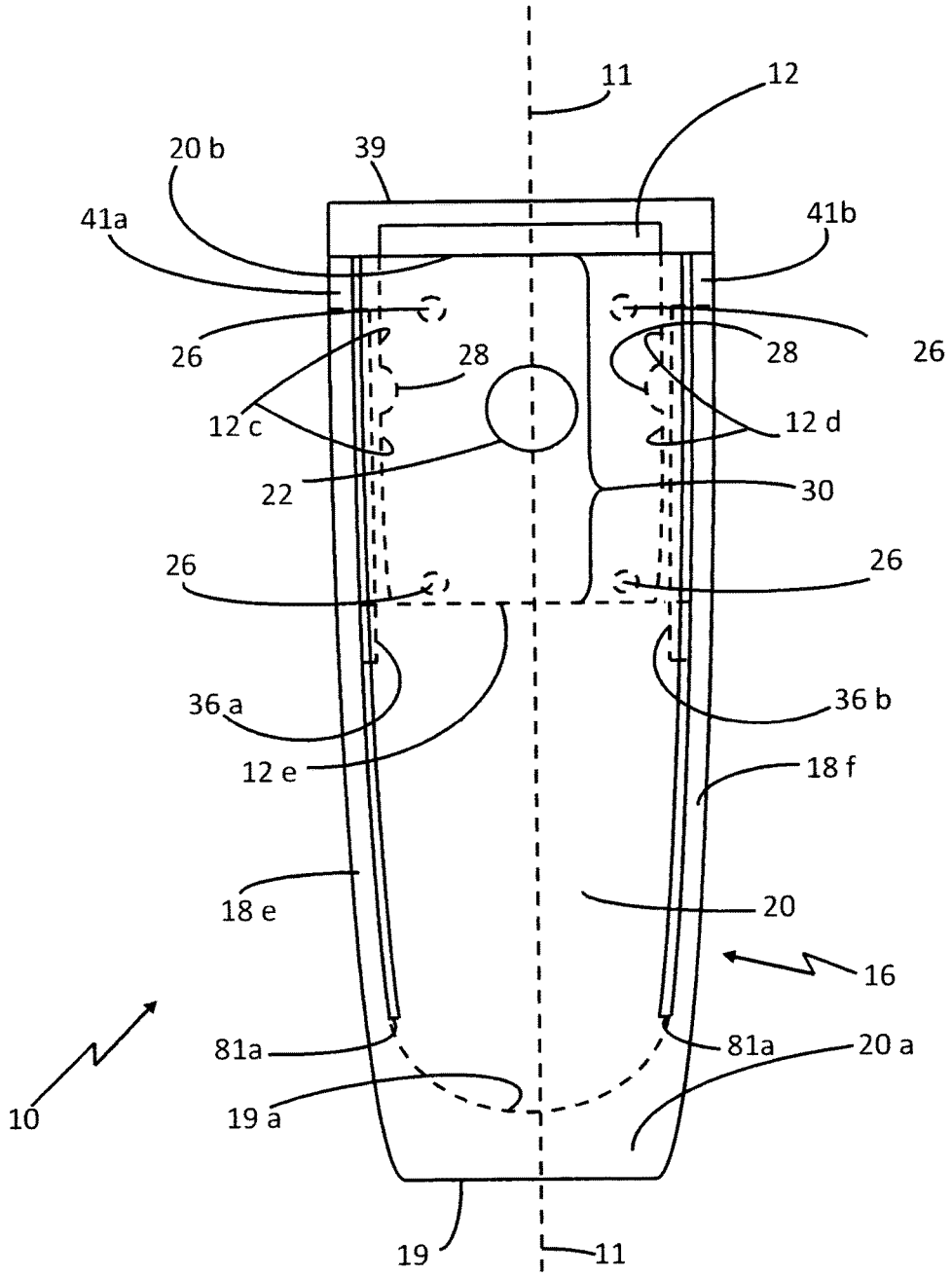
FIG. 2 is an enlarged top view of the nail clipper of FIG. 1 utilizing a straight blade of FIG. 11 and including a straight safety bumper, with a lever and a center rod removed for improved clarity of view.
Figure 3:
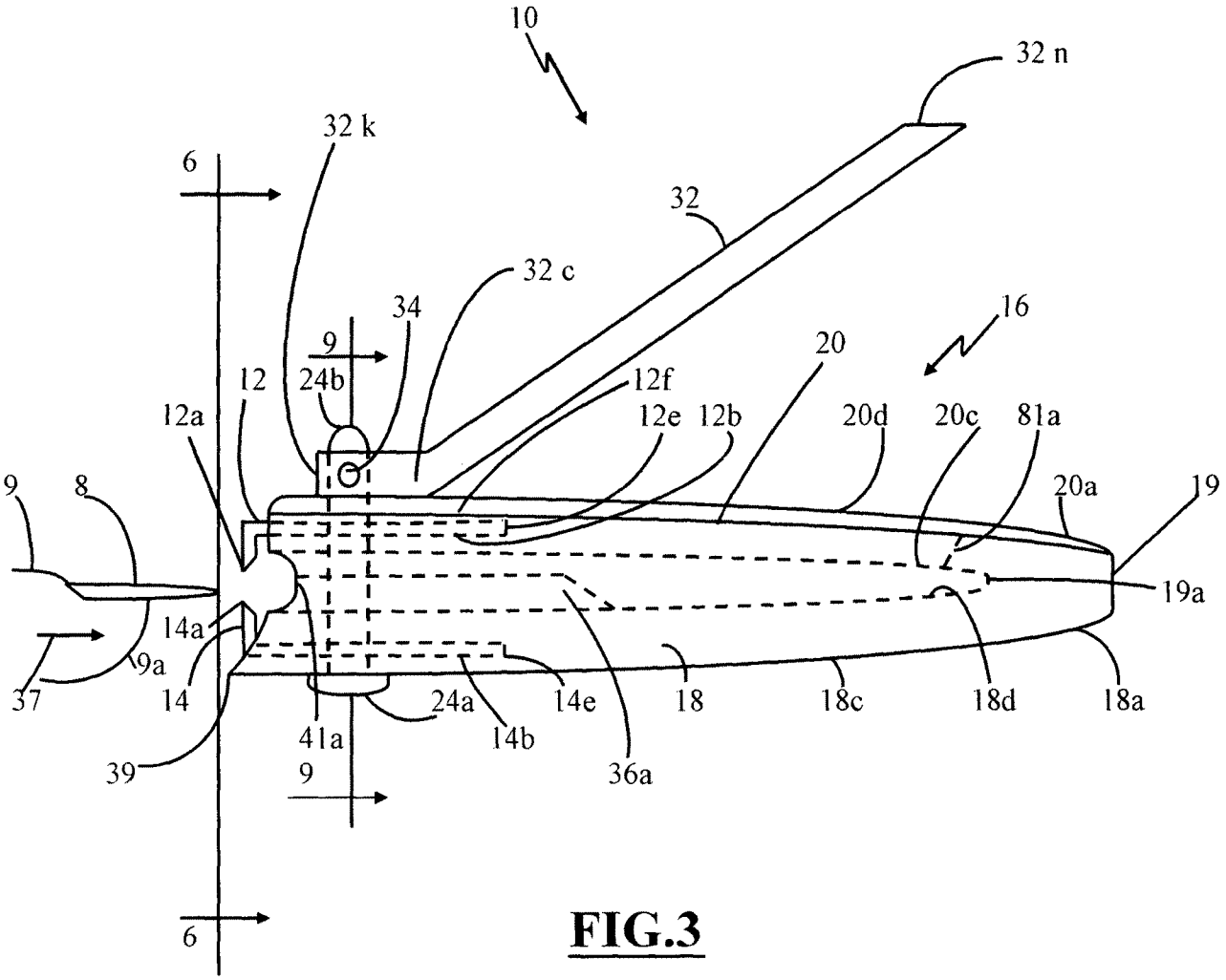
FIG. 3 is side view of the nail clipper of FIG. 1 with the nail clipper disposed in an open position showing a portion of a finger and a nail disposed slightly away from the nail clipper, with the nail clipper ready for use prior to making a cut of the nail.
Figure 4:
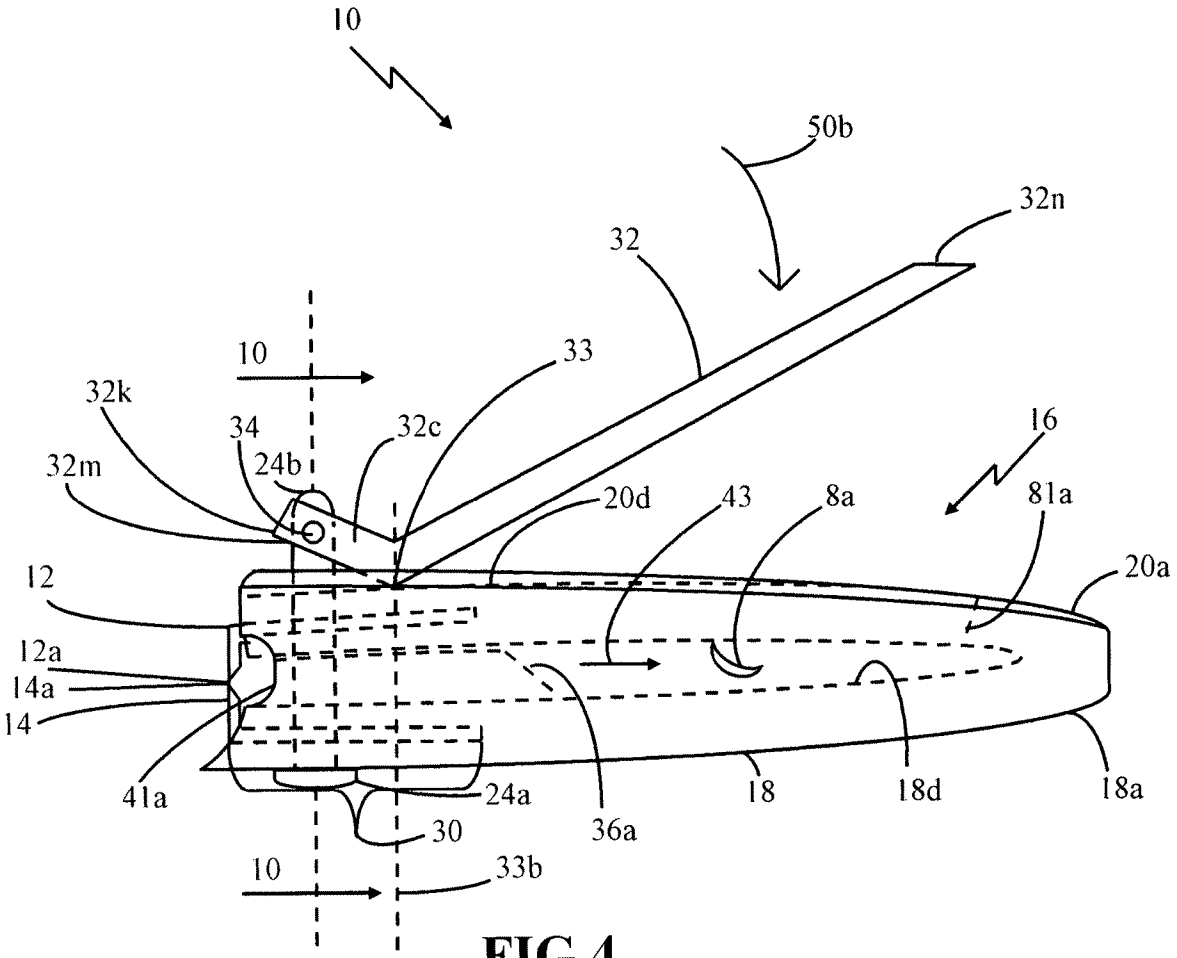
FIG. 4 is a side view of the nail clipper of FIG. 1 with the nail clipper disposed in a closed position after completion of the cut with a nail clipping disposed in a container portion of the nail clipper.
Figure 5:
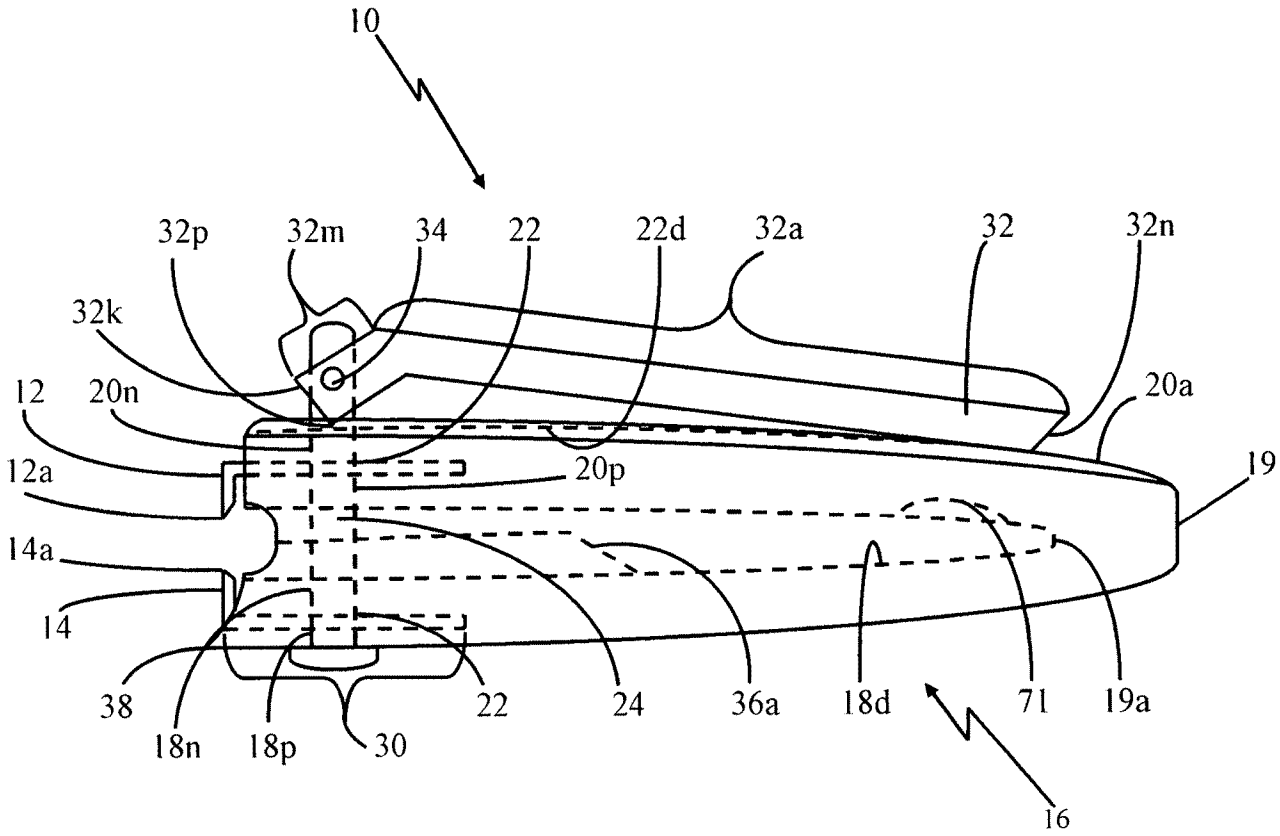
FIG. 5 is a side view of the nail clipper of FIG. 1 with the nail clipper disposed in a rest position intended for storage or transportation and not for use.
Figure 6:
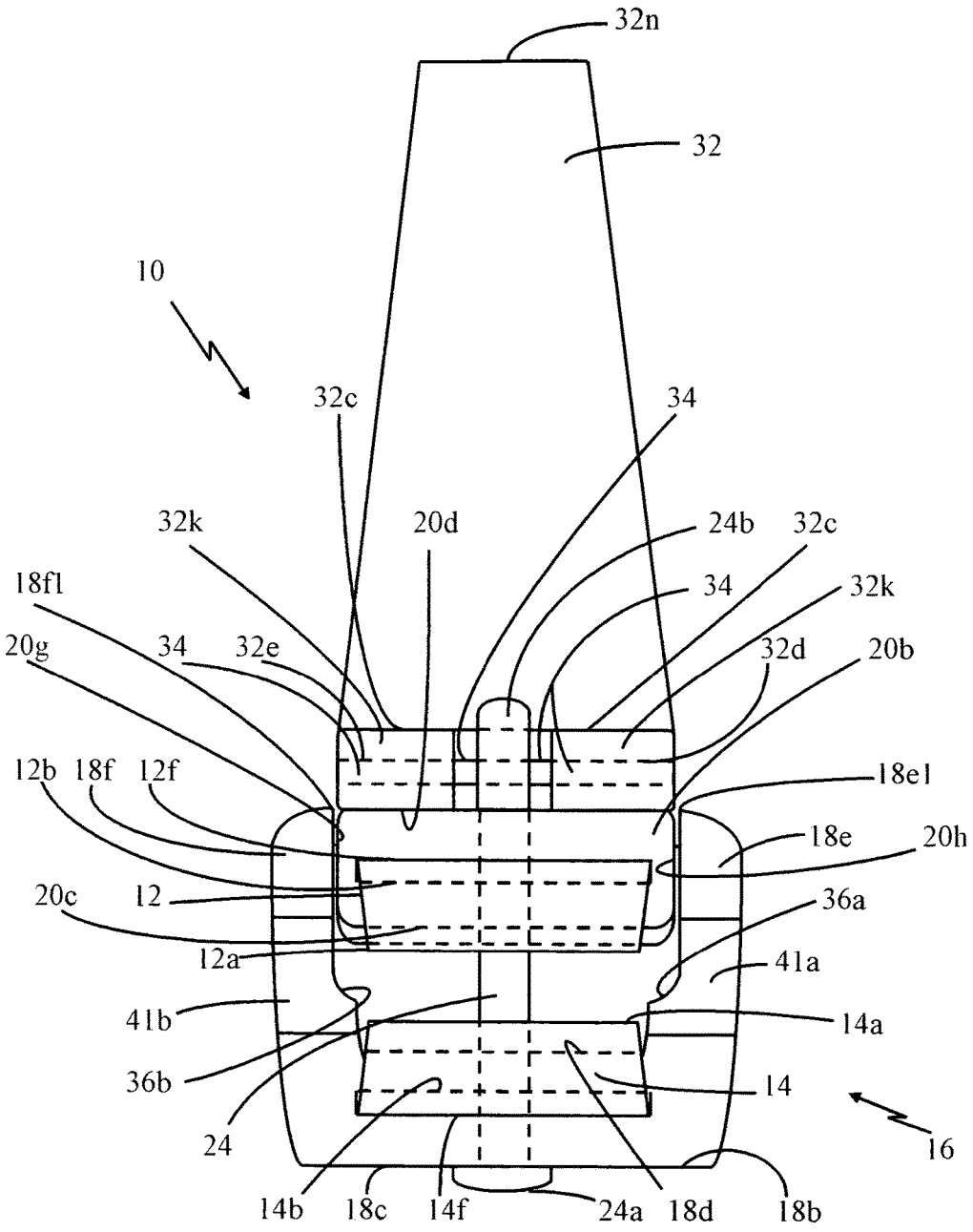
FIG. 6 is an enlarged front view of the nail clipper of FIG. 3 with the nail clipper disposed in the open position, and absent the portion of the finger and the nail of FIG. 3.
Figure 7:
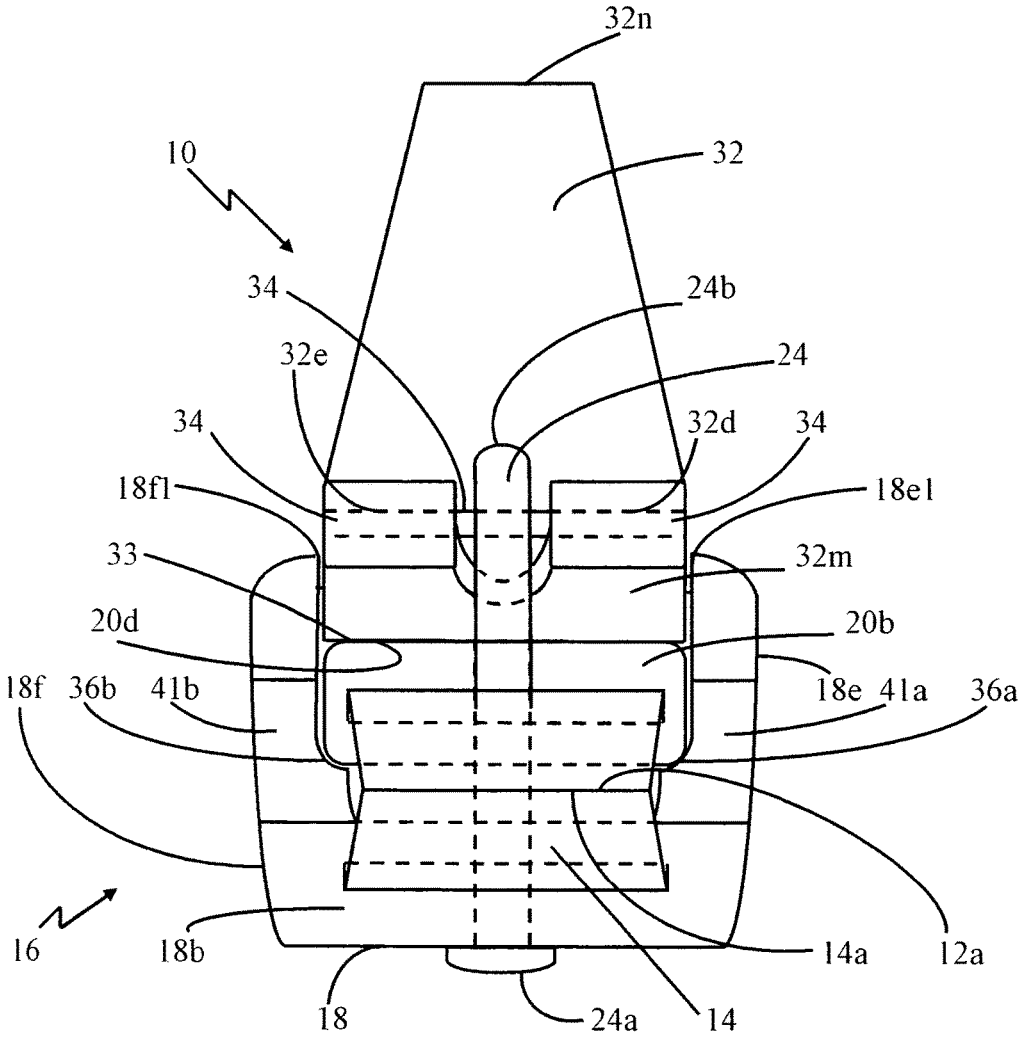
FIG. 7 is an enlarged front view of the nail clipper of FIG. 4 with the nail clipper in the closed position.
Figure 8:
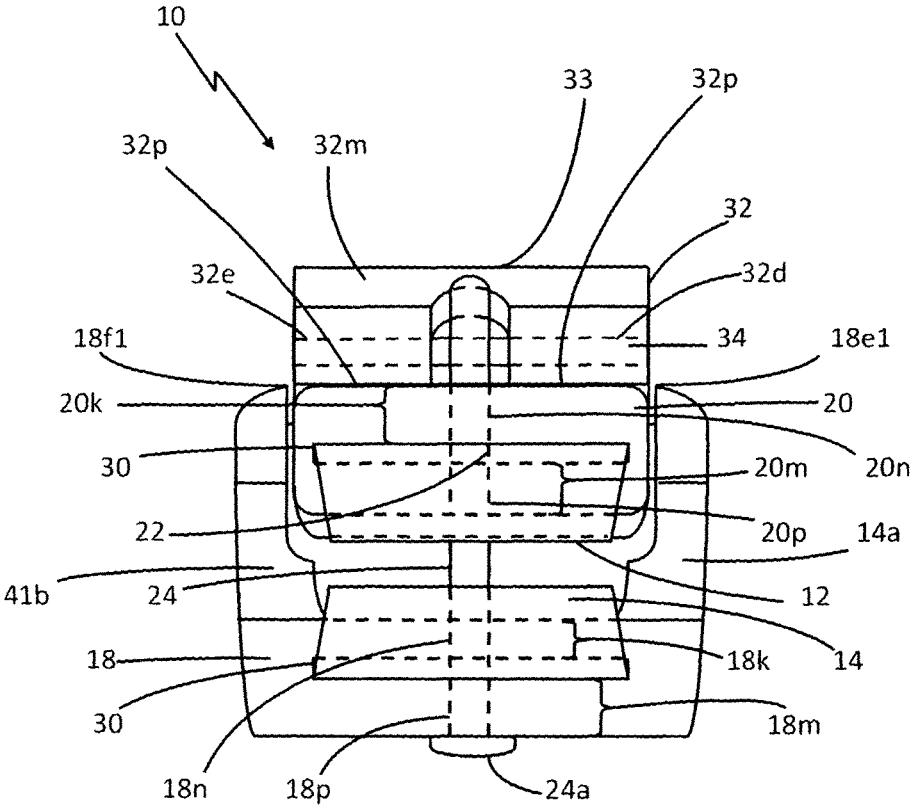
FIG. 8 is an enlarged front view of the nail clipper of FIG. 5 with the nail clipper disposed in the rest position intended for storage or transportation and not for use.
Figure 9:
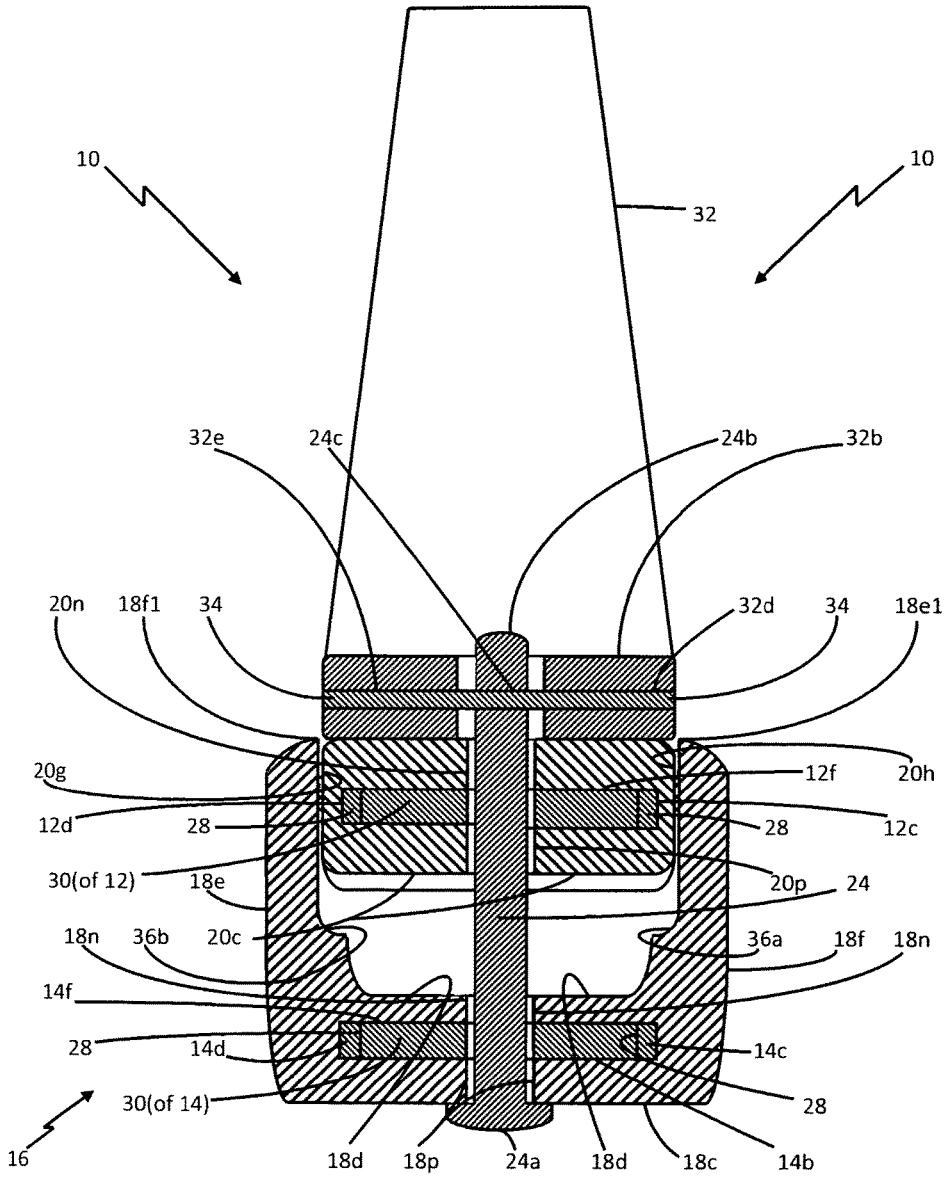
FIG. 9 is an enlarged cross-sectional view taken along line 9-9 of the nail clipper of FIG. 3 with the nail clipper disposed in the open position and line 9-9 of FIG. 3 passing through a center longitudinal axis of the center rod.
Figure 10:
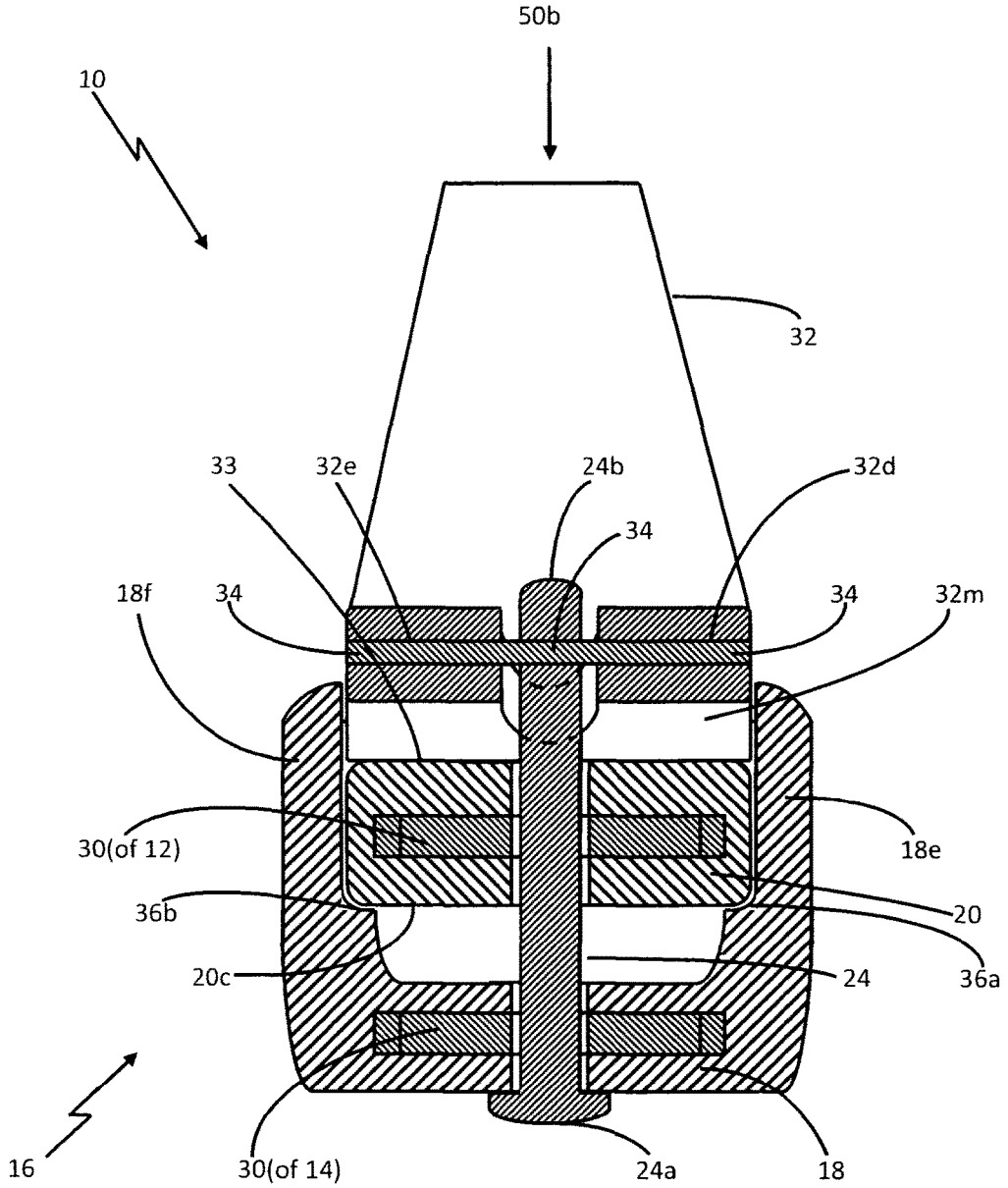
FIG. 10 is an enlarged cross-sectional view taken along line 10-10 of FIG. 4 with the nail clipper disposed in the closed position and line 10-10 of FIG. 4 passing through the center longitudinal axis of the center rod.
Figure 11:
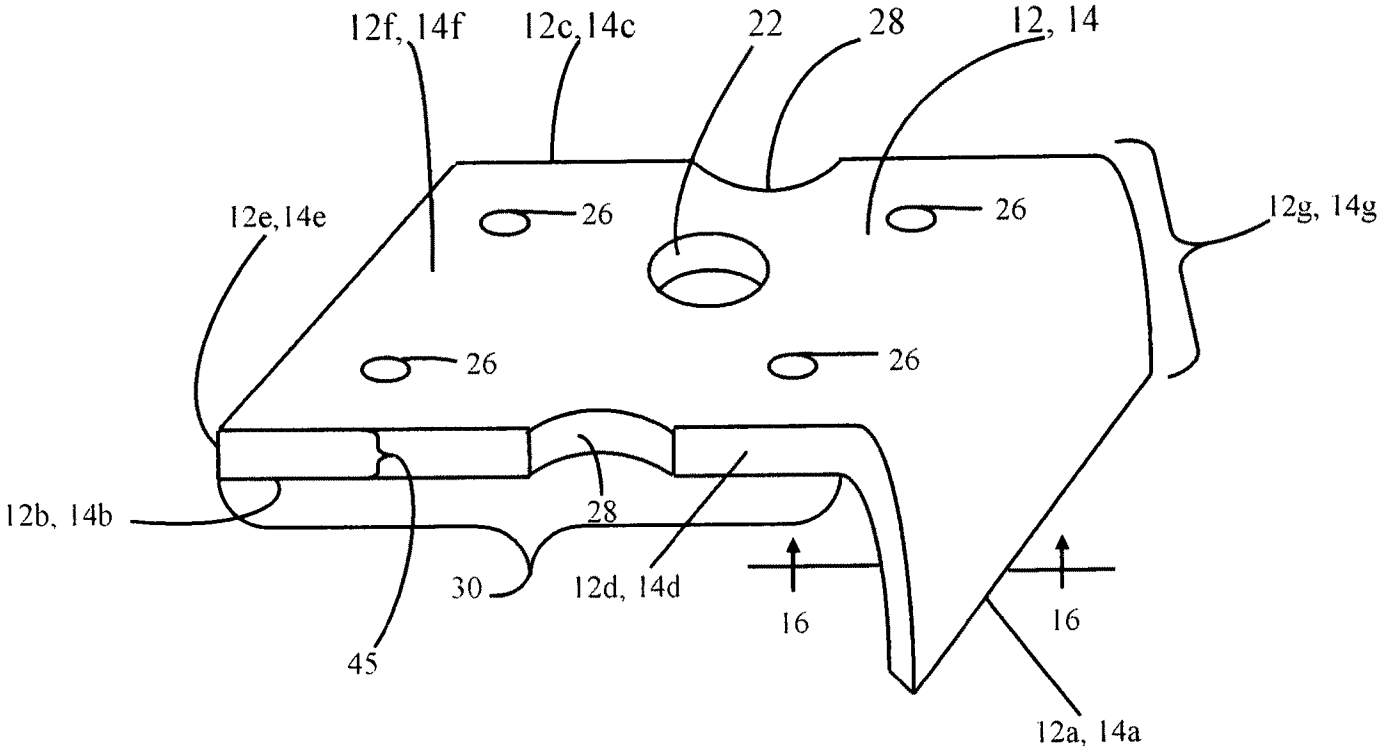
FIG. 11 is an enlarged view in perspective of a blade of the nail clipper of FIG. 1, showing a possible straight cutting edge of the blade.
Figure 11A:
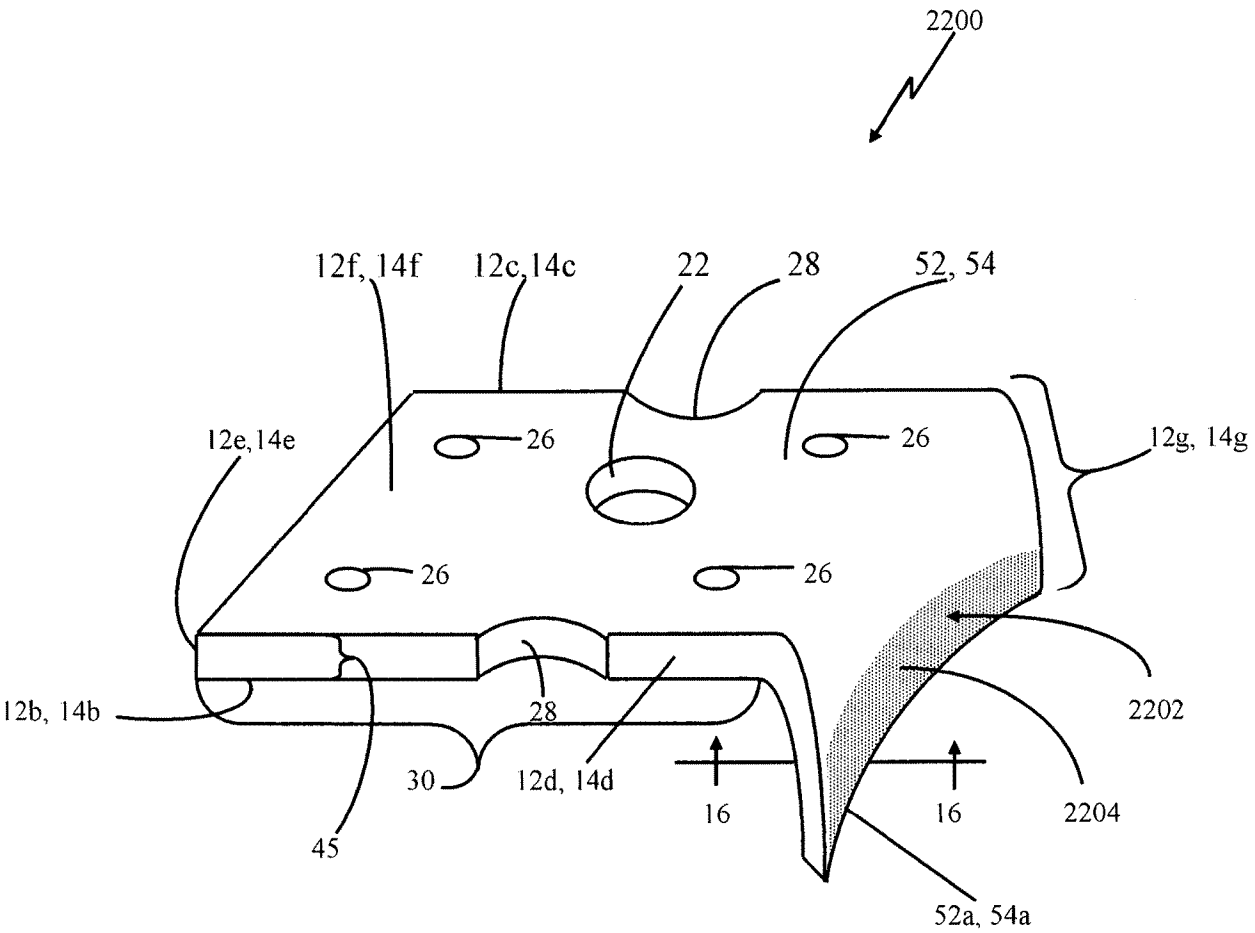
FIG. 11A is a perspective view of a modified abrasive blade.
Figure 12:
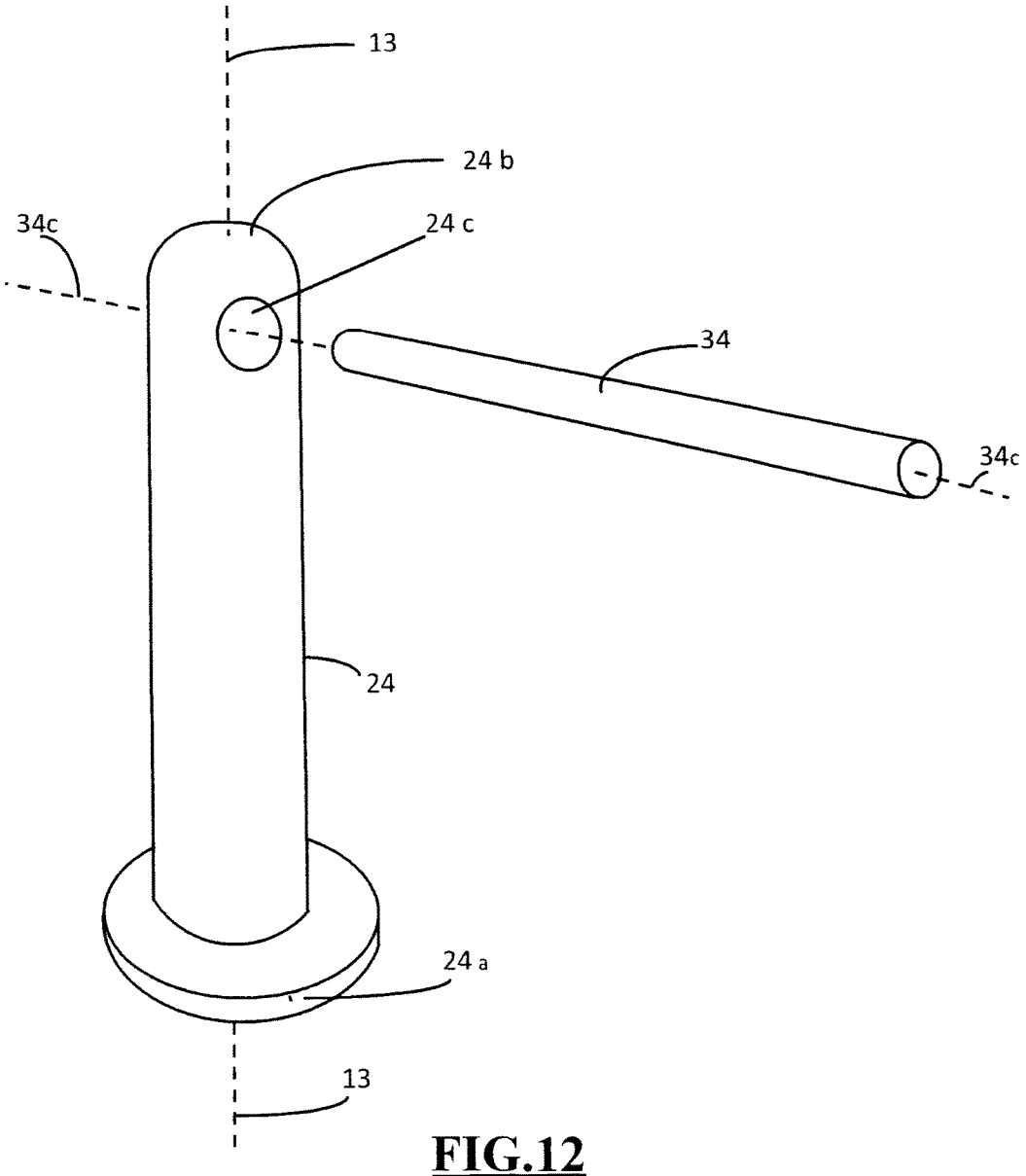
FIG. 12 is an enlarged exploded view in perspective of the center rod and a pin of the nail clipper of FIG. 1.
Figure 13:
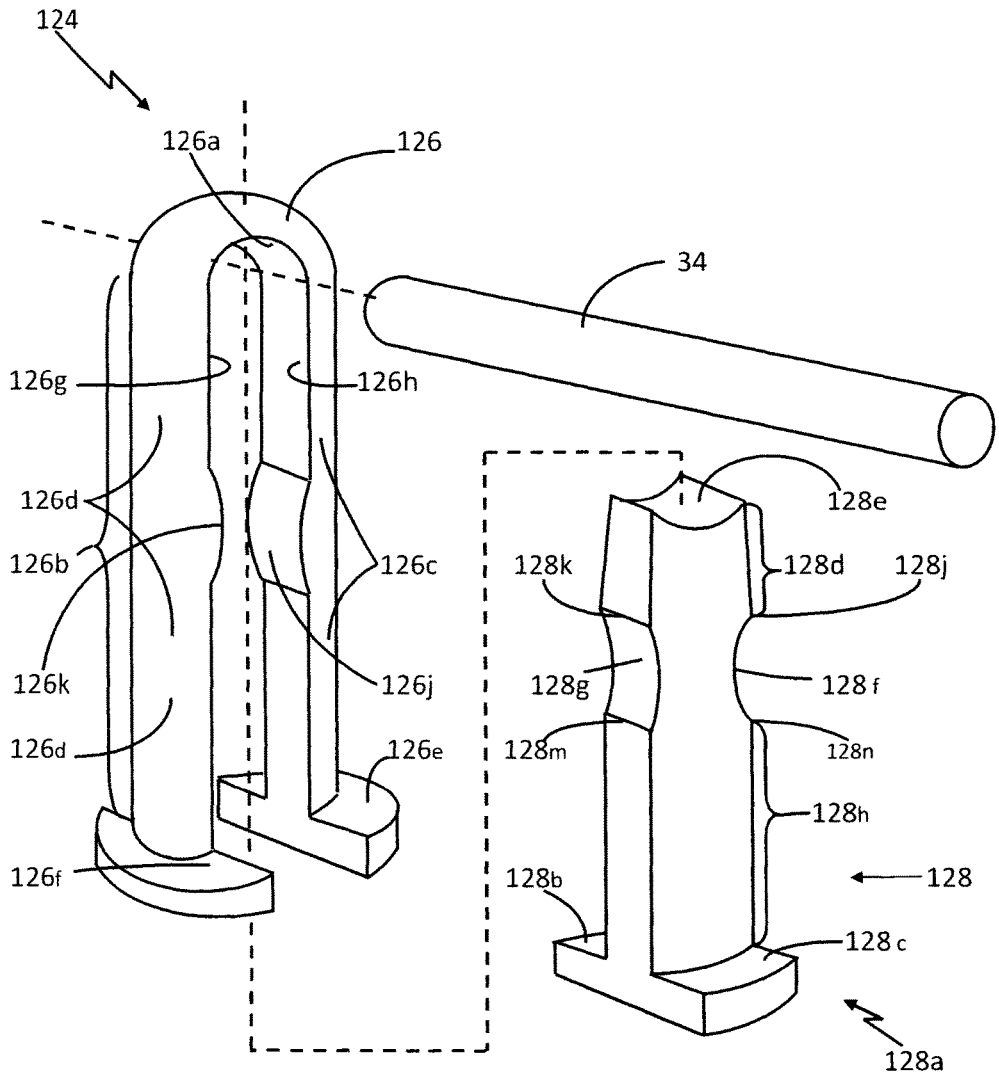
FIG. 13 is an enlarged exploded view in perspective of an alternative two-piece center rod and the pin for use with the nail clipper of FIG. 1.
Figure 13A:
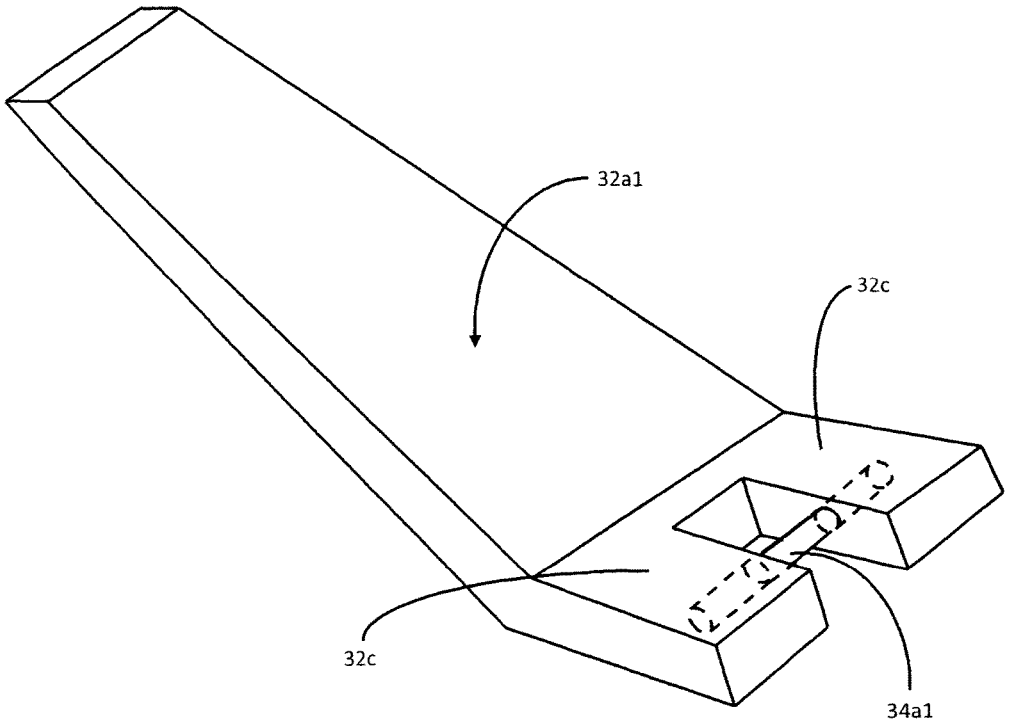
FIG. 13A is an enlarged view in perspective of an embedded pin lever.
Figure 14:
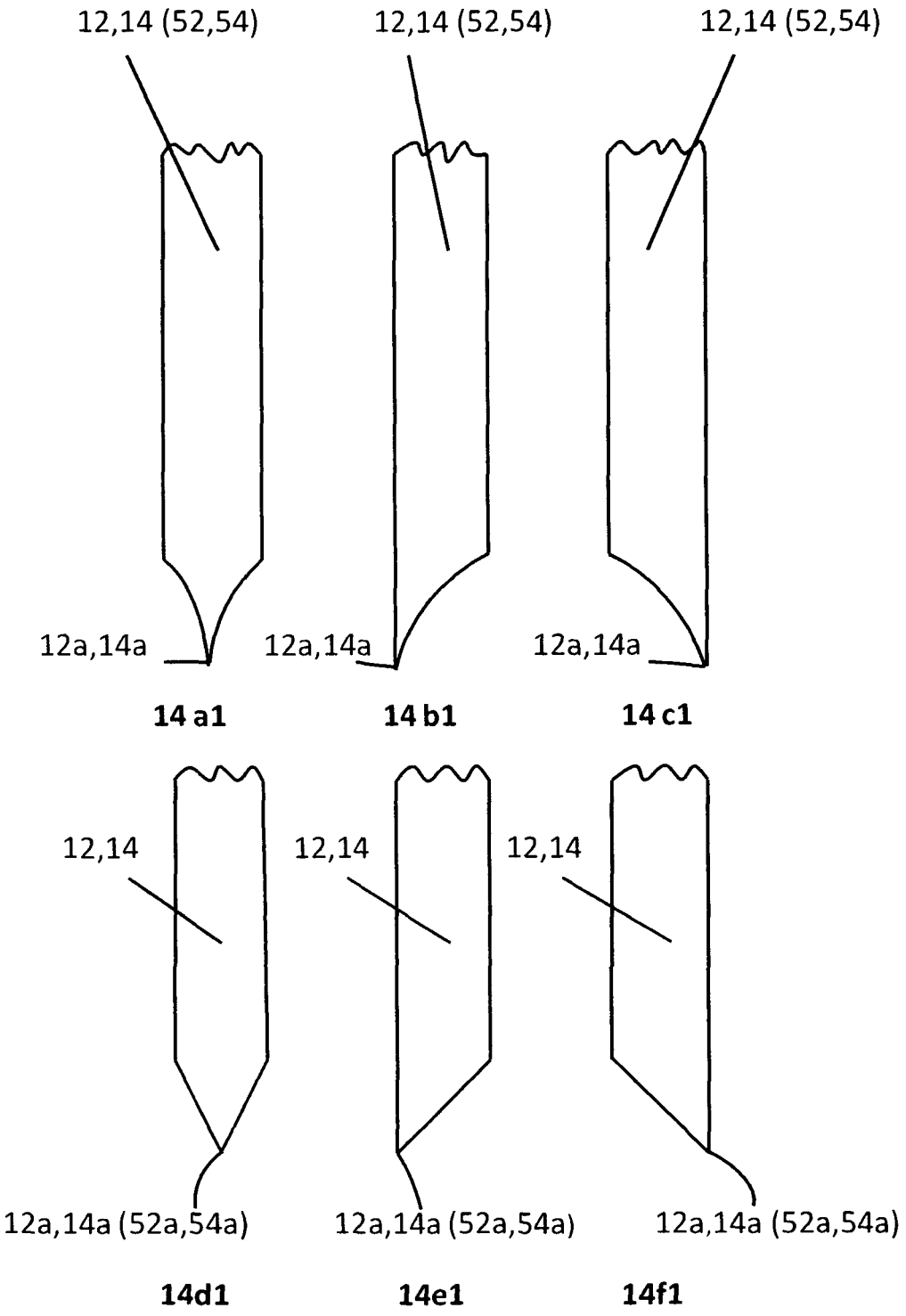
FIG. 14 is an enlarged cross-sectional view of six possible cutting edges for use with the nail clipper of FIG. 1.
Figure 15:
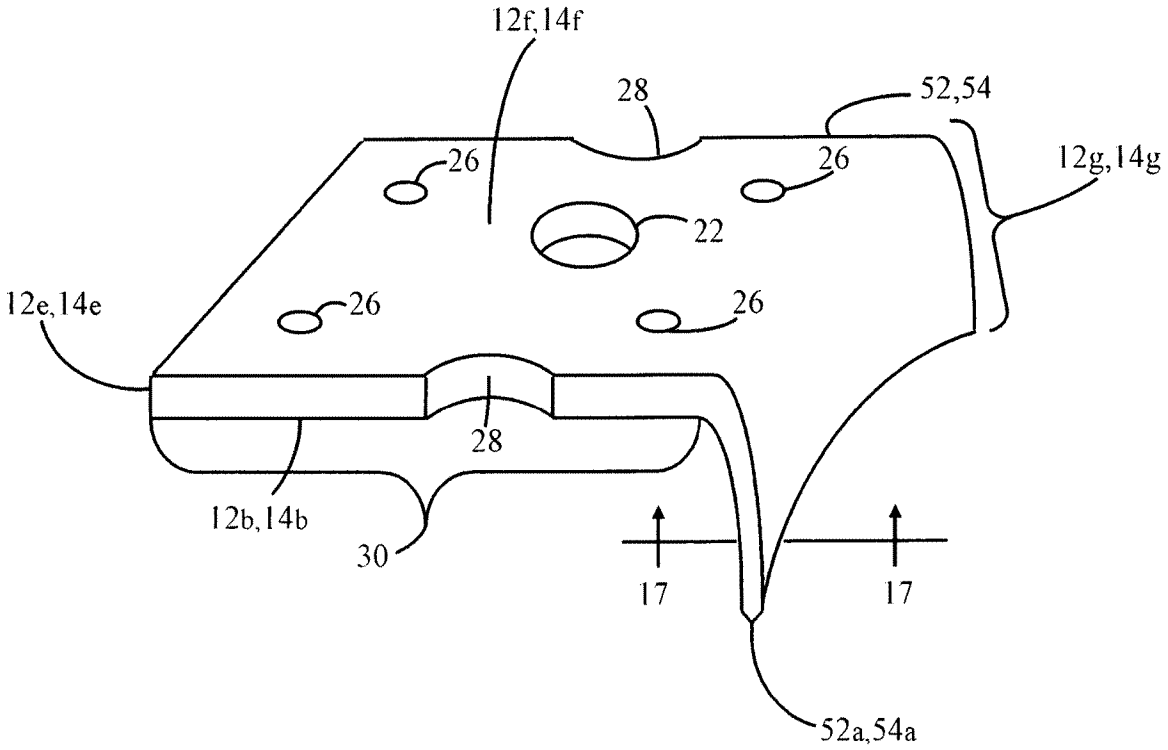
FIG. 15 is an enlarged view in perspective of a modified blade for use with the nail clipper of FIG. 1, showing a curved contour and curved cutting edge of the modified blade.
Figure 16:
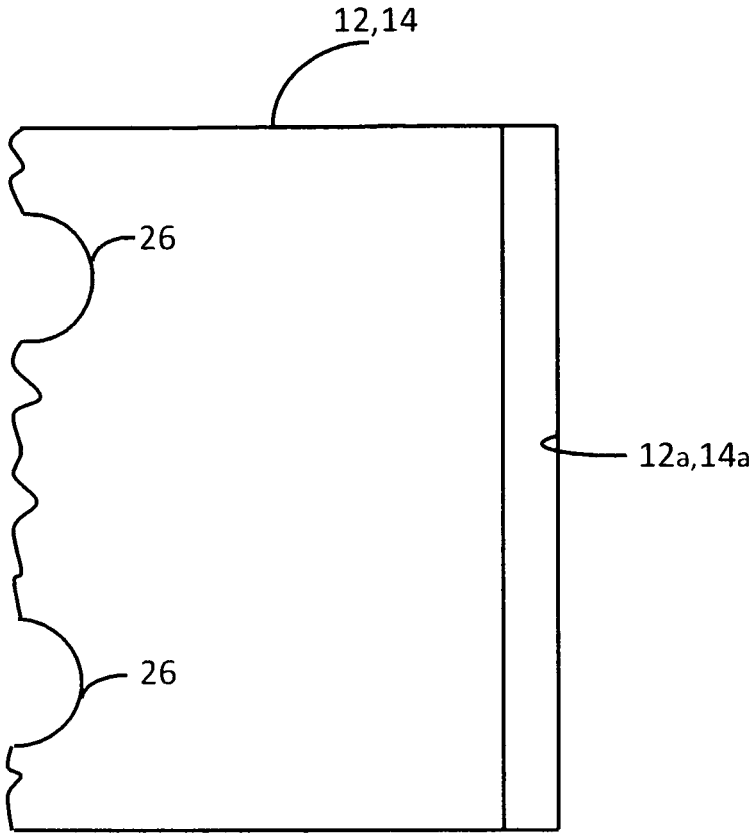
FIG. 16 is an enlarged bottom view taken along line 16-16 of FIG. 11.
Figure 17:
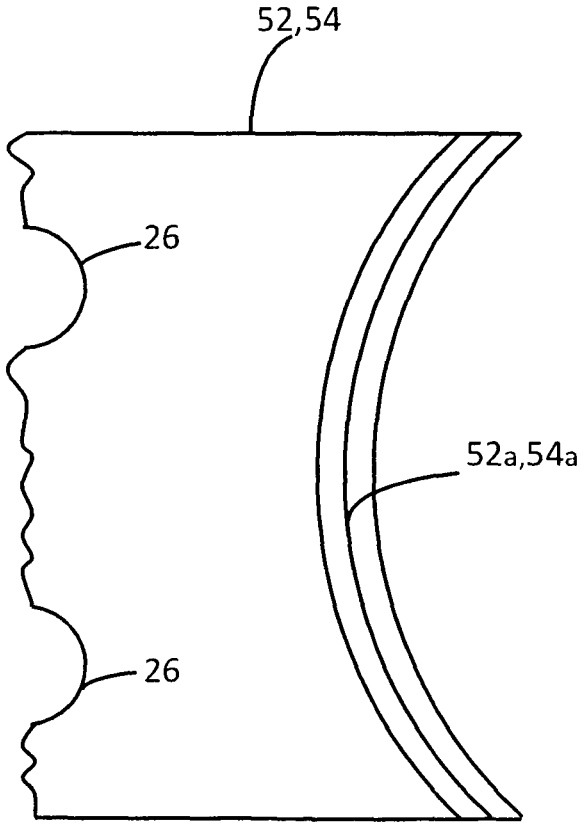
FIG. 17 is an enlarged bottom view taken along line 17-17 of FIG. 15.
Figure 18:
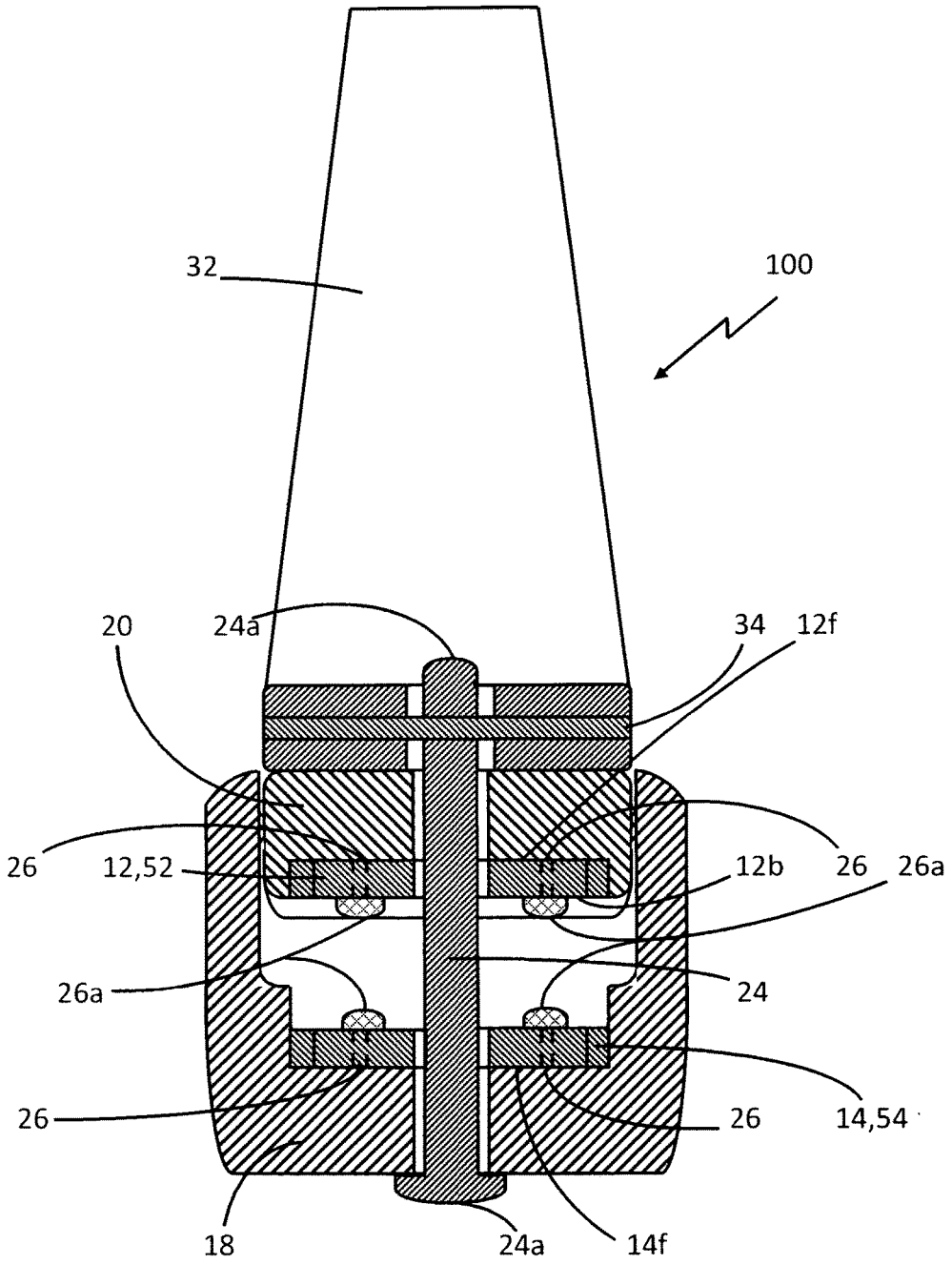
FIG. 18 is an enlarged cross-sectional view of a first modified dual parallel opposing blade embedded member nail clipper, similar to the view of FIG. 9, and instead showing a modified embedded position for the blades of the first modified dual parallel opposing blade embedded member nail clipper, with the first modified dual parallel opposing blade embedded member nail clipper disposed in an open position.
Figure 19:
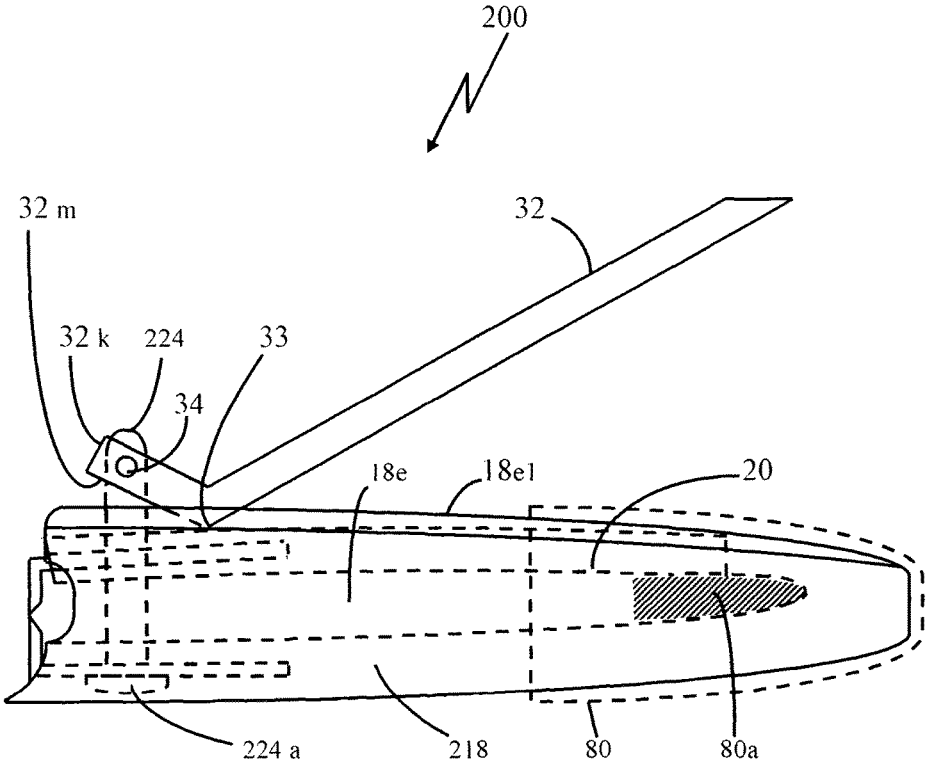
FIG. 19 is a side view of a second modified dual parallel opposing blade embedded member nail clipper, similar to the view of FIG. 4, and instead showing a modified embedded position for an enlarged head of a shorter center rod in an underside of a second modified lower frame member, wherein the enlarged head applies an upward force directly to a horizontal blade portion of a lower blade.
Figure 20:
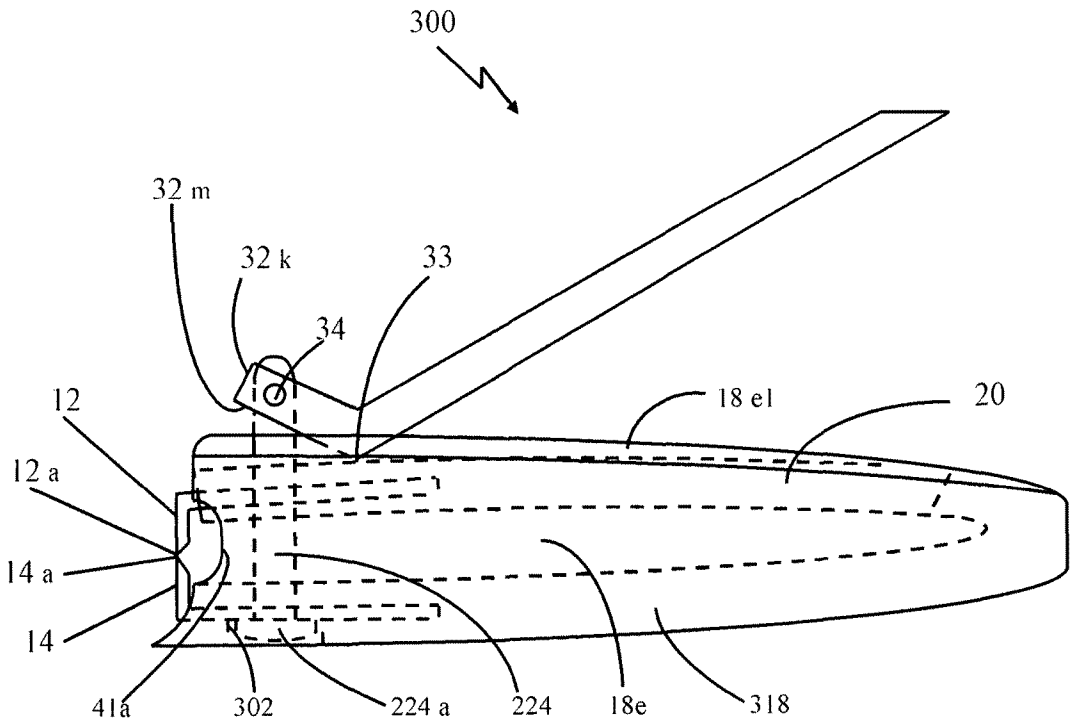
FIG. 20 is a side view of a third modified dual parallel opposing blade embedded member nail clipper, similar to the view of FIG. 19, and instead showing a modified position for the enlarged head of the shorter center rod in an underside of a third modified lower frame member, where the enlarged head is disposed in an enlarged lower frame opening that is provided in the third modified lower frame member.
Figure 21:
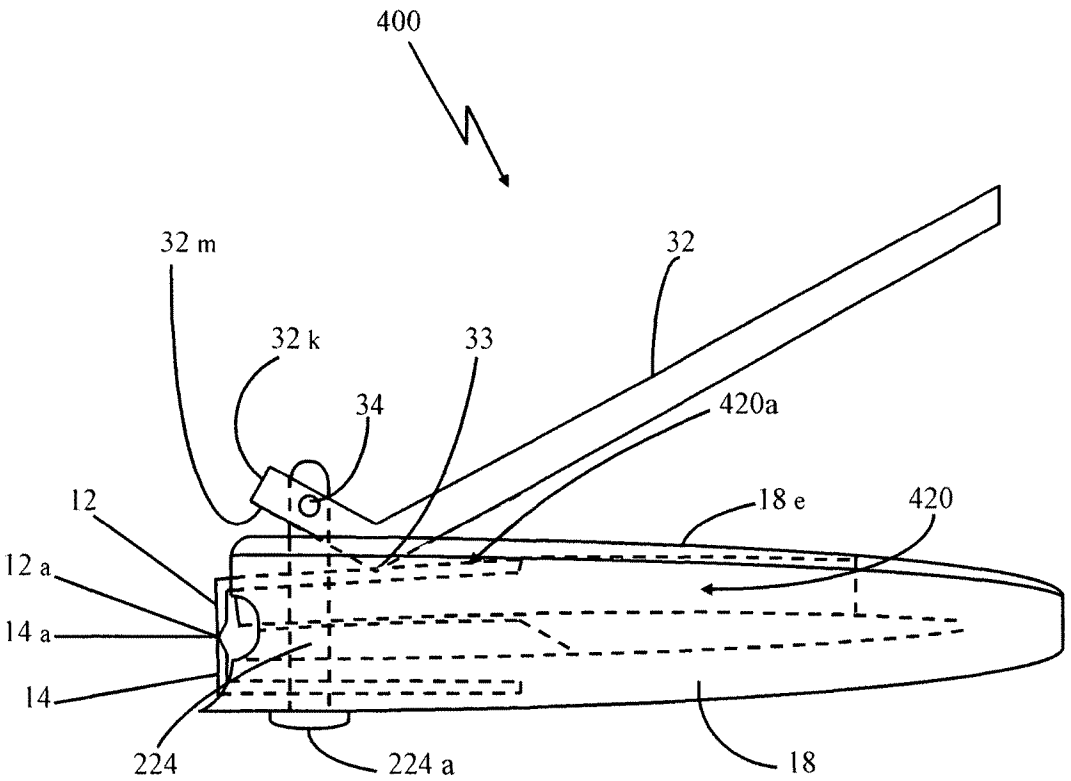
FIG. 21 is a side view of a fourth modified dual parallel opposing blade embedded member nail clipper similar to the view of FIG. 4, where a modified upper frame member does not include plastic (i.e., material) over at least a portion of an upper surface of the horizontal blade portion of an upper blade, and wherein the lever is able to apply a downward force directly to the upper surface of the horizontal blade portion of the upper blade.
Figure 22:
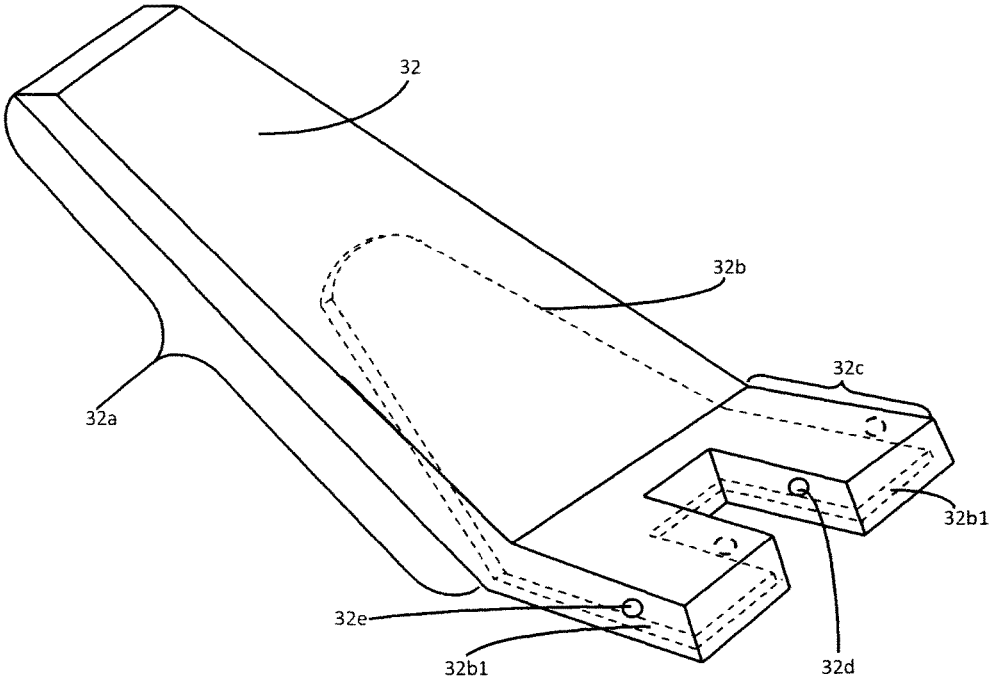
FIG. 22 is a view in perspective of an optional reinforcing embedded member molded in the lever of FIG. 1 in which the lever, other than the reinforcing member, is preferably formed entirely of a polymer (i.e., plastic) or other non-metallic material.
Figure 23:
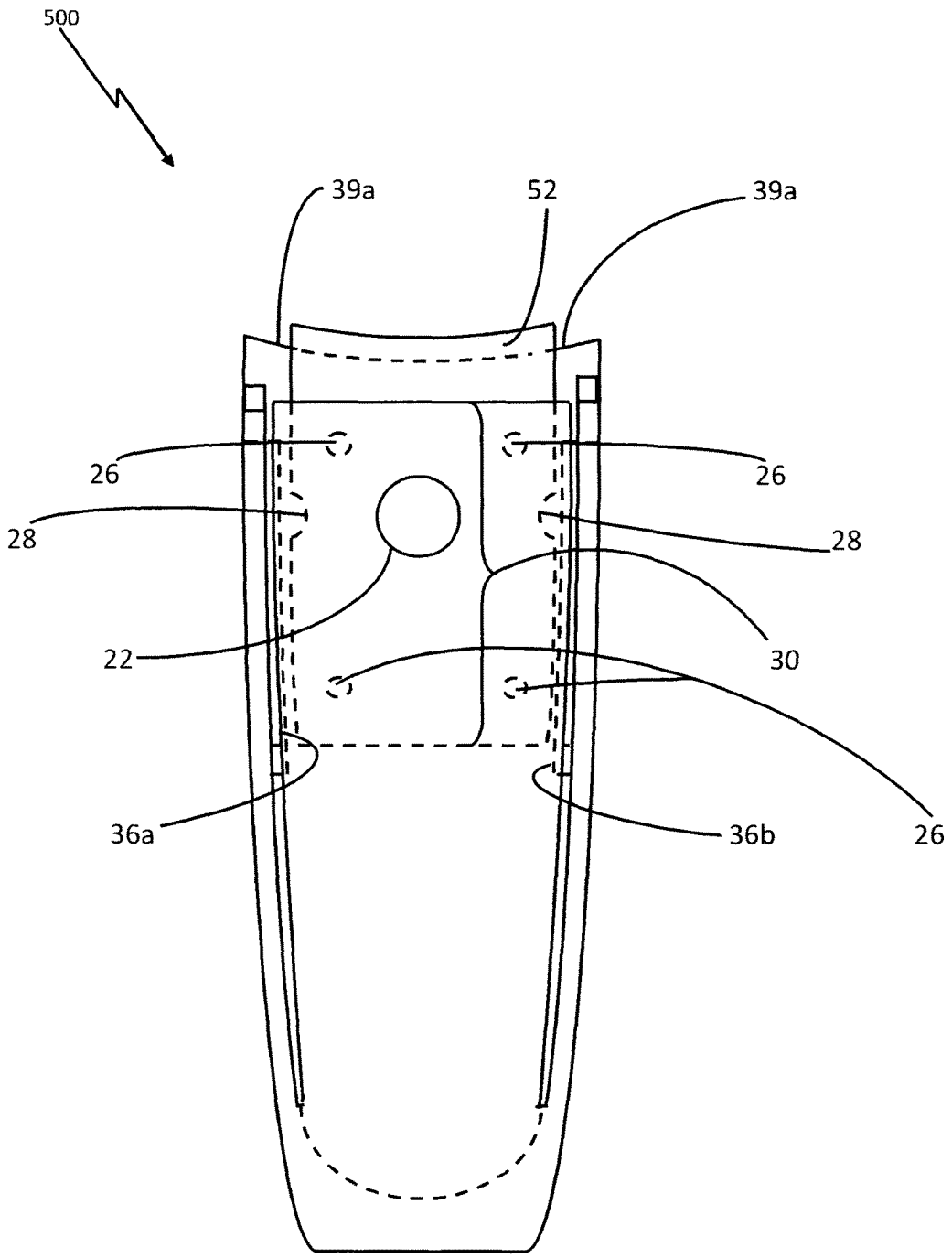
FIG. 23 is an enlarged top view of a fifth modified dual parallel opposing blade embedded member nail clipper that includes the curved blades of FIGS. 15 and 17, and a curved safety bumper, with the lever and the center rod removed for improved clarity of view.
Figure 24:
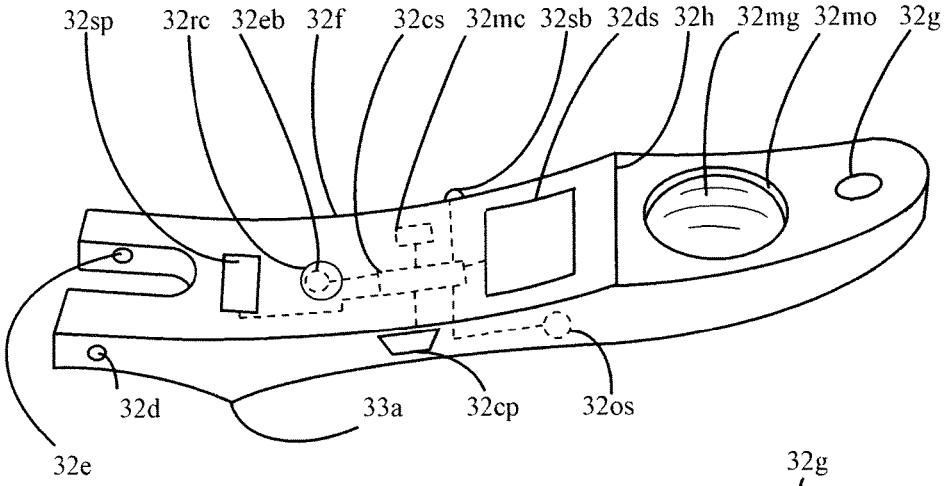
FIG. 24 is a view in perspective of a first modified lever that includes a modified fulcrum and which is formed entirely of a polymer (i.e., plastic) material to illustrate possible design variability.
Figure 25:
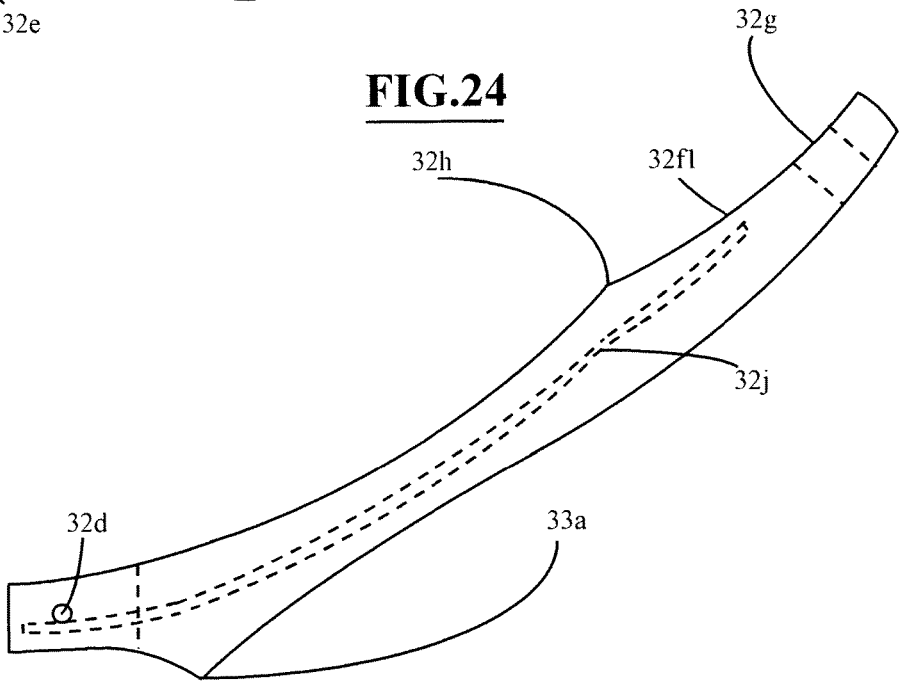
FIG. 25 is a side view of a second modified lever that is similar to the first modified lever of FIG. 24, and which includes a reinforcing elongated member insert embedded in the second modified lever.
Figure 26:
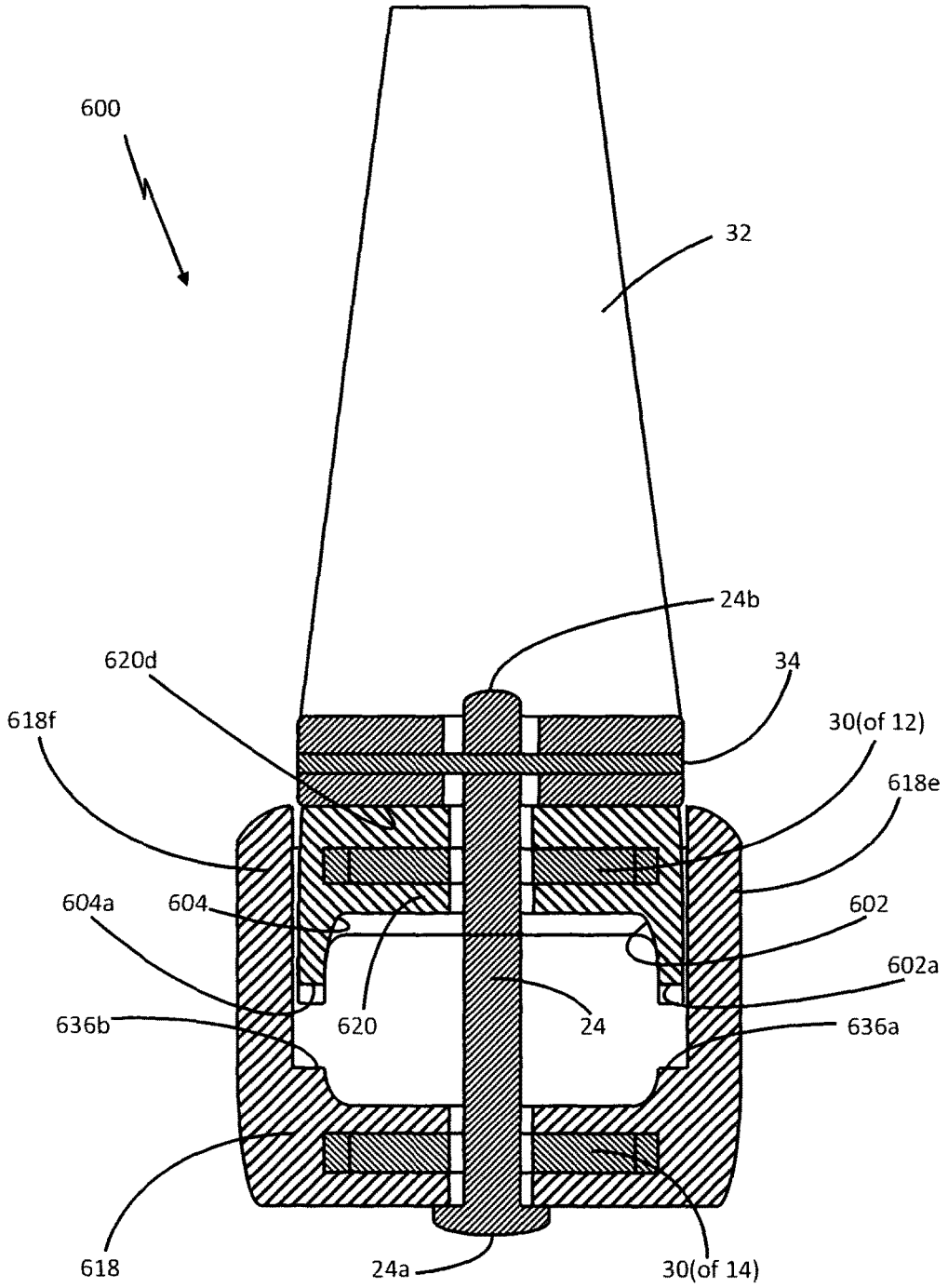
FIG. 26 is an enlarged cross-sectional view of a sixth modified dual parallel opposing blade embedded member nail clipper, in a view similar to FIG. 9, taken along a line passing through the center longitudinal axis of the center rod of the sixth modified dual parallel opposing blade embedded member nail clipper that includes a modified U-shaped upper frame member and with the sixth modified dual parallel opposing blade embedded member nail clipper disposed in an open position.
Figure 27:
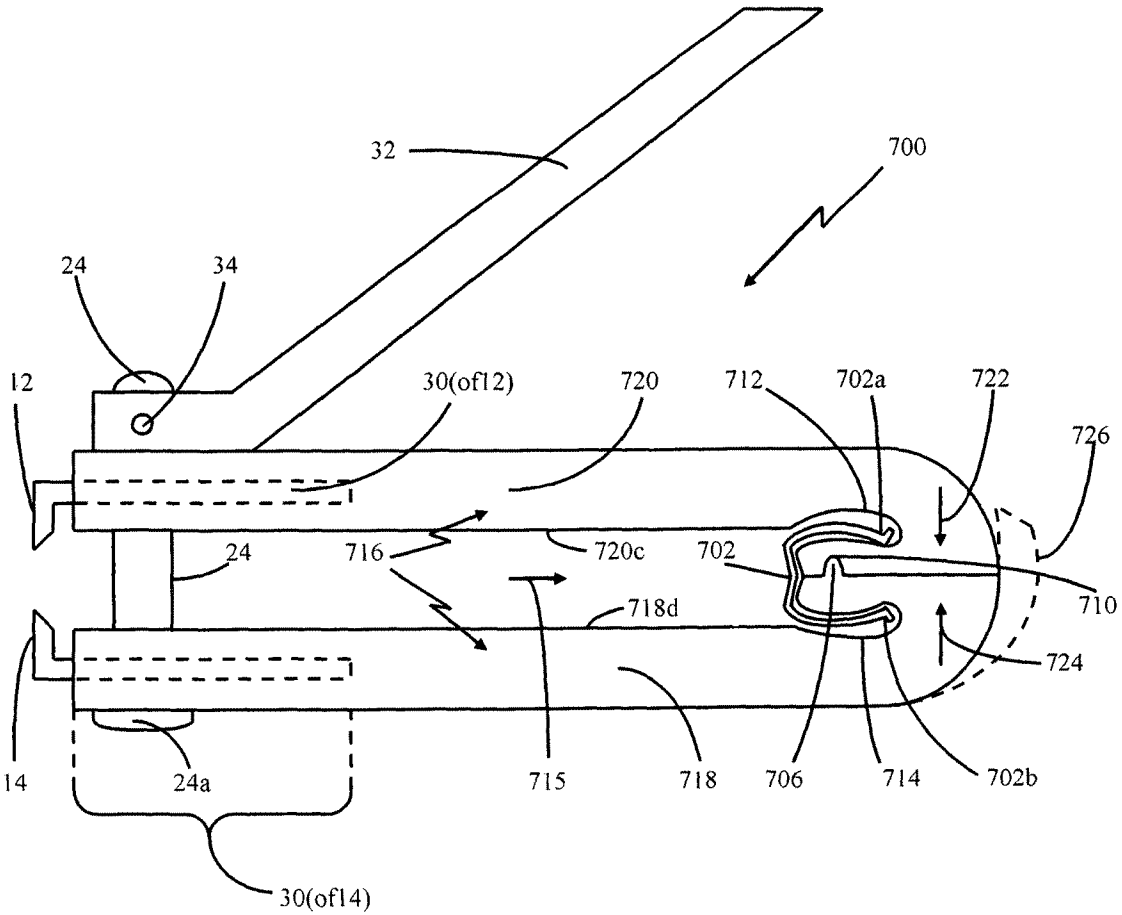
FIG. 27 is an enlarged side view of a modified spring clip nail clipper in an open position.
Figure 27A:
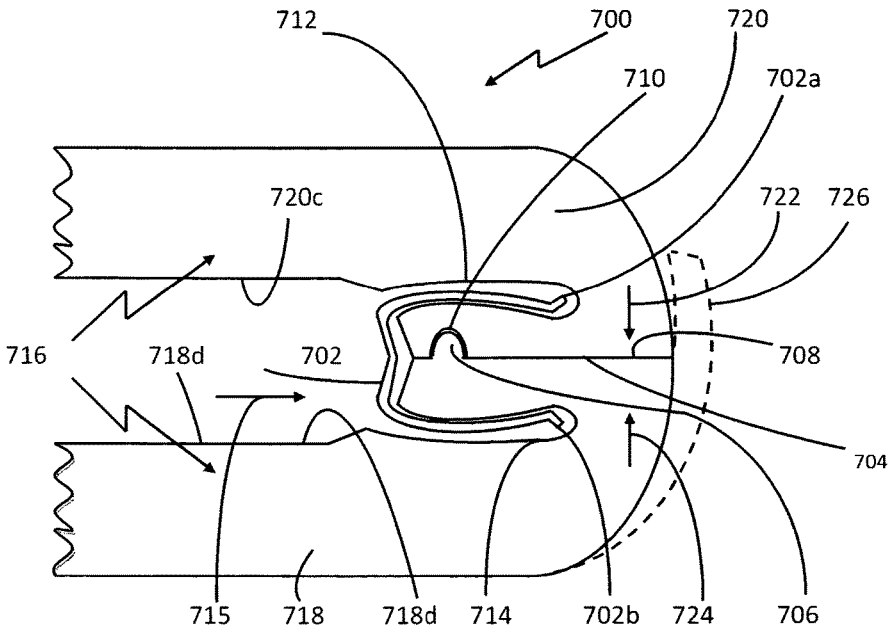
FIG. 27A is a further enlarged side view of a rear portion of the modified spring clip nail clipper of FIG. 27.
Figure 28:
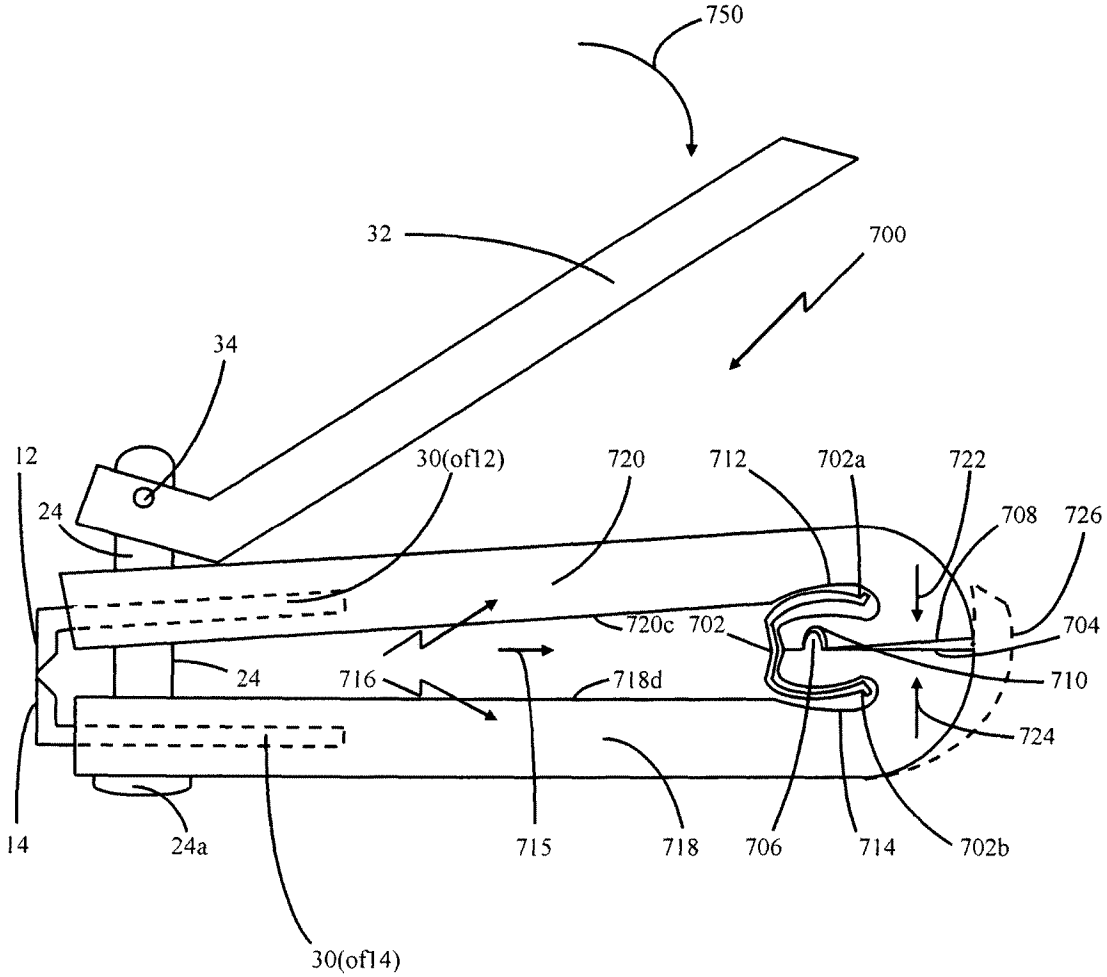
FIG. 28 is an enlarged side view of the modified spring clip nail clipper of FIG. 27 in a closed position.
Figure 28A:
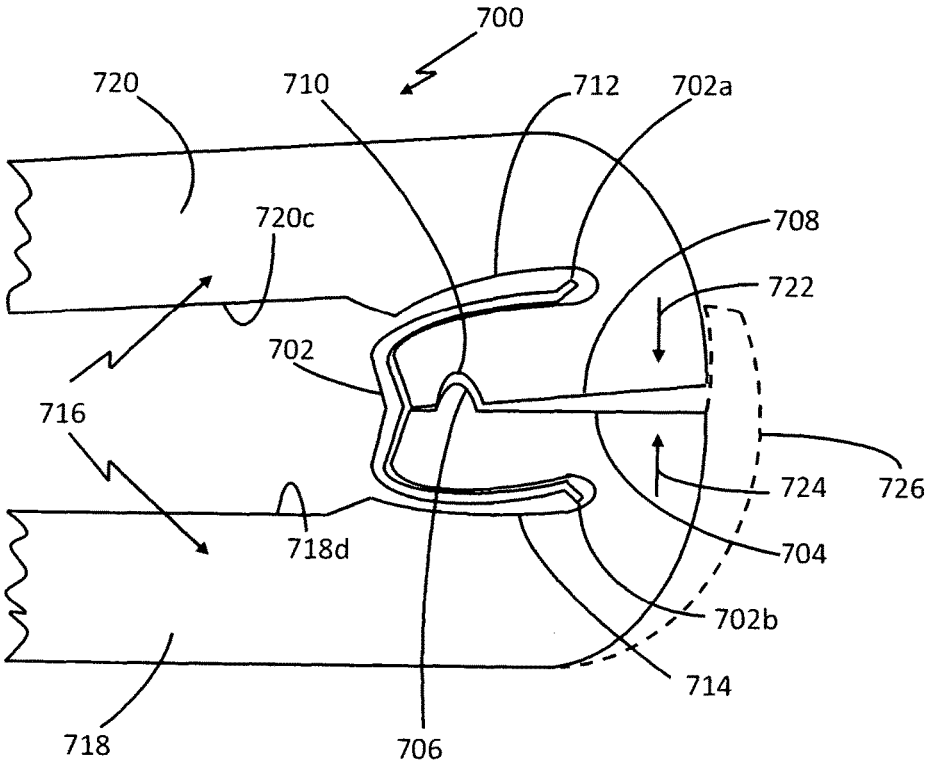
FIG. 28A is a further enlarged side view of the rear portion of the modified spring clip nail clipper of FIG. 28.
Figure 29:
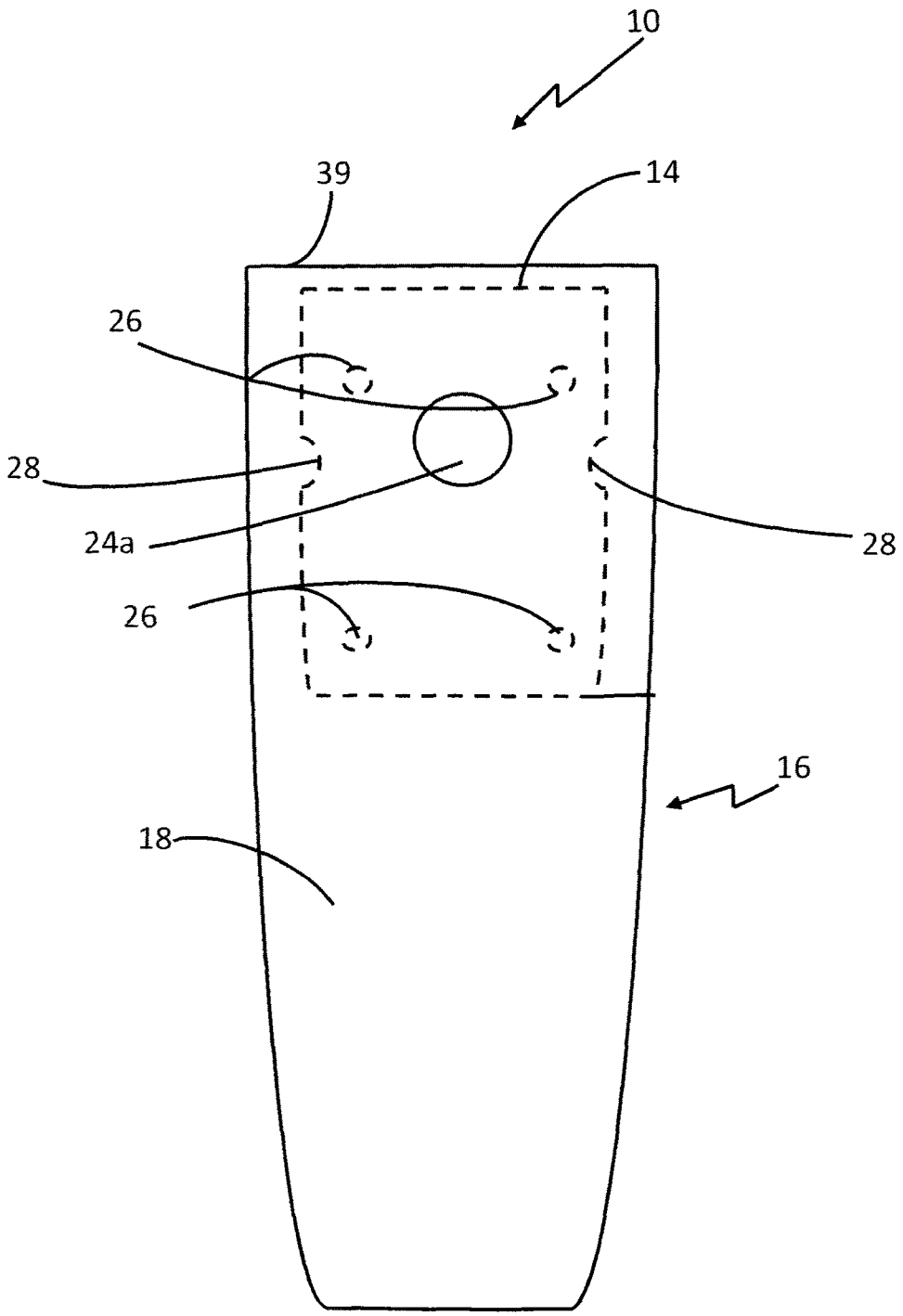
FIG. 29 is a bottom view of the nail clipper of FIG. 1.
Figure 30:
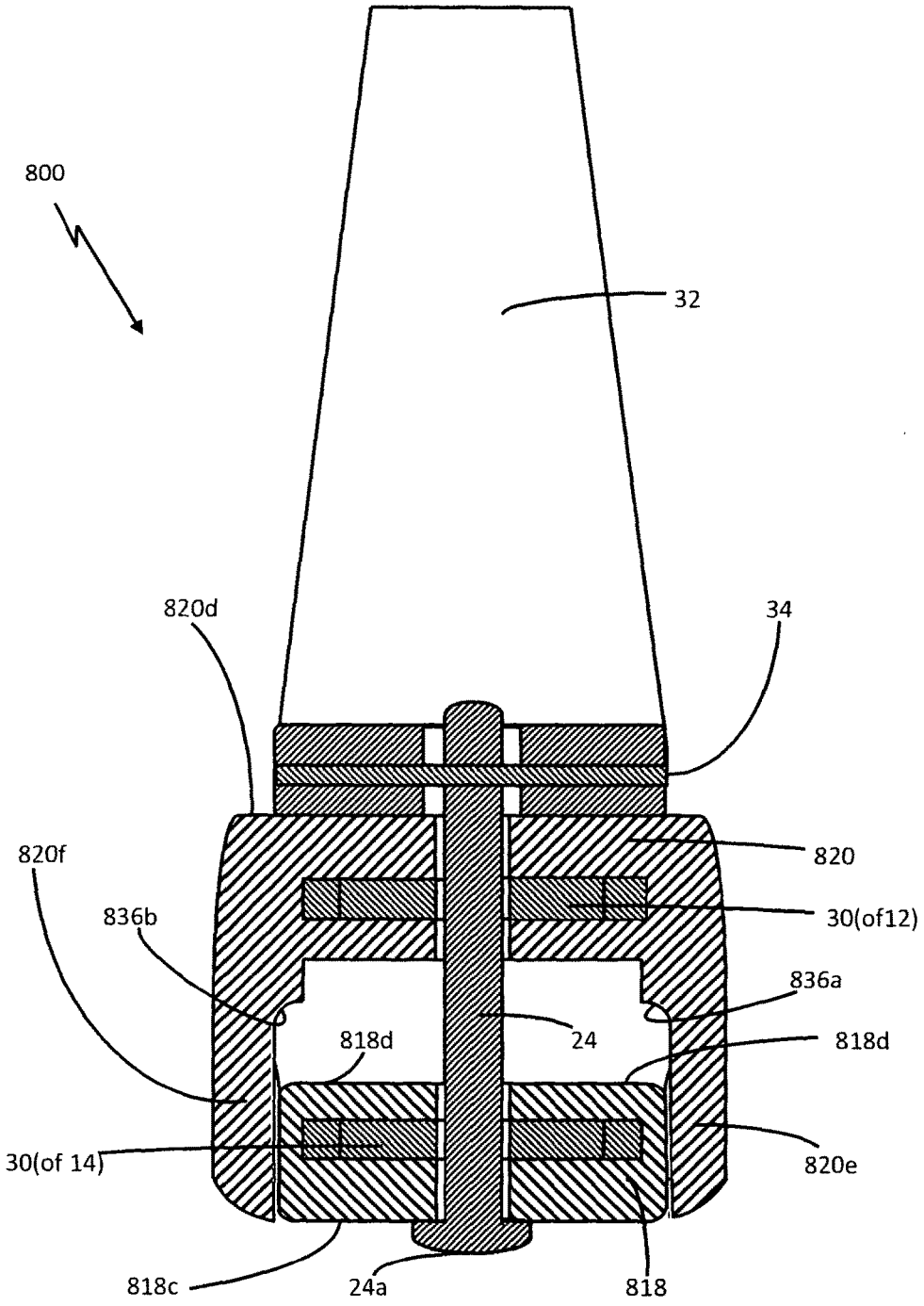
FIG. 30 is an enlarged cross-sectional view of an eighth modified dual parallel opposing blade embedded member nail clipper where certain of its component parts are inverted in their positioning.
Figure 31:
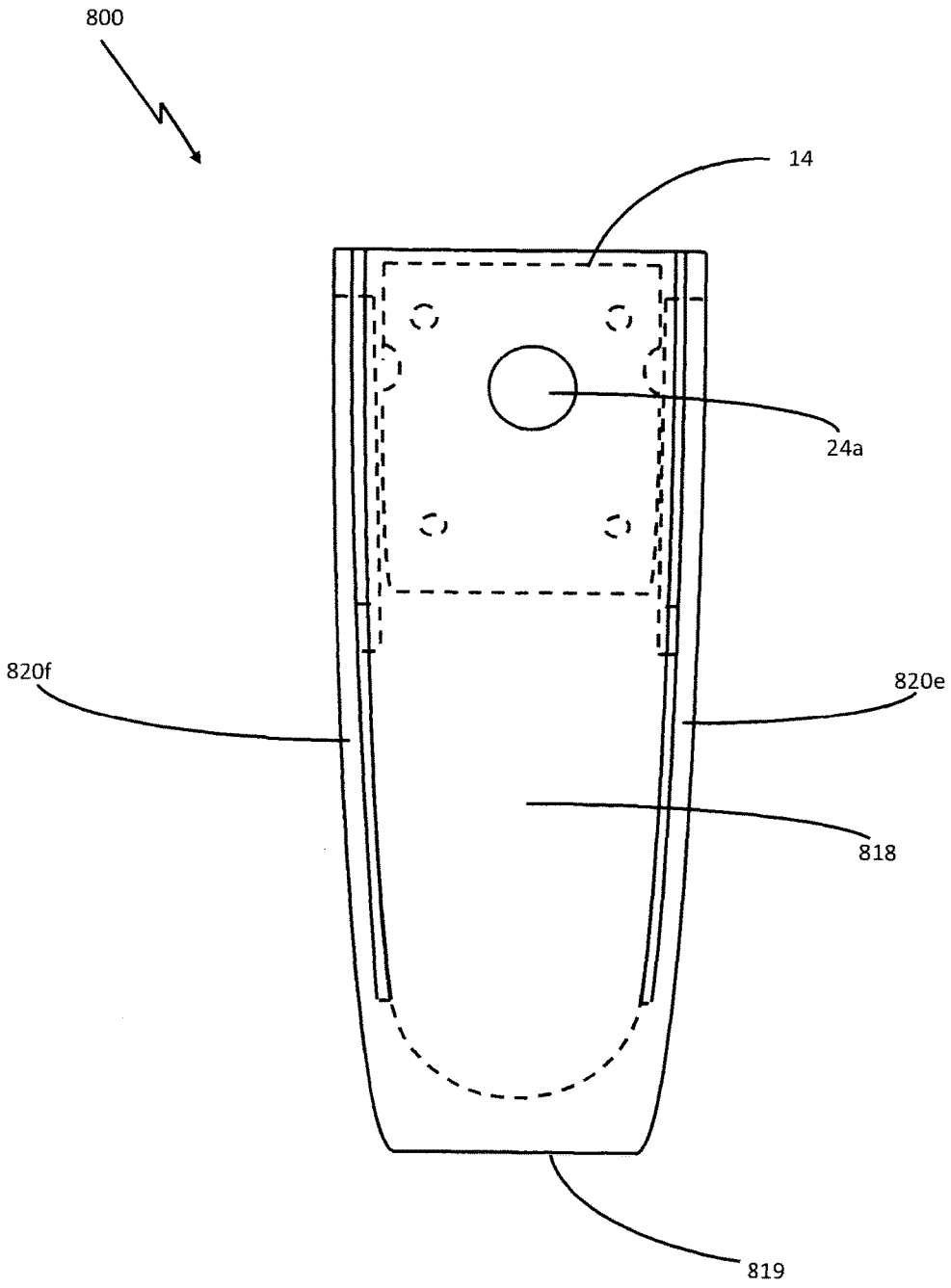
FIG. 31 is an enlarged bottom view of the eighth modified dual parallel opposing blade embedded member nail clipper that also includes a forward portion, thereof, which is not shown in FIG. 30.
Figure 32:
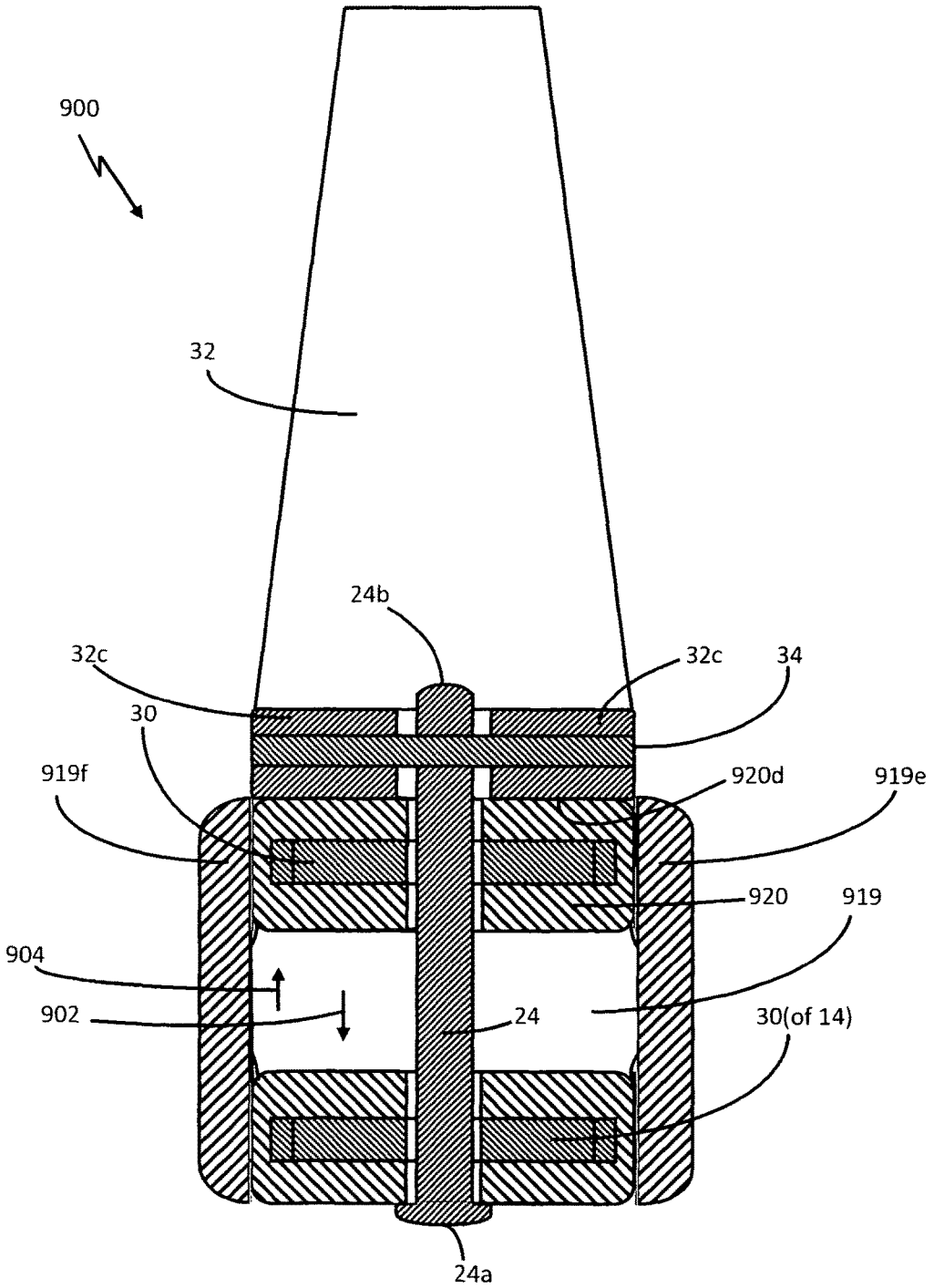
FIG. 32 is a cross-sectional view of a ninth modified dual parallel opposing blade embedded member nail clipper with a floating upper member and a floating lower member and a pair of floating container sidewalls that are attached to a modified vertical floating rear wall.
Figure 32A:
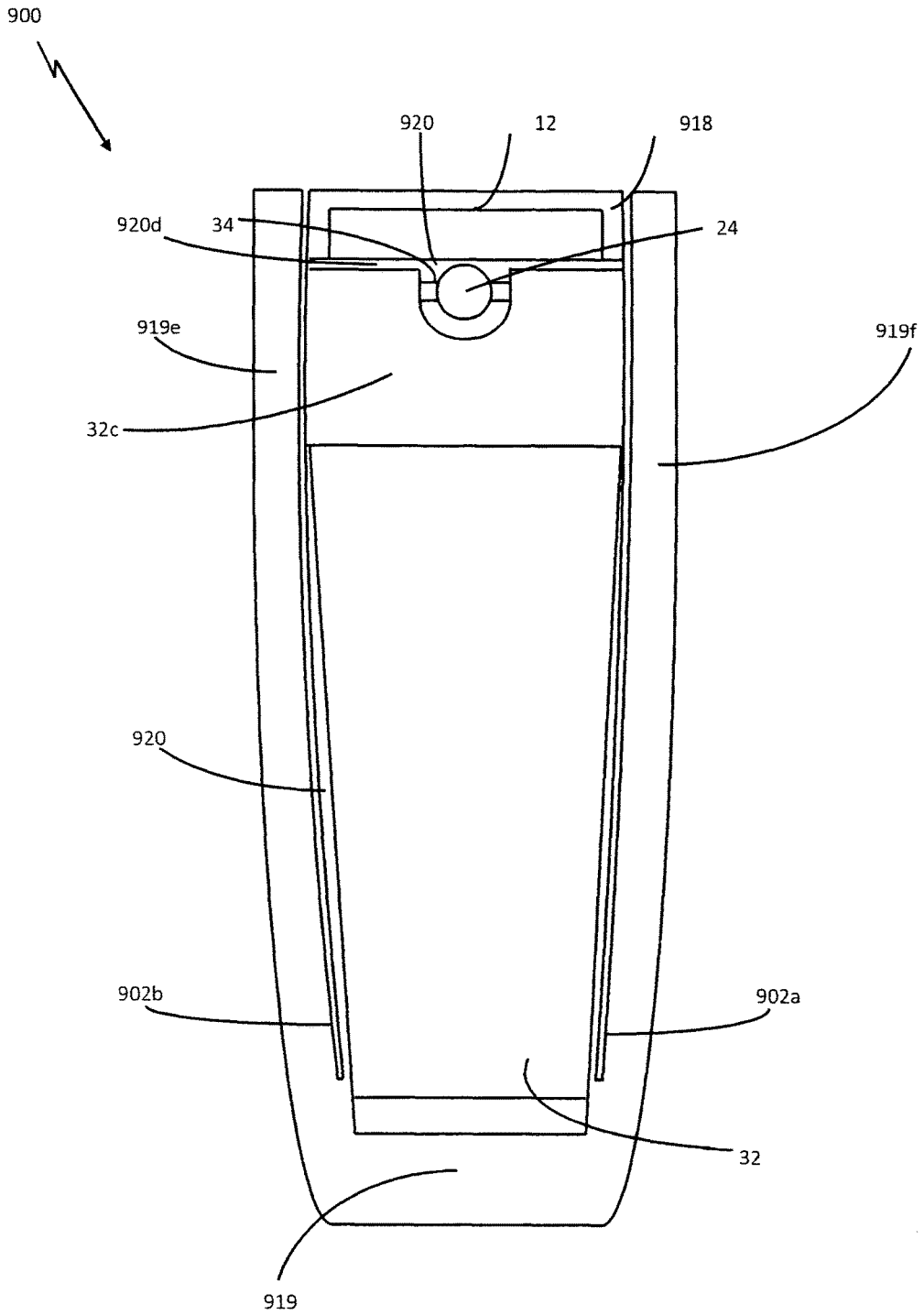
FIG. 32A is a top view of the ninth modified dual parallel opposing blade embedded member nail clipper of FIG. 32 in an open position after its assembly is complete.
Figure 32B:
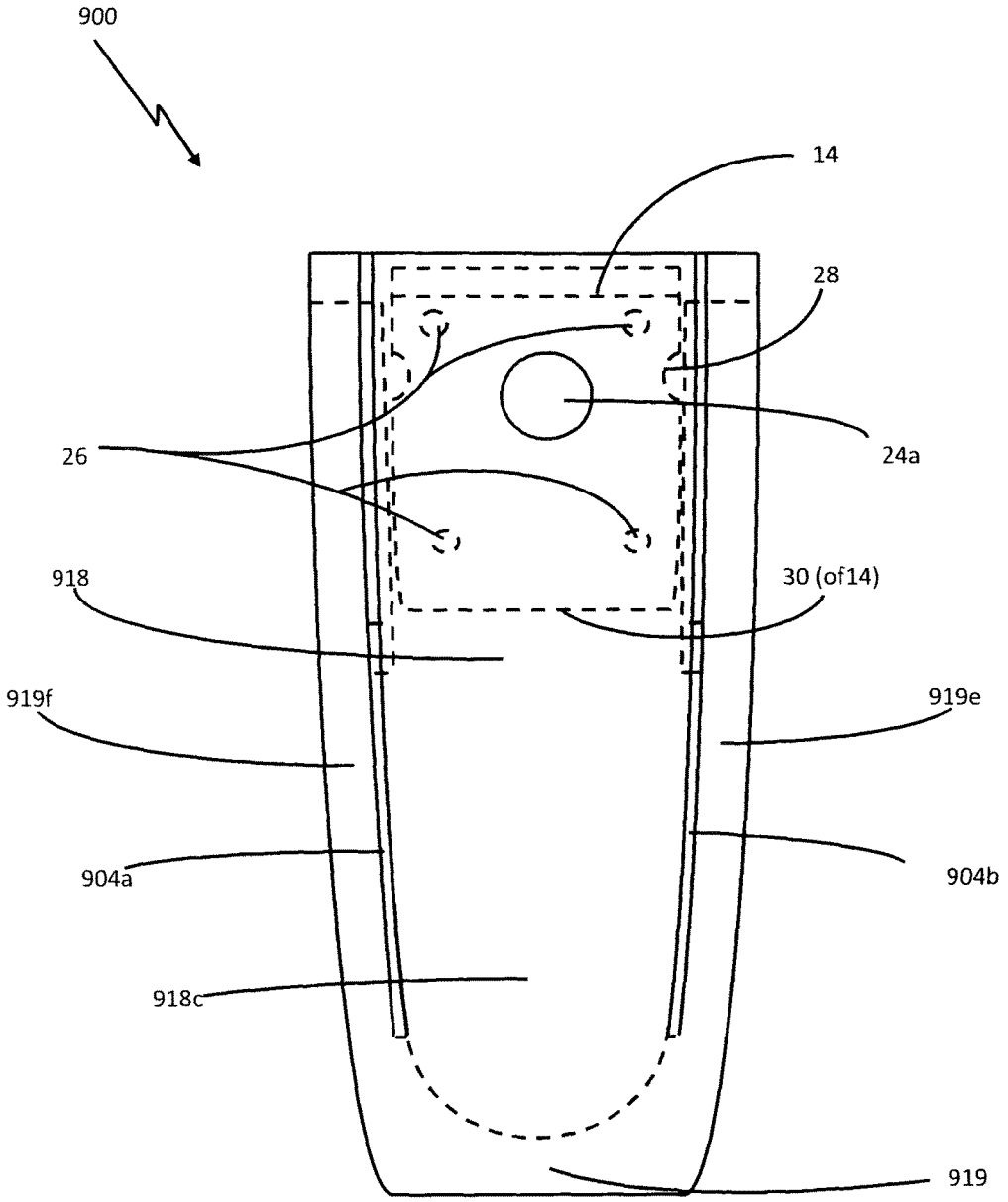
FIG. 32B is a bottom view of the ninth modified dual parallel opposing blade embedded member nail clipper of FIG. 32.
Figure 33:
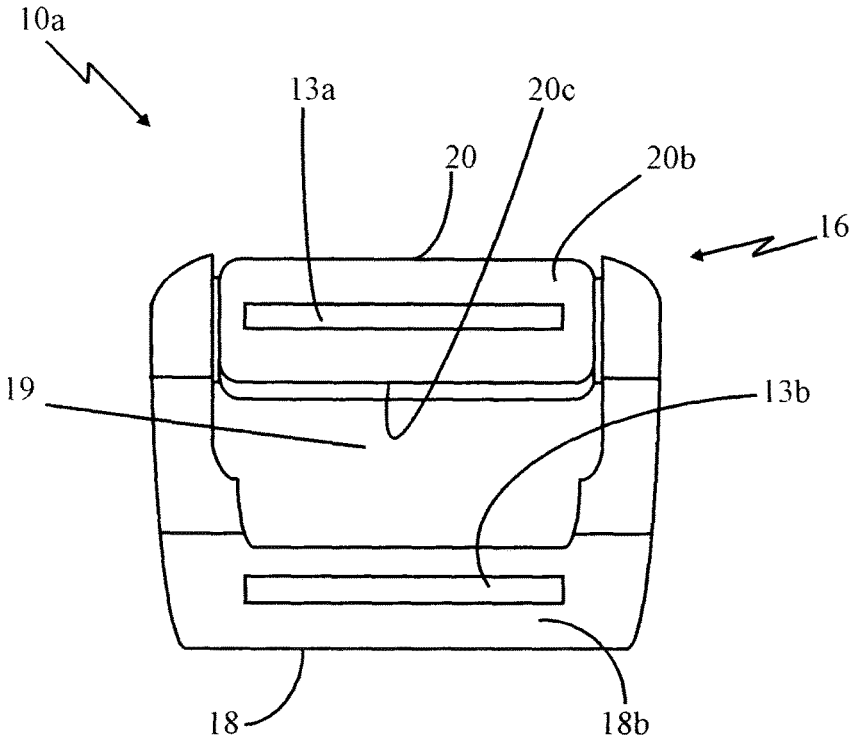
FIG. 33 is an enlarged end view of a modified dual parallel opposing blade embedded member nail clipper similar to the nail clipper of FIG. 1 and the view shown in FIG. 6, absent a pair of parallel opposing blades, the lever, the center rod, and the pin, wherein the modified dual parallel opposing blade embedded member nail clipper includes a pair of optional openings for later insertion of the parallel opposing blades, therein.
Figure 34:
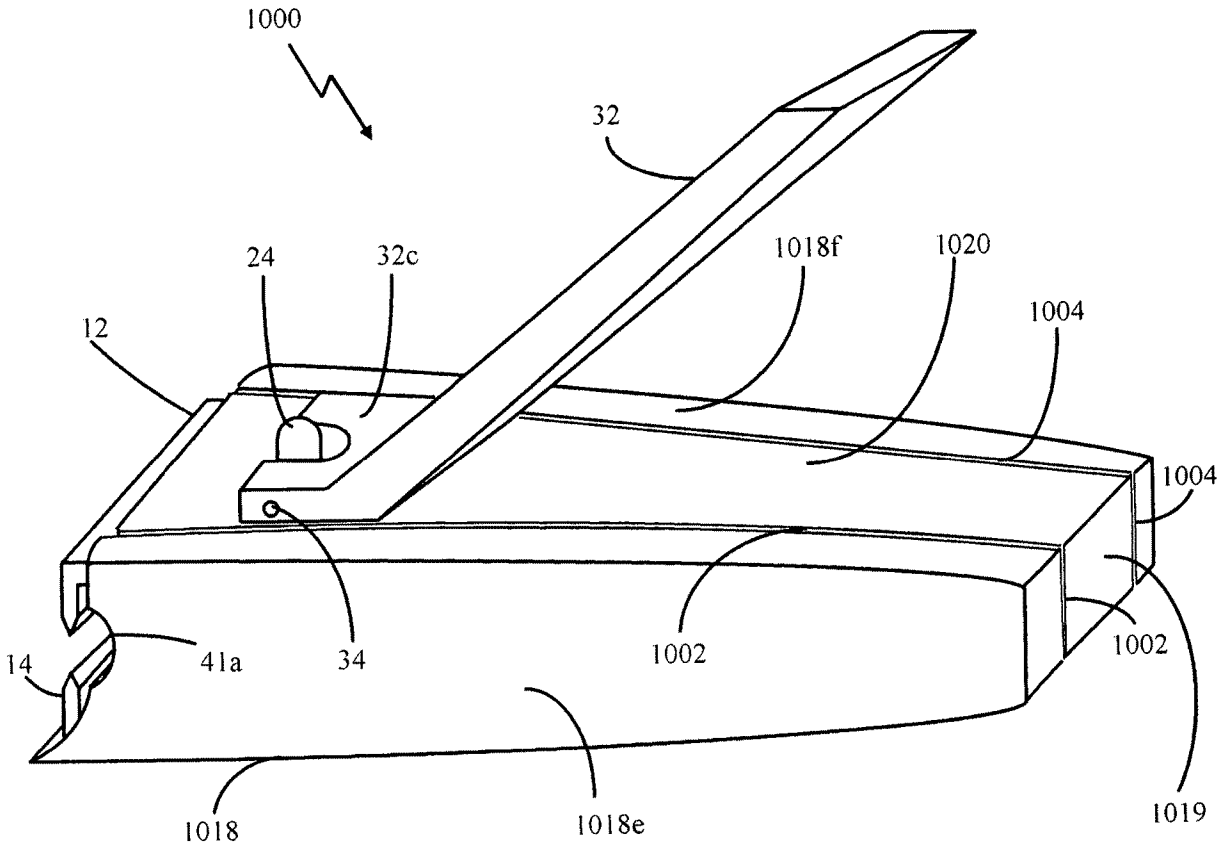
FIG. 34 is view in perspective of a tenth modified dual parallel opposing blade embedded member nail clipper that includes a pair of gaps that extend around a rear and a bottom of the tenth modified dual parallel opposing blade embedded member nail clipper to increase flexibility of a tenth modified upper frame member and a tenth modified lower frame member and where a pair of tenth container sidewalls are each attached only to the tenth modified lower frame member.
Figure 35:
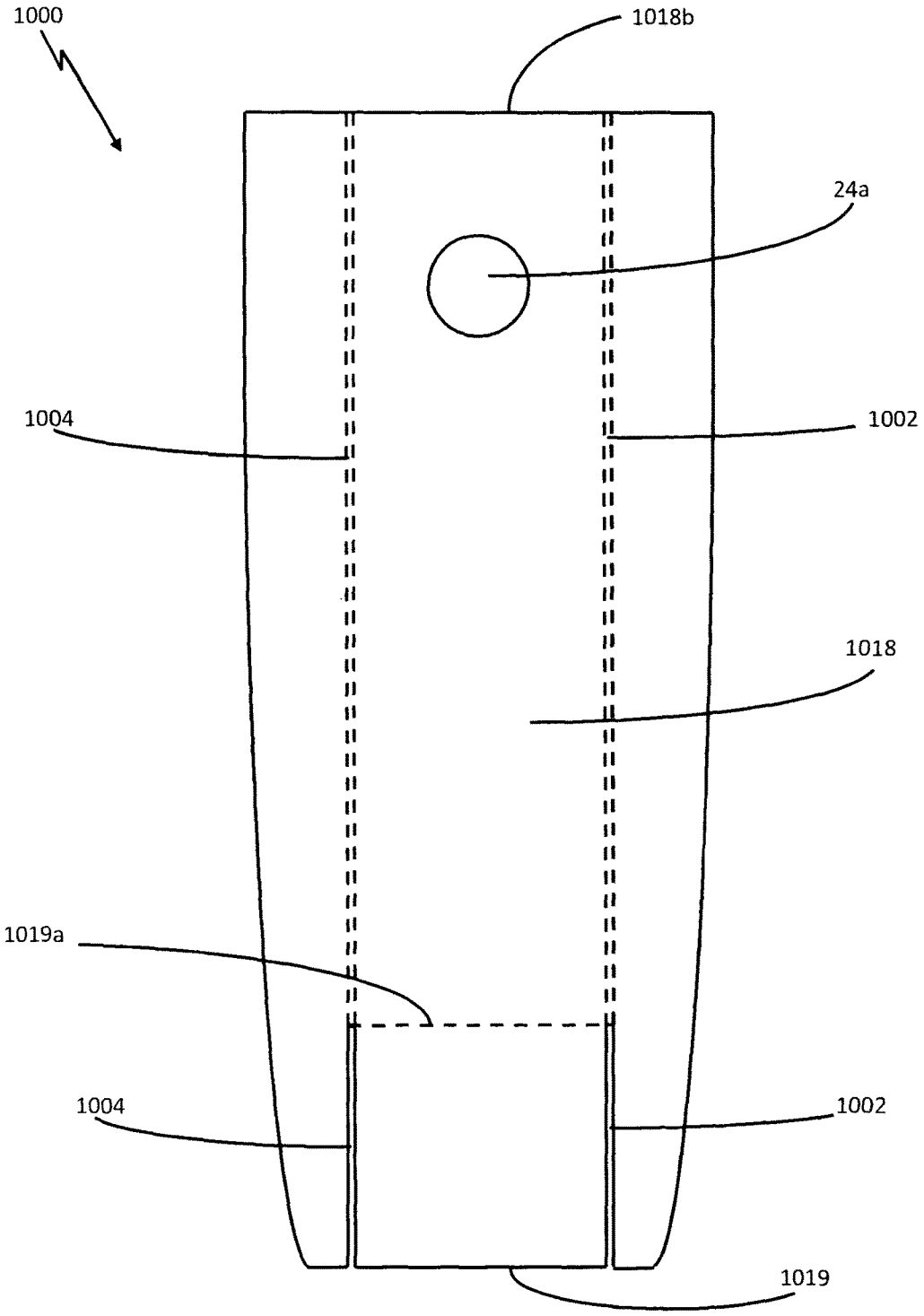
FIG. 35 is an enlarged bottom view of the tenth modified dual parallel opposing blade embedded member nail clipper of FIG. 34.
Figure 36:
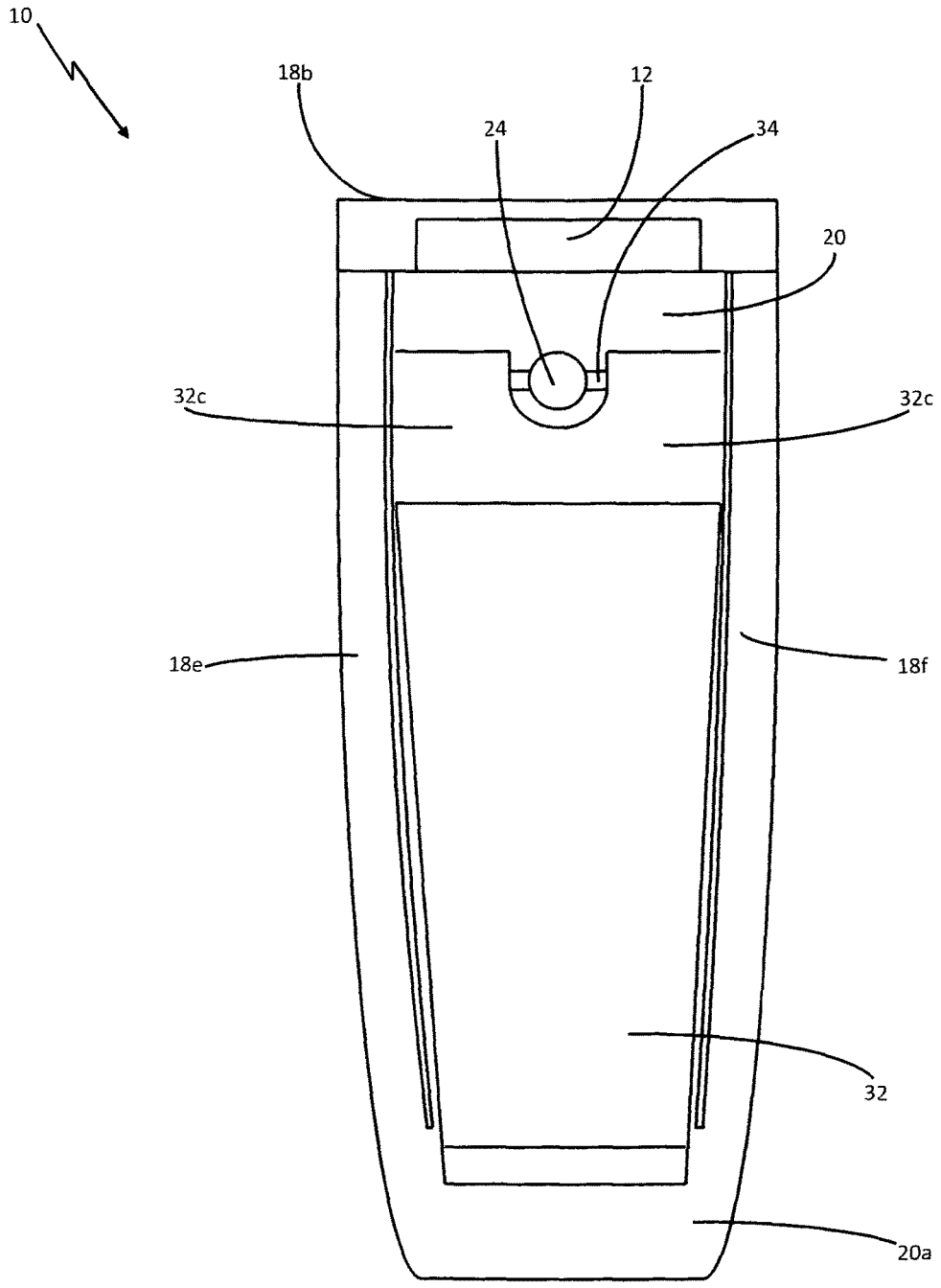
FIG. 36 is an enlarged top view of the nail clipper of FIG. 1, with the lever and the center rod of FIG. 1 attached, thereto.
Figure 37:
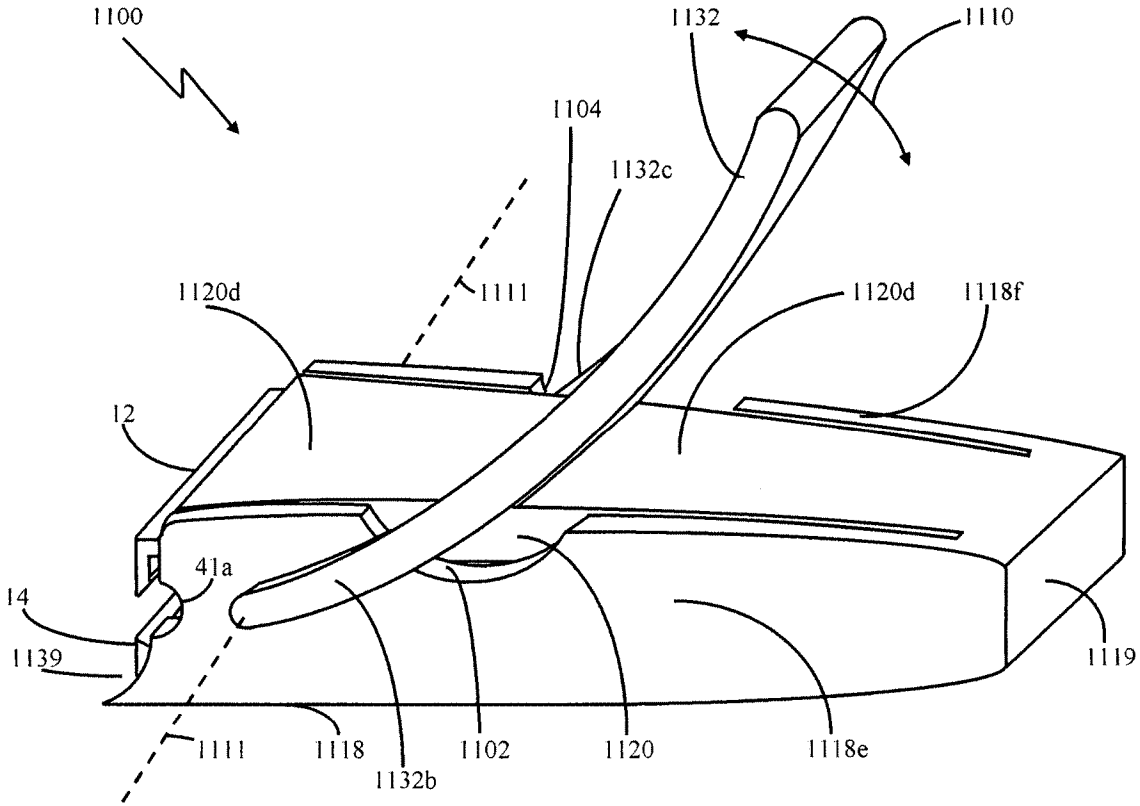
FIG. 37 is a view in perspective of an axially pivoting dual parallel opposing blade embedded member nail clipper in an open position.
Figure 38:
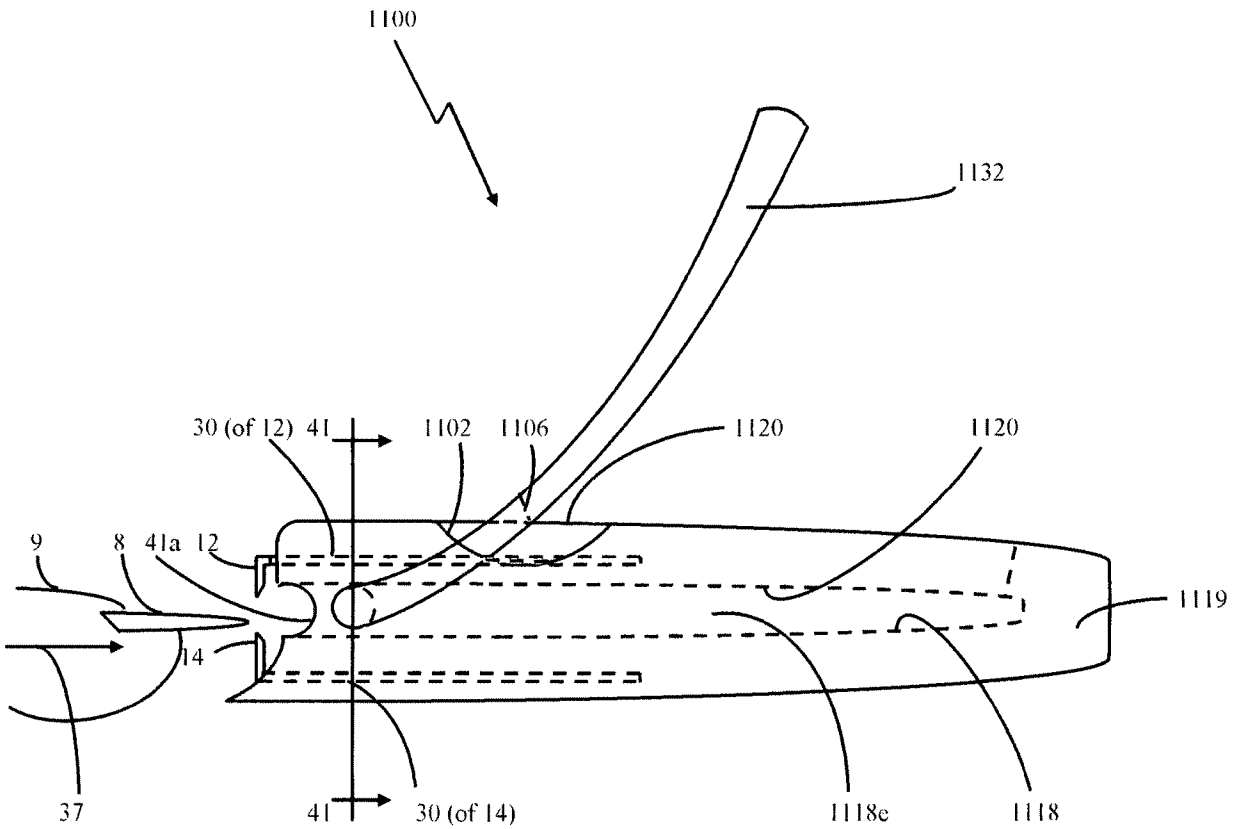
FIG. 38 is a side view of the axially pivoting dual parallel opposing blade embedded member nail clipper of FIG. 37 in the open position.
Figure 39:
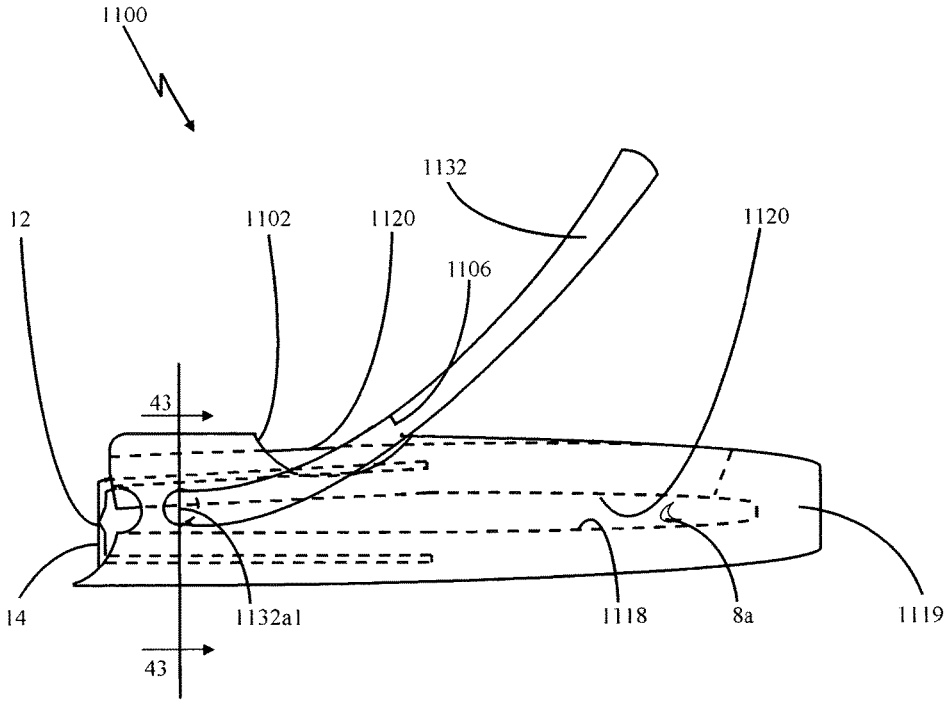
FIG. 39 is a side view of the axially pivoting dual parallel opposing blade embedded member nail clipper of FIG. 37 in a closed position.
Figure 40:
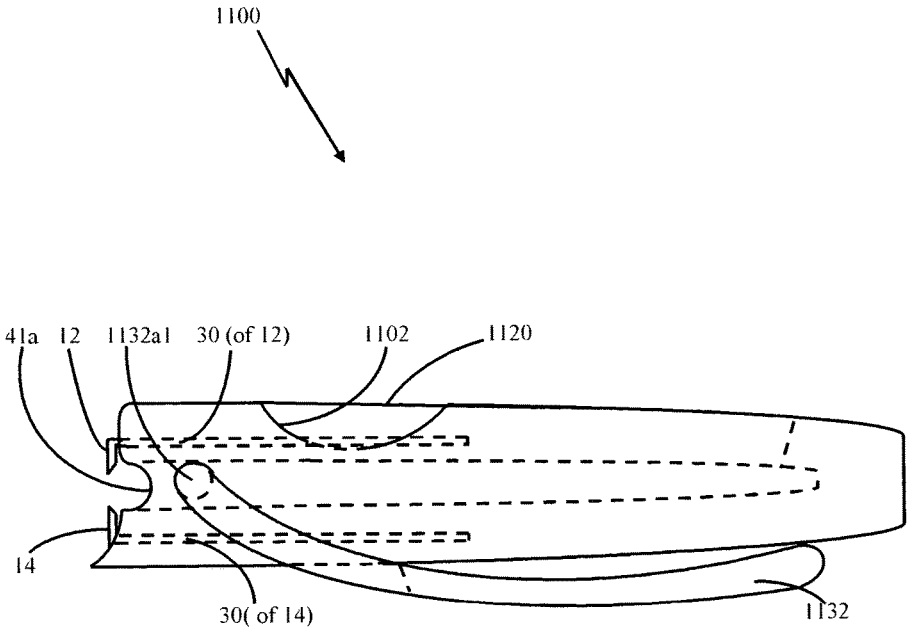
FIG. 40 is a side view of the axially pivoting dual parallel opposing blade embedded member nail clipper of FIG. 37 in a rest or transit position.
Figure 41:
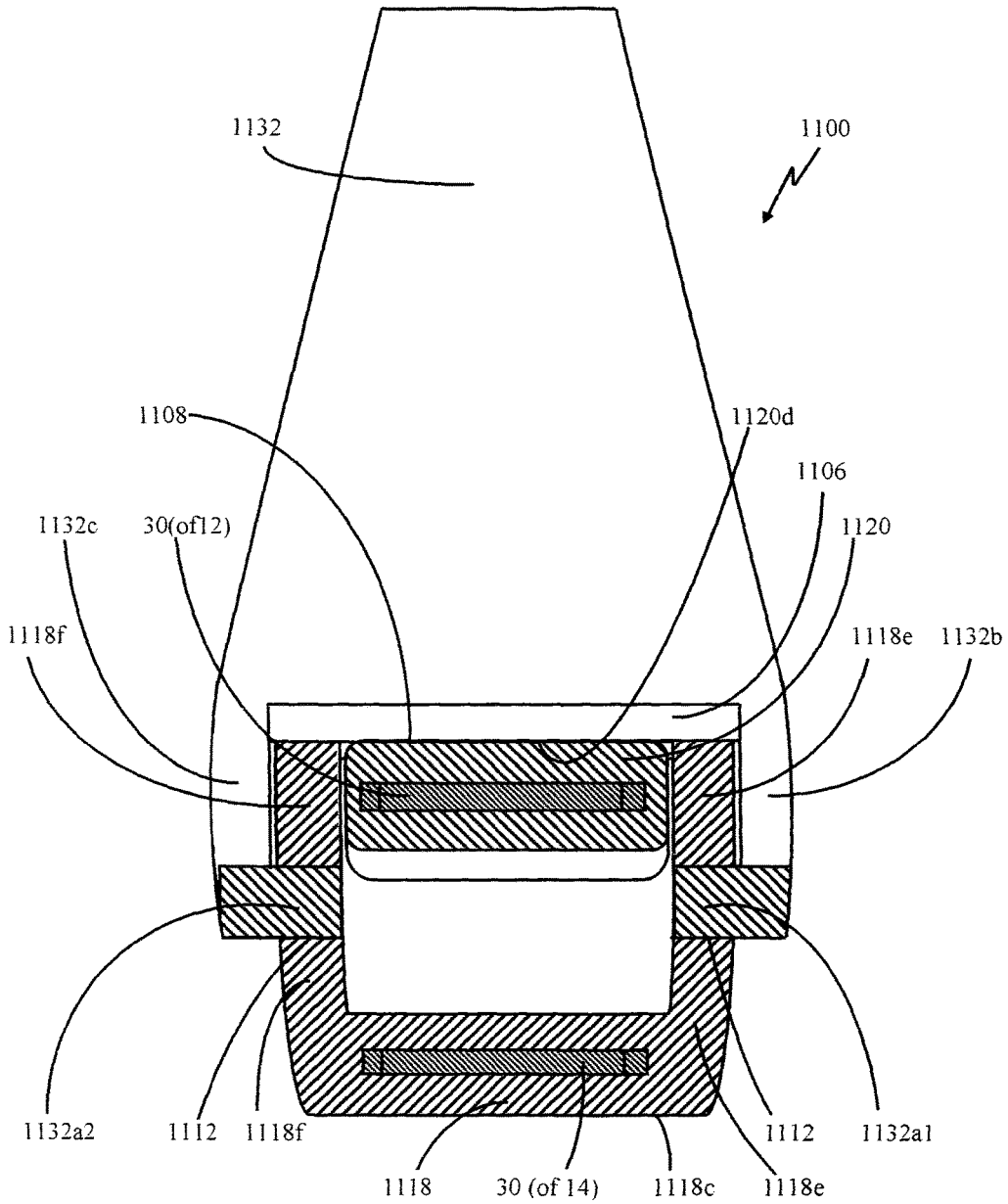
FIG. 41 is a cross-sectional view of the axially pivoting dual parallel opposing blade embedded member nail clipper in the open position taken along the line 41-41 of FIG. 38.
Figure 42:
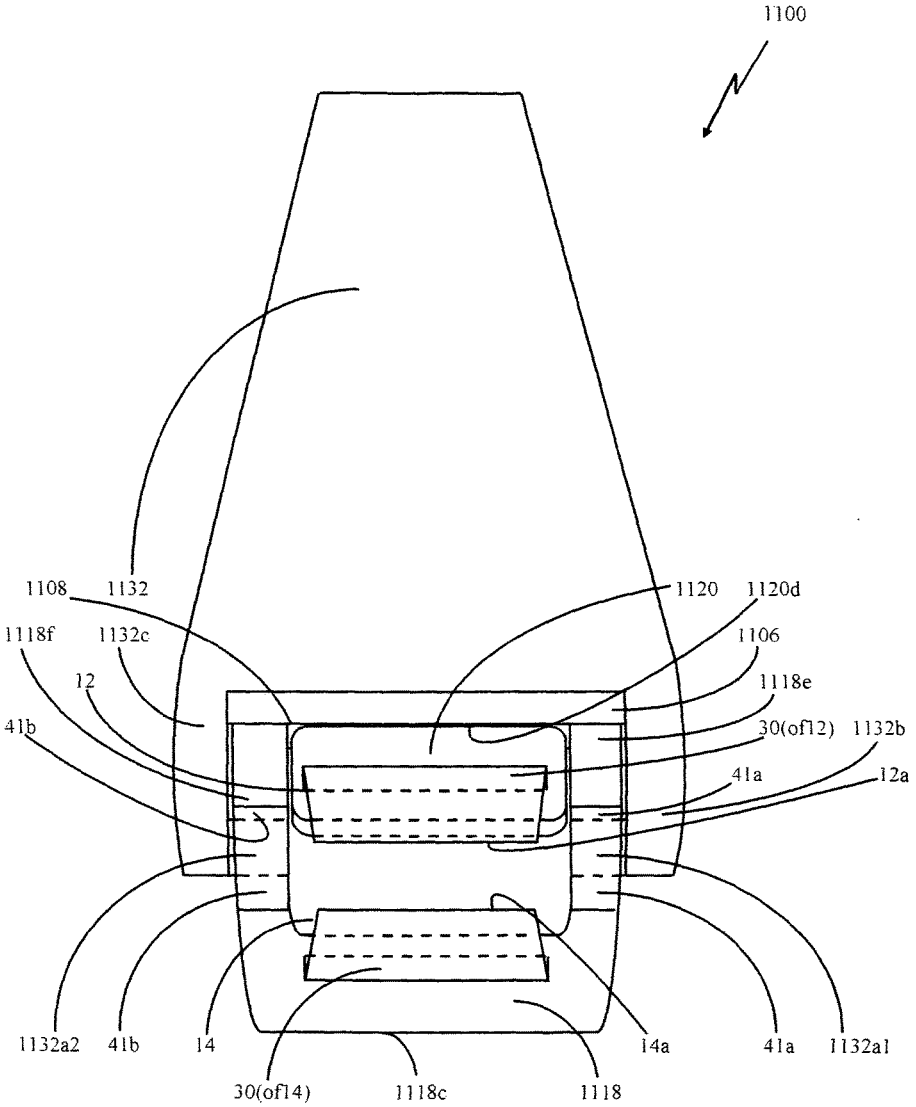
FIG. 42 is a front view of the axially pivoting dual parallel opposing blade embedded member nail clipper of FIG. 37 in the open position.
Figure 43:
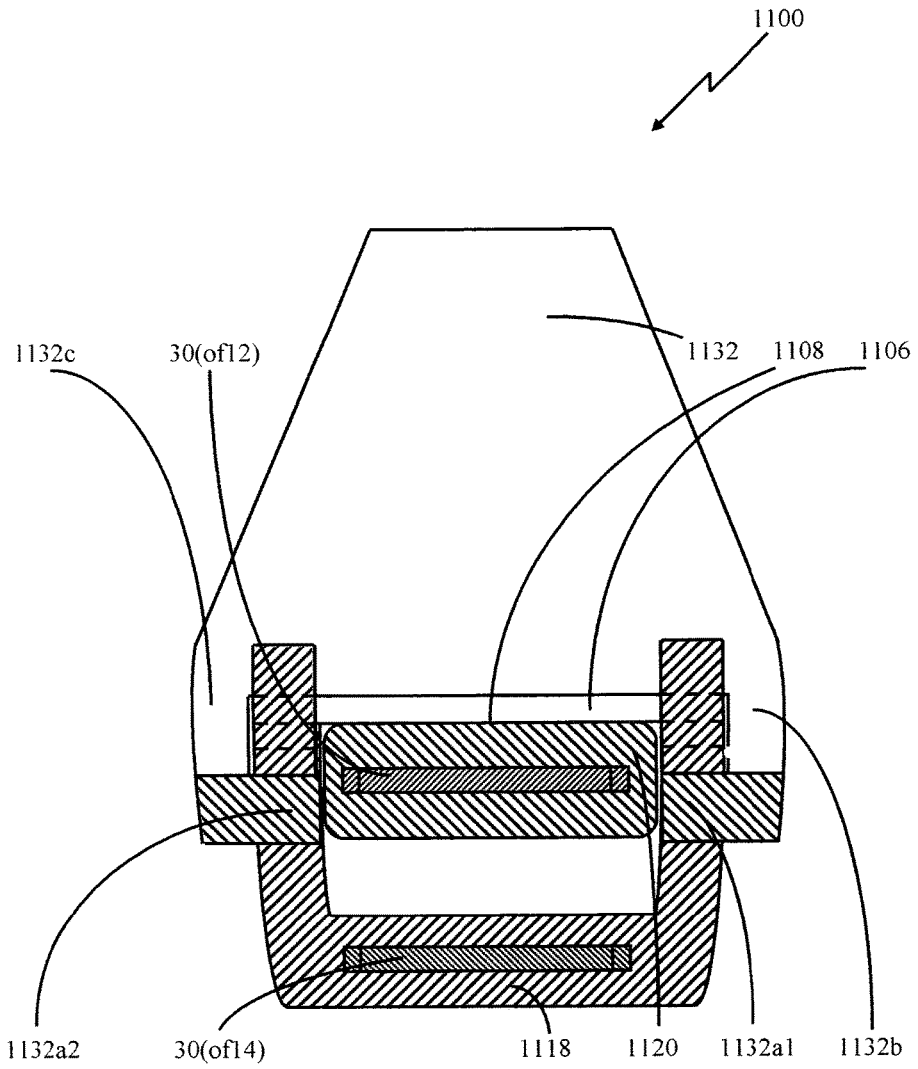
FIG. 43 is a cross-sectional view of the axially pivoting dual parallel opposing blade embedded member nail clipper in the closed position taken along the line 43-43 of FIG. 39.
Figure 44:
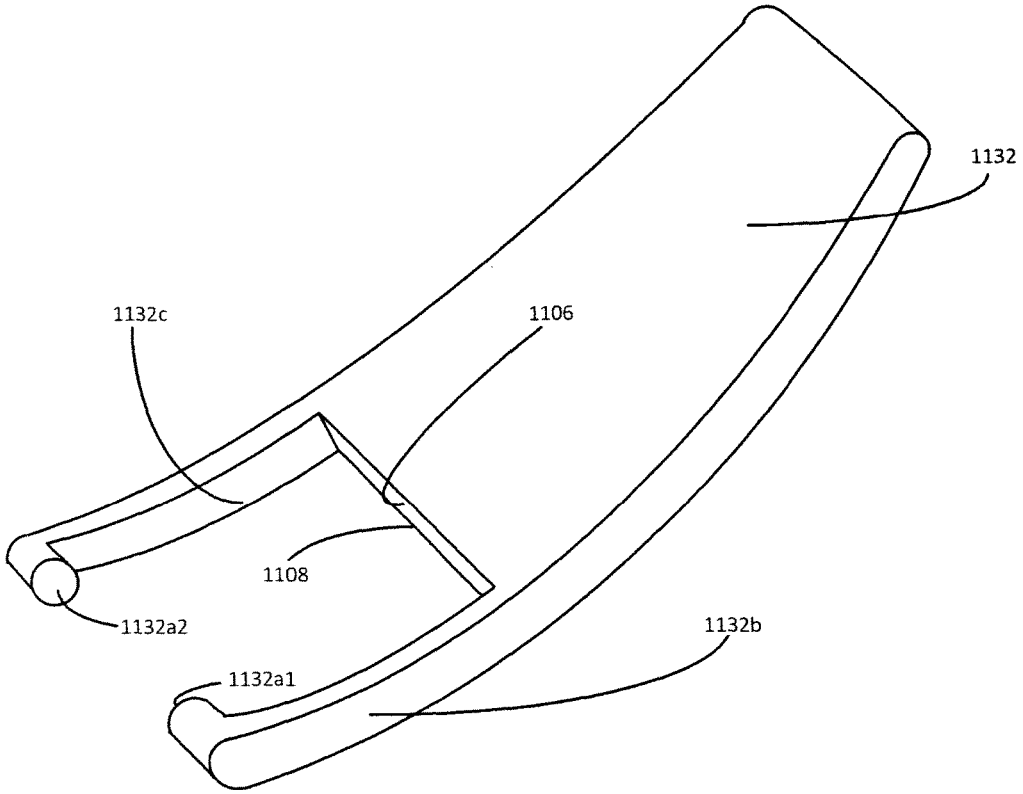
FIG. 44 is a view in perspective of an axially pivoting lever of the axially pivoting dual parallel opposing blade embedded member nail clipper of FIG. 37.
Figure 45:
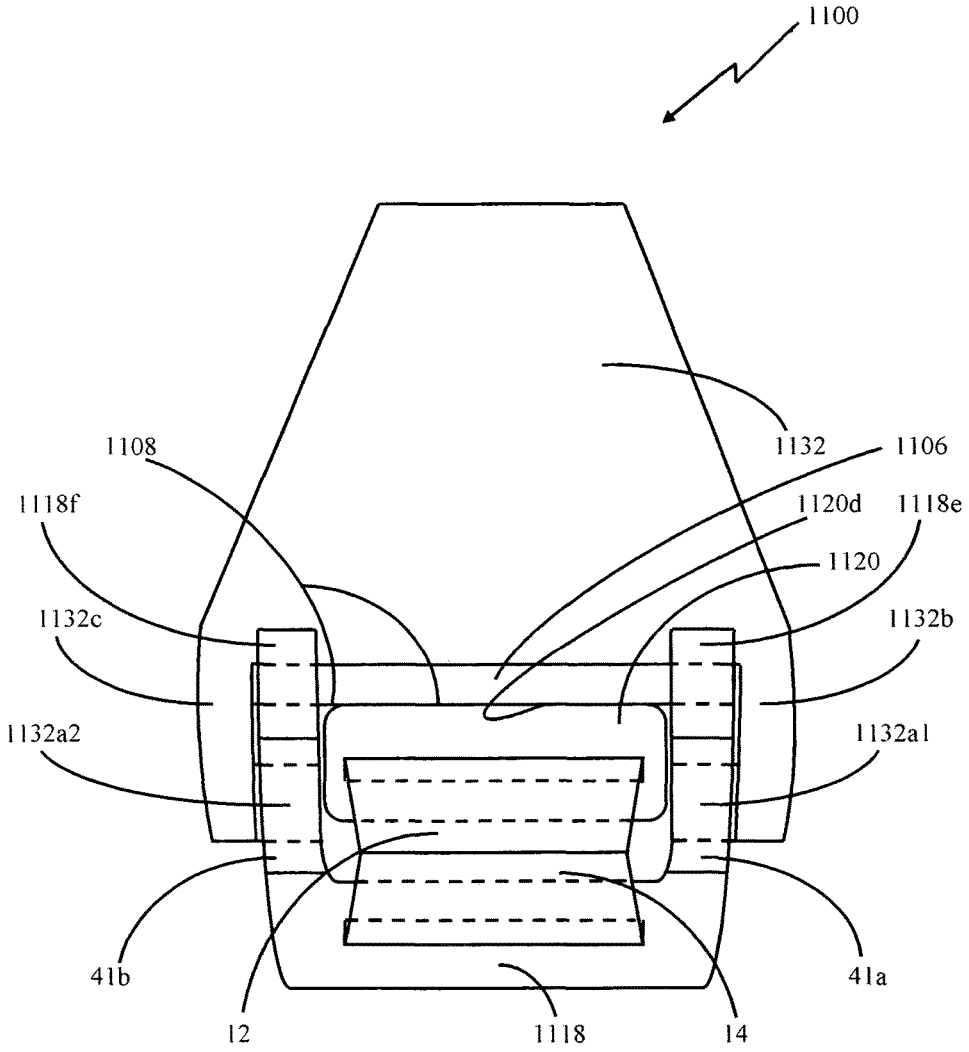
FIG. 45 is a front view of the axially pivoting dual parallel opposing blade embedded member nail clipper of FIG. 37 in the closed position.
Figure 46:
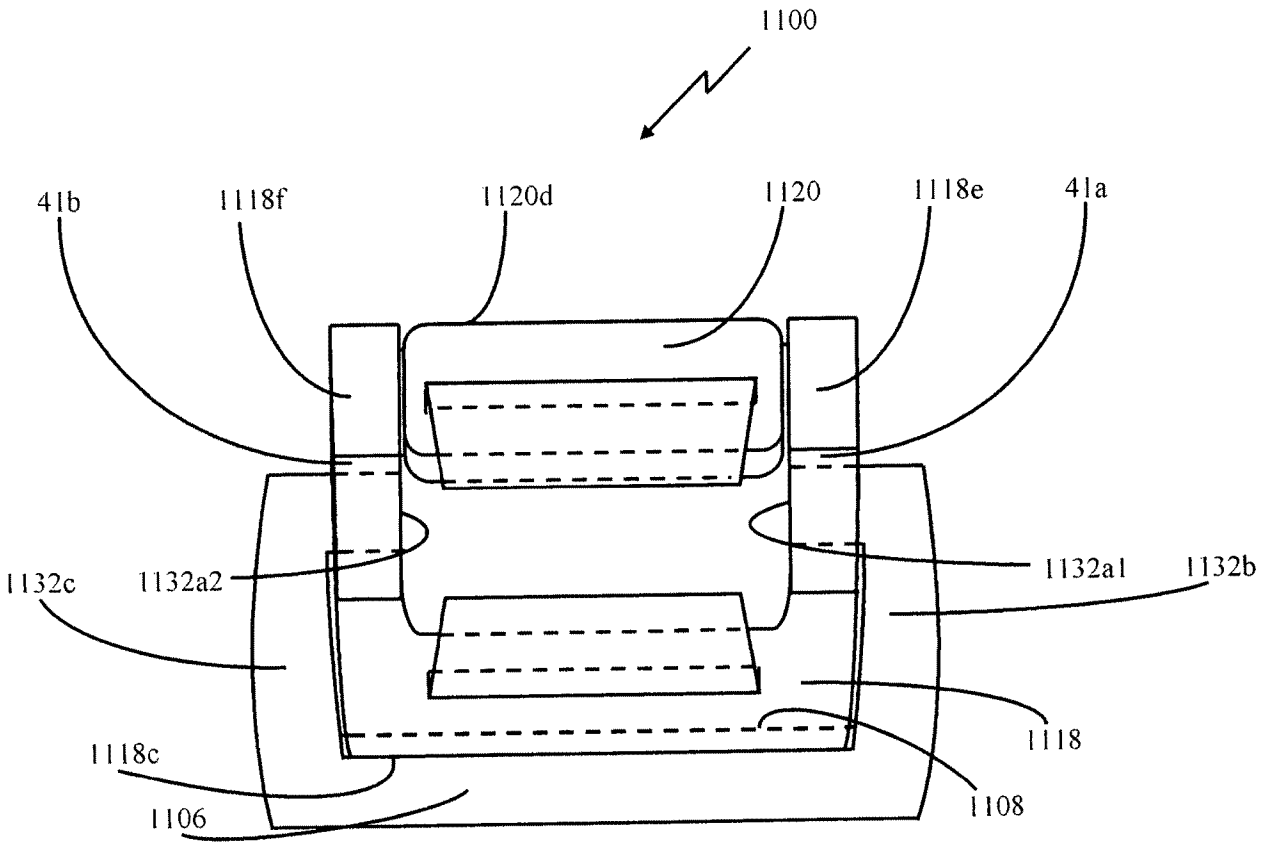
FIG. 46 is a front view of the axially pivoting dual parallel opposing blade embedded member nail clipper of FIG. 37 in the rest or storage position.
Figure 47:
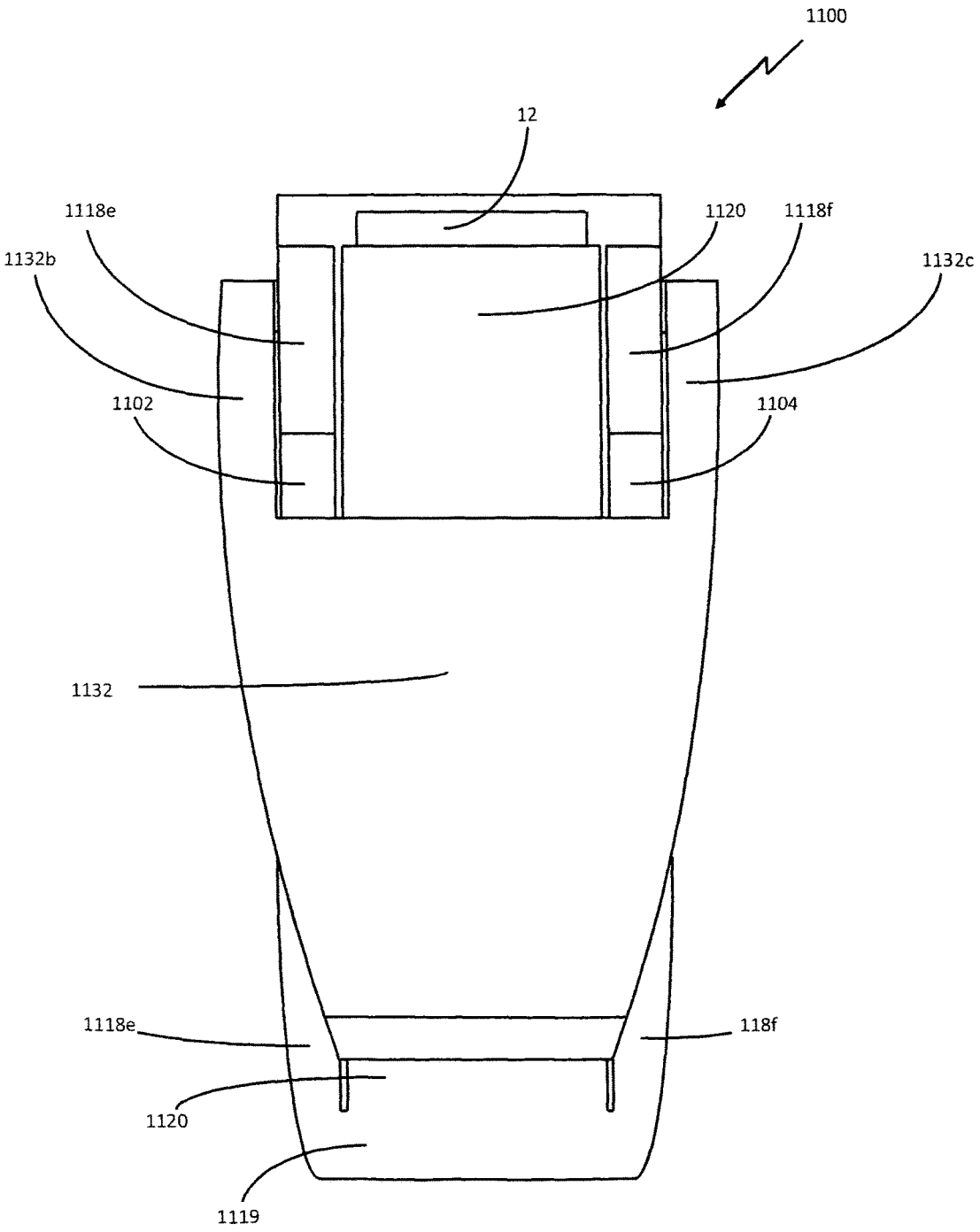
FIG. 47 is a top view of the axially pivoting dual parallel opposing blade embedded member nail clipper of FIG. 37.
Figure 48:
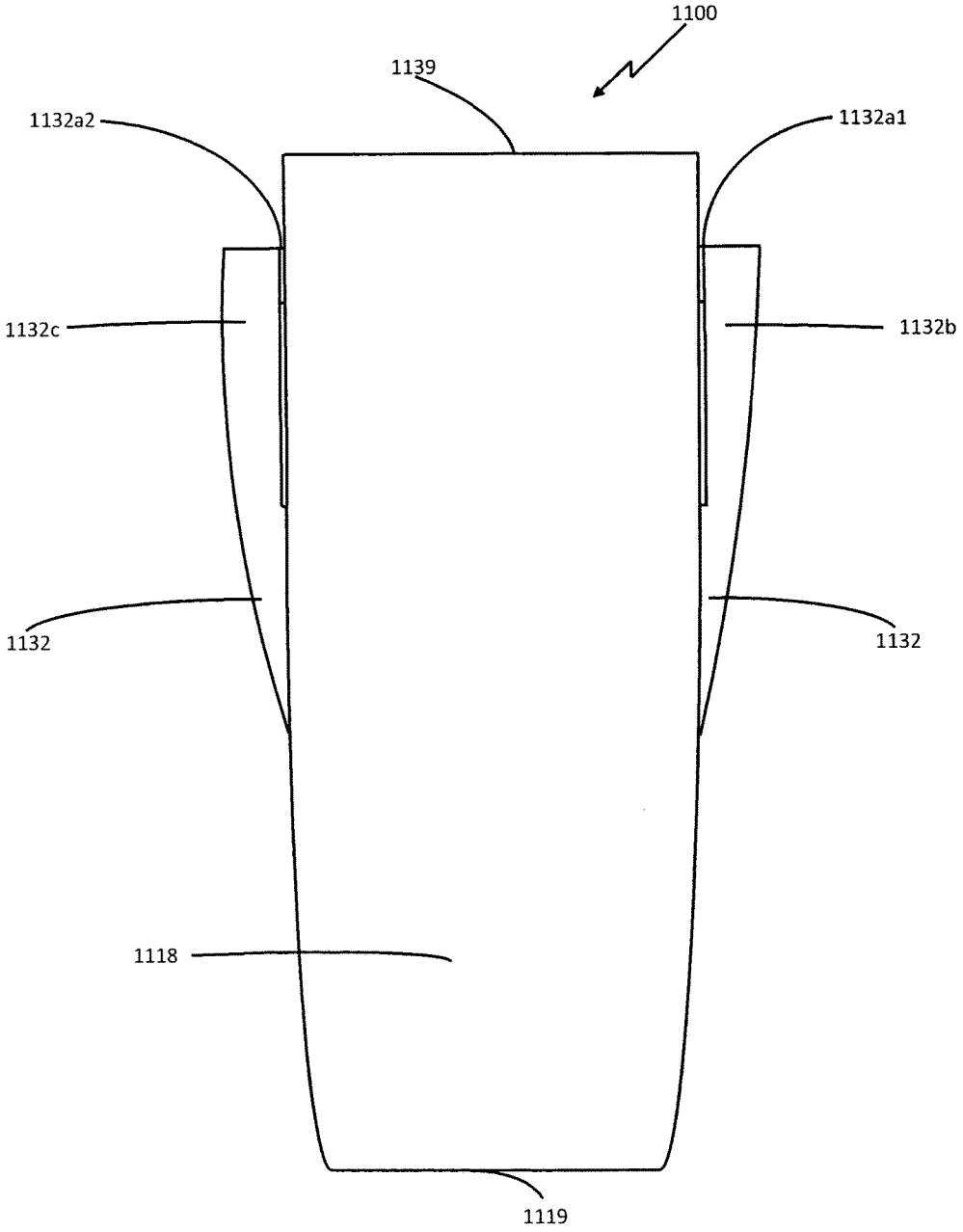
FIG. 48 is a bottom view of the axially pivoting dual parallel opposing blade embedded member nail clipper of FIG. 37.
Figure 49:
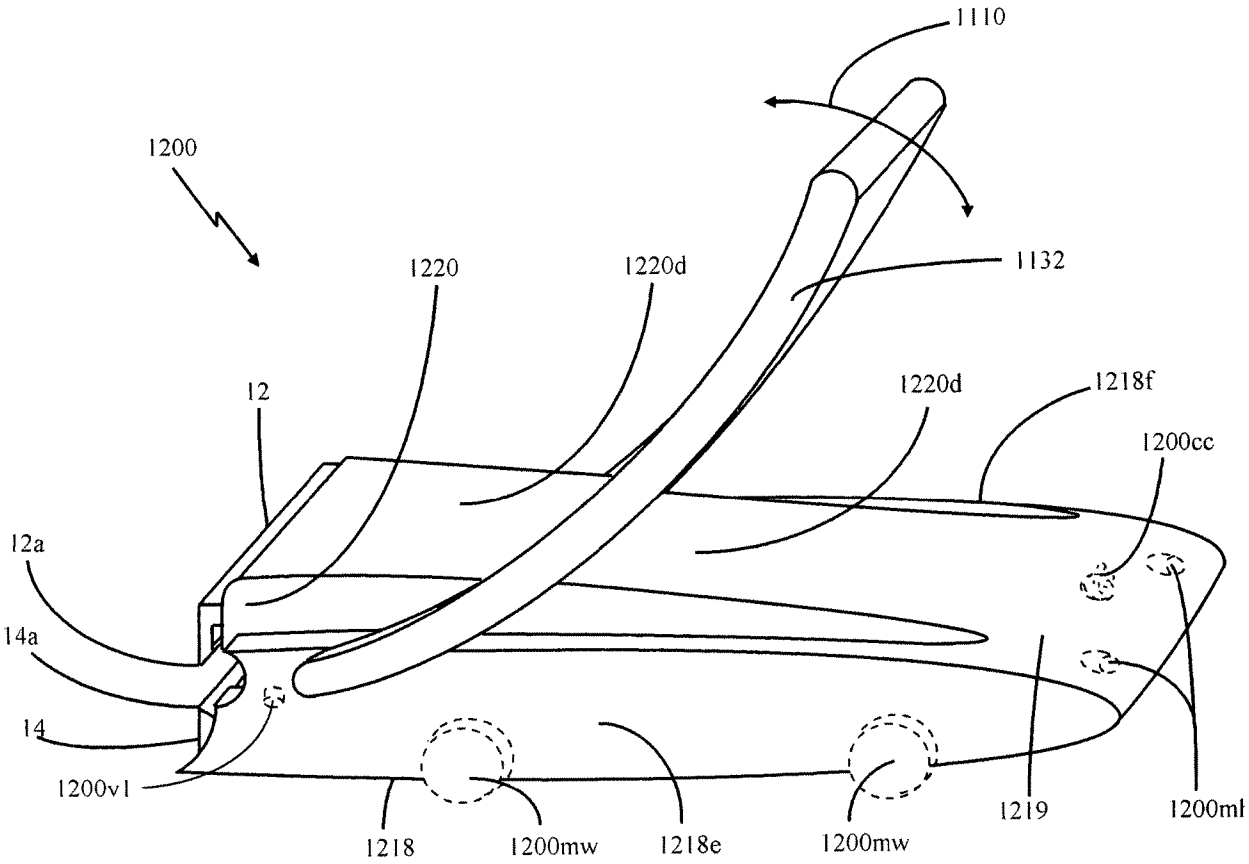
FIG. 49 is a view in perspective of a modified dual parallel opposing blade embedded member axially pivoting nail clipper that includes a raised upper frame member and several optional modifications shown in dashed lines.
Figure 49A:
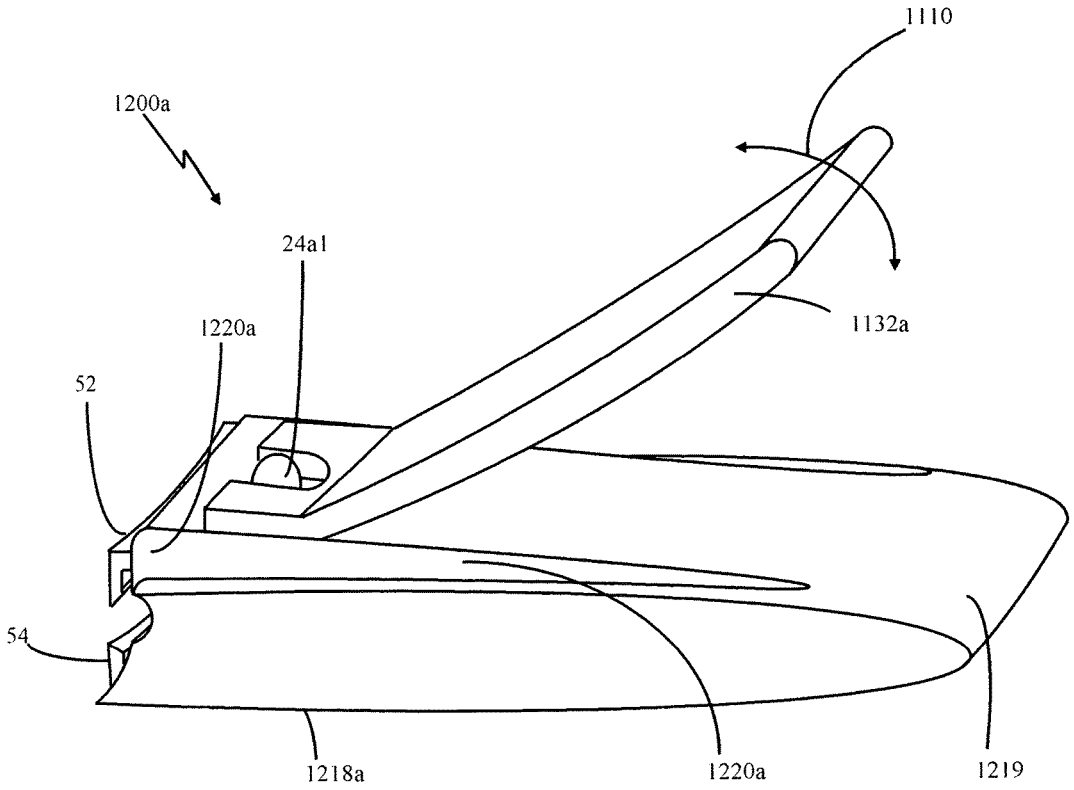
FIG. 49A is a view in perspective of a raised dual parallel opposing blade embedded member nail clipper that is similar to the modified dual parallel opposing blade embedded member axially pivoting nail clipper of FIG. 49 and instead including curved opposing blades and an axially pivoting lever that cooperates with the center rod.
Figure 50:
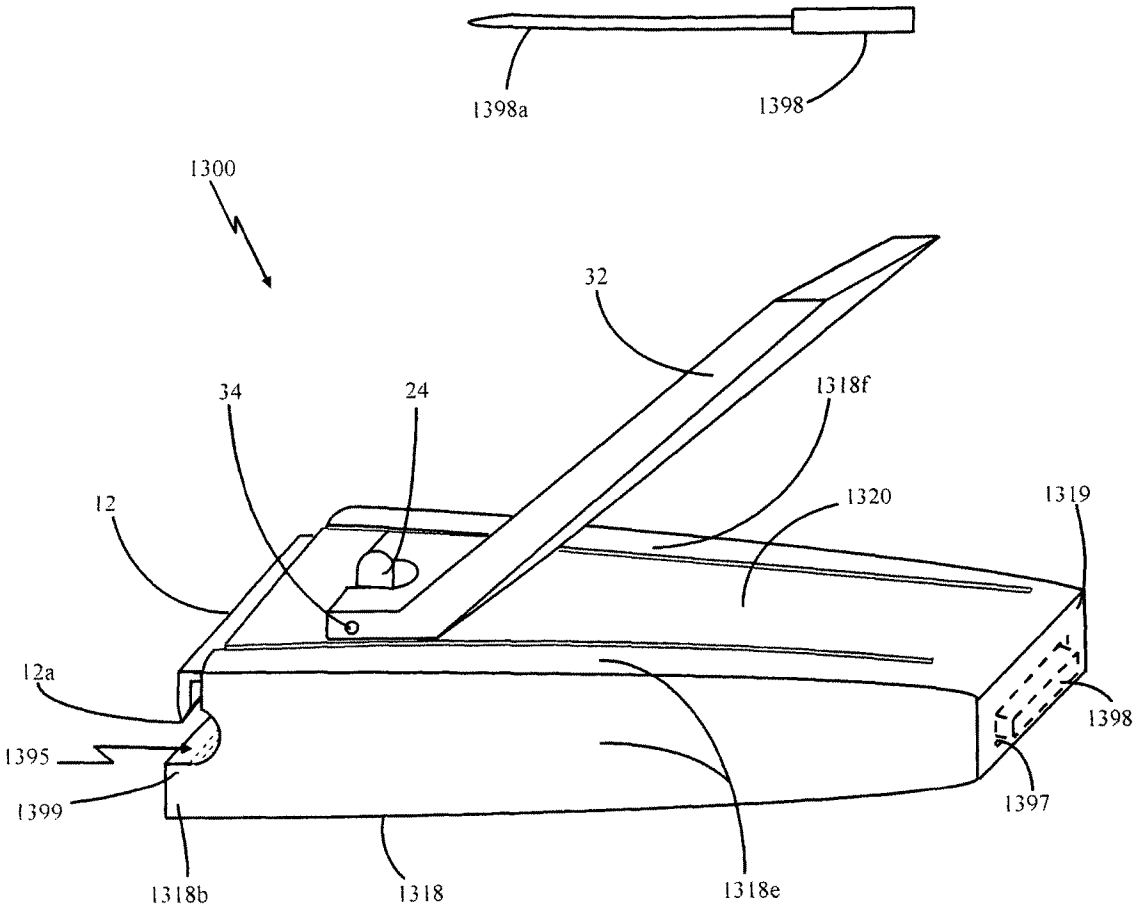
FIG. 50 is a view in perspective of a first single blade embedded member nail clipper, with an optional opening containing an optional file.
Figure 51:
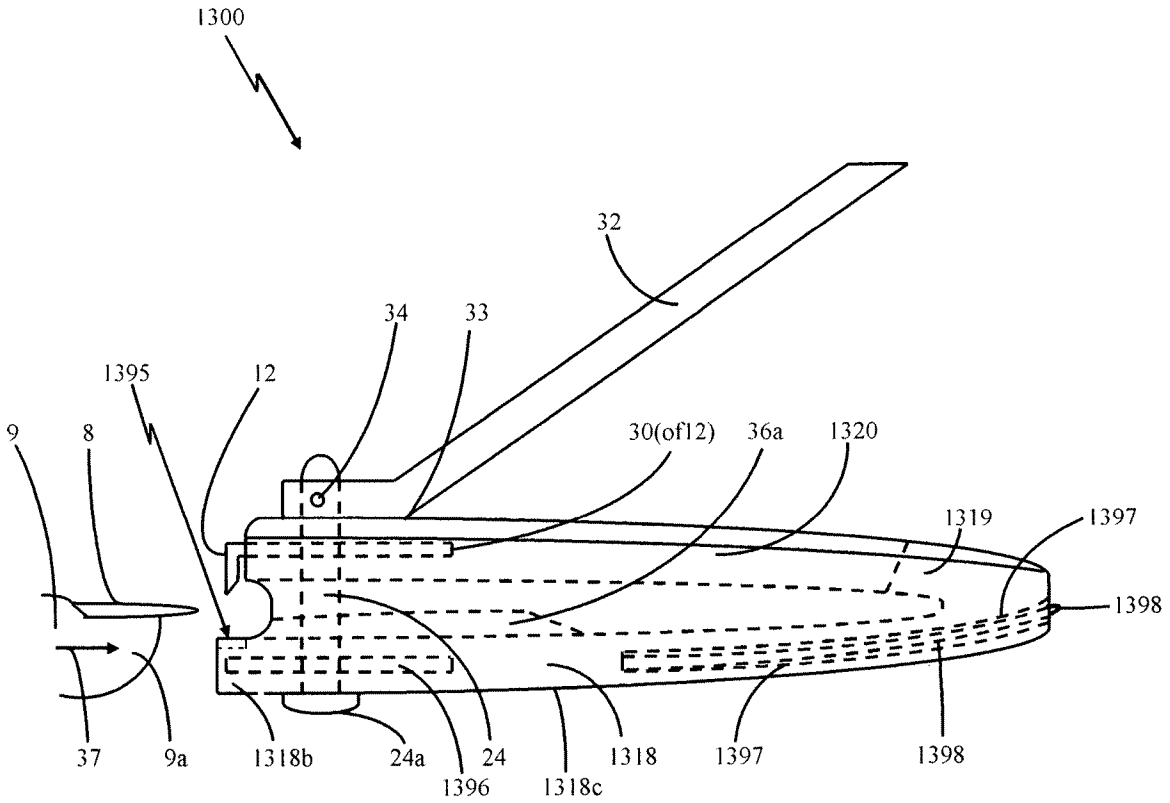
FIG. 51 is a side view of the first single blade embedded member nail clipper of FIG. 50 disposed in an open position.
Figure 52:
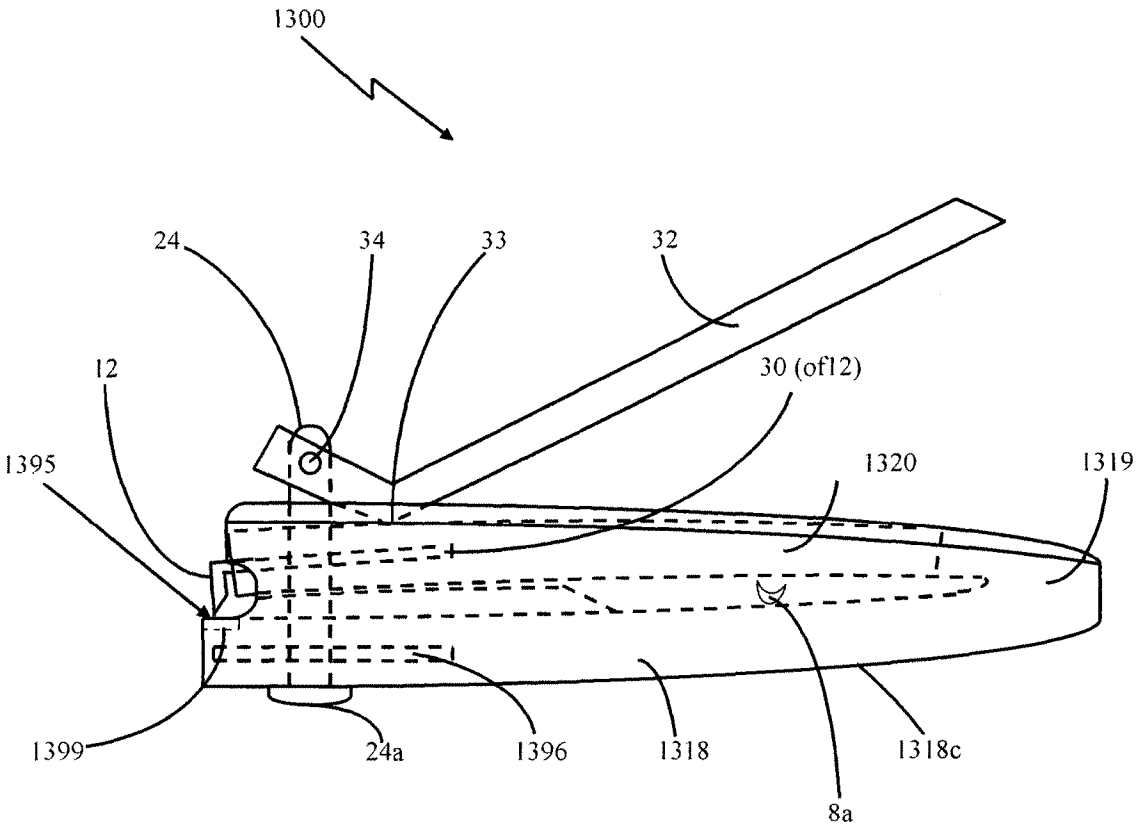
FIG. 52 is a side view of the first single blade embedded member nail clipper of FIG. 50 disposed in a closed position.
Figure 53:
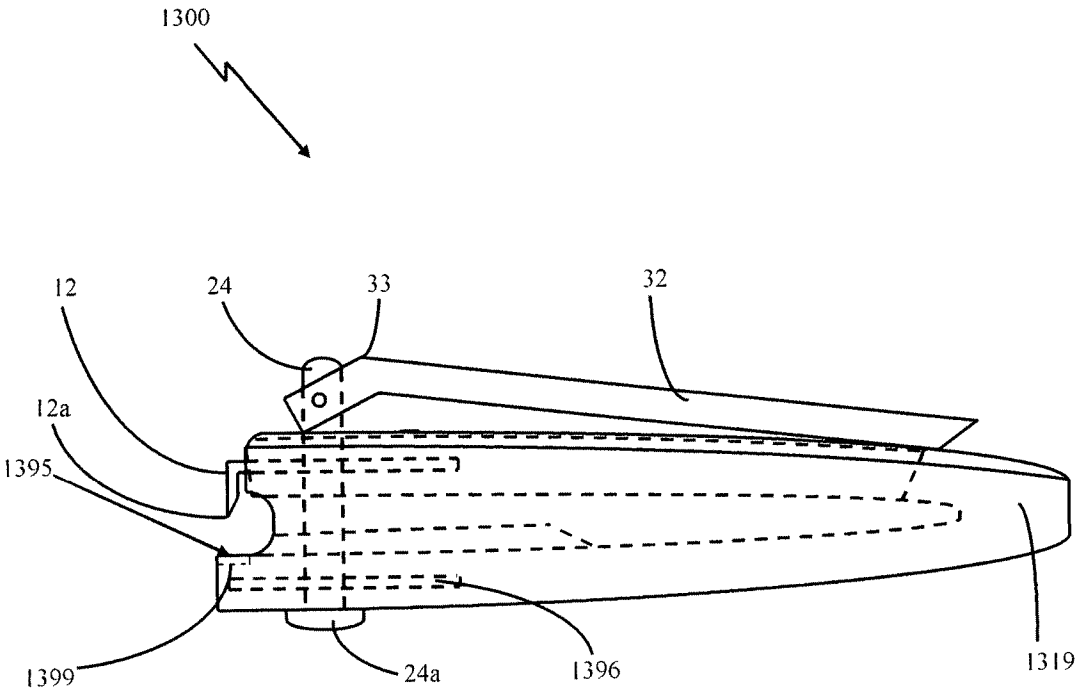
FIG. 53 is a side view of the first single blade embedded member nail clipper of FIG. 50 disposed in a rest or storage (transit) position.
Figure 54:
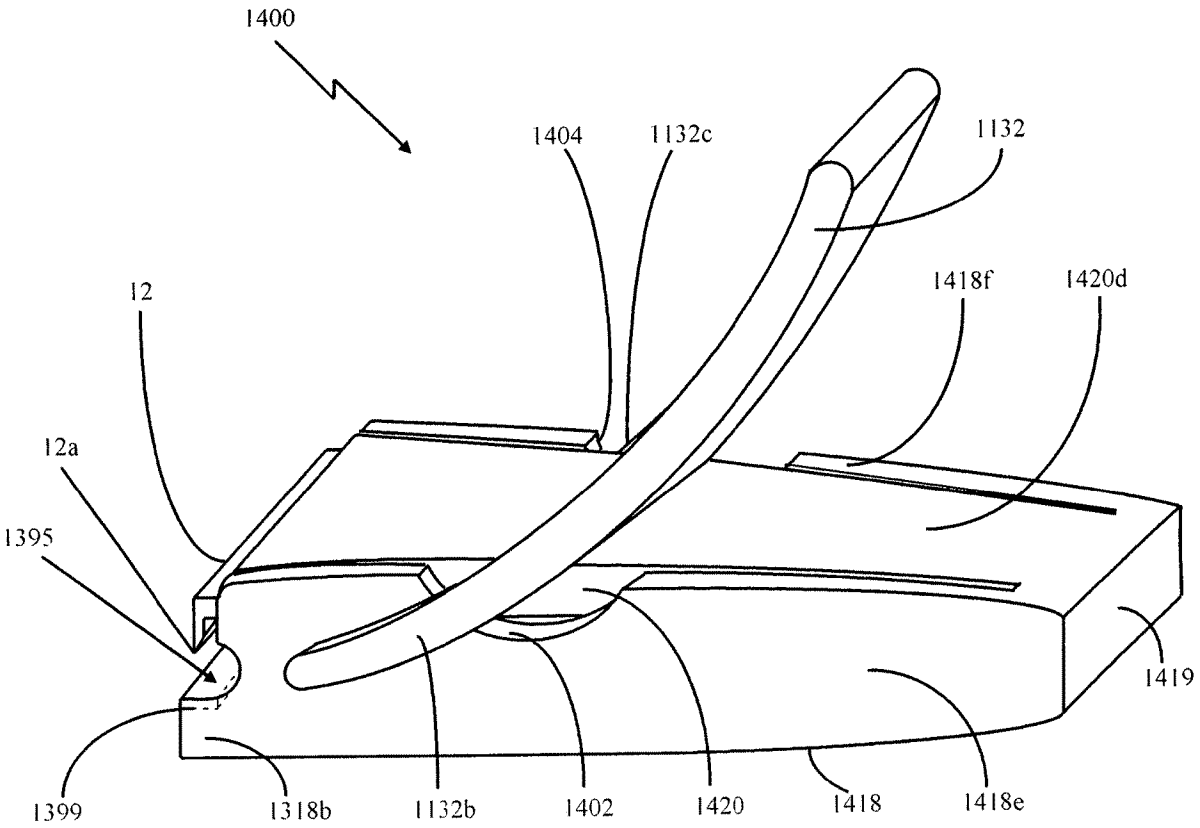
FIG. 54 is a view in perspective of a second single blade embedded member nail clipper.
Figure 55:
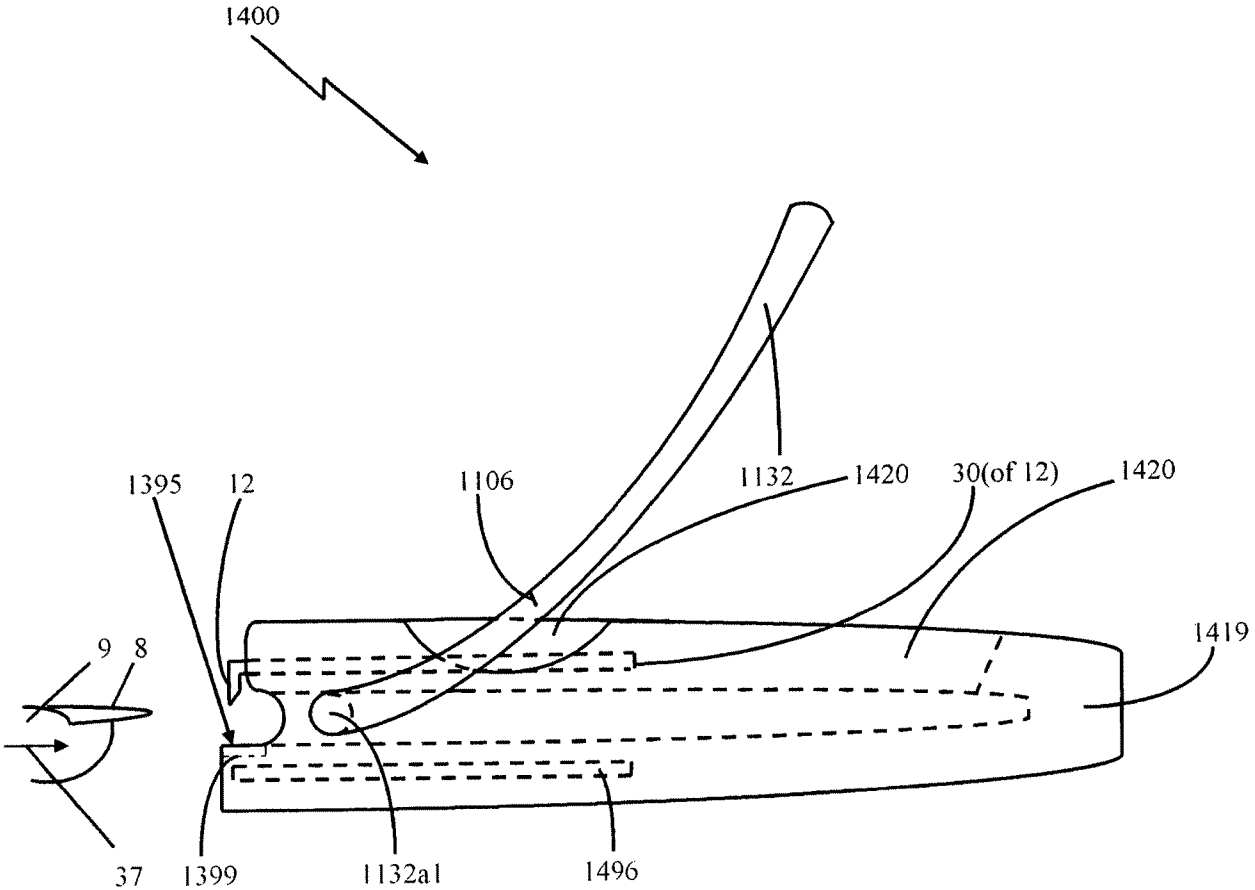
FIG. 55 is a side view of the second single blade embedded member nail clipper of FIG. 54 disposed in an open position.
Figure 56:
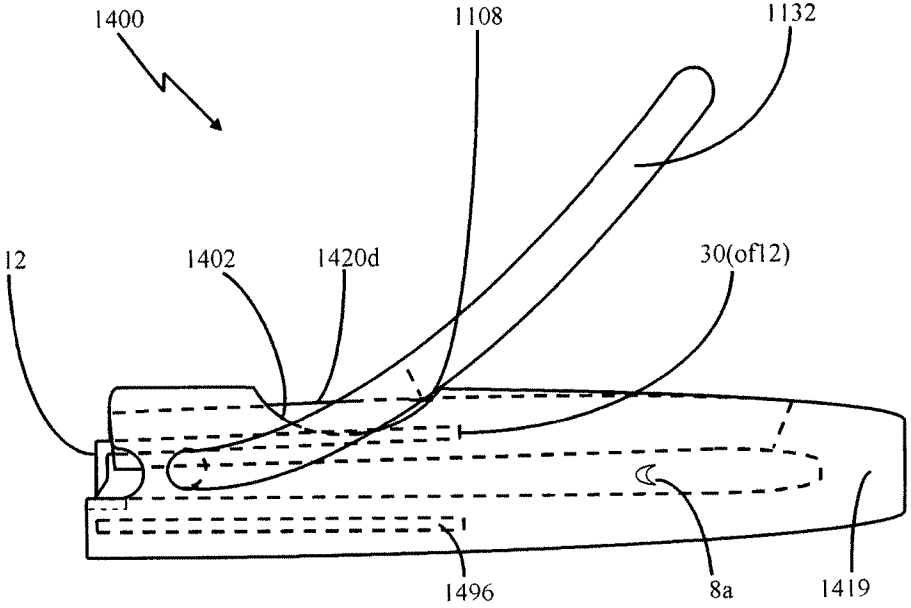
FIG. 56 is a side view of the second single blade embedded member nail clipper of FIG. 54 disposed in a closed position.
Figure 57:
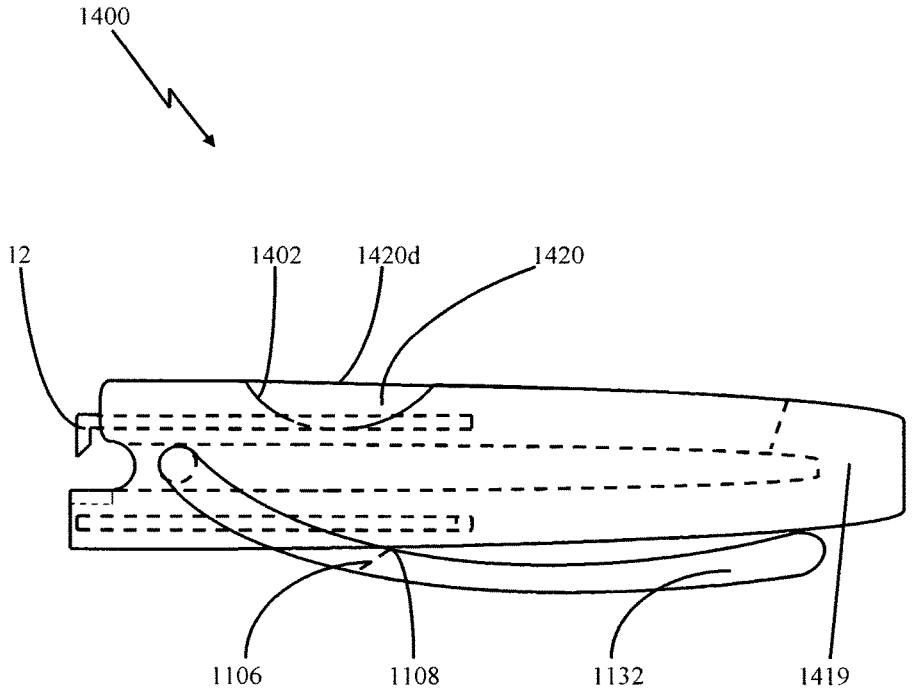
FIG. 57 is a side view of the second single blade embedded member nail clipper of FIG. 54 disposed in a rest or storage (transit) position.
Figure 58A:
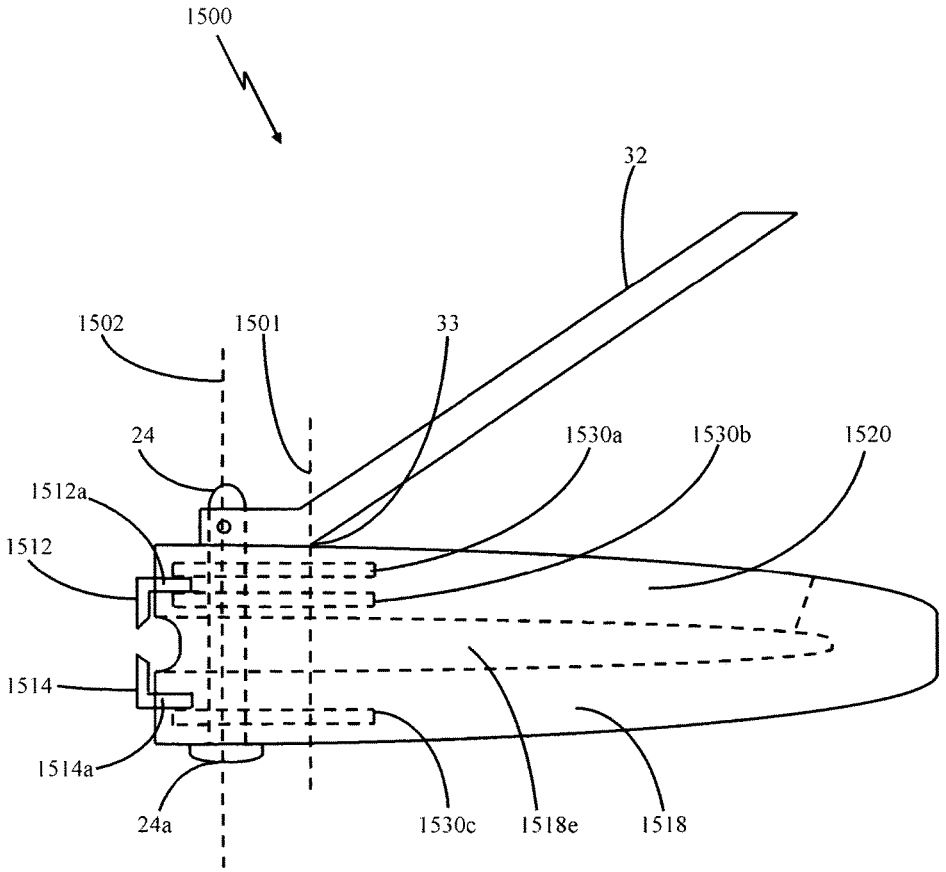
FIG. 58A is a side view of a first dual parallel opposing blade discreet embedded member nail clipper including a pair of shortened embedded blades that is disposed in an open position.
Figure 58B:
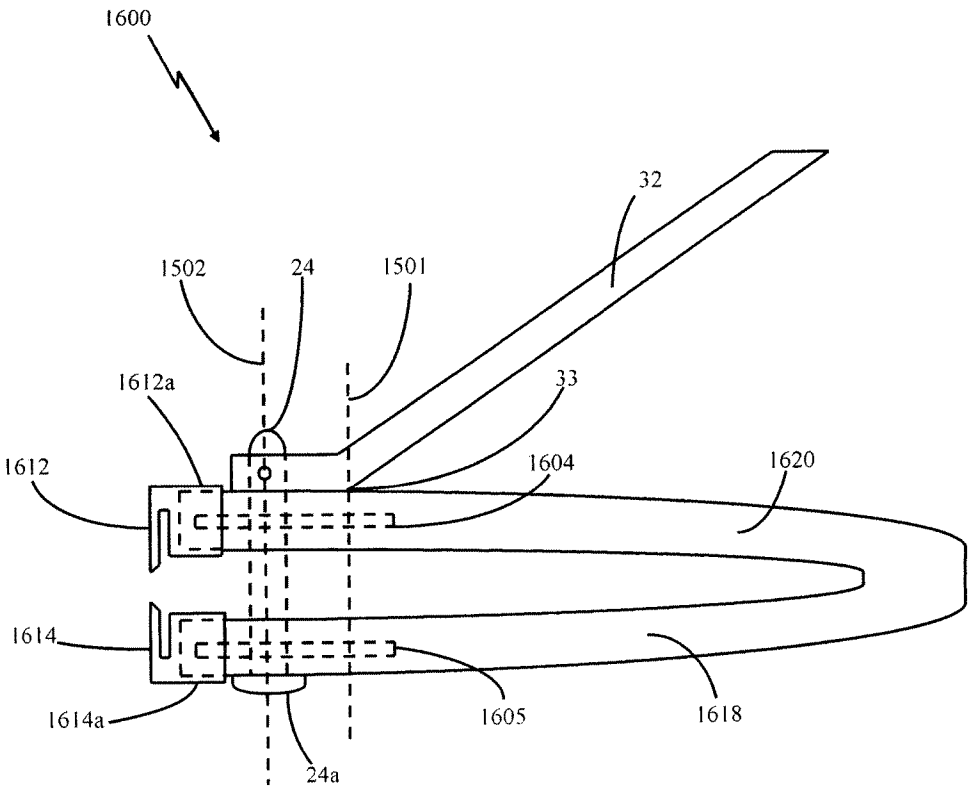
FIG. 58B is a side view of a second dual parallel opposing blade discreet embedded member nail clipper including a pair of wrap-around blades that is disposed in an open position.
Figure 59:
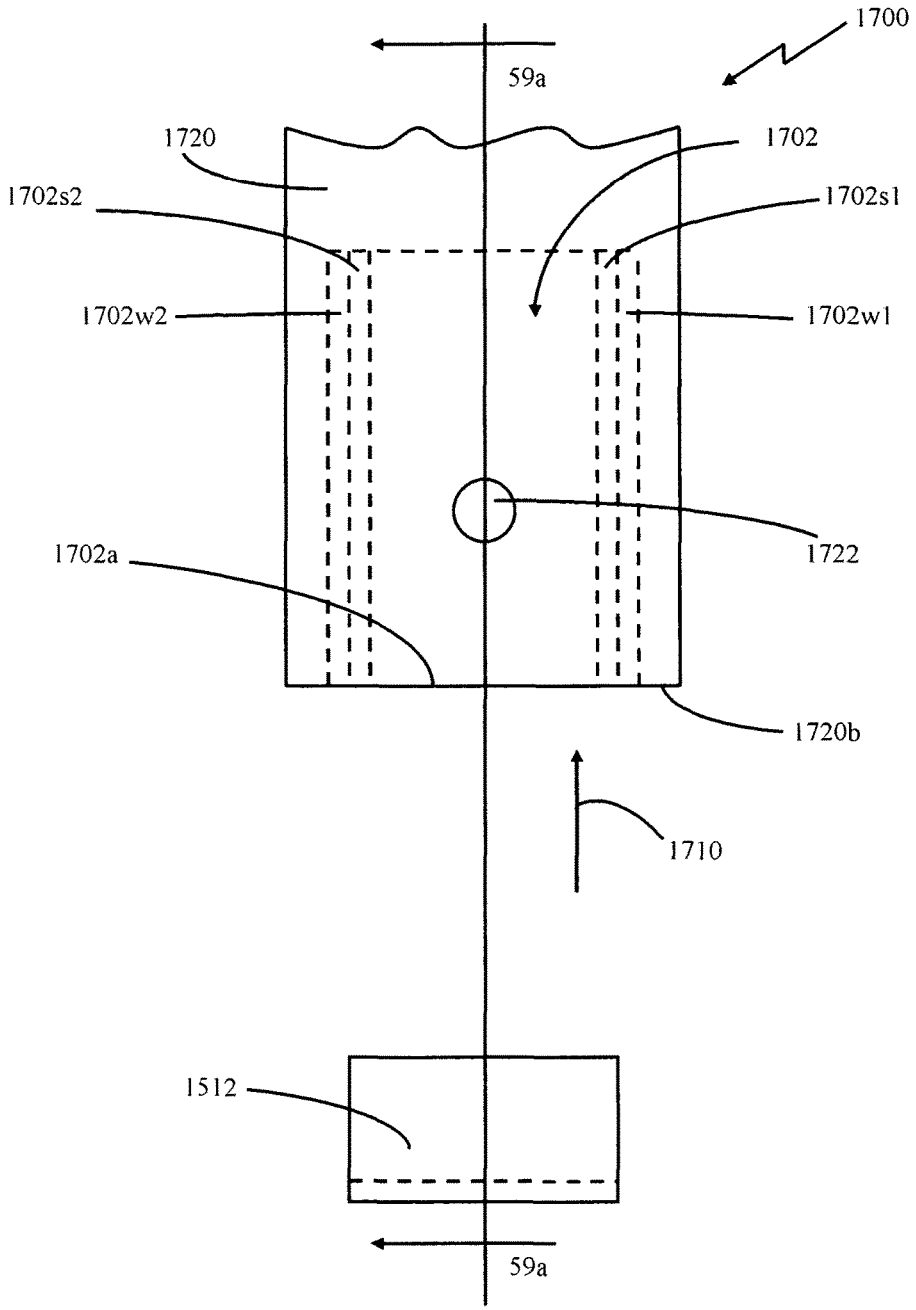
FIG. 59 is a partial top view of an upper member of a third discreet embedded member nail clipper that could be constructed to include a single insertable blade or dual parallel opposing insertable blades.
Figure 59A:
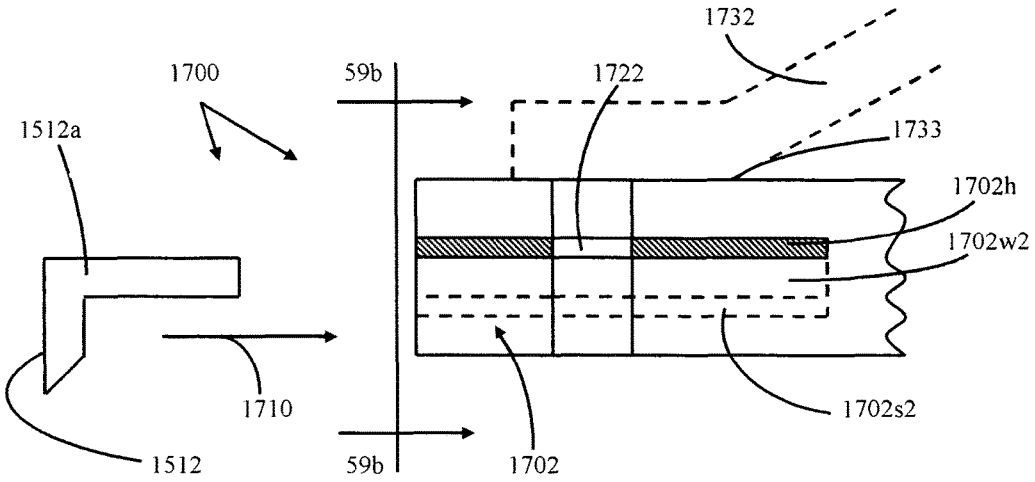
FIG. 59A is a partial side view of the third discreet embedded member nail clipper taken along the line of 59A-59A of FIG. 59.
Figure 59B:
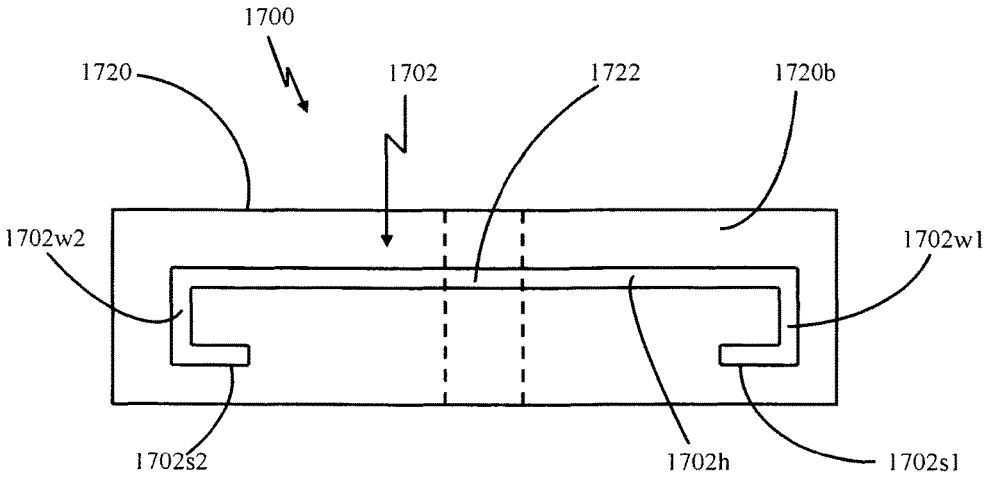
FIG. 59B is a front view of the upper member of the third discreet embedded member nail clipper taken along the line of 59B-59B of FIG. 59A.
Figure 60A:
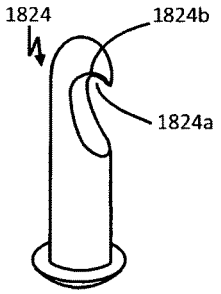
FIG. 60A is a view in perspective of a PRIOR ART center rod for optional use with the integral pin lever of FIG. 60 or with a PRIOR ART lever (not shown).
Figure 60:
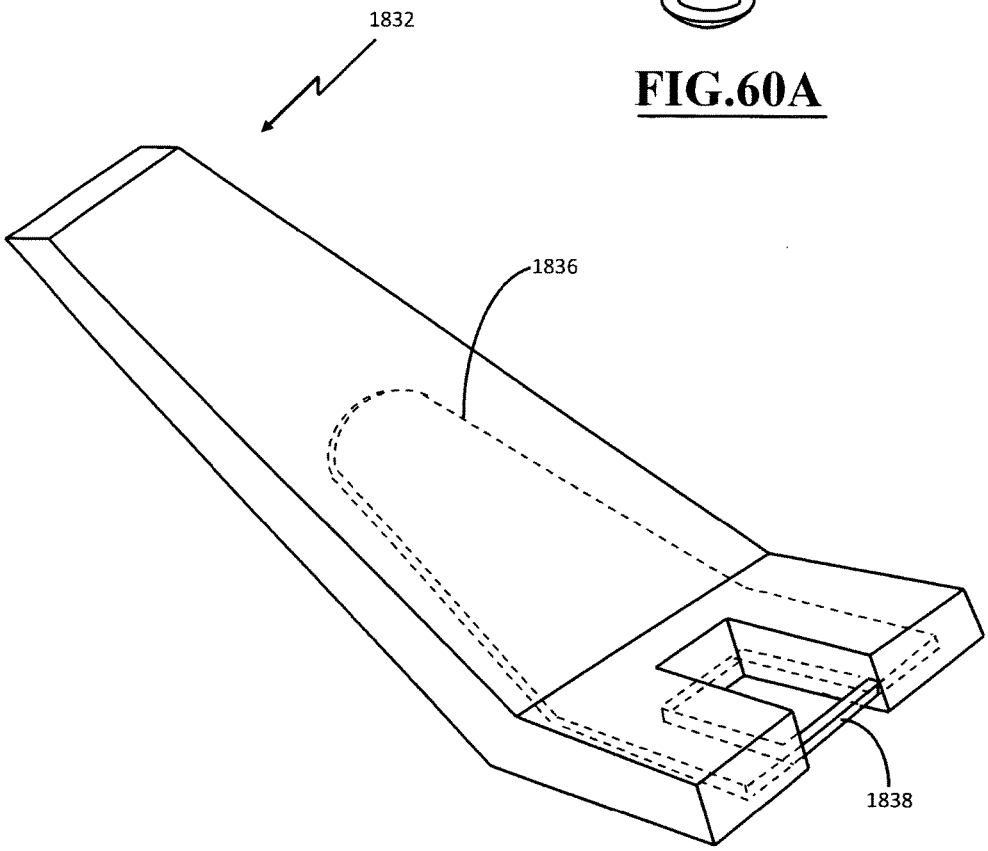
FIG. 60 is a view in perspective of an integral pin lever.
Figure 61:
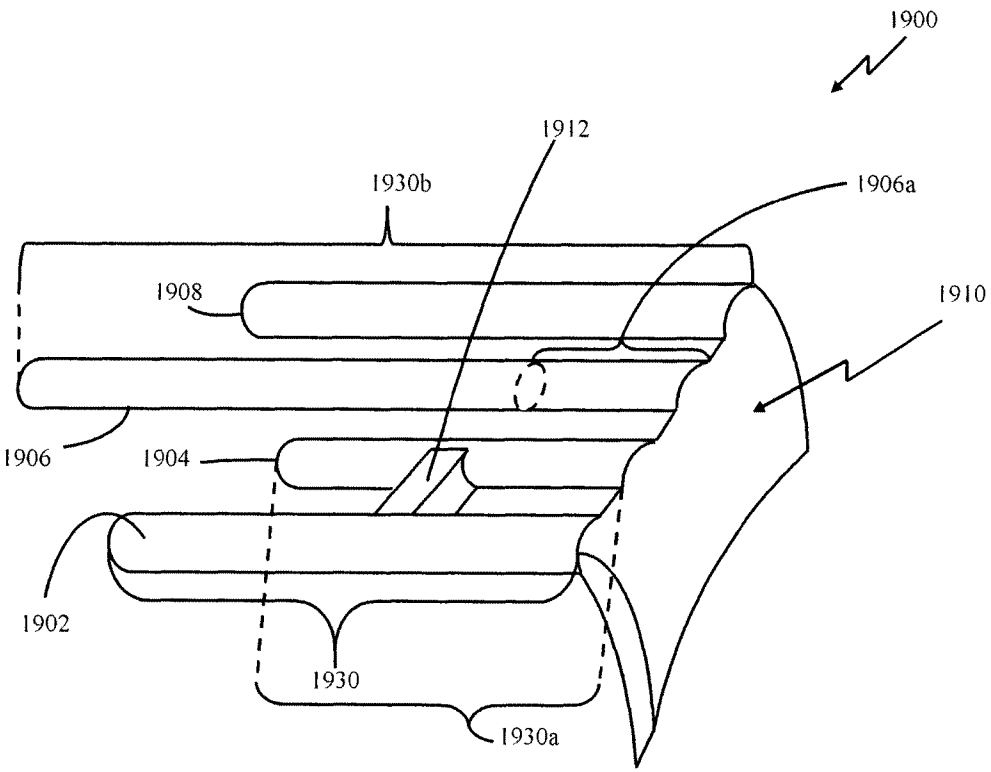
FIG. 61 is a view in perspective of a modified embedded member blade.
Figure 62:
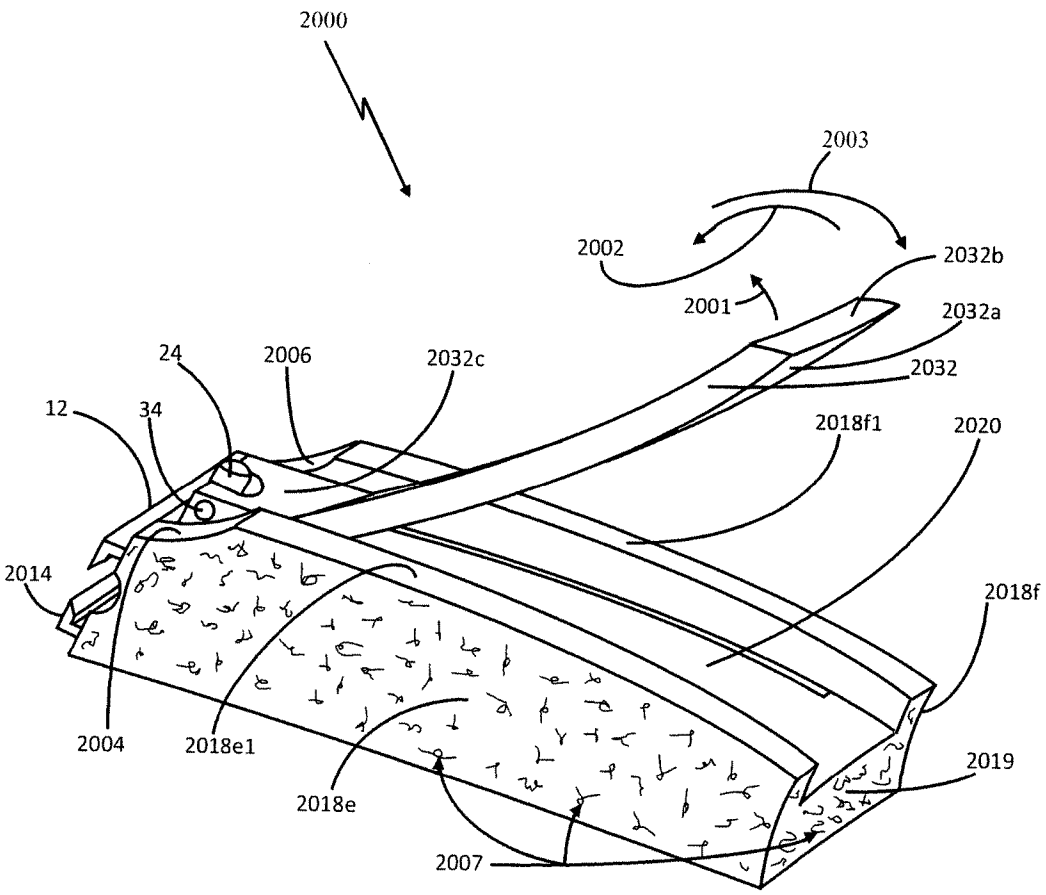
FIG. 62 is a view in perspective a concealed lever nail clipper disposed in an open position.
Figure 63:
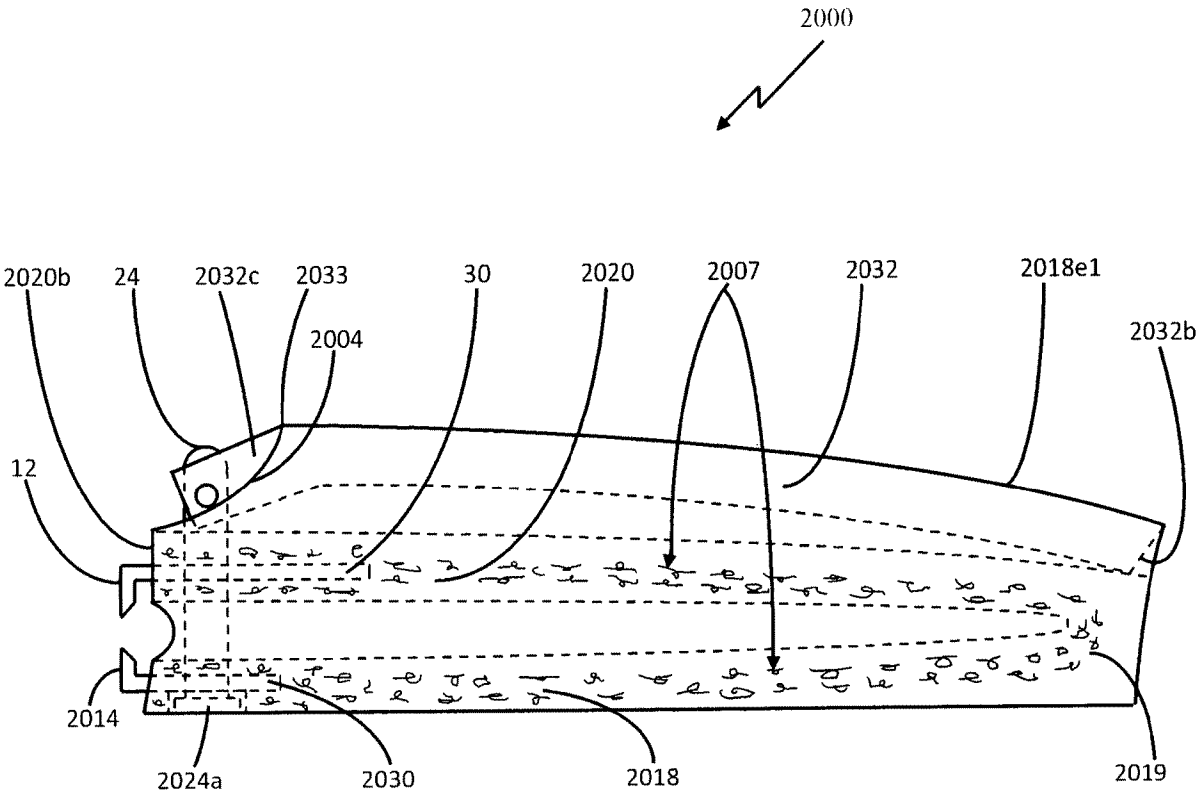
FIG. 63 is a side view of the concealed lever nail clipper of FIG. 62 disposed in a rest position.
Figure 64:
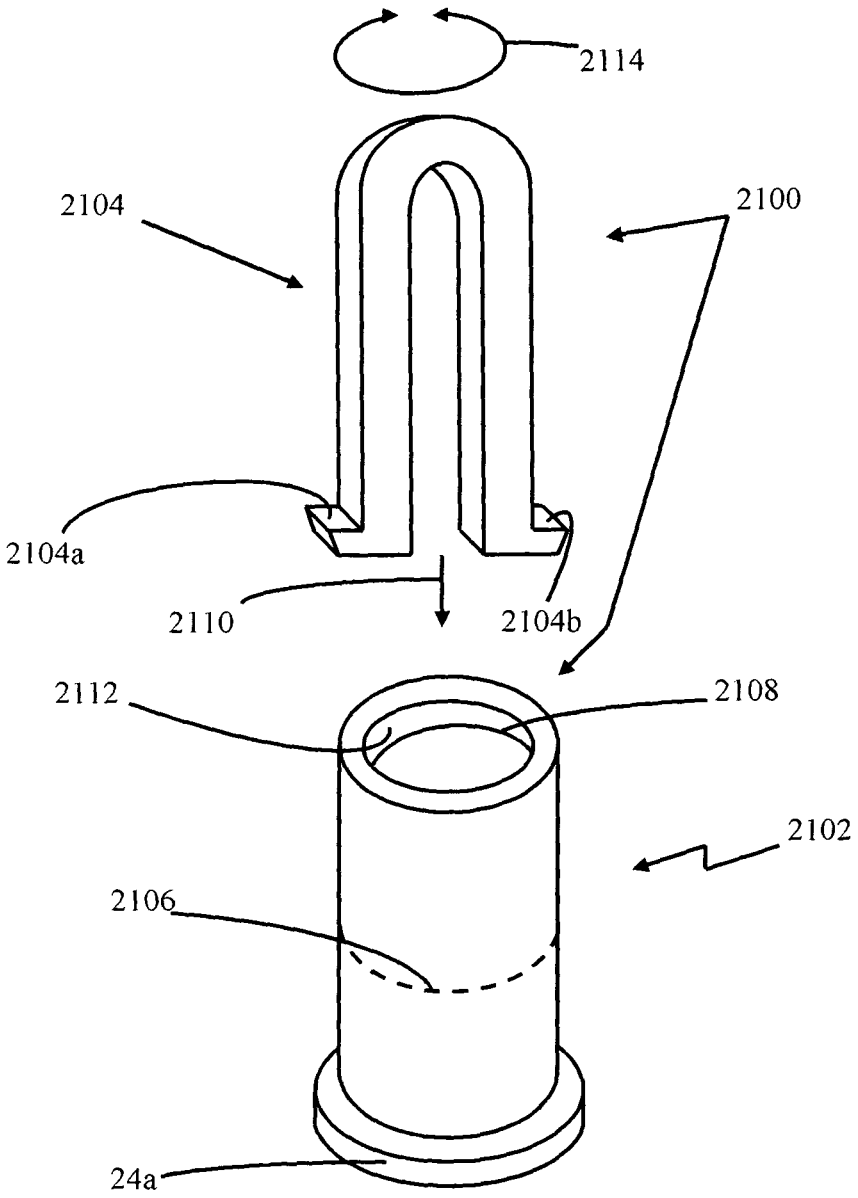
FIG. 64 is a view in perspective of an enlarged exploded view of a two-piece rotating center rod.
Figure 65:
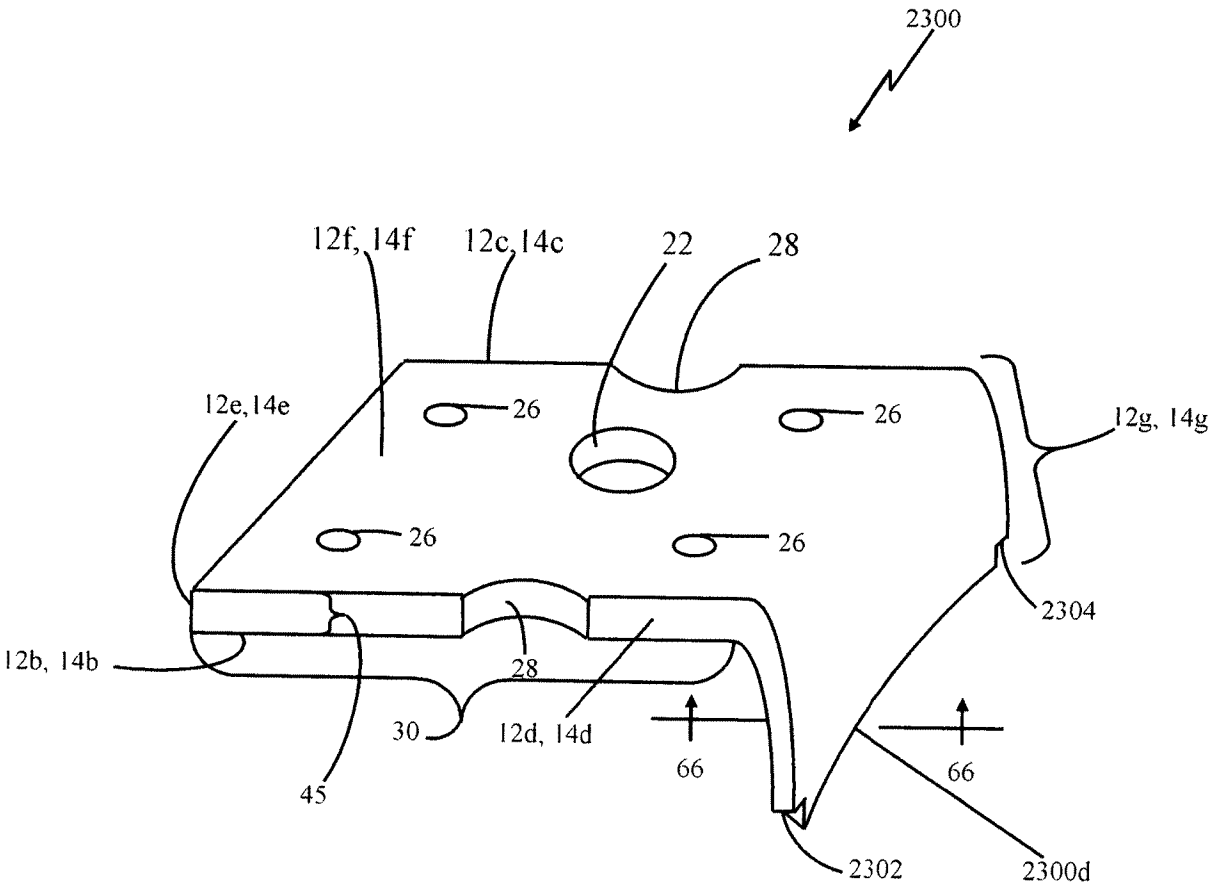
FIG. 65 is a view in perspective of a safety blade that includes a first radius of cut.
Figure 65A:
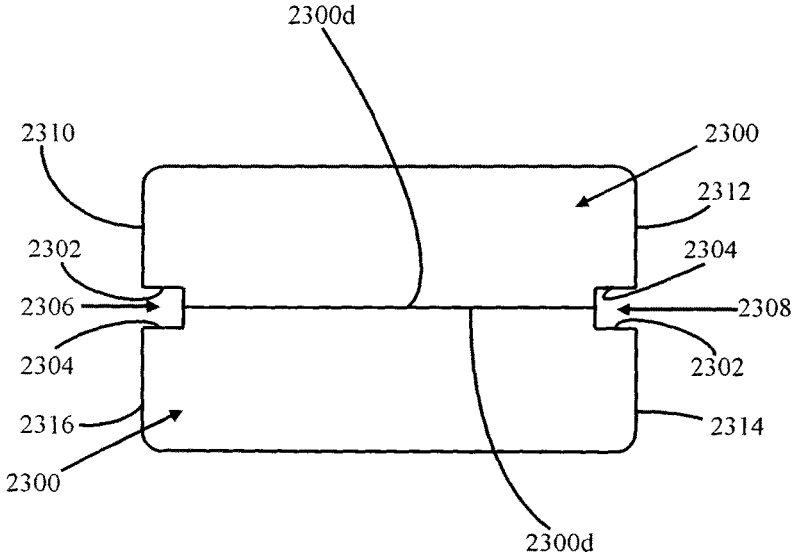
FIG. 65A is a front view showing a cutting edge of each of two of the safety blades of FIG. 65 abutting one-another as when disposed in a closed position, absent a supporting frame structure.
Figure 66:
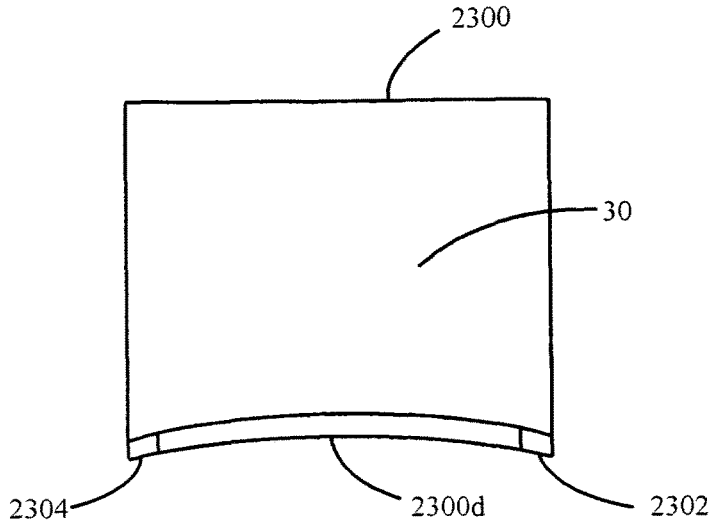
FIG. 66 is a bottom view of the safety blade of FIG. 65.
Figure 66A:
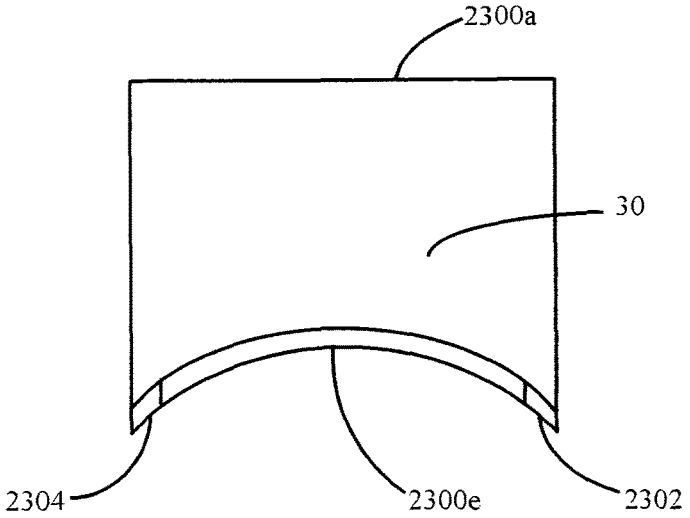
FIG. 66A is a bottom view of a modified first safety blade that includes a more pronounced (i.e., sharper) second radius of cut than the first radius of cut of the safety blade of FIG. 65.
Figure 66B:
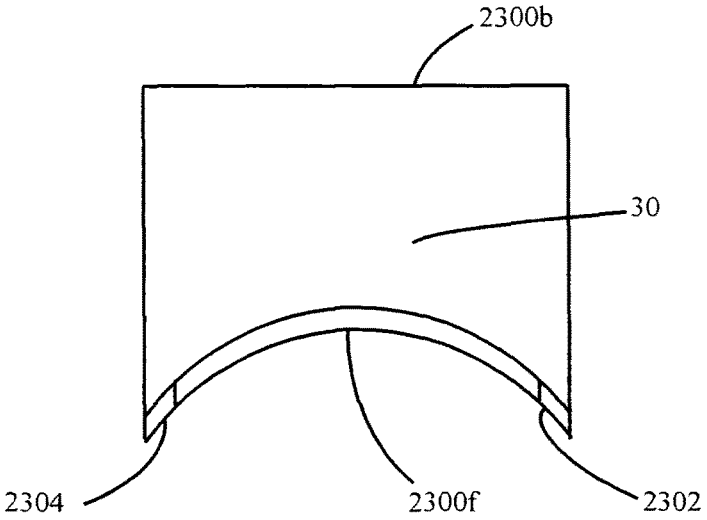
FIG. 66B is a bottom view of a modified second safety blade that includes an even more pronounced (i.e., even sharper) radius of cut than the first radius of cut of the safety blade of FIG. 65.
Figure 67:
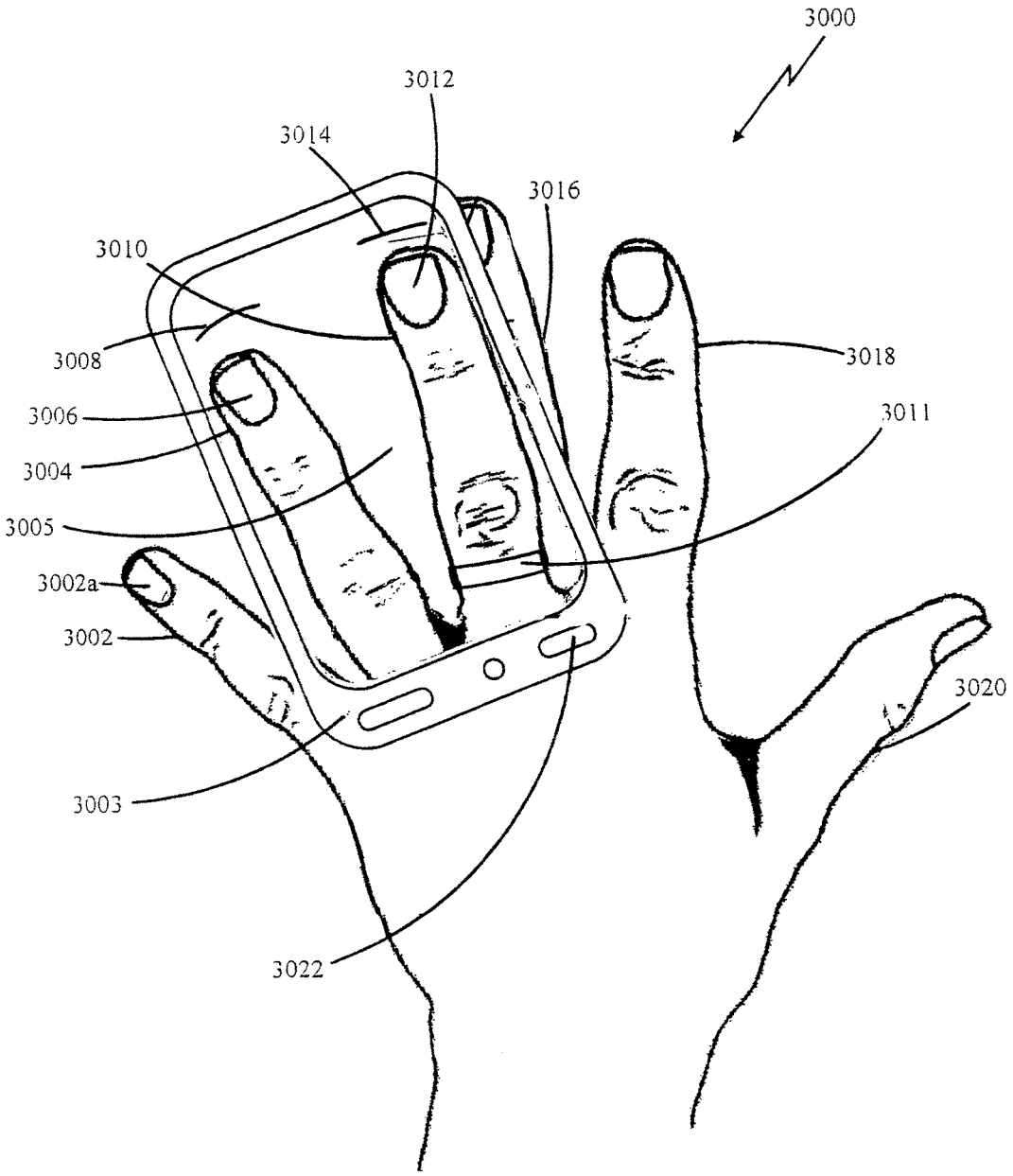
FIG. 67 is a view in perspective of a method for providing (i.e., manufacturing or selecting or obtaining at retail) a customized nail clipper using a mobile computing device and a software application to determine a desired radius of cut for one or more fingernails.

Briefly considering the drawings that relate most directly to the nail clipper 10 and alternative embodiments, thereof, FIG. 1 provides a perspective view of the nail clipper 10 in an open position. FIG. 2 provides a top view of the nail clipper 10 with a lever 32, a center rod 24, and a pin 34 removed for improved clarity of view. FIG. 3 is a side view of the nail clipper 10 disposed in the open position. FIG. 4 is a side view of the nail clipper 10 disposed in a closed position. FIG. 5 is a side view of the nail clipper 10 disposed in a rest or transit position useful for storage or transportation. FIG. 6 is a front view of the nail clipper 10 disposed in the open position. FIG. 7 is a front view of the nail clipper 10 disposed in the closed position. FIG. 8 is a front view of the nail clipper 10 disposed in the rest, storage or transit position. FIG. 9 is a cross-sectional view of the nail clipper 10 disposed in the open position taken along line 9-9 of FIG. 3. FIG. 10 is a cross-sectional view of the nail clipper 10 disposed in the closed position taken along line 10-10 of FIG. 4. FIG. 11 is an enlarged view in perspective of the blades 12, 14 of the nail clipper 10. FIG. 11A is a perspective view of a modified abrasive blade, identified in general by the reference numeral 2200. FIG. 12 is an enlarged view in perspective of the center rod 24 and the pin 34 that cooperates with the center rod 24 and with the lever 32 of the nail clipper 10. FIG. 13 is an enlarged view in perspective of a modified two-piece center rod, identified in general by the reference numeral 124, which can be used in any version of the invention that includes a type of a center rod to replace the center rod 24, as desired. FIG. 13A is an enlarged perspective view of an embedded pin lever, identified in general by the reference numeral 32*a*1, with an embedded pin 34*a*1. FIG. 14 is an enlarged cross-sectional view of a plurality of possible contours for the cutting edges 12*a*, 14*a* of the blades 12, 14. FIG. 15 is an enlarged view in perspective of one of a pair of modified blades 52, 54 that can be used instead of the blades 12, 14 in the nail clipper 10 and in any possible embodiment or modification of the invention, as desired. Therefore, whenever the blades 12, 14 or the modified blades 52, 54 are identified herein, it is understood that either the blades 12, 14 or the modified blades 52, 54 may be used, as desired. FIG. 16 is an enlarged bottom view of a portion of the blades 12, 14 taken along line 16-16 of FIG. 11. FIG. 17 is an enlarged bottom view of a portion of the modified blades 52, 54 taken along line 17-17 of FIG. 15. FIG. 18 is an enlarged cross-sectional view of a first modified dual parallel opposing blade embedded member nail clipper, identified in general by the reference numeral 100, similar to the view of FIG. 9 and looking rearward, disposed in an open position that shows a modified embedded position for the blades 12, 14. FIG. 19 is a side view of a second modified dual parallel opposing blade embedded member nail clipper, identified in general by the reference numeral 200, similar to the view of FIG. 4 that includes a modified embedded position for a modified enlarged head 224*a* of a shorter center rod 224 disposed in an underside of a second modified lower frame member 218, wherein during use, the enlarged head 224*a* applies an upward force directly to a horizontal blade portion, identified by bracket 30, of the lower blade 14. FIG. 20 is a side view of a third modified dual parallel opposing blade embedded member nail clipper, identified in general by the reference numeral 300, similar to the view of FIG. 19, showing a further modified position for the enlarged head 224*a* of the shorter center rod 224 disposed in a lower frame opening 302 that is provided in a third modified lower frame member 318. FIG. 21 is a side view of a fourth modified dual parallel opposing blade embedded member nail clipper, identified in general by the reference numeral 400, similar to the nail clipper of FIG. 4, where plastic is absent over an area, identified in general by the reference numeral 420*a*, which enables a fulcrum 33 of the lever 32 to apply a downward force directly to a top blade surface 12*f* of the horizontal blade portion 30 of the upper blade 12. FIG. 22 is an enlarged view in perspective of the lever 32 of the nail clipper 10 that also includes an optional reinforcing embedded member 32*b*, as shown in dashed lines. FIG. 23 is a top view of a fifth modified dual parallel opposing blade embedded member nail clipper, identified in general by the reference numeral 500, that includes the modified blades 52, 54 and a curved modified safety bumper 39*a* with the lever 32 and the center rod 24 removed for clarity of view. FIG. 24 is a view in perspective of a first modified lever 32*f* and FIG. 25 is a side view of a second modified lever 32*f*1, both including a modified fulcrum 33*a* for optional use with the nail clipper 10 or for use with any embodiment of the invention, as desired. FIG. 25 also shows an embedded reinforcing elongated member 32*j*. FIG. 26 is an enlarged cross-sectional view of a sixth modified dual parallel opposing blade embedded member nail clipper, identified in general by the reference numeral 600 and similar to the view of FIG. 9, taken along a line passing through a center longitudinal axis 13 of the center rod 24 and looking rearward. The sixth modified dual parallel opposing blade embedded member nail clipper 600 is disposed in an open position and it includes a modified U-shaped upper member 620. FIG. 27 is a side view of a modified spring clip nail clipper, identified in general by the reference numeral 700, disposed in an open position. FIG. 28 is a side view of the modified spring clip nail clipper 700 of FIG. 27 disposed in a closed position. FIG. 27A is an enlarged side view of the modified spring clip nail clipper 700 of FIG. 27 and FIG. 28A is an enlarged side view of the modified spring clip nail clipper 700 of FIG. 28. FIG. 29 is an enlarged bottom view of the nail clipper 10 of FIG. 1. FIG. 30 is an enlarged cross-sectional view of an eighth modified dual parallel opposing blade embedded member nail clipper, identified in general by the reference numeral 800, disposed in an open position where certain of its component parts are inverted in their positioning as compared to the nail clipper 10 of FIG. 9. FIG. 31 is an enlarged bottom view of the eighth modified dual parallel opposing blade embedded member nail clipper 800 of FIG. 30 that includes detail of a forward portion, thereof, which is not shown in the view of FIG. 30. FIG. 32 is a cross-sectional view of a ninth modified dual parallel opposing blade embedded member nail clipper, identified in general by the reference numeral 900, in an open position that includes a floating upper frame member 920, a floating lower frame member 918 and a pair of first and second spaced-apart floating container sidewalls 919*e*, 919*f* that are each attached at their respective distal ends to (or proximate) a modified vertical floating rear wall 919. FIG. 32A is a top view of the ninth modified dual parallel opposing blade embedded member nail clipper 900 of FIG. 32 in an open position after its assembly is complete. FIG. 32B is a bottom view of the ninth modified dual parallel opposing blade embedded member nail clipper 900 of FIG. 32. FIG. 33 is a front view of a modified dual parallel opposing blade embedded member nail clipper 10*a* with the upper and lower blades 12, 14, the center rod 24, the pin 34 and the lever 32 removed to illustrate an alternate method of inserting (i.e., embedding) the blades 12, 14 (or the modified blades 52, 54) therein during manufacture. The modified dual parallel opposing blade embedded member nail clipper 10*a* is illustrative of an alternate method for embedding the blades 12, 14 into the modified dual parallel opposing blade embedded member nail clipper 10*a* during manufacture. FIG. 34 is view in perspective of a tenth modified dual parallel opposing blade embedded member nail clipper, identified in general by the reference numeral 1000 that includes a pair of spaced-apart gaps 1002, 1004 that extend longitudinally along a top, a rear and a portion of a bottom of the tenth modified dual parallel opposing blade embedded member nail clipper 1000 to provide increased flexibility of a tenth modified upper frame member 1020 and a tenth modified lower frame member 1018. FIG. 35 is an enlarged bottom view of the tenth modified dual parallel opposing blade embedded member nail clipper of FIG. 34. FIG. 36 is an enlarged top view of the fully assembled nail clipper 10, as shown in FIG. 1. FIG. 36 is similar to the view shown in FIG. 2, except that FIG. 36 also includes the lever 32, the center rod 24 and the pin 34. FIG. 37 is a view in perspective of an axially pivoting dual parallel opposing blade embedded member nail clipper, identified in general by the reference numeral 1100, and hereinafter referred to as "the axially pivoting nail clipper 1100" in an open position that includes an axially pivoting lever 1132 which pivots around a horizontal axis 1111. FIG. 38 is a side view of the axially pivoting nail clipper 1100 of FIG. 37 in the open position. FIG. 39 is a side view of the axially pivoting nail clipper 1100 in a closed position. FIG. 40 is a side view of the axially pivoting nail clipper 1100 in a rest or transit position. FIG. 41 is a cross-sectional view of the axially pivoting nail clipper 1100 taken along line 41-41 of FIG. 38. FIG. 42 is a front view of the axially pivoting nail clipper 1100 of FIG. 37 in the open position. FIG. 43 is a cross-sectional view of the axially pivoting nail clipper 1100 taken along line 43-43 of FIG. 39 with the axially pivoting nail clipper 1100 disposed in the closed position. FIG. 44 is a view in perspective of the axially pivoting lever 1132 of the axially pivoting nail clipper 1100 of FIG. 37. FIG. 45 is a front view of the axially pivoting nail clipper 1100 of FIG. 37 in the closed position as also shown in the side view of FIG. 39. FIG. 46 is a front view of the axially pivoting nail clipper 1100 of FIG. 37 in the rest or storage position as also shown in the side view of FIG. 40. FIG. 47 is a top view of the axially pivoting nail clipper 1100 of FIG. 37. FIG. 48 is a bottom view of the axially pivoting nail clipper 1100 of FIG. 37. FIG. 49 is a view in perspective of a modified dual parallel opposing blade embedded member axially pivoting nail clipper, identified in general by the reference numeral 1200, in an open position. FIG. 49A is a view in perspective of a raised dual opposing blade embedded member nail clipper, identified in general by the reference numeral 1200*a*, that is similar to the modified dual parallel opposing blade embedded member axially pivoting nail clipper 1200 of FIG. 49 and instead including a modified rotating lever 1132*a* that cooperates with a proper length center rod 24*a*1 and the curved opposing modified upper and lower blades 52, 54. FIG. 50 is a view in perspective of a first single blade embedded member nail clipper 1300, with an optional file opening 1397 containing an optional file 1398 and a side-view of the optional file 1398 proximate the first single embedded member blade nail clipper 1300. FIG. 51 is a side view of the first single blade embedded member nail clipper 1300 of FIG. 50 disposed in an open position with the optional file 1398 disposed in the optional file opening 1397. FIG. 52 is a side view of the first single blade embedded member nail clipper 1300 of FIG. 50 disposed in a closed position, but not including the optional file opening 1397 and not including the optional file 1398. FIG. 53 is a side view of the first single blade embedded member nail clipper of FIG. 50 disposed in a rest or storage (transit) position, but not including the optional file opening 1397 and not including the optional file 1398. FIG. 54 is a view in perspective of a second single blade embedded member nail clipper 1400. FIG. 55 is a side view of the second single blade embedded member nail clipper 1400 of FIG. 54 disposed in an open position. FIG. 56 is a side view of the second single blade nail clipper 1400 of FIG. 54 disposed in a closed position. FIG. 57 is a side view of the second single blade nail clipper 1400 of FIG. 54 disposed in a rest or storage (transit) position. FIG. 58A is a side view of a first dual parallel opposing blade discreet embedded member nail clipper 1500 including a pair of shortened upper and lower blades 1512, 1514 that is disposed in an open position. FIG. 58B is a side view of a second dual parallel opposing blade discreet embedded member nail clipper 1600 including a pair of shortened wrap-around upper and lower blades 1612, 1614 that is disposed in an open position. FIG. 59 is a partial top view of a seventeenth upper frame member 1720 of a third discreet embedded member nail clipper 1700 that includes an embedded U-shaped member 1702 and an insert-able shortened upper blade 1712, with the shortened upper blade 1712 disposed away from the embedded U-shaped member 1702 prior to its insertion. FIG. 59A is a side view of the third embedded member nail clipper taken along line 59A-59A of FIG. 59. FIG. 59B is a front view of the upper member 1720 of the third discreet embedded member nail clipper 1700 taken along line 59B-59B of FIG. 59A prior to insertion of the shortened upper blade 1712, therein. FIG. 60 is a view in perspective of an integral pin lever, identified in general by the reference numeral 1832. FIG. 60A is a view in perspective of a PRIOR ART center rod, identified in general by the reference numeral 1824, for possible optional use with the integral pin lever 1832 and other versions of the invention that include the center rod 24. The integral pin lever 1832 can also be used with the modified two-piece center rod 124 and a lower rod portion, identified in general by the reference numeral 128. FIG. 61 is a view in perspective of a modified embedded member blade, identified in general by the reference numeral 1900. Please occasionally refer alternately to each of these drawing figures for a more complete understanding of the invention. FIG. 62 is a view in perspective a concealed lever nail clipper, identified in general by the reference numeral 2000, disposed in an open position. FIG. 63 is a side view of the concealed lever nail clipper 2000 of FIG. 62 disposed in a rest position. FIG. 64 is a view in perspective of an enlarged exploded view of a two-piece rotating center rod, identified in general by the reference numeral 2100. FIG. 65 is a perspective view of a safety blade, identified in general by the reference numeral 2300. FIG. 65A is a front view showing two of the safety blades 2300 of FIG. 65 in a closed position, absent any supporting structure. FIG. 66 is a bottom view of the safety blade 2300 of FIG. 65 having a first radius of cut 2300*d*. FIGS. 66A, and 66B each respectively include a bottom view of a modified first safety blade 2300*a*, and a modified second safety blade 2300*b* that are identical to the safety blade 2300 of FIG. 65 other than each having a progressively sharper second radius of cut 2300*e* and third radius of cut 2300*f*, respectively. FIG. 67 is a view in perspective of method for providing (i.e., manufacturing or selecting or obtaining at retail) a customized nail clipper 3000 using a mobile computing device 3003 and a software application 3022 to determine a desired radius 3008, 3012 of cut for one or more fingernails 8, each hereinafter referred to as "the nail 8", and using the desired radius 3008, 3012 information to provide (new custom manufacture or select from inventory) one or more customized nail clippers with a safety blade 2300, 2300*a*, or 2300*b* (or which may include any other desired blade 12, 14, 52, 54) that best approximates the desired radius 3008, 3012 or, alternately, inform a user where he or she may purchase at retail one or more of the already-manufactured customized nail clippers that best meet his or her overall desires and specific curvature of cut needs. If the customized nail clippers are manufactured specifically for the user, it is possible to use a frame of the modified dual parallel opposing blade embedded member nail clipper 10*a* (or any other preferred embodiment whether a single blade or a dual blade version) for insertion therein of whichever one (for single blade versions) of the safety blades 2300, 2300*a*, 2300*b* (or any other desired blade 12, 14, 52, 54) that includes a radius of cut which best approximates the desired radius 3008, 3012 or for insertion of two (for dual blade versions) of the same radius safety blades 2300, 2300*a*, 2300*b* (or two of any other desired blade 12, 14, 52, 54) that both include a radius of cut which best approximates the desired radius 3008, 3012.

The nail clipper 10, is shown specifically in FIGS. 1-17, 29 and 36. FIGS. 29, 33 and 36 disclose closely related modifications of the nail clipper 10. Please refer forward and back to review all of the FIGURES and their associated detailed descriptions when considering each embodiment disclosed, herein, as the teachings of each can be selectively modified for use, as desired, with other disclosed forms (i.e., other embodiments) of the invention.

The nail clipper 10 includes a one-piece frame, identified in general by the reference numeral 16. The frame 16 minimally includes the upper frame member 20 and the lower frame member 18 that are either joined together at a respective distal end 20*a*, 18*a* of the upper and lower frame members 20, 18 by molding, fusion, welding or by any preferred method to form a one-piece version of the frame 16. The distal ends 20*a*, 18*a* of the upper and lower frame members 20, 18 can be attached to each other or, as shown, they can each be attached to a common rear member. As shown for the nail clipper 10, the distal ends 20*a*, 18*a* of the upper and lower frame members 20, 18 are attached to a generally vertical rear wall 19. Alternately, the upper frame member 20 and the lower frame member 18 are manufactured as separate component parts that are fastened and secured together at their respective distal ends 20*a*, 18*a* by any preferred method, such as by use of an adhesive or fastener, as is described in greater detail, hereinafter. The frame 16 (whether of one-piece or two-piece construction) may optionally include the vertical rear wall 19 or any desired modification, thereof. If included, the vertical rear wall 19 may be used to elevate the distal end 20*a* of the upper frame member 20 with respect to the distal end 18*a* of the lower frame member 18 and/or the vertical rear wall 19 may be used as part of a perimeter of an optional preferred container structure, as is described in greater detail, hereinafter. The vertical rear wall 19 includes an exterior surface visible from the outside of the nail clipper 10 and it also includes an interior rear wall surface 19*a*, as shown in FIGS. 2 and 3. As used herein, reference to the "rear wall 19" or "vertical rear wall 19" includes any portion, thereof including, as appropriate, the visible exterior surface and/or the interior rear wall surface 19*a* including possible modifications, made thereto.

The frame 16 is formed substantially (i.e., more than 50%) of a desired grade of plastic or other polymer, nylon, synthetic, thermoplastic, thermoplastic rubber, or composite material, or of any other preferred non-metallic material or combination of materials. Ideally, all of the frame 16 is formed of a plastic or other non-metallic material with the exception of the horizontal portion 30 of the blades 12, 14 (52, 54) or with the exception of any embedded discreet members, or with the exception of an embedded horizontal portion of a modified embedded member blade, as are described in greater detail, hereinafter. For example, the frame 16 could be formed of a plastic or composite material and any desired portion of the frame 16 could be covered with another material, for example, with a rubber or other elastomeric material. Alternately, the frame 16 could be formed of nylon and any desired portion of the frame 16 could be covered with another material, for example, with a rubber or other elastomeric material. As described below, the frame 16 is fabricated using a minimum amount of metal, however, the frame 16 is always fabricated so that a majority of the frame includes a non-metallic material. As used herein, the general terms plastic and polymer are used interchangeably and are intended to encompass any desired chemically related material.

The use of selected metal components is, however, anticipated to augment function and durability of the nail clipper 10. An important aspect of the invention includes a novel design for the blades 12, 14, 52, 54 which are preferably formed of a metal such as hardened steel that is also used to increase stiffness and strength of the frame 16 at a critical location. This is described in greater detail, below.

The upper and lower blades 12, 14 are preferably formed of a metal, such as steel or other alloy. However, the blades 12, 14 (or any variation of the blades 12, 14 as disclosed, herein) can be formed of any suitable material, such as being formed of a ceramic material or formed of any other sufficiently hard material that is also sufficiently strong and durable.

The horizontal blade portion, identified by bracket 30, and hereinafter referred to as "the horizontal portion 30" or "the horizontal portions 30", as shown in FIG. 2 and FIG. 11, of the upper and lower blade 12, 14 is embedded in the upper and lower frame members 20, 18, respectively. It is a design variable, within certain limits discussed herein, as to how much of the upper and lower blades 12, 14 are to be utilized as the horizontal portions 30. In other words, either more or less of horizontal portion 30 of the blades 12, 14 can be embedded in the upper and lower frame members 20, 18. Generally, as much of the horizontal portion 30 is embedded into the upper and lower frame members 20, 18 as is possible. This maintains the upper cutting edge 12*a* of the upper blade 12 and the lower cutting edge 14*a* of the lower blade 14 as close as possible to the respective upper and lower frame members 20, 18 which decreases stress experienced by the upper and lower frame members 20, 18 during cutting by decreasing a length of a moment arm that extends forward, out from the upper and lower frame members 20, 18 to the cutting edges 12*a*, 14*a*.

The horizontal portions 30 are embedded sufficiently far into at least one of the upper and lower frame members 20, 18 to ensure that the forces experienced when cutting the nail 8 (FIGS. 3 and 4) are applied over or under the horizontal portions 30, or the use of one or more embedded discreet members or use of the modified embedded member blade or the use of sidewalls is required to provide sufficient stiffening for the frame member. These alternative solutions are further described, below.

In summary thus far, the horizontal portion 30 of each of the blades 12, 14 includes a horizontal plane that is disposed at an angle with respect to a more vertical plane, as shown by bracket 12*g*, 14*g* (See FIGS. 11, 11A and 15) that passes through the cutting edges 12*a*, 14*a* of the blades 12, 14, and wherein as much as possible of the horizontal portion 30 of each of the blades 12, 14 is embedded in the frame 16 of the nail clipper 10, and wherein the frame 16 is formed substantially of a plastic or other non-metallic material or combination of mostly non-metallic materials, and wherein the horizontal portion 30 includes a length that is sufficient to ensure that a portion of the horizontal portion 30 of each blade 12, 14 that is embedded in the frame 16 is disposed under or over (i.e., in vertical alignment with) any force that is applied to the frame 16 of the nail clipper 10 during cutting of the nail 8 for at least one of the frame members 20, 18, and preferably for both of the frame members 20, 18. This combination of novel elements, arranged as described herein, provides benefits and advantages that are not available with prior art dual parallel opposing blade types of nail clippers (not shown).

As previously mentioned, it is generally preferred to embed as much of the blades 12, 14 in the upper and lower frame members 20, 18 as possible to improve durability and to have as little of the blades 12, 14 protruding forward and out of the front end 20*b* of the upper frame member 20 and/or out of the front end 18*b* of the lower frame member 18, as possible. If an excessive amount of the blades 12, 14 were permitted to protrude forward and out of the front end 20*b* of the upper frame member 20 and/or out of the front end 18*b* of the lower frame member 18 then, during use, the protruding portions would act as a lever arm (i.e., the moment arm) that would increase a magnitude of force, by way of mechanical advantage, that is experienced by the plastic of the upper and lower frame members 20, 18 at the area where the blades 12, 14 protrude out of the front end 20*b* of the upper frame member 20 and/or out of the front end 18*b* of the lower frame member 18.

The greater the length of protrusion of the blades 12, 14 out of the front ends 20*b*, 18*b* of the upper and lower frame members 20, 18, the greater the length of the moment arm which would, in turn, proportionally increase the magnitude of force experienced by the plastic of the upper and lower frame members 20, 18 proximate the front end 20*b* of the upper frame member 20 or proximate the front end 18*b* of the lower frame member 18. As the force experienced increases, there is increasing risk that, during cutting of the nail 8 (See FIG. 3), the blades 12, 14 could fracture the plastic above the front end 20*b* of the upper frame member 20 or below the front end 18*b* of the lower frame member 18. Therefore in order to minimize such risk, it is desirable to embed as much of each of the blades 12, 14, as possible, in the upper and lower frame members 20, 18 which minimizes the overall length of the inherent moment arm that occurs which, in turn, minimizes the magnitude of force experienced by the plastic and the risk of damage occurring to the plastic proximate the front end 20*b* of the upper frame member 20 or proximate the front end 18*b* of the lower frame member 18.

As mentioned above and as described in greater detail hereinafter, the upper and lower blades 12, 14 are embedded in the upper and lower frame members 20, 18 of the frame 16 during manufacture of the frame 16 or, if preferred, they can each be inserted (i.e., urged) into a respective upper opening 13*a* and a lower opening 13*b* (See FIG. 33) that are provided at the front ends 20*b*, 18*b* of each of the upper and lower frame members 20, 18 after the frame 16 has been formed by injection molding or by any other molding technique.

With further regard to a consideration of the horizontal portion 30, refer momentarily also to FIG. 15 in which the horizontal portion 30 is shown as also being included with the pair of modified blades 52, 54. The modified blades 52, 54 each include a curved contour and a corresponding curved modified cutting edge 52*a*, 54*a*. The modified blades 52, 54 are described in greater detail, hereinafter.

The horizontal portion 30 of the modified blades 52, 54, in a manner identical to that of the horizontal portion 30 of the blades 12, 14, are embedded into the upper and lower frame members 20, 18 by molding or by otherwise forming or manufacturing an integral assembly that includes the horizontal portion 30 of the blades 12, 14 or the horizontal portion 30 of the modified blades 52, 54 in the upper and lower frame members 20, 18 or by later insertion.

As briefly mentioned above, the horizontal portion 30 of each of the blades 12, 14 or the horizontal portion 30 of each of the modified blades 52, 54 can alternately be embedded into the upper and lower frame members 20, 18 by urging the horizontal portion 30 into the upper opening 13*a* (FIG. 33) that is provided at the front end 20*b* of the upper frame member 20 or by urging the horizontal portion 30 into the lower opening 13*b* that is provided at the front end 18*b* of the lower frame member 18. If the upper and lower openings 13*a*, 13*b* are properly sized, by using sufficient force, the horizontal portion 30 of each blade 12, 14 (or each modified blade 52, 54) are embedded in the upper and lower openings 13*a*, 13*b* and are held in place by friction.

When the horizontal portion 30 of the blades 12, 14 (or the modified blades 52, 54) are fully inserted in the upper and lower openings 13*a*, 13*b*, the cutting edges 12*a*, 14*a* (or the modified cutting edges 52*a*, 54*a*) of the nail clipper 10 oppose each other and are parallel with respect to one-another and the cutting edges 12*a*, 14*a* (or the modified cutting edges 52*a*, 54*a*) are preferably disposed in a vertical alignment with respect to one-another.

Whether the blades 12, 14 or the modified blades 52, 54 are utilized, they are always used in corresponding pairs. Preferably to lower cost, the upper blade 12 and the lower blade 14 as well as the upper modified blade 52 and the lower modified blade 54 are identical in construction. During manufacture, the lower blade 14 (or the lower modified blade 54) is inverted in its position with respect to the upper blade 12 (or with respect to the upper modified blade 52).

As a point of understanding, a blade portion of all prior art steel-framed dual parallel opposing blade types of nail clippers include the cutting edge and a remainder of the blade that is disposed on the same general vertical plane or nearly vertical plane as the prior art cutting edge is disposed. The blade portion of an upper blade of the prior art steel-framed dual parallel opposing blade type of nail clipper descends downward from a front end of the upper steel frame member. The blade portion of a lower blade of the prior art steel-framed dual parallel opposing blade type of nail clipper descends upward from a front end of a lower steel frame member. Therefore, a fulcrum of a lever of a prior art steel-framed dual parallel opposing blade type of nail clipper applies a force during use to a portion of the steel frame of the prior art nail clipper. Accordingly, the horizontal portion 30, as disclosed herein, is a new element not previously known for a blade of a prior art dual parallel opposing blade type of nail clipper. The horizontal portion 30 is an improvement to the blade 12, 14 or to the modified blade 52, 54 that, when embedded in the respective frame members 20, 18 provide significant advantages and benefits not previously available by the prior art devices.

If preferred, differences in structure may exist between the upper and lower blades 12, 14 or between the upper and lower modified blades 52, 54 whereby they would not be identical, however, they would still be similar-enough to cooperate sufficiently with one-another to function. What is crucial is that the cutting edges 12*a*, 14*a* of the blades 12, 14 or the modified cutting edges 52*a*, 54*a* of the modified blades 52, 54 correspond sufficiently in size and contour with one-another for any version of the nail clipper 10 to permit the nail clipper 10 to function properly. In general, the cutting edges 12*a*, 14*a* and the modified cutting edges 52*a*, 54*a* of each pair of upper and lower blades 12, 14 or each pair of modified upper and lower blades 52, 54 cooperate with one-another during use. The upper cutting edge 12*a* of the upper blade 12 is parallel with respect to the lower cutting edge 14*a* of the lower blade 14. Similarly, the upper modified cutting edge 52*a* of the modified upper blade 52 is parallel with respect to the lower modified cutting edge 54*a* of the lower modified blade 54. Alignment of the cutting edges 12*a*, 14*a*, or alignment of the modified cutting edges 52*a*, 54*a*, is described in greater detail, hereinafter.

Continuing with reference on occasion to FIG. 1 while also continuing reference to FIGS. 2-20, 29, and 36, the vertical rear wall 19 is attached to and connects the lower frame member 18 to the upper frame member 20 at the lower distal end 18*a* of the lower frame member 18 and at the upper distal end 20*a* of the upper frame member 20.

When the frame 16 is molded, attachment of the lower distal end 18*a* of the lower frame member 18 to a bottom of the vertical rear wall 19 and attachment of the upper distal end 20*a* of the upper frame member 20 to top of the vertical rear wall 19 preferably occurs during manufacture by any preferred molding process in which the upper frame member 20, the lower frame member 18 and the vertical rear wall 19 are integrally formed of a single piece of plastic (or other preferred non-metallic material) and the blades 12, 14 (or the modified blades 52, 54) are attached, thereto, during the molding process. If desired, the distal ends 18*a*, 20*a* of the lower and upper frame members 18, 20 could be attached later to the vertical rear wall 19 by any preferred method or attached in a manner that eliminates the vertical rear wall 19. This is described in greater detail hereinafter during discussion of a two-piece version of the invention. See also FIG. 27, 27A and FIG. 28, 28A.

The advantages of attaching the blades 12, 14 (or the modified blades 52, 54) to upper frame member 20 and the lower frame member 18 by molding are additionally described, hereinafter.

The blades 12, 14 can also be inserted into the openings 13*a*, 13*b* (FIG. 33) that are provided in the upper frame member 20 and/or in the lower frame member 18 after molding (manufacture) of the upper frame member 20 and/or the lower frame member 18 has been accomplished, either when utilizing a one-piece construction or a two-piece construction for the frame 16 of the invention. This is described in greater detail, hereinafter.

Resuming discussion of the nail clipper 10, as shown in FIGS. 1-10 and 29, when the nail clipper 10 is viewed along a cross-sectional side view (not shown) taken along a vertical plane passing through a longitudinal center axis 11 (shown in dashed line, FIG. 1) of the nail clipper 10, the upper frame member 20, the vertical rear wall 19 and the lower frame member 18 of the frame 16, taken together, somewhat resemble an elongated "U-shape" in appearance.

The general or overall U-shape appearance of the lower and upper frame members 18, 20 and vertical rear wall 19 is not as apparent when viewed from an external side view (i.e., from the outside) of the nail clipper 10 because the preferred embodiment, as shown, includes an optional pair of opposing first and second container sidewalls 18*e*, 18*f* that are preferably molded as integral vertically extending component parts of the lower frame member 18. The opposing first and second container sidewalls 18*e*, 18*f* obscure (i.e., cover) from view an opposing pair of vertical planar surfaces 20*g*, 20*h* of the upper frame member 20. The first and second container sidewalls 18*e*, 18*f* also obscure from view the basic shape of the lower frame member 18 when viewed along the vertical plane passing through the center longitudinal axis 11 of the nail clipper 10.

According to a less-expensive, more basic version of the nail clipper 10 (not shown) that may be produced as desired, the first and second container sidewalls 18*e* and 18*f* are eliminated. Doing so would prevent capture of a nail clipping 8*a* (See FIG. 4) in the nail clipper 10. A failure to capture the nail clipping 8*a* may be acceptable for certain users if the cost of the more basic version of the nail clipper 10 is sufficiently low. Capture of the nail clipping 8*a* in the nail clipper 10 is discussed in greater detail, hereinafter. However, if the first and second container sidewalls 18*e*, 18*f* were eliminated in the more basic version, the overall U-shape of the upper frame member 20, the vertical rear wall 19 and the lower frame member 18 of the frame 16 would be readily apparent. It is, of course, possible to modify the overall shape of the nail clipper 10. For example, more of an overall V-shape is also possible as are other overall shapes.

It is, of course, to be understood that many variations in shape are possible for the frame 16 or for any other aspect of the nail clipper 10 that embody the cardinal teachings, herein.

Additionally, it is possible and anticipated that certain embodiments of the invention will form the upper frame member 20 and the lower frame member 18 out of two pieces that are subsequently fastened together at the distal ends 20*a*, 18*a* by any preferred means during manufacture. The distal ends 20*a*, 18*a* may be joined together by ultrasonic, thermal, or chemical welding, by use of an adhesive, or by use of a desired type of mechanical fastener(s) (not shown) such as one or more machine screws, rivets, or secured together by one or more retaining clips, or by any other preferred means. See FIG. 27 and FIG. 28 and a description included hereinafter for an example of the modified spring clip nail clipper-700, that includes a preferred two-piece frame 16 design for certain embodiments of the invention (when a two-piece frame 16 design is desired).

If a two-piece frame 16 embodiment of the invention is utilized, then the vertical rear wall 19 can be modified to include one-half of the vertical rear wall 19 attached to each of the distal ends 20*a*, 18*a* of each upper and lower frame member 20, 18 so that, when joined together, the vertical rear wall 19 is provided. Alternately, the vertical rear wall 19 could be included in its entirety on either the upper frame member 20 or, alternately, in its entirety on the lower frame member 18. Another possible variation is to omit the vertical rear wall 19 and modify the distal end 20*a* of the upper frame member 20 and/or the distal end 18*a* of the lower frame member 18 so that, when the upper frame member 20 and the lower frame member 18 are joined (fastened) together, a desired spaced-apart (when not cutting the nail 8) positioning of the front end 20*b* of the upper frame member 20 with respect to the front end 18*b* of the lower frame member 18 occurs when the further modified invention is disposed in an open position. As such, use of the vertical rear wall 19 is not necessary for all embodiments of the invention. What is essential is to provide the necessary spaced-apart positioning of the cutting edges 12*a*, 14*a* (or modified cutting edges 52*a*, 54*a*) when the nail clipper 10 (or any embodiment, thereof) is disposed in the open position. The desired spaced-apart positioning of the nail clipper 10 in the open position is shown in FIGS. 1, 3, and 6. An example of forming a modified type of an upper frame member and a modified type of a lower frame member out of two pieces that are secured (i.e., fastened) together at a distal end, thereof, is shown in FIGS. 27 and 28 and is further discussed, hereinafter. If sidewalls 18*e*, 18*f* are included, as discussed below, it is preferable but not necessary to include the vertical rear wall 19 and attach a distal end of each of the sidewalls 18*e*, 18*f* to the rear wall 19.

If desired, a modified embodiment that includes a one-piece modified frame (not shown) could also eliminate the rear wall 19 of the nail clipper 10, as preferred. The desired spaced-apart positioning of the front end 20*b* of the upper frame member 20 with respect to the front end 18*b* of the lower frame member 18 could be provided by the overall shape of the molded one-piece modified frame. For example, see FIG. 1 of currently co-pending patent application Ser. No. 13/385,701, entitled, "Nail Clipper with Opposing Parallel Blades," that was filed on Mar. 1, 2012 as being illustrative of an example of a one-piece modified frame design that includes a curved continuous structure at a distal end, thereof, and which could be further modified to include the essential structural attributes and cardinal teachings of the current invention. The continuously curving structure would eliminate the need to include the vertical rear wall 19 of the nail clipper 10 at the distal ends 18*a*, 20*a*.

The preceding examples and all variations mentioned or described herein or included herein by way of reference illustrate alternate ways of bringing forth the current invention (i.e., different shapes and/or different options for construction of the frame 16 including frames that include either one and/or two-piece variations, thereof), and are intended to further illustrate that while a few possible preferred embodiments are shown and described herein, that other modifications and/or changes are possible. The use of plastic to form the greater part of the frame 16 (or any variation/or modification of the frame 16) is what provides a virtually unlimited range of new, previously unavailable design possibilities.

The cardinal teachings disclosed herein permit the structural use of plastic for the frame members 20, 18 (as opposed to the requirement to use steel for the prior art frame (not shown) of prior art devices). The structural use of plastic, as disclosed herein, to form the frame members 20, 18 in turn allows for many of the other benefits and advantages of the nail clipper 10 (or other embodiments, thereof) that are not available with the prior art devices. Accordingly, the invention is not limited to the examples shown herein but is defined by the scope of the claims, as later appended, hereto.

Preferably, the frame 16, including the upper frame member 20, the vertical rear wall 19 and the lower frame member 18 are formed by molding these component parts substantially (i.e., over 50% of the frame 16) from a plastic (i.e., any desired polymer) or from any other preferred non-metallic material. This is preferred whether the frame 16 is formed as a one-piece assembly or if the upper frame member 20 and the lower frame member 18 are modified and formed as two separate pieces that are then fastened together. As mentioned before, as much of the frame 16, as possible, are formed of the plastic (or other non-metallic material).

Any molding technique is available for use with any embodiment of the invention to manufacture any of the component parts that are substantially formed of plastic or of another non-metallic material or combination of materials. If desired, any of the plastic or non-metallic component parts can alternately be formed by cutting, grinding, or otherwise removing unwanted material from a larger block of material or by any other desired manufacturing technique or method of fabrication, including, for example, but in no way limited to the use of layering or other techniques or methods of polymer fabrication that are generally referred to as "3-D printing" technologies.

For additional examples of possible two-piece modified frames that could be further modified for use with the current invention, please see related presently co-pending patent application Ser. No. 13/385,701 noted above, wherein the entire content of the above-identified co-pending patent application is included herein by way of reference. In particular, please refer to FIGS. 4 and 8 of the above-referenced co-pending patent application.

Returning to FIG. 1 of the current invention, the frame 16 can be molded using any desired type of plastic or polymer or it can be formed primarily from any other desired non-metallic material including any preferred type of composite non-metallic material. It is to be understood that while the frame 16 is molded or otherwise formed substantially (more than 50%) of a non-metallic material, the frame 16, or any other component part of the nail clipper 10, can include the use of metal for reinforcing or attaching purposes. However, the frame 16 of the nail clipper 10 is not formed primarily of a metal.

For example, the frame 16, while formed primarily of a non-metallic material, may include one or more metallic members embedded or molded therein. Typically such a member or members, if included, are used to stiffen or otherwise reinforce or strengthen some portion of the frame 16 of the nail clipper 10. Such use of a very small amount of metal (in a predominantly plastic frame 16 is different than what is known, taught or suggested by the relevant prior art that appertains to the prior art dual parallel opposing blade types of nail clippers.

The horizontal portion 30 of the blades 12, 14 is an example of a metallic element that is embedded into the frame 16. The horizontal portion 30 provides numerous advantages. The horizontal portion 30 stiffens, reinforces and/or strengthens this portion of the frame 16 (i.e., a forward area proximate the front end 20*b* of the upper frame member 20 and proximate the front end 18*b* of the lower frame member 18 that includes the horizontal portion 30 embedded, therein.) The horizontal portion 30 also significantly changes the way in which a pair of opposing cutting forces are applied to the frame 16 (as compared to all prior art dual parallel opposing blade types of nail clippers with dual parallel opposing cutting blades) and, additionally, the horizontal portion 30 significantly changes the manner by which the cutting forces are transferred through the frame 16 to the blades 12, 14 and, finally, to the upper and lower cutting edges 12*a*, 14*a*.

Current placement of the horizontal portion 30 of the blades 12, 14 in the front end 20*b* of the upper frame member 20 and in the front end 18*b* of the lower frame member 18 reduces the amount of shear force that is applied to, and experienced by the frame 16 by replacing shear force with a compressive force. This is a substantial improvement in design that permits the inexpensive use of plastic, rather than steel, in construction of the frame 16 of the nail clipper 10, resulting in a durable and an aesthetically improved device appearance.

To better understand the improvement provided by the horizontal portions 30, a contrasting example is now provided that includes making a proposed modification to a prior art type of relevant device. By way of contrast with the prior art, excessive shear force would occur if a modification of a prior art type of a steel-frame dual parallel opposing blade type of nail clipper (not shown) with dual parallel opposing cutting blades that included a steel frame structure and steel parallel opposing blades included only replacing the steel frame of the prior art all-steel dual parallel opposing blade nail clipper with a plastic frame to provide a modified plastic frame for the steel-frame prior art device. It is understood that the prior art device could, of course, also include non-metallic coverings or accessories, as desired, understanding that the all-steel frame is used for the transfer of cutting forces during use. The substitution of a plastic frame for the steel frame would not anticipate the current invention or the benefits provided by the nail clipper 10. The use (i.e., cutting) of the proposed modified plastic frame nail clipper would require depressing a lever included with the prior art nail clipper, the lever being identically disposed on the modified plastic frame as compared to where the lever was disposed when the frame (of the prior art device) was made of steel. Therefore, the lever of the proposed modified plastic frame would apply the force along a longitudinal length of the frame during cutting. Force would not be applied specifically or directly over or directly under or directly to any portion of the blade. The cutting force would be applied to the frame along the length of the unreinforced modified plastic frame, at the same locations along the frame as where the force is applied to the prior art steel-framed device.

Before concluding consideration of the efficacy of the proposed modified plastic frame, let us momentarily review how operation occurs with the prior steel frame device during use. The force produced by the lever is experienced by the steel frame as a downward force applied on top of the steel frame that is caused by downward pressure applied to the top of the steel frame by the lever and as an opposing upward force applied to bottom of the steel frame by a steel center rod that is simultaneously urging a bottom of the steel frame upward which prevents the bottom of the steel frame from being urged further downward. All of the force during cutting is applied to the steel frame of the prior-art device. The steel frame must then transfer the cutting force to the integrally formed (or detachable) parallel steel blades and ultimately to the cutting edges of the blades. Resistance of the nail (not shown with a prior art device) applies a resistive force that is opposite in direction to the direction of movement of the cutting edges during cutting of the nail. The resistive force is also opposite to the direction of the applied cutting forces. The difference between the direction of the resistive force and the direction of the cutting force produces an area of shear along a portion of the steel frame between where the blade begins and where the cutting force is applied. Because steel is sufficiently strong, the amount of shear experienced does not cause damage to the steel frame. Sufficient cutting force is applied through the area of shear and to the blades to sever the nail.

Returning to the consideration of the efficacy of the proposed modified plastic frame, plastic cannot withstand this level of shear. Therefore, if the previously noted cutting forces are applied to the proposed modified plastic frame (of this example which proposes substitution of the steel prior art frame with a plastic frame), excessive shear (also referred to as shear force) would occur between the beginning of the (steel) blades and where the cutting force is applied to the plastic frame of the proposed modified prior art device. The excessive level of shear would distort the frame, bending and/or damaging it. Therefore, inherent structural limitations preclude substitution of plastic for the steel frame of the prior-art all-steel dual parallel opposing blade nail clipper. In summary, this is because the forces that would be applied to the modified plastic frame would then have to be transferred through the plastic frame to the blades of the modified prior art nail clipper. This transfer of cutting forces would result in an excessive amount of shear occurring at an area of intersection between the plastic frame and a beginning of the blades. This, in turn would render the resultant device inoperative.

It is noted that the use of plastic for the structural members that include opposing blades of a dual parallel blade nail clipper is not previously known outside (i.e., before) the earliest priority date of the parental patent lineage (i.e., ancestry) of the current invention (beginning with currently pending application Ser. No. 11/305,561 that was filed on Dec. 15, 2005).

As discussed herein, the nail clipper's 10 use of the embedded horizontal portion 30 in plastic provides several important and unexpected benefits that allow the nail clipper 10 to function reliably and which permit manufacture at exceptionally low cost while also increasing eye-appeal (i.e., aesthetic attractiveness), durability, ergonomics, texture, utility and improving the way the nail clipper 10 feels during use.

The application of cutting forces, as applied to the nail clipper 10, when cutting the nail 8 (FIG. 3) is described in greater detail, hereinafter.

As a further example of the use of metal during manufacture of the nail clipper 10, any component part of the nail clipper 10 other than the frame 16 as described above (i.e., excluding the upper frame member 20, the vertical rear wall 19 (if included) and the lower frame member 18) can be formed partially, substantially, or entirely of metal or, alternately, partially, substantially, or entirely of plastic (or any other non-metallic material), as desired. Such specific use of metal with the nail clipper 10 (or any version thereof) is possible while keeping in mind that it is also a general object of the invention to reduce the use of metal in an parallel opposing dual blade type of nail clipper whenever possible and, if possible, to eliminate the use of metal entirely from certain of the component parts. However, this general objective does not prevent or preclude the manufacture of certain component parts of the nail clipper 10 largely or entirely from metal (other than the upper frame member 20, vertical rear wall 19 and the lower frame member 18 (i.e., the frame 16), which is/are substantially comprised (formed) of a non-metallic material). In general, metal is used in the nail clipper 10 when the use of a metal provides a benefit or advantage in terms of cost, manufacture, aesthetics, utility, durability, consumer preference and/or a structural advantage.

For example if desired, the lever 32 (FIG. 1) can be formed entirely or substantially of any preferred metal or alloy. However, it is generally preferred, as noted above, to form the lever 32 substantially or even entirely from a plastic, or from a composite material or from another non-metallic material, whenever possible.

Accordingly, the use of the reinforcing embedded member 32*b* that is embedded in the plastic (non-metallic) lever 32 is clearly anticipated by this disclosure, as shown in FIG. 22 and FIG. 25 (where the embedded reinforcing elongated member 32*j* is shown) to stiffen, reinforce and/or strengthen the lever 32, as desired. Similarly, the pin 34 (As shown in FIGS. 1, 3-10, 12, 13, 18-21, 26-28, 30, 32; 32A, 34, 36, 50-53, and 58A-58B) can be formed of a metal or formed of an alloy. Any preferred sufficiently strong non-metallic material can also be used to form the pin 34. Similarly, the lever 32 or the center rod 24 (FIG. 12) or the modified two-piece center rod 124 (FIG. 13), as preferred, can be formed of a metal or formed of an alloy or, alternately, formed of any preferred non-metallic material providing the material used to form the pin 34 and/or the lever 32 and/or the center rod 24 or the modified two-piece center rod 124 is sufficiently strong and durable. See also FIGS. 22, 24 and 25 and a later description regarding these drawings for additional possible modifications to the lever 32.

Additionally as mentioned herein, a metal fastener (for example, a machine screw and nut (not shown)) or clip can be included to secure the upper and lower members 20, 18 of a two-piece embodiment of the invention together. The screw, nut or clip can be formed of plastic, nylon or a preferred metal. As an example, refer momentarily to FIGS. 27 and 28 where the modified spring clip nail clipper 700 is shown that includes a spring clip 702. The spring clip 702 is formed of any preferred material. The use of a metal to form the spring clip 702 may be preferred to minimize the cost of manufacture and to increase a force that is applied to a modified spring clip frame, identified in general by the reference numeral 716, of the modified spring clip nail clipper 700. The force supplied by the spring clip 702 is described in greater detail, hereinafter.

Similarly, the modified spring clip frame 716 or the frame 16 can be molded using any desired color or type of plastic. For example, a pink color of the modified spring clip frame 716 or the frame 16 may appeal to girls and women whereas another color, such as blue or green, may be more likely to appeal to boys and men. Multiple colorings are possible for inclusion with any version of the nail clipper 10, as well as the inclusion of logos, lettering and numerous other possible aesthetic modifications. If included with the nail clipper 10, the logos, lettering and other aesthetic modifications can include raised and/or recessed lettering or symbols. It is also possible to fabricate multiple portions of the modified spring clip frame 716 of the modified spring clip nail clipper 700 or the frame 16 of the nail clipper 10 utilizing two or more different polymers, or two or more different non-metallic materials if an aesthetic or structural advantage or a desired "feel" is derived from doing so. Please refer to co-pending patent application Ser. No. 13/385,701 for additional discussion regarding the advantages and versatility derived from the use of one or more polymers for the frame of a dual parallel opposing blade type of nail clipper.

What is especially important to appreciate is that the design of the nail clipper 10 (including any embodiment, thereof), unlike prior art dual parallel opposing blade types of nail clippers (not shown), relies very little on the inherent mechanical strength and stiffness of the frame 16 to transfer force during use (i.e., during cutting of the nail 8) to the pair of opposing blades 12, 14 because the design of the nail clipper 10 significantly reduces shear in the frame 16. Please refer, in particular, to FIGS. 1-5, 9-11, 15, and 18-33, 36 and the following discussions that appertain to these FIGURE drawings. This is of significant importance because the novel transfer of force provided by the nail clipper 10 and any embodiment, thereof, allows the frame 16 (or any modification made to the frame 16, thereof) to be substantially (i.e., greater than 50%) formed of plastic (i.e., polymer) or from another non-metallic material and, in certain embodiments the frame 16 (or any modification made to the frame 16, thereof) the design of the nail clipper 10 allows the frame 16 to be fabricated/formed of a lesser grade of plastic or possibly utilizing another non-metallic material than would otherwise be suitable for use.

An appreciation of the forces and stress involved is useful in understanding the advantages and benefits of the nail clipper 10. The nail clipper 10 is being used to illustrate the stresses and forces that occur when cutting the nail 8 using the nail clipper 10 or which similarly occur when using any steel-framed prior art type of dual parallel opposing blade type of nail clipper.

When using any prior art dual parallel opposing blade type of nail clipper or when using the nail clipper 10 or any embodiment, thereof, it is important to appreciate that significant force and stress is applied to and experienced by the nail clipper 10 during actual cutting of a portion of the nail 8. This is because the cut through the nail 8 is occurring simultaneously across an entire length of the nail 8 that is disposed between the cutting edges 12*a*, 14*a* (or the modified cutting edges 52*a*, 54*a*) and because it is occurring simultaneously on both sides of the nail 8. Please refer momentarily to FIG. 14 where a cross-sectional view illustrates six of many possible profiles that are available for the cutting edges 12*a*, 14*a*. Please refer also to FIG. 3.

As each cutting edge 12*a*, 14*a* is progressively urged deeper into the nail 8 during cutting of the nail 8, a progressive increase in a thickness of the blade 12, 14 proximate the cutting edge 12*a*, 14*a* is also occurring. Increasing thickness of the blade 12, 14 increases resistance to the cut as the cut progresses through the nail 8. As noted above, the resistance is experienced as an opposing resistive force experienced by the blades 12, 14 that occurs in a direction opposite to the direction that the blades 12, 14 are each, respectively, being urged.

This is because a portion of the force applied to the nail 8 by the blades 12, 14 is experienced by the nail 8 as a horizontal force vector applied to the nail 8 and offset approximately ninety degrees from a primary force, or vertical vector applied to the nail 8 occurring along the vertical plane of cut (i.e., urging the cutting edges 12*a*, 14*a* toward one-another). The cross-section profile of the cutting edges 12*a*, 14*a* (See also FIG. 14) significantly influences the magnitude of the horizontal force vector applied to the nail 8. The horizontal force vector applied to the nail 8 is attempting to urge the nail clipping 8*a* away from a remaining portion of the nail 8, which the nail 8 continues to resist until the cut through the nail 8 is nearly complete or has been completed. The magnitude of the horizontal force vector applied to the nail 8 increases as the depth of cut into the nail 8 increases in response to the progressive increase in the thickness of the blades 12, 14. Again, this is simultaneously occurring on both sides of the nail 8.

As the width of the blades 12, 14 entering into the nail 8 and the horizontal force vector applied to the nail 8 are both simultaneously increasing, these forces are experienced by the nail clipper 10 as a progressive increasing in resistance (i.e., a resistive force opposing the direction of cut) consistent with Newton's third law of motion, "for every action there is an equal and opposite reaction." The increasing resistance results in an opposing force vector that represents the resistive force. The opposing force vector includes an upper and a lower opposing force vector that are each experienced by the blades 12, 14 in a direction that is opposite that of the primary force vectors that are applied to a top planar surface 20*d* of the upper frame member 20 and simultaneously to a bottom planar surface 18*c* of the lower frame member 18, and which are then transferred to the blades 12, 14 and to the cutting edges 12*a*, 14*a* of the blades 12, 14. Increasing resistive force demands that an even greater cutting force is applied to the frame 16 of the nail clipper 10 by increasing a downward force that is applied to the lever 32 of the nail clipper 10. This urges the blades 12, 14 deeper into the nail 8 which further increases the magnitude of the resistive force.

Therefore, the primary force vectors during cutting are experienced by the frame 16 of the nail clipper 10 substantially as a first compressive force attempting to urge the plastic on top of the horizontal portion 30 of the upper frame member 20 in a downward direction toward the horizontal portion 30 of the upper blade 12, and as a second compressive force attempting to urge the plastic below the horizontal portion 30 of the lower frame member 18 in an upward direction toward the horizontal portion 30 of the lower blade 14. By design, these first and second compressive forces occur along the length of the upper and lower frame members 20, 18 that also include the horizontal portions 30 embedded, therein. A small amount of shear may occur along the longitudinal length of the horizontal portions 30; however shear experienced by any portion of the upper and/or lower frame members 20, 18 is minimal and the greater portion of the minimal shear that is experienced is confined to the portion of the upper and lower frame members 20, 18 that also include the horizontal portions 30 embedded, therein, and which are thereby easily able to accommodate the small amount of shear that is experienced. The amount of shear experienced is a small fraction of the magnitude of shear that would be experienced by the frame 16 if the cutting forces were instead applied to the upper and lower frame members 20, 18 at a location that did not include the embedded horizontal portions 30.

The opposing resistive forces continue to increase until the cut is finished (or very nearly finished), at which point the nail clipping 8*a* is forcibly ejected from a remaining portion of the nail 8 in the direction of arrow 43 (FIG. 4). The stress that occurs in the prior art dual parallel opposing blade type of nail clipper during cutting of the nail 8 results in progressively increasing shear force occurring within the frame of the prior art nail clipper, as earlier described. The preceding additional discussion further illustrates, consistent with earlier discussions, why the mere substitution of the proposed modified plastic frame for the steel frame of the prior art dual parallel opposing blade type of nail clipper will result in excessive stress occurring within the proposed modified plastic frame.

As briefly discussed above, because of the horizontal portion 30 embedded in the nail clipper 10, the force applied is primarily experienced by the nail clipper 10 as the first compressive force that is applied in a downward first direction by the fulcrum 33 (See FIGS. 1 and 4) of the lever 32 to the top planar surface 20*d* of the upper frame member 20 proximate the front end 20*b* of the upper frame member 20 and simultaneously as the second compressive force that is applied in an opposite upward second direction (as compared to the first force) to the bottom planar surface 18*c* of the lower frame member 18 proximate the front end 18*b* of the lower frame member 18.

Certain embodiments described herein apply the first compressive force and the second compressive force to a different portion (location) as described, herein, however all embodiments include the embedded (or a partially embedded) horizontal portion 30 and the resulting application of both the first and second compressive forces to occur in vertical alignment with (i.e., over or under) each of the respective horizontal portions 30 of the blades 12, 14.

This novel arrangement in structure is satisfied specifically, by including an approximate ninety degree bend in the blades 12, 14, and by extending the horizontal portion 30 of the blades 12, 14 a sufficient amount, and by embedding the horizontal portions 30 a sufficient amount into the front ends 20*b*, 18*b* of the upper and lower frame members 20, 18, and by ensuring that the application of cutting forces applied to the frame members 18, 20 occurs over the horizontal portions 30.

This novel arrangement in structure is accompanied by a significant reduction in the magnitude of shear force that is experienced by the frame 16 and it also provides the frame 16 with a significantly greater ability to withstand shear as well as compressive force in the areas where the primary cutting forces are applied to the upper and lower members 18, 20 of the frame 16, specifically over or under the horizontal portions 30. This arrangement in structure applies to the nail clipper 10 and any modification, thereto.

The horizontal portion 30 (Please refer also to FIGS. 2, 11 and 15) of the blades 12, 14, as discussed above, are embedded in the upper and lower frame members 20, 18 in any of a variety of possible described ways. Some of the variation possible is discussed later. The horizontal portion 30 of the blades 12, 14 receives and responds to the first and second compressive forces which are applied in opposite directions to the upper and lower frame members 18, 20 by urging the front end 20*b* of the upper frame member 20 and the front end 18*b* of the lower frame member 18 toward each other.

Plastic is able to withstand substantial compressive force if adequately supported on an opposite side. The horizontal portions 30 provide the support necessary for the plastic to withstand the applied compressive forces as well as any shear that is experienced in this general area (i.e., over or under the horizontal portions 30).

As the front end 20*b* of the upper frame member 20 and the front end 18*b* of the lower frame member 18 are urged toward each other, a remaining portion of the upper and lower frame members 20, 18 (from the end of each of the horizontal portions 30 to the respective distal ends 20*a*, 18*a* of the upper and lower frame members 20, 18) are also urged toward each other a proportionate amount until the nail clipper 10 is disposed in the closed position.

The novel transfer of forces that occur, during cutting, within the nail clipper 10 can perhaps be further understood by considering that as the horizontal portions 30 are each urged toward one-another they, in turn, urge the remaining portion of the upper and lower frame members 20, 18 a necessary amount toward each other. In this manner, a minimal magnitude force is experienced by the remaining portions of the upper and lower frame members 20, 18, and, most importantly, the remaining portion of the upper and lower frame members 20, 18 of the nail clipper 10 (by way of comparative illustration) do not initially receive the cutting forces and then have to transfer the cutting forces through the unreinforced plastic remaining portion of the upper and lower frame members 20, 18 and apply the forces to the blades 12, 14, as occurs with all prior art similar devices that, of necessity, include steel frames. To the contrary, the overwhelming majority of cutting forces are applied directly above and/or below the horizontal portions 30 of the blades 12, 14 of the nail clipper 10.

Therefore, the blades 12, 14 experience the overwhelming majority of cutting forces. The cutting forces (i.e., the first and second compressive forces) urge the blades 12, 14 toward one-another. As the blades 12, 14 are urged toward each other the blades 12, 14, in turn, urge the remaining portions of the upper and lower frame members 20, 18 toward each other a minimal, yet sufficient amount, until the nail clipper 10 has been urged into the closed position.

This is the diametric opposite of the prior art approach of applying force directly to the prior art frame members sufficient to urge the prior art frame members toward each other and then relying on the prior art frame members to, in turn, urge the prior art cutting edges of the prior art blades toward each other. The prior art blades include the prior art cutting edges and are on a different plane than the plane of the prior art frame members. The prior art frame members are disposed on a generally horizontal plane while the prior art blades are disposed on a generally vertical plane that is disposed at approximately a ninety-degree angle with respect to the prior art frame members.

With the nail clipper 10, an increased reliance on compressive force is used to help urge the blades 12, 14 toward one-another. The blades 12, 14 each respectively help urge the frame members 18, 20 toward each other. As the upper and lower frame members 20, 18 are urged toward each other and into the closed position a slight amount of shear is experienced by the remaining portions of the upper and lower frame members 20, 18 (i.e., the remaining portions include that portion of the upper and lower frame members 20, 18 that does not include the horizontal portions 30). However, the amount of shear experienced by the remaining portions of the upper and lower frame members 20, 18 is minimal and can be easily accommodated by the upper and lower frame members 20, 18 without causing damage to the plastic or to any other non-metallic material that may be used to form the majority of the frame 16 structure.

It is preferred that, except for the horizontal portions 30 that are embedded in the upper and lower frame members 20, 18 and, possibly excluding the center rod 24 and, if included, possibly excluding the spring clip 702 (see FIGS. 27 and 28), that the remainder of the frame 16 is formed of one or more types of polymers and/or one or more types of other non-metallic materials.

Please refer momentarily now to FIG. 8, which shows the nail clipper 10 disposed in a rest or transit position that provides a thin contour (i.e., minimum volume) for storage or transportation.

The upper frame member 20 includes an upper segment, identified by bracket 20*k* of the upper frame member 20 where the upper segment 20*k* is disposed above the horizontal portion 30 of the upper blade 12, and a lower segment identified by bracket 20*m* of the upper frame member 20, where the lower segment 20*m* is disposed under the horizontal portion 30 of the upper blade 12. The overall thickness of the upper frame member 20 at the horizontal portion 30 is the sum of the thickness of the upper segment 20*k* plus the thickness of the lower segment 20*m* plus a blade thickness 45 (See bracket 45, FIG. 11) of the horizontal portion 30 of the upper blade 12.

The lower frame member 18 includes an upper segment of the lower frame member 18, identified by bracket 18*k*, where the upper segment 18*k* is disposed above the horizontal portion 30 of the lower blade 14, and a lower segment, identified by bracket 18*m*, of the upper frame member 20, where the lower segment 18*m* is disposed under the horizontal portion 30 of the lower blade 14. The overall thickness of the lower frame member 18 at the horizontal portion 30 is the sum of the thickness of the upper segment 18*k* plus the thickness of the lower segment 18*m* plus the blade thickness 45 of the horizontal portion 30 of the lower blade 14.

The downward first compressive force is applied by the fulcrum 33 to the top of the upper segment 20*k* of the upper frame member 20, transferred downward through the upper segment 20*k* to the horizontal portion 30 of the upper blade 12. A bottom of the upper segment 20*k* is above and, thereby, supported by the top blade surface 12*f* (FIG. 11) of the horizontal portion 30 of the upper blade 12. Therefore, the plastic (or other non-metallic material) used to form the upper segment 20*k* or any other portion of the upper frame member 20 is not damaged by the downward first compressive force because the downward first compressive force is smoothly transferred through the upper segment 20*k* and to the upper blade 12.

The upward second compressive force is applied by an enlarged head 24*a* of the center rod 24 to the bottom of the lower segment 18*m* of the lower frame member 18, transferred upward through the lower segment 18*m* to the horizontal portion 30 of the lower blade 14. A top of the lower segment 18*m* is supported by a bottom blade surface 14*b* of the horizontal portion 30 of the lower blade 14. Therefore, the plastic (or other non-metallic material used to form the lower segment 18*m*) is not damaged by the upward second compressive force because the upward second compressive force is smoothly transferred through the lower segment 18*m* and to the lower blade 14.

In this manner the downward first compressive force and the upward second compressive force urge the upper blade 12 and the lower blade 14 toward each other when the lever 32 is depressed with sufficient force. See also FIG. 36. The upward second compressive force can also be seen as sufficient to keep the lower frame member 18 from being urged (i.e., displaced) away from the upper frame member 20 during use. In other words, the lower frame member 18 does not have to be urged upward during use. The upper frame member 20 can do all the movement relative to the lower frame member 18 by flexing downward and upward. Or both the upper frame member 20 and the lower frame member 18 can both flex an equal amount or an unequal amount. As long as either blade (12 or 14) or both blades 12, 14 can be sufficiently urged toward each other from the open position into the closed position and back into the open position, then the nail clipper 10 can function properly.

As shown in FIG. 1 and FIGS. 6-8, the lower frame member 18 includes the first and second container sidewalls 18*e*, 18*f* attached thereto along a longitudinal length of the bottom of the sidewalls 18*e*, 18*f*. As the first and second container sidewalls 18*e*, 18*f* are also attached to the vertical rear wall 19, this provides considerable stiffness to the lower frame member 18. Therefore, the upper frame member 20 experiences a significantly greater degree of flexing during cutting.

Therefore, with the nail clipper 10, the upward second compressive force is used primarily to prevent the lower frame member 18 from being urged downward and away from the upper frame member 20 when the lever 32 is depressed during cutting. The stiffening provided to the lower frame member 18 by the optional first and second container sidewalls 18*e*, 18*f* significantly increases the resistance of the lower frame member 18 to vertical flexing during use. This results in less reliance upon the horizontal portion 30 in the lower frame member 18 to stiffen and convert a portion of the force applied, thereto, into a compressive force. Accordingly, use of the first and second container sidewalls 18*e*, 18*f* may be used in certain embodiments of the invention to eliminate the need for a portion of the horizontal portion 30 of the lower blade 14 to be disposed in vertical alignment with the (upward) force that is applied to the lower frame member 18 during cutting of the nail 8. However, even if the first and second container sidewalls 18*e*, 18*f* are included it is generally preferred that the horizontal portion 30 of the lower blade 14 is disposed in vertical alignment with the applied (upward) force.

Other changes are possible that would allow equal or near equal flexing of both a modified upper frame member and a modified lower frame member with respect to each other, as shown in FIGS. 34 and 35. These embodiments are described in greater detail, hereinafter.

If it was desired to increase flexing of either the upper or lower frame member 20, 18 an optional flex area 71 (See dashed lines, FIG. 5) could be included across the upper frame member 20 (as shown) proximate the vertical rear wall 19 or elsewhere, as desired. The optional flex area 71 is molded to include less material under the dashed line showing the optional flex area 71 and it, therefore, weakens the upper frame member 20 at this area. If included, the flex area 71 acts as a hinge to aid in flexing the upper frame member 20 about the flex area 71.

If desired, the flex area 71 could extend only partway across the upper frame member 20 to provide a more resistive (to flexing) hinge. Similarly, the flex area 71 could include different depths across the width of the upper frame member 20. If desired, the above teachings regarding the flex area 71 could alternately be optionally included across the entire or partial width of the lower frame member 18 or across both the lower and upper frame members 18, 20. As shown, the flex area 71 is curved to minimize stress and fatigue; however any preferred shape or variation in shape is possible for the flex area 71, which is optional for various embodiments of the invention.

Referring also to FIGS. 1, 3, 6, 8, 9, 11 and 12 the placement of the center rod 24 can be understood, as follows. From an upper end 24*b* of the center rod 24 proceeding downward, the upper end 24*b* of the center rod 24 is disposed in a U-shaped recessed area 32*c* of the lever 32. A remainder of the center rod 24 extends downward, through the nail clipper 10. The pin 34, as mentioned above, passes through a pair of aligned pin openings 32*d*, 32*e* of the U-shaped recessed area 32*c* of the lever 32 and through a pin aperture 24*c* (FIG. 12) of the center rod 24, thereby securing the U-shaped recessed area 32*c* of the lever 32 to the center rod 24.

The center rod 24 then passes downward through an upper center rod hole 20*n* (FIG. 8) that is provided through the upper segment 20*k* of the upper frame member 20. The center rod 24 continues downward through a center hole 22 (FIG. 11) of the upper blade 12 and through a lower center rod hole 20*p* (FIG. 8) that is provided through the lower segment 20*m* of the upper frame member 20. The center rod 24 continues downward through a gap between the upper frame member 20 and the lower frame member 18. The center rod 24 then passes through an upper center rod hole 18*n* that is provided through the upper segment 18*k* of the lower frame member 18. The center rod 24 continues downward through the center hole 22 of the lower blade 14 and through a lower center rod hole 18*p* that is provided through the lower segment 18*m* of the lower frame member 18. A bottom of the center rod 24 is attached to, and thereby includes, the enlarged head 24*a*. The upper surface of the enlarged head 24*a* bears against the bottom planar surface 18*c* of the lower segment 18*m* of the lower frame member 18. The center hole 22 is disposed in the horizontal portion 30 of both the upper blade 12 and the lower blade 14.

The center rod 24 passing through the upper center rod hole 20*n*, the center hole 22 of the upper blade 12, and the lower center rod hole 20*p* ensures that the upper frame member 20 maintains alignment with the center longitudinal axis 13 (FIGS. 1 and 12) of the center rod 24 as the upper frame member 20 is urged vertically downward toward the lower frame member 18 or upward and away from the lower frame member 18.

Similarly, the center rod 24 passing through the upper center rod hole 18*n*, the center hole 22 of the lower blade 14, and the lower center rod hole 18*p* ensures that the lower frame member 18 maintains concentric alignment with the center longitudinal axis 13 of the center rod 24 as the lower frame member 18 is urged closer to the upper frame member 20 or further away from the upper frame member 20, regardless of which frame member (20 or 18) is flexing most.

In this manner, the center rod 24 also helps to maintain vertical alignment between the upper and lower frame members 20, 18 as they move toward or away from each other. This arrangement helps ensure that a significant amount of the cutting force applied to the frame 16 by the fulcrum 33 of the lever 32 (as the downward first compressive force is applied to the upper frame member 20) and by the enlarged head 24*a* of the center rod 24 (as the upward second compressive force is applied to the lower frame member 18), which occur simultaneously whenever the lever 32 is urged downward in the direction of arrow 50*b* (FIG. 4) remain as compressive forces. It is desirable to maximize compressive force and minimize shear force that is experienced by the frame 16. By maintaining vertical alignment between the upper and lower members 20, 18 during use, less of the cutting force applied to the nail clipper 10 is experienced as shear force by the frame 16 and a greater proportion of the cutting force is experienced by the frame 16 as the first and second compressive forces.

As the upper and lower frame members 20, 18 move relative to each-other, the upper surface of the enlarged head 24*a* maintains contact with the bottom planar surface 18*c* of the lower segment 18*m* of the lower frame member 18.

Also, because the lever 32 is attached to the center rod 24 by the pin 34, upward motion of the upper frame member 20 is limited. FIGS. 1, 3, 6 and 9 are illustrative of the nail clipper 10 disposed in the fully open position. The upper frame member 20 is maximally away from the lower frame member 18 when the (fully assembled) nail clipper 10 is disposed in the open position. This is true after the nail clipper 10 has been fully assembled. Providing increased separation between the upper and lower frame members 20, 18 than is required when the nail clipper 10 is disposed in the open position is described in greater detail, below.

Conversely, when the cutting edge 12*a* of the upper blade 12 contacts the cutting edge 14*a* of the lower blade 14, the nail clipper 10 is disposed in the fully closed position. The upper frame member 20 and the lower frame member 18 are disposed maximally close to each other when the nail clipper 10 is disposed in the closed position. FIGS. 4, 7 and 10 are illustrative of the nail clipper 10 disposed in the closed position.

The downward first compressive force applied to the nail clipper 10 attempts to compress in a downward direction the plastic of the top planar surface 20*d* of the upper frame member 20 directly under the fulcrum 33. The downward first compressive force is applied by the fulcrum 33 of the lever 32 to the top planar surface 20*d* of the upper segment 20*k* as an upper portion, identified by bracket 32*a*, (FIG. 1) of the lever 32 is depressed (urged in the downward direction of arrow 50*b*.)

Concurrently, as the lever 32 is depressed, the opposite second compressive force is applied in an opposite, or upward direction, to the center rod 24 by the upward motion of a U-shaped area 32*c* of the lever 32 that is disposed forward of the fulcrum 33. The pin 34 passes through the pair of aligned pin openings 32*d*, 32*e* that are provided in opposite sides of the U-shaped area 32*c*. Between the aligned pin openings 32*d*, 32*e*, the pin 34 passes through the pin aperture 24*c* that is provided in the upper end 24*b* of the center rod 24. A bottom of the U-shaped area 32*c* is identified in FIG. 5 by bracket 32*m*.

As the lever 32 is further depressed the U-shaped area 32*c* is progressively raised and the increasing second compressive force prevents downward movement of the lower frame member 18. For certain embodiments of the invention, the second compressive force may flex and urge in an upward direction a modified version of the lower frame member 18. The enlarged head 24*a* of the center rod 24 applies the upward force to the bottom planar surface 18*c* of the lower frame segment 18*m* of the lower frame member 18. An underside of the enlarged head 24*a* attempts to upwardly compress the plastic of the bottom planar surface 18*c* of the lower frame member 18 that is disposed above the enlarged head 24*a*.

The downward first compressive force applied to the top planar surface 20*d* of the upper frame member 20 urges the upper frame member 20 in a downward direction, toward the lower frame member 18 as the downward first compressive force is transferred through the plastic below the fulcrum 33 and to the horizontal portion 30 of the upper blade 12. Simultaneously, the upward second compressive force that is applied to the bottom planar surface 18*c* of the lower frame member 18 prevents downward deflection (i.e., movement) by the lower frame member 18. The upward second compressive force is transferred through the plastic above the enlarged head 24*a* and to the horizontal portion 30 of the lower blade 14.

By this arrangement, excessive shear forces are not experienced by the upper frame member 20 or by the lower frame member 18 during a cutting of the nail 8. After transfer of forces by compression through the upper segment 20*k* and the lower segment 18*m* to the horizontal portion 30, the horizontal portions 30 of the blades 12, 14 provide stiffening and increased resistance to whatever shear force may be experienced in this area.

It is important to note that the downward and upward first and second compressive forces experienced by the plastic material of the upper frame member 20 and by the lower frame member 18 occur, respectively, over the horizontal portion 30 of the upper blade 12 and under the horizontal portion 30 of the lower blade 14. These first and second compressive forces are experienced as compressive forces because they occur over the horizontal portion 30 of the upper blade 12 (i.e., through the upper segment 20*k* of the upper frame member 20) and under the horizontal portion 30 of the lower blade 14 (i.e., through the lower segment 18*m* of the lower frame member 18). During cutting, force is not applied to any portion of the upper frame member 20 or to any portion of the lower frame member 18 of the nail clipper 10 that does not also include at least a portion of a respective one of the horizontal portions 30, therein.

If, by way of contrast as compared to the nail clipper 10, such force during cutting is applied to an imagined upper frame member or applied to an imagined lower frame member at a location that does not include a respective one the horizontal portions 30 of the blades 12, 14, therein (Note: this application of force does not occur with the nail clipper 10 as the horizontal portions 30 are present in the nail clipper 10), then the mechanism of transferring these cutting forces through the imagined upper and lower frame members to imagined blades that do not include the horizontal portion 30 would result in a substantial shear force occurring between the imagined upper and lower frame members and the beginning of the imagined blades. The necessary transfer of such a force, during use, from the unreinforced imagined upper and lower frame members (i.e., where the force is applied according to this example, which is included as an illustrative example in contrast to that of the current invention, and wherein the contrasting example includes a teaching that is in opposition to the structure and intent of the nail clipper 10) to each of the imagined blades would, in turn, result in a significant shear force being applied to the unreinforced plastic imagined upper and lower frame members. As a result, the unreinforced plastic imagined upper and lower frame members would likely fracture or bend in response to the excessive shear forces that would be experienced. This problem cannot occur with the disclosed nail clipper 10 because compression, rather than shear, is used to transfer force to the horizontal portion 30 of the blades 12, 14.

It is by design of the blades 12, 14 to include the horizontal portions 30, embedding the horizontal portions 30 in the front end 20*b* of the upper frame member 20 and in the front end 18*b* of the lower frame member 18, including sufficient length in the horizontal portions 30 to ensure that at least a portion of the horizontal portion 30 of the upper blade 12 is disposed under the fulcrum 33 and that at least a portion of the horizontal portion 30 of the lower blade 14 is disposed over the enlarged head 24*a* of the center rod 24, so that when these elements are included in combination together, the structure of the nail clipper 10 is able to provide the substantial and largely unexpected benefits disclosed herein.

By relying on the first and second compressive forces that are applied to the upper and lower frame members 20, 18 and by including the horizontal portions 30, the current arrangement avoids areas that could cause the nail clipper 10 to experience an excessive degree of shear force. Instead, the nail clipper 10 uses opposing compressive forces that occur in vertical alignment over a respective portion of each of the horizontal portions 30 of each of the blades 12, 14 to move the horizontal portions 30, which, in turn, then move the upper and lower frame members 20, 18, and the blades 12, 14, and their cutting edges 12*a*, 14*a* toward each other during cutting of the nail 8. Therefore, the nail clipper 10 is easily able to withstand the significant compressive forces (and minimal shear forces) that are experienced during use and to transfer the compressive forces to the blades 12, 14 for cutting of the nail 8.

During actual cutting of the nail 8, the first and second compressive forces are able to urge the opposing pair of cutting edges 12*a*, 14*a* of the blades 12, 14 of the nail clipper 10 through the nail 8 without causing damage to the frame 16. The plastic frame 16 experiences little stress during use and is used primarily to maintain the blades 12, 14 in parallel alignment with respect to one-another.

As mentioned herein, application of the first and second compressive forces applied over the horizontal portion 30 of the blades 12, 14 allows for the nail clipper 10 to be fabricated using a much wider array of polymers and non-metallic materials, thereby further decreasing cost. In particular, less expensive or a greater variety of elastomeric polymers can be used than would otherwise be possible. Not only does this result in a more durable device (i.e., the nail clipper 10) but it also allows the use of polymers and other non-metallic materials that, being more elastic, provide a more aesthetically pleasing feel to the nail clipper 10 during use. Further, less plastic (or other non-metallic material) is required because less strength and rigidity is required of any part of the frame 16 (i.e., any part of the upper and lower frame members 20, 18).

These and other significant benefits arising from the structure of the nail clipper 10, are described in greater detail, hereinafter, and are not available with prior art nail clippers and, in particular, with an all steel type of prior art device.

By way of comparison, prior art dual parallel opposing blade types of nail clippers that have frame members (not shown) that are exclusively made of steel and the blades (and their respective cutting edges) are also exclusively made of steel. Furthermore, the prior art steel blades are either integrally formed with the upper or lower frame members of the prior-art nail clippers or the steel blades are attachable to a steel frame in order to provide sufficient strength to withstand the stress caused primarily by shear force that occurs during cutting of a nail with a parallel type of blade cutting action. As a result, such types of prior art nail clippers include a significant amount of steel and require considerable machining which substantially increases their cost and weight. Additionally, a cutting edge of the described prior art upper steel blade must precisely align with a cutting edge of the prior art lower steel blade of the prior art nail clipper which further increases manufacturing cost when compared to the simplicity and low cost of manufacture and of aligning the cutting edges 12*a*, 14*a* of the upper and lower blades 12, 14 of the nail clipper 10.

The nail clipper 10 includes an optional pair of spaced-apart ledges 36*a*, 36*b* (FIGS. 6 and 9) disposed on each of the sidewalls 18*e*, 18*f*. The ledges 36*a*, 36*b* are optionally included to help protect the frame 16 of the nail clipper 10, the blades 12, 14, and the cutting edges 12*a*, 14*a* from damage in the event a user (not shown) continues to apply force to the lever 32, in the direction of arrow 50*b*, after the nail clipper 10 has reached the closed position. In particular, if the user applies excessive force to the lever 32 after the nail clipper 10 has reached the closed position, the ledges 36*a*, 36*b* support a bottom surface 20*c* of the upper frame member 20 at opposite sides of the upper frame member 20. The ledges 36*a*, 36*b* can extend as little or as much as desired along any portion of the container sidewalls 18*e*, 18*f*. The ledges 36*a*, 36*b* preclude further downward movement of the upper frame member 20 after the nail clipper 10 has been urged downward into the fully closed position. Preferably, the ledges 36*a*, 36*b* are located under at least a portion of horizontal portion 30, and preferably the ledges 36*a*, 36*b* extend the full depth of the horizontal portion 30. In this manner, the ledges 36*a*, 36*b* prevent damage from occurring, when excessive force is applied to the lever 32, to any portion of the upper frame member 20 or to the lower frame member 18. The ledges 36*a*, 36*b* can easily be included as part of the mold used to form the nail clipper 10 and the ledges 36*a*, 36*b* provide a significant structural benefit, when included.

FIGS. 7 and 10 show the left and right sides of the bottom surface 20*c* of the upper frame member 20 lightly making contact with (or disposed slightly above) the ledges 36*a*, 36*b* when the nail clipper 10 is disposed in the closed position. Additional downward pressure applied to the lever 32 in the direction of arrow 50*b* will firmly seat the left and right sides of the bottom surface 20*c* of the upper frame member 20 on the ledges 36*a*, 36*b*, thereby preventing additional downward movement by the upper frame member 20 from occurring if an even greater downward force is applied to the lever 32. Preventing additional downward movement will protect the nail clipper 10 from possible damage occurring to the frame 16 or to the cutting edges 12*a*, 14*a*.

Alternately, an upward support protrusion (not shown) that extends upward from a more central area of a top planar surface 18*d* of the lower frame member 18 could be used to preclude further downward movement by the upper frame member 20. If the upward support protrusion is included it is preferable for the reasons noted above that the upward support protrusion be disposed under as much of the depth of the horizontal portion 30, as possible.

By this structural arrangement, the upper and lower frame members 20, 18 experience minimal stress and minimal strain even if subjected to limited abuse. Therefore, the upper and lower frame members 20, 18 can be formed primarily (more than 50%) of any desired polymer, (plastic), or other non-metallic material, for example nylon, including using less material and/or a lesser grade (i.e., strength) of material for the frame 16 than would otherwise be possible without the horizontal portions 30 of the blades 12, 14 being embedded in the upper and lower frame members 20, 18.

The function of the frame 16 with the nail clipper 10 is primarily to maintain parallel alignment of the cutting edges 12*a*, 14*a* with respect to one-another. The forces experienced during cutting of prior-art steel-framed dual parallel opposing blade types of nail clippers are applied to the frame and then transferred through the frame of the prior art nail clipper to the blades of the prior art nail clipper predominantly as a shear force that occurs between the body where force is applied and the blades. The steel frame of the prior art nail clipper is able to withstand this level of shear.

Furthermore, the nail clipper 10 does not require critical mechanical tolerances during manufacture, is undetectable by most airport security screening technologies, and is exceptionally easy and inexpensive to manufacture. It is also considerably lighter in weight than prior art steel blade devices, and it provides other important advantages and benefits not available with the prior art devices, some of which are described, herein.

Referring now to FIG. 11 is a view in perspective that applies equally to either of the blades 12, 14. FIG. 16 is a bottom view of FIG. 11, taken along the line 16-16 of FIG. 11.

In order for the nail clipper 10 to operate reliably and withstand the forces experienced during cutting, the blades 12, 14 include a novel structure. The blades 12, 14, as mentioned above, include the horizontal portions 30 which prior art blades of prior art dual parallel opposing blade types of nail clippers do not include. The width and length of the horizontal portions 30 is a design variable. Therefore, any desired change regarding the width or the length or both the width and the length of the horizontal portions 30 is possible. For example if desired, the length of the horizontal portions 30 may be increased (or decreased) while decreasing (or increasing) the width of the horizontal portions 30.

As shown, the upper and lower cutting edges 12*a*, 14*a* are disposed along a straight line. The straight line design for the upper and lower cutting edges 12*a*, 14*a* is also reflected in FIGS. 1, 2, 3, 4, 5, 6, 7, 8, 19, 20, and 21. A modification that can be made to the upper and lower cutting edges 12*a*, 14*a* for possible use with all possible versions of the nail clipper 10 is discussed in greater detail, hereinafter, and is shown in FIGS. 15 and 17. Other possible blade modifications are also discussed, hereinafter.

Referring now momentarily to FIG. 14 and, in particular to view 14*f*1 of FIG. 14, a cross-sectional view of the upper cutting edge 12*a* is shown. If view 14*f*1 were turned upside down then it would be representative of the lower cutting edge 14*a*.

When the nail clipper 10 is disposed in the open position, the upper and lower cutting edges 12*a*, 14*a* (or 52*a*, 54*a*, see also FIG. 15) are parallel with respect to each other along both a horizontal axis and a vertical axis. In the open position the upper and lower cutting edges 12*a*, 14*a* (or 52*a*, 54*a*) are disposed away from each other a sufficient predetermined distance for insertion of the nail 8 (See FIG. 3). When the nail clipper 10 is disposed in the closed position, the upper and lower cutting edges 12*a*, 14*a* (or 52*a*, 54*a*) remain parallel with respect to each other along both the horizontal axis and the vertical axis. In the closed position, the upper and lower cutting edges 12*a*, 14*a* (or 52*a*, 54*a*) are disposed closer to each other than they are when the nail clipper 10 is disposed in the open position. It is generally preferred that the cutting edges 12*a*, 14*a* (or 52*a*, 54*a*) of the nail clipper 10 abut (i.e., touch) each other along most or all of their longitudinal length when the nail clipper 10 is disposed in the closed position. This helps to provide a cleaner cut for the nail 8. However if preferred, the cutting edges 12*a*, 14*a* (or 52*a*, 54*a*) of the nail clipper 10 may also include a slight overlap (not shown) when the nail clipper 10 is disposed in the closed position.

Referring momentarily to FIG. 7, where an enlarged front view of the nail clipper 10 is shown disposed in the closed position. The upper and lower cutting edges 12*a*, 14*a* abut one another along the entire longitudinal length of the cutting edges 12*a*, 14*a*. This is preferred as it provides the cleanest possible cut of the nail 8. However if desired, it is possible to include an offset (not shown) between the cutting edges 12*a*, 14*a* and/or to include a slight overlap of the offset between the cutting edges 12*a*, 14*a* when the nail clipper 10 is disposed in the closed position. However, the plane of each of the cutting edges 12*a*, 14*a* are always parallel with respect to each other.

FIG. 14 illustrates several other possible cross-sectional views (views 14*a*1 through 14*e*1) that illustrate possible variations which can be made to the cutting edges 12*a*, 14*a*, as desired. It is, of course possible, to further modify the cross-section of any of the blades 12, 14 as desired to include cross-sections other than as shown, or to combine portions of any of these cross-sectional views (such as a cross-section that includes one-half of view 14*a*1 and one-half of view 14*d*1) to create any desired cross-section, in this example, a curved line on one side and a straight line on the remaining side.

Experimentation with the cross-sectional shape of the cutting edges 12*a*, 14*a* is expected to result in further refinement of the shape or contour of the cutting edges 12*a*, 14*a* to produce the nail clipping 8*a* (See FIG. 4) that includes a sharper, cleaner cut (i.e., severed) edge, with a minimally ragged and/or torn appearance or texture. This is because it is desired that the nail 8, after cutting, include as clean and as sharp a cut edge as is possible. This would lessen an amount, and possibly even eliminate, the need for filing. A further objective to decrease the amount of filing required is satisfied by an improvement described hereinafter (see FIG. 11A).

The more gradual the taper from the cutting edge 12*a*, 14*a* to the full thickness 45 of the blade 12, 14 is made, the less is a magnitude of the horizontal force vector that is applied to the nail 8, during cutting of the nail 8 and therefore, also, attempting to urge the nail clipping 8*a* away from a remainder of the nail 8. As mentioned above, when the cutting edges 12*a*, 14*a* are urged deeper into the nail 8 during cutting of the nail 8, the increasing thickness 45 of the blades 12, 14 supplies an increasing magnitude to the horizontal force vector. Therefore, before the nail 8 is finally severed by the cutting edges 12*a*, 14*a*, it is actually torn apart from the remainder of the nail 8 and expelled away from the nail 8 at significant velocity.

It is desirable and another object of the invention to lessen the magnitude of the horizontal force vector to permit a maximum amount of cutting by the cutting edges 12*a*, 14*a* to occur while, at the same time, minimizing the tearing that occurs near a center of the nail 8 along the length of cut. Minimizing the horizontal force vector minimizes tearing which, in turn, results in a cleaner edge for the cut nail 8. When a cut nail (not shown) that has not been filed smooth accidentally brushes against the skin of another person, the other person is likely to feel discomfort from the sharp or ragged edge of the torn exterior of the cut nail.

Optimum design of the cross-sectional shape (i.e., cross-sectional contour) of the cutting edge 12*a*, 14*a* can minimize the tearing that occurs. This, in turn, can lessen and may even in certain instances eliminate the need to file the nail 8 after it has been cut using the nail clipper 10.

For example, an exaggerated-length taper of any of the cross-sectional views of FIG. 14, or of any other conceivable cross-sectional profile, may be preferred for the cutting edges 12*a*, 14*a* to minimize tearing of the nail clipping 8*a* apart from the nail 8 during cutting.

Referring now momentarily to FIG. 15 and FIG. 17 is shown an enlarged view in perspective of the modified upper blade 52 and the modified lower blade 54, for possible use in the nail clipper 10, as desired. The modified upper blade 52 and the modified lower blade 54 each include the curved modified cutting edge 52*a*, 54*a*. The modified upper blade 52 and the modified lower blade 54, like the upper and lower blades 12, 14, are used in pairs (for dual-blade versions of the invention) and either version (straight or curved) can be used with the nail clipper 10 or with any possible embodiment of the invention. It is a matter of design prerogative as to whether the upper and lower blades 12, 14 or the modified upper and lower blades 52, 54 are used or other blade improvements, as described hereinafter.

The modified cutting edges 52*a*, 54*a* are preferred for many versions of the nail clipper 10 because the curvature of the modified cutting edges 52*a*, 54*a* approximates a desired finished curvature for the nail 8 after the nail 8 has been cut.

If desired, the curvature of the modified cutting edges 52*a*, 54*a* can be varied to provide a range of finished curvatures for the nail 8, after cutting is completed. The modified cutting edges 52*a*, 54*a* provide the desired finished curvature for the nail 8 with a minimum number of cuttings for each nail 8. If the modified cutting edges 52*a*, 54*a* are a perfect match for the desired curvature and if a width of the modified cutting edges 52*a*, 54*a* equals or exceeds a width of the nail 8 prior to cutting, then it may be possible to obtain the desired curvature of the nail 8, after cutting, with only one cut being required for the nail 8 by the nail clipper 10. See FIGS. 65, 65A, 66, 66A, 66B, and 67 and also FIG. 11A for additional disclosure providing the desired finished curvature.

The modified cutting edges 52*a*, 54*a*, like the upper and lower cutting edges 12*a*, 14*a*, can include any desired cross-sectional shape as shown in FIG. 14 or any desired modification, thereto. FIG. 15 and FIG. 17 illustrate the modified blades 52, 54 as including the cross-sectional shape of illustration 14*d*1 of FIG. 14, although any desired cross-sectional shape is possible.

The upper blades 12, 52 and the lower blades 14, 54 are formed of a metal, such as steel, or any preferred sufficiently hard and rigid material, such as a ceramic or a sufficiently hard composite material capable of holding an edge for a sufficient period of time to provide a desired service life for the nail clipper 10. Additionally, whatever material is used to form the blades 12, 14, 52, 54 must be capable of providing the necessary mechanical (i.e., structural) support to the upper frame member 20 and to the lower frame member 18 from their respective horizontal portions 30. Whenever discussion herein makes reference to the blades 12, 14, it is understood that the modified blades 52, 54 could be used instead of the blades 12, 14, as desired. Similarly, whenever discussion herein makes reference to the modified blades 52, 54, it is understood that the blades 12, 14 could be used in place of the modified blades 52, 54. Other metals, alloys, composite materials, or non-metallic materials may also be used to form the blades 12, 14, 52, 54, however, the blades 12, 14, 52, 54 are formed of a dissimilar material as compared to a remainder (i.e., the frame 16) of the nail clipper 10.

It is important to note that the cardinal improvement to the blades 12, 14 and to the modified blades 52, 54 includes the inclusion of the horizontal portion 30 as an integral part of the blades 12, 14, 52, 54. Additionally, the cutting edge 12*a*, 14*a*, 52*a*, 54*a* is disposed on a first plane and the horizontal portion 30 is disposed on a second plane, where the second plane is disposed at an angle with respect to the first plane. The first plane is identified in FIGS. 11, 11A, and 15 by the vertical plane (bracket 12*g*, 14*g*). The second plane extends through a center of the horizontal portion 30. In particular, an angle exists between the first and second planes of the blades 12, 14, 52, 54 which permits as much as possible of the horizontal portions 30 to be embedded in the upper and lower frame members 20, 18 and therefore on the same or similar generally horizontal plane as the front ends 20*b*, 18*b* of the upper and lower frame members 20, 18, and wherein the first plane of the cutting edges 12*a*, 14*a*, 52*a*, 54*a* is more vertically disposed than is the second plane of the horizontal portion 30.

However as mentioned above, the majority of the frame 16, as compared to either the upper blade 12 or the lower blade 14, is formed of a different (i.e., a dissimilar) material than that used for either of the blades 12, 14 for all versions of the nail clipper 10.

It is also possible, and for certain versions of the nail clipper 10 may be desirable, to include any desired embedded metallic or non-metallic member to stiffen or reinforce any part of the nail clipper 10. For example, refer to FIGS. 22 and 25 to see various embedded members 32*b*, 32*j* (that are each embedded inside of a respective modified type of plastic lever, as shown and described, later).

The upper blade 12 and the lower blade 14 are preferably identical to minimize parts inventory and thereby help to lower cost of manufacture. If after benefit of these teachings for some reason it was desired to change either the upper blade 12 or the lower blade 14 so that they were not identical this is also, of course, possible though, as mentioned above, it is generally not preferred.

As the upper blade 12 and the lower blade 14 are preferably identical, all discussion and usage of the straight upper and lower blades 12, 14 apply equally to the modified blades 52, 54. In other words, for all possible embodiments of the current invention it is a design prerogative as to whether the blades 12, 14 are included or whether the modified blades 52, 54 (or any further modification or improvement to any of the blades 12, 14, 52, 54 are utilized).

It is to be understood that for any embodiment of the nail clipper 10 (or any modification made thereto) which refers specifically to the blades 12, 14 or to the modified blades 52, 54 that either may be used. Therefore, such omission of discussion in the detailed description does not preclude the use of any of the blades 12, 14, 52, 54.

As shown, the blades 12, 14, 52, 54 each include the center hole 22 through which the center rod 24 (See detail of center rod 24 in FIG. 12) passes. Referring also to FIG. 12, the center rod 24 includes the enlarged head 24*a*, attached at a bottom, thereof. A cylindrical body extends upward from the enlarged head 24*a*. The upper end 24*b* includes the pin aperture 24*c*, into which the pin 34 is inserted during manufacture along dashed line 34*c*. Additional assembly of the nail clipper 10 is described in greater detail, hereinafter. Certain alternate embodiments of the invention do not include the center rod 24 and, therefore, the center hole 22 can be eliminated from the blades 12, 14, 52, 54 for these embodiments.

The blades 12, 14, 52, 54 preferably include one or more means for securing the lower blade 14 (or 54) in position at or proximate the front end 18*b* (FIG. 1) of the lower frame member 18 and for securing the upper blade 12 (or 52) at or proximate the front end 20*b* (FIG. 1) of the upper frame member 20. Friction alone or friction in combination with other means or solely other means may also be used.

As shown in FIGS. 11 and 15, one or more optional securing holes 26 are preferably included, but not mandatory, that pass through each of the horizontal portions 30 of the blades 12, 14, 52, 54. Also shown are a pair of optional side indentations 28 in the horizontal portions 30 that may be included for securing the blades 12, 14, 52, 54 to the respective upper and lower frame members 20, 18. Protrusions (not shown) or indentations (not shown) may similarly be included in the horizontal portions 30 to help secure the blades 12, 14 (52, 54) in position or in the upper and lower frame members 20, 18.

During manufacture and molding, preferably at least some of the material comprising the upper and lower frame members 20, 18 (i.e., plastic or other non-metallic material) flows through any or all of the securing holes 26 that are included and/or through and around any or all of the side indentations 28 that are included, thereby securing the blades 12, 14, 52, 54 in position with respect to the front ends 18*b*, 20*b* of the upper and lower frame members 20, 18.

The center rod 24 that passes through the center hole 22 of each of the blades 12, 14, 52, 54 also helps to secure the blades 12, 14, 52, 54 in position in the upper and lower frame members 20, 18. If desired, the center hole 22, in combination with the center rod 24, may be used to secure the blades 12, 14, 52, 54 in a desired position in the upper and lower frame members 20, 18 without additional means. The desired position is as shown in all of the drawing FIGURES and occurs when the cutting edges 12*a*, 14*a*, 52*a*, 54*a* abut each other along their length (i.e., when they are in parallel alignment with respect to each other and the upper and lower cutting edges 12*a*, 14*a*, 52*a*, 54*a* are in contact with each other) when the nail clipper 10 is disposed in a closed position, as shown in FIGS. 4 and 7 for example.

An alternate and generally less-desired position occurs when the cutting edges 12*a*, 14*a*, 52*a*, 54*a* include a slight overlap with respect to each other along their length (i.e., when they are in parallel alignment with respect to each other and when the upper and lower cutting edges 12*a*, 14*a*, 52*a*, 54*a* include a slight horizontal and/or a slight vertical offset with respect to each other—not shown). The nail clipper 10 (or any embodiment, thereof) would still function, however, it could result in a more ragged (i.e., torn) cut for the finished nail 8, as previously mentioned.

The upper blade 12 (or 52) is embedded into the front end 20*b* of the upper frame member 20 and the lower blade 14 (or 54) is similarly embedded into the front end 18*b* of the lower frame member 18. Where either the blades 12, 14 or the modified blades 52, 54 are described herein it is understood that either may be used, as desired. Preferably during manufacture, the upper and lower frame members 20, 18 are molded over at least a part of the horizontal portion 30 of each of the blades 12, 14, 52, 54. After fabrication by any means, plastic or another non-metallic material adjoins (i.e., covers) the horizontal portions 30 proximate at least a portion of the top blade surface 12*f*, 14*f* and/or at least a portion of a bottom blade surface 12*b*, 14*b*, and/or at least a portion of either or both of a pair of opposing sidewalls 12*c*, 12*d*, 14*c*, 14*d*, and/or at least a portion of a rear sidewall 12*e*, 14*e*.

Preferably, the plastic covers and surrounds the horizontal portion 30 over the top blade surface 12*f*, 14*f*, and over the bottom blade surface 12*b*, 14*b*, and over the pair of opposing sidewalls 12*c*, 12*d*, 14*c*, 14*d*, and over the rear sidewall 12*e*, 14*e*, as shown in FIGS. 2, 3, 4, 6, 7, 9 and 10. This full or complete embedding of the blades 12, 14 (or the modified blades 52, 54) is generally preferred for various reasons. One reason is that none of the horizontal portion 30 is visible with full or complete embedding, and this results in an appearance that is especially aesthetically pleasing. Also, full or complete embedding of the horizontal portion 30 of the blade 12, 14 may result in greater strength for the upper and lower frame members 20, 18 than would occur with a partial embedding. However, any desired degree of latitude in variation in the amount and location of plastic (or other non-metallic material) that extends over any length of the horizontal portion 30 is possible for assembly of the nail clipper 10, as desired as long as the blades 12, 14 (52, 54) are sufficiently secured to the upper and lower frame members 20, 18.

Refer now momentarily to FIG. 18 where an enlarged cross-sectional view of the first modified dual parallel opposing blade embedded member nail clipper 100, hereinafter referred to as the "first modified nail clipper 100," is shown. FIG. 18 is taken through the center rod 24, looking toward the rear, similar to view of the nail clipper 10 shown in FIG. 9. The first modified nail clipper 100 is similar to the nail clipper 10, however, the first modified nail clipper 100 includes a modified embedded position for the blades 12, 52, 14, 54. As shown in FIG. 18 the plastic extends over the top blade surface 12*f*, 14*f* of the horizontal portion 30 of both of the blades 12, 14, while not entirely extending (i.e., not covering) all of the bottom blade surface 12*b*, 14*b*. With this type of partial embedding the bottom blade surface 14*b* (of the lower blade 14) is either flush with or protruding slightly above the top planar surface 18*d* of the lower frame member 18. Similarly, the bottom blade surface 12*b* (of the upper blade 12) is either flush with or protruding slightly below the bottom planar surface 20*c* of the upper frame member 20.

To better secure the blades 12, 14 of the first modified nail clipper 100 in position, during fabrication (i.e., molding) plastic is preferably allowed to flow through the securing holes 26. By allowing extra space in a mold (not shown) additional plastic could be included to form an enlarged cap (i.e., a crown) 26*a* proximate each of the securing holes 26. As shown, the enlarged cap 26*a* includes a shaped that resembles a cap of a mushroom (not shown) or a rivet head (not shown). As many securing holes 26 as desired can be included in the blades 12, 14.

If desired, fasteners (such as screws) could be used in lieu of the enlarged caps 26*a*. If included, the fasteners (i.e., small screws) could pass through the securing holes 26 and into screw openings (not shown) that are provided in the upper and lower frame members 20, 18 under the securing holes 26. Screw threads of the screws would engage with the screw openings to embed, and thereby secure, the blades 12, 14 against the upper and lower frame members 20, 18. Alternately or in conjunction with other means, an adhesive could be used on the top blade surface 12*f*, 14*f* and/or on the opposing sidewalls 12*d*, 14*d* to secure the blades 12, 14 in position. Either alone or in conjunction with other means, friction between the opposing sidewalls 12*d*, 14*d* of the blades 12, 14 and the adjoining portions of the upper and lower frame members 20, 18 may be used as a further alternative means for securing the blades 12, 14 of the first modified nail clipper 100 in position. Also, including a protrusion in the upper and/or lower frame members 20, 18 that engages with the side indentations 28 may be used to increase friction or to better secure the blades 12, 14 in position.

Numerous alternative positions and means of attachment (i.e., means for securing) of the blades 12, 14 consistent with the cardinal teaching herein, are possible for the first modified nail clipper 100. Additionally, any means for securing the blades 12, 14 to the upper and lower frame members 20,

18 disclosed herein or which would be obvious to those having ordinary skill in the art after benefit of this disclosure that is consistent with the teachings herein is available for use with the nail clipper 10 or the first modified nail clipper 100 as desired, or with any possible alternative embodiment of the invention.

The cardinal teaching for all embodiments of the nail clipper 10 or the first modified nail clipper 100 or any other possible variation/embodiment thereof, whether specifically disclosed herein or not, requires that the horizontal portion 30 of the upper blade 12, (and preferably for the lower blade 14) extend sufficiently far into the upper and lower frame members 20, 18 so that a portion of the horizontal portion 30 of at least one of the blades 12 (the upper blade 12) is disposed in the upper frame member 20 and is in vertical alignment with the downward first compressive force applied by the fulcrum 33 of the lever 32, and preferably so that a portion of the horizontal portion 30 of a remaining one of the blades 14 (the lower blade 14) is disposed in the lower frame member 18 and is in vertical alignment with the upward second compressive force applied by the enlarged head 24*a* of the center rod 24.

If this cardinal teaching is satisfied (i.e., the horizontal portion 30 of at least the upper blade 12 (or 52) extends beyond the location of a downward force that is applied to the upper frame member 20), an amount of shear stress that is experienced by the upper frame member 20 (and if constructed as shown for any of the embodiments, also for the lower frame member 18) during cutting of the nail 8 is sufficiently decreased to then permit fabrication of the upper and lower frame members 20, 18 primarily (over 50%) from plastic or from another preferred non-metallic material. This, in turn, provides numerous benefits and advantages, many of which are unexpected, and it provides an ability to expand both utility and aesthetics of the nail clipper 10 or the first modified nail clipper 100 in ways not previously available. Fabrication of the nail clipper 10 or the first modified nail clipper 100 (or any other embodiment, thereof) in a manner consistent with this cardinal teaching overcomes a long-standing need that has not been adequately satisfied before the current invention.

It is important to note that a further modification to the nail clipper 10 (or to any modified dual parallel opposing blade embodiment, thereof) is possible that would allow for shortening or possibly for the elimination of one of the horizontal portions 30, specifically for the lower blade 14 or for the lower modified blade 54. This is because the (vertical) container sidewalls 18*e*, 18*f* that are attached to the lower frame member 18 provide significant stiffening for the lower frame member 18. The stiffening provided by the container sidewalls 18*e*, 18*f* resists flexing by the lower frame member 18 during use. Accordingly, during use it is primarily the upper frame member 20 of the nail clipper 10 that flexes.

The stiffening provided to the lower frame member 18 by the container sidewalls 18*e*, 18*f* also significantly increases the lower frame member's 18 ability to resist the application of shear force to the lower frame member 18. Therefore, inclusion of the embedded horizontal portion 30 of the lower blade 14 (or 54) past the center rod 24 can be eliminated, if desired. In other words, it is possible to include a modified horizontal portion (not shown) that is shorter in length than the horizontal portion 30 for the lower blade 14 (or for the lower modified blade 54) and for the modified lower frame member (not shown) that includes the container sidewalls 18*e*, 18*f* and the shorter horizontal portion 30 to provide sufficient strength and structural integrity to function properly. The stiffening provided by the container sidewalls 18*e*, 18*f* can, instead, be used to stiffen and provide increased resistance to shear for the modified lower frame member.

It is also possible to include the (shortened horizontal portion 30 length) modified blade and provide sufficient stiffening to the lower frame member 18 by means other than the use of the container sidewalls 18*e*, 18*f* or in addition to the use of the container sidewalls 18*e*, 18*f*. For example, the lower frame member 18 could be modified so that it was considerably thicker, or to include a different or a modified embedded member other than the horizontal portion 30 that is embedded therein, or by the use of a stiffer material added to or blended in with the non-metallic material. In particular, refer momentarily to FIGS. 58A, 58B, 59, 59A, 59B, and 61 that illustrate various alternative embedded discreet members and other possible modifications to the horizontal portion 30 of the blades 12, 14, 52, 54. These and other means may be used to form the resulting modified lower frame member that eliminates the need for a longer horizontal portion 30 of the lower blade 14 (or 54).

It is also possible to invert the nail clipper 10 along with the preceding teachings. See FIGS. 30 and 31 and an accompanying description, hereinafter. In this example, an inverted lower frame member 818 must be able to flex between the open and closed positions. Therefore, the inverted lower frame member 818 must include the lower blade 14 (or the modified lower blade 54) that also must include the horizontal portion 30 that extends beyond a vertical line where a force that causes the inverted lower frame member 818 to flex is applied. Although it is preferred that an inverted upper frame member 820 include the upper blade 12 (or the modified upper blade 52) that also includes the horizontal portion 30 it is possible to use a shorter horizontal portion 30 and rely on a pair of inverted sidewalls 820*e* and 820*f* to provide increased strength and resistance to shear for the inverted upper frame member 820.

What is essential for operation of the nail clipper 10 (or any embodiment of the invention) is that either the upper frame member 20 or the lower frame member 18 is able to flex enough for the nail clipper 10 to be repeatedly urged from the open position to the closed position and back again. It is also possible that both may flex equally. See FIGS. 32, 32A and 32B. When only one of the frame members (20 for the nail clipper 10, 820 for the eighth modified nail clipper 800) experiences the bulk of the flexing that occurs, then that frame member (20, 820) must include the horizontal portion 30. Although preferred, the horizontal portion 30 may be eliminated from inclusion in the opposite frame member (18, 818) and the shorter horizontal portion may instead be utilized if the opposite frame member (18, 818) is sufficiently stiff.

The use of friction as an alternative means for securing the blades 12, 14 in the upper and lower frame members 20, 18 is additionally described, hereinafter, along with a description of the embodiment of FIG. 33.

Continuing to refer on occasion to FIGS. 1, 6 and 9 and especially to FIG. 3, each of which is illustrative of the nail clipper 10 disposed in the open position. Hysteresis of the plastic or other material used to fabricate the frame 16 and disposed at the distal end 18*a* of the lower frame member 18 and at the distal end 20*a* of the upper frame member 20 (i.e., at the vertical rear wall 19) supplies a force that is normally urging the upper frame member 20 upward and away from the lower frame member 18. If desired, a wedge (not shown) and/or a spring (not shown) may be included between the upper and lower frame members 20, 18 to supply an even greater separating force. Refer also to co-pending patent application Ser. No. 13/385,701, which is included herein by way of reference, for additional information regarding the use of the spring and/or wedge. Different polymers exhibit different properties, including different elastomeric characteristics and/or different amounts of hysteresis. The polymer (plastic) or other non-metallic material that is chosen for the frame 16 is selected, as desired, to include whatever properties are deemed to be most important. It is also possible to include a plurality of non-metallic materials to fabricate the frame 16 or other component parts of the nail clipper 10, or other embodiment. For example, the frame 16 could be fabricated (molded) from any desired polymer or plurality of polymers that also includes a fiberglass or other webbing or filament embedded where desired, for added stiffening and increased hysteresis. See FIGS. 62 and 63 for additional disclosure regarding the use of reinforcing strands. Alternately, the upper frame member 20 could be formed from a first type of polymer, the lower frame member could be formed from a second type of polymer, and the rear wall 19 could be formed from a third type of polymer or other variation. If desired, a non-metallic material other than a polymer could be used in lieu of the first, second or third type of polymer to form the greater portion (i.e., more than 50%) of these component parts of the nail clipper 10.

The maximum amount of separation between the upper and lower frame members 20, 18, as mentioned above, is limited after assembly by the length of the center rod 24, and by its positional attachment to the lever 32.

Prior to a completion of manufacture, before inclusion of the center rod 24, the upper frame member 20 must be minimally capable of being urged upward (away from the lower frame member 18) into the fully open position, as shown in FIGS. 1, 3, 6, and 9. The magnitude of available hysteresis can also be increased by including an even greater separation than is required when the nail clipper 10 is disposed in the open position between the front end 20*b* of the upper frame member 20 and the front end 18*b* of the lower frame member 18 during molding of the frame 16. Inclusion of a greater separation during formation of the frame 16 increases the inherent magnitude of hysteresis that urges the upper and lower frame members 20, 18 apart. After assembly, when the nail clipper 10 is disposed in the open position, the upper frame member 20 is preferably disposed closer to the lower frame member 18 than they are disposed prior to assembly of the nail clipper 10 (in particular, prior to inclusion of the center rod 24 and attachment of the lever 32, thereto). In other words, after formation of the upper frame member 20 and the lower frame member 18 hysteresis is tending to urge the upper frame member 20 and the lower frame member 18 further apart than they are disposed after attachment of the lever 32 to the center rod 24 has occurred (i.e., than when the nail clipper 10 is disposed in the open position). Therefore, when the nail clipper 10 is disposed in the open position, hysteresis is attempting to urge the upper frame member 20 and the lower frame member 18 further away from each other, but this is prevented by cooperation of the center rod 24 and the lever 32 acting on the lower frame member 18 and the upper frame member 20. This added separation force ensures that sufficient tension is present at a bottom of the U-shaped recessed area 32*c* of the lever 32 to maintain the lever 32 as shown when the nail clipper 10 is disposed in the open position.

The plastic (or other non-metallic) material used to form the upper and lower frame members 20, 18 is, to a certain degree, innately flexible. The flexibility of the upper and/or lower frame members 20, 18 correspond with an inherent elasticity of the material(s) used to form the upper and lower frame members 20, 18 and, additionally, to the manner in which the upper and lower frame members 20, 18 are attached to a remainder of the nail clipper 10. Innovative options for varying flexibility of the upper frame member 20 and/or the lower frame member 18 by various means are disclosed, herein. Hysteresis, as used herein, refers to an inherent tendency of the material that is used to form the upper and lower frame members 20, 18, to return to the respective original positions that they first had after molding (i.e., after the frame 16 has initially been formed and/or assembled). Therefore, as used herein, the term "hysteresis" refers to the inherent flexibility or elasticity of the plastic or other non-metallic material used to form the upper frame member 20 and/or the lower frame member 18 as supplying a force that is always attempting to urge the upper and lower frame members 20, 18 apart from each other and into their original positions.

Additionally, it may be desirable to form portions of the frame 16 of the nail clipper 10 out of two or more different non-metallic materials that are layered. For example, the inclusion of an overlay 80 (shown in dashed lines in FIG. 19) of a more elastomeric non-metallic material can be applied over, under, or in-between any desired portion of the nail clipper 10. The overlay 80 may be applied to an exterior of the frame 16 and used to provide a softer, more compliant feel to the nail clipper 10 or an enhanced appearance. The size of the optional overlay 80, as shown in FIG. 19, can be increased or decreased, as desired. The overlay 80 may be strategically applied, where desired, to the nail clipper 10. Alternately, the overlay 80 may include an interior overlay portion 80*a* as shown in angled lines that is disposed between the upper and lower frame members 20, 18 proximate their distal ends 20*a*, 18*a* to provide additional force for urging the upper and lower frame members 20, 18 apart and the nail clipper 10 into the open position. The interior overlay portion 80*a* acts as a wedge (as previously described) to help urge the upper and lower frame members 20, 18 apart. The interior overlay portion 80*a* may be connected to the exterior overlay 80 or not, as desired.

Therefore, either sufficient hysteresis and/or additional means, such as the overlay portion 80, the interior overlay portion 80*a*, the spring and/or the wedge or other means are included, as desired, to supply whatever force is necessary to urge the upper frame member 20 apart from the lower frame member 18 an amount sufficient to place the nail clipper 10 in the open position, when desired. Alternately as desired, the amount of plastic (or other material) included at or proximate the vertical rear wall 19 during molding can also be increased to provide an increased amount of hysteresis (force) as desired to urge the upper frame member 20 upward and away from the lower frame member 18 a sufficient amount.

It is also possible to increase the amount of attachment of the upper frame member 20 proximate the vertical rear wall 19 if increased stiffness and increased hysteresis for the upper frame member 20 is desired. Referring to FIG. 1 a pair of gaps, identified in general by the reference numeral 81, exists between each of the vertical planar surfaces 20*g*, 20*h* of the upper frame member 20 and the vertical interior surfaces of the first and second container sidewalls 18*f*, 18*e*, respectively. A first distal end 81*a* of each of the two gaps 81 is preferably disposed the same distance from the plane of the rear wall 19 to prevent possible rotation of the upper frame member 20 with respect to the lower frame member 18 as the upper frame member 20 is urged toward the lower frame member 18 (i.e., when the nail clipper 10 is urged into the closed position).

A possible alternate location for a modified pair of second distal ends of the gaps 81 is shown by dashed line 81*b*. If the longitudinal length of the gaps 81 were shortened to instead end at the second distal end (i.e., at dashed line 81*b*) instead of at the first distal end 81*a*, a greater amount of the upper frame member 20 would be attached to the first and second container sidewalls 18*e*, 18*f* (during molding of the frame 16) and therefore the upper frame member 20 would include a shorter longitudinal length (along the gaps 81) that was available for flexing. The upper frame member 20 is intended to flex primarily along the length of the gaps 81. However, the upper frame member 20 strongly resists any flexing along the length of the horizontal portion 30 which stiffens the upper frame member 20. Therefore, the bulk of flexing occurs between a rear of the horizontal portion 30 and the first distal end 81*a* (or at dashed line 81*b* if the gap 81 length is shortened). All other variables not changing, the possible location for the pair of second distal ends (i.e., along dashed line 81*b*) can be used to increase stiffness and hysteresis of the upper frame member 20 as compared to if the two gaps 81 were extended and disposed at the first distal ends 81*a*. Accordingly, shortening the length of the gaps 81 can be used to increase hysteresis force as well as stiffness and thereby to decrease flexibility while a lengthening of the gaps 81 can be used to decrease hysteresis force as well as stiffness and increase flexibility of the upper frame member 20.

If, prior to completion of manufacture (i.e., prior to inclusion of the center rod 24 and the lever 32) a sufficient force urging the upper frame member 20 in an upward direction away from the lower frame member 18 is available (by hysteresis, the spring, or the wedge or by any preferred means or combination, thereof), the upper frame member 20 may rise above the fully open position. That is, in fact, likely to occur. It may, therefore, be necessary during assembly (i.e., manufacture) of the nail clipper 10 to first slightly urge the upper frame member 20 downward, toward the lower frame member 18, in order to then properly insert the center rod 24 and attach the lever 32 to the center rod 24 by inserting the pin 34 through the pair of aligned pin openings 32*d*, 32*e*. However, after inclusion of the center rod 24 and attachment of the lever 32 to the center rod 24 has occurred during manufacture of the nail clipper 10, the maximum upward movement of the upper frame member 20 will be limited to that as defined by the fully open position.

FIG. 3 shows the nail 8 disposed slightly away from the blades 12, 14. Prior to cutting of the nail 8, the user will urge the nail 8 in the direction of arrow 37 until either the nail 8 has been urged a desired distance in the direction of arrow 37 or until a fleshy portion 9*a* of a finger 9 of the user contacts an optional safety bumper, identified in general by the reference numeral 39. The safety bumper 39 extends below and forward of the cutting edge 14*a* of the lower blade 14, and is used to limit the depth of cut of the nail 8 that is possible. Different contours and projections of the safety bumper 39 are, of course, possible to provide a different overall length of the nail 8 after it has been cut. Refer again to co-pending patent application Ser. No. 13/385,701 for additional information regarding the safety bumper 39.

The first and second container sidewalls 18*e*, 18*f* each optionally include, at a forward end, thereof, between the front end 18*b* of the lower frame member 18 and the front end 20*b* of the upper frame member 20, a first nail recess 41*a* disposed in the first container sidewall 18*e* and a corresponding second nail recess 41*b* (See FIGS. 3 and 7) disposed in the second container sidewall 18*f*. The first and second nail recesses 41*a*, 41*b*, being part of the first and second container sidewalls 18*e*, 18*f*, are disposed in a spaced-apart orientation with respect to each other. The first and second nail recesses 41*a*, 41*b* allow the nail 8 to be inserted a greater distance in the direction of arrow 37, as desired, providing that sufficient contact of the fleshy portion 9*a* of the finger 9 with the safety bumper 39 does not occur before the nail 8 has been maximally inserted between the cutting edges 12*a*, 14*a*.

The first and second nail recesses 41*a*, 41*b* thereby permit more of the nail 8 to be removed during each cutting (i.e., a larger nail clipping 8*a*), thereby possibly lessening a time required to cut the nail 8.

FIG. 6 is front view of the nail clipper 10 of FIG. 3 disposed in the open position and FIG. 6 shows additional detail of its construction. Select aspects of the nail clipper 10 are shown in dashed lines throughout this disclosure to better reveal its construction. For example in FIG. 6, the top blade surface 12*f* of the horizontal portion 30 of the upper blade 12 is shown in a solid line and the bottom blade surface 12*b* of the upper blade 12 is shown in a dashed line. Similarly, the top blade surface 14*f* of the bottom blade 14 is shown in a solid line and the bottom blade surface 14*b* of the bottom blade 14 is shown in a dashed line. The top blade surfaces 12*f*, 14*f* and the bottom blade surfaces 12*b* 14*b* extend along the entire width and length of the horizontal portions 30 of the blades 12, 14.

The bottom surface 20*c* of the upper frame member 20 is shown in a dashed line (under the vertical portion or vertical plane 12*g* of the upper blade 12) and in solid lines on opposite sides of the blade 12. The top planar surface 18*d* of the lower frame member 18 is shown in a dashed line (under the vertical portion or vertical plane 14*g* of the lower blade 14). The bottom planar surface 18*c* of the lower frame member 18 is shown in a solid line. The area provided by the first and second nail recesses 41*a*, 41*b* is shown in solid lines.

During manufacture of the blades 12, 14, a bend of approximately ninety degrees, plus or minus any desired amount, is provided between the (first) vertical plane 12*g*, 14*g* that the cutting edges 12*a*, 14*a* are disposed on and the second horizontal plane of the horizontal portions 30. Inclusion of the horizontal portion 30 and a change in angle between the vertical plane 12*g*, 14*g* of the cutting edges 12*a*, 14*a* and the second horizontal plane of the inventive horizontal portion 30 is an improvement in design over prior art nail clipper opposing parallel blade design.

Additionally, a portion of the pin 34 that is not visible in FIG. 3 is also shown in dashed lines in FIG. 6. Also, portions of the center rod 24 not visible in certain of the FIGURE drawings are shown in dashed lines in FIG. 6.

The optional pair of ledges 36*a*, 36*b*, are included as molded inward extensions of the first and second container sidewalls 18*e*, 18*f* and are visible below the bottom surface 20*c* of the upper frame member 20. Therefore, the ledges 36*a*, 36*b* are disposed away from and, accordingly, do not contact the bottom surface 20*c* of the upper frame member 20 when the nail clipper 10 is disposed in the open position.

FIG. 9 is a cross-sectional view of the nail clipper 10 in the open position taken vertically through the center rod 24. The horizontal portions 30 of the upper and lower blades 12, 14 are shown embedded in the upper and lower frame members 20, 18, respectively and extending further into the body of the upper and lower frame members 20, 18. See also FIGS. 3, 4, and 5. Therefore, a portion of the horizontal portion 30 of the lower blade 14 is disposed in vertical longitudinal alignment with respect to the center rod 24. This, in turn, ensures that a lesser magnitude of shear force is experienced by the lower frame member 18 than would occur if the horizontal portion 30 did not extend beyond the position of the center rod 24. FIGS. 3, 4, and 5 show that the horizontal portions 30 of the upper blade 12 of the nail clipper 10 extend beyond (i.e., further to the rear) of a vertical dashed fulcrum line 33*b* (FIG. 4) that passes through the fulcrum 33 of the lever 32. This, in turn, ensures that a lesser magnitude of shear force is experienced by the upper frame member 20 than would occur if the horizontal portion 30 did not extend beyond the position of the fulcrum 33. See also FIGS. 19, 20 and 21 for alternate embodiments of the invention that also include horizontal portions 30 that extend rearward of each of the center rods 24 and rearward of each of the fulcrums 33.

Also, clearly shown in FIG. 9 are the optional pair of ledges 36*a*, 36*b* that are included, respectively in the first container sidewall 18*e* and the second container sidewall 18*f*. As shown, the ledges 36*a*, 36*b* include a contour that corresponds with a bottom contour of the upper frame member 20 disposed above each of the ledges 36*a*, 36*b*. If included, the ledges 36*a*, 36*b* are preferably disposed between the horizontal portions 30 of the blades 12, 14 where maximum strength of the upper and lower frame members 20, 18 occurs. The ledges 36*a*, 36*b* help to prevent unwanted tilting or bending of the upper and lower frame members 20, 18 at this important area when excessive force is applied to the lever 32 after the nail clipper 10 has reached the closed position.

Referring again also to FIG. 3, the ledge 36*a* that is included in the first container sidewall 18*e* is shown as a dashed line. It is important to note that the ledges 36*a*, 36*b* can easily be included in the nail clipper 10 by molding the ledges 36*a*, 36*b* as integral component parts of the sidewalls 18*e*, 18*f* of the lower frame member 18. This is true whether the frame 16 is of a one-piece design, as shown for the nail clipper 10, or if it is a two-piece design. Inclusion of the ledges 36*a*, 36*b* or providing any other supplemental means (in addition to contact of prior art cutting edges with one-another) that limit approach of the upper and lower frame members 20, 18 toward each other or which prevent damage from excessive pressure being applied, are not previously known for dual parallel opposing blade types of nail clippers.

It is also important to note that the inclusion of the sidewalls 18*e*, 18*f*, whether as separate component parts or as integral component parts of the lower frame member 18, is also not previously known for this type of device. However, it is a relatively simple matter to include the sidewalls 18*e*, 18*f* in the basic mold that provides the lower frame member 18, whether the frame 16 is of one-piece construction, as is the case with the nail clipper 10 or if the frame 16 is of a two-piece construction (See FIGS. 27 and 28 for an example of two-piece construction).

Inclusion of the sidewalls 18*e*, 18*f* and disposing the upper frame member 20 between the sidewalls 18*e*, 18*f* promotes proper operation of the upper frame member 20 to be urged downward during cutting, toward the lower frame member 18 until the nail clipper 10 is disposed in the closed position, and then upward again to the open position by permitting vertical movement of the upper frame member 20 to occur between the two opposing sidewalls 18*e*, 18*f*.

This structure also provides a container area disposed in an interior of the nail clipper 10 when the nail clipper 10 is disposed in the open and in the closed position (and anywhere in-between). When the nail clipper 10 is disposed in the closed position the cutting edges 12*a*, 14*a* abut each other and thereby provide a closure at the front end of the container area. The interior surfaces of the opposing sidewalls 18*e*, 18*f* provide closure along the sides of the container area. The bottom surface 20*c* of the upper frame member 20 provides closure along the top of the container area. The top planar surface 18*d* of the lower frame member 18 provides closure along the bottom of the container area. The rear vertical wall 19, if included, provides closure of the container area at the rear of the nail clipper 10. If the rear wall 19 is omitted on a modified version of the invention, the area where the upper frame member 20 is attached to the lower frame member 18 at the distal ends 20*a*, 18*a*, respectively, provides alternate means for closure of the container area at the rear. Accordingly, the container area of the nail clipper 10 is able to capture the nail clipping 8*a*, therein.

Additionally, at the moment the nail clipping 8*a* is severed apart from the nail 8, the nail clipping 8*a* is ejected into the container area where it is captured. After continued use numerous nail clippings 8*a* will accumulate in the interior (i.e., container area) of the nail clipper 10. To remove the nail clippings 8*a* from the container area, the nail clipper 10 is disposed in the open position and held over a waste-basket (not shown) with the blades 12, 14 facing downward. The nail clipper 10 is then shaken up and down until all or a sufficient number of the nail clippings 8*a* have fallen out of the nail clipper 10 from between the cutting edges 12*a*, 14*a* and into the waste-basket.

In order for the container area (that is created by the container sidewalls 18*e*, 18*f*, the upper frame member 20, the lower frame member 18, the vertical rear wall 19, and at the front blades 12, 14) to effectively capture the nail clipping 8*a*, the container sidewalls 18*e*, 18*f* must extend upward from the lower frame member 18 toward the upper frame member 20 an amount sufficient for the upper edges 18*e*1, 18*f*1 of the container sidewalls 18*e*, 18*f* to at least reach, and preferably overlap, the bottom surface 20*c* (or sides) of the upper frame member 20 when the nail clipper 10 is disposed in the closed position. This helps to ensure that the nail clipping 8*a*, at the moment of its being severed from a remaining portion of the nail 8, will be captured in the container area. To better retain the nail clipping 8*a* in the container area it is preferable to extend the container sidewalls 18*e*, 18*f* higher so that the upper edges 18*e*1, 18*f*1 of the container sidewalls 18*e*, 18*f* at least reach the bottom surface 20*c* of the upper frame member 20 when the nail clipper 10 is disposed in the open position. This helps retain the nail clipping 8*a* in the container area until deliberate discharge of the nail clipping 8*a* from the container area is desired.

However, other important benefits are provided by extending the container sidewalls 18*e*, 18*f* further upward so that at least a portion of the upper edges 18*e*1, 18*f*1 correspond in elevation with the top planar surface 20*d* of the upper frame member 20. This helps prevent undesired movement by the lever 32 during cutting of the nail 8. Further benefits are obtained by further elevating the upper edges 18*e*1, 18*f*1 of the container sidewalls 18*e*, 18*f* above the top planar surface 20*d* as shown in FIGS. 62 and 63 and later described.

To understand the purpose of the ledges 36*a*, 36*b*, additionally refer to FIGS. 4, 7, and 10 which show the nail clipper 10 disposed in the closed position. The nail 8 is not shown in FIG. 4, however the nail clipping 8*a* is shown disposed in the container area (i.e., in an interior portion) of the nail clipper 10. This is consistent with normal usage because after insertion of the nail 8, as previously described, between the cutting edges 12*a*, 14*a* and after having fully depressed the lever 32 in the direction of arrow 50*b* (FIG. 4), the nail clipper 10 will be disposed in the closed position and the nail clipping 8*a* will be captured in the container area (interior) of the nail clipper 10. Capture of the nail clipping 8*a* is generally preferred because it provides an environment that is free of a scattering of the nail clippings 8*a*. After the nail clipping 8*a* has been produced, it is assumed that cutting of the nail 8 is now complete. The finger 9 and nail 8 will then be pulled back and away from the nail clipper 10. If additional nails 8 (not shown) are to be cut or if the nail 8 is to be further cut, the previously described and illustrated process is repeated as often as needed.

When the nail clipper 10 is disposed in the closed position, the bottom surface 20*c* of the upper frame member 20 is disposed even with or it is disposed slightly above the top of the ledges 36*a*, 36*b*. Referring momentarily now to FIGS. 3 and 4, the ledge 36*b* is disposed within the container area (interior) of the nail clipper 10 and is, therefore, hidden from view. The opposite ledge 36*a* that is included as an integral part of the first container sidewall 18*e* is shown by use of dashed lines.

If desired, the ledges 36*a*, 36*b* can include a slight rise as they progress toward the rear of the first and second container sidewalls 18*e*, 18*f*, as shown in FIGS. 3 and 4 (and other FIGURES), to better correspond with an angle of the bottom surface 20*c* of the upper frame member 20 when the nail clipper 10 is disposed in the closed position. The slight rise of the ledges 36*a*, 36*b* ensures that most, if not all of the bottom surface 20*c* of the portion of the upper frame member 20 that is disposed above the ledges 36*a*, 36*b* is in parallel alignment with the ledges 36*a*, 36*b* when the nail clipper 10 is disposed in the closed position.

If the user continues to apply force to the lever 32 in the direction of arrow 50*b* after the nail 8 has been cut, additional friction between the cutting edges 12*a*, 14*a* can occur, which is generally undesirable, as it may lead to premature dulling of the cutting edges 12*a*, 14*a* or even cause damage to the cutting edges 12*a*, 14*a* or possibly elsewhere. Additionally, there is also increasing risk that continuation of an application of excessive force to the lever 32 in the direction of arrow 50*b* after the nail clipper 10 is disposed in the closed position can cause damage to the enlarged head 24*a*, elsewhere to the center rod 24, to the front end 18*b* of the lower frame member 18 or to the front end 20*b* of the upper frame member 20 or elsewhere along the length of the upper and lower frame members 20, 18.

However, contact by the bottom surface 20*c* of the upper frame member 20 with the ledges 36*a*, 36*b* limits movement of the upper frame member 20 and the lower frame member 18 toward each other. This significantly lessens the likelihood of damage occurring to any of the component parts of the nail clipper 10, thereby extending the useful life of the nail clipper 10.

In particular, other benefits also arise. For example, the ledges 36*a*, 36*b* allow the frame 16 of the nail clipper 10 to be formed primarily of plastic or of another non-metallic material and be even more resistant to damage from abuse than would otherwise be possible.

The ledges 36*a*, 36*b* provide further unexpected benefits and advantages. Additionally, the ledges 36*a*, 36*b* provide a firm and positive stop that limits downward motion of the upper frame member 20 with respect to the lower frame member 18. This creates a firm "stop" that provides tactile feedback to the user. The tactile feedback, over the course of time, helps to "condition" the user to stop applying force to the lever 32 once the final click indicating that the nail clipping 8*a* has been severed is heard and from the tactile feedback that occurs when the closed position is reached and the ledges 36*a*, 36*b* provide a firm and positive cessation of movement by the upper frame member 20 and, therefore, by the lever 32 as well.

The firm stop provided by the ledges 36*a*, 36*b* also includes a small amount of elasticity due to the slightly elastic (i.e., elastomeric) nature of plastic. This, in turn, provides an aesthetically pleasing feel for the nail clipper 10 during use that, it is believed, many users will find far more satisfying than the cold hard feel that accompanies use of a prior art steel-frame dual parallel opposing blade type of nail clipper. Prior art dual parallel opposing blade types of nail clippers fail completely to address these issues and long-standing needs and, accordingly, provide no solution to these needs.

Alternately, a lower support protrusion (not shown) that extends upward from a central area of a top of a modified lower frame member could be included (i.e., molded) as part of the modified lower frame member and similarly used to preclude further movement of the upper frame member 20 and the modified lower frame member toward each other, either with or without inclusion of the ledges 36*a*, 36*b*. Alternately, the lower support protrusion could be omitted and an upper support protrusion that extends downward from a central area of a bottom of a modified upper frame member could, instead, be included (i.e., molded) as part of the modified upper frame member. Or, if desired, a modified lower support protrusion that is not as high as the lower support protrusion could be included (i.e., molded) as part of the modified lower frame member along with inclusion of a modified upper support protrusion that is not as high as the upper support protrusion could, instead, be included wherein the combined height of the modified upper support protrusion plus the height of the modified lower support protrusion is equal to the height of either the upper support protrusion or the height of the lower upper protrusion. If any support protrusion(s) is/are included it is preferable for the reasons noted above that they are disposed in vertical alignment with as much of the horizontal portion 30, as possible for the same reasons as appertaining to the preferred location for the ledges 36*a*, 36*b*. However, the support protrusions, if included, can provide an obstacle that could hinder capture of the nail clipping 8*a*. Therefore, the ledges 36*a*, 36*b* are preferred.

By this structural arrangement, the upper and lower frame members 20, 18 experience minimal shear and, accordingly, minimal structural stress. Therefore, the upper and lower frame members 20, 18 can be formed primarily (more than 50%) of any desired polymer, (plastic), or other non-metallic material, for example nylon, including using less material and/or a lesser grade (i.e., strength) of material for the frame 16 than would otherwise be possible without at least one of the horizontal portions 30 of the blades 12, 14 being embedded in at least one of the upper or lower members 20, 18.

When the nail clipper 10 is disposed in the open position (as shown in FIGS. 1, 3, 6, and 9) the top planar surface 20*d* of the upper frame member 20 is disposed at approximately the same height as an upper edge 18*e*1, 18*f*1 (See FIGS. 6-9) of the first and second container sidewalls 18*e*, 18*f*, respectively. Therefore, the bottom 32*m* of the U-shaped area 32*c* is disposed at, or slightly above, the height of the upper edges 18*e*1, 18*f*1. This allows rotation of the lever 32 to occur around the center longitudinal axis 13 of the center rod 24. See arrow 50 of FIG. 1 and also refer to a discussion regarding a rest position for the nail clipper 10 that follows regarding rotation of the lever 32 around the center longitudinal axis 13.

When the nail clipper 10 is initially disposed in the open position and an end 32*n* of the lever 32 is depressed downward (toward the frame 16) in the direction of arrow 50*b* (FIG. 4), the top planar surface 20*d* of the upper frame member 20 is progressively urged by the fulcrum 33 below the upper edges 18*e*1, 18*f*1 of the first and second container sidewalls 18*e*, 18*f*, respectively, until the lever 32 has been maximally urged downward and the nail clipper 10 is disposed in the closed position. When the lever 32 is urged downward, force can be applied anywhere along the upper portion 32*a* of the lever 32, however, a greater mechanical advantage is attained when applying force as close to the end 32*n* of the lever 32, as practical. In the closed position, the fulcrum 33 is disposed between the container sidewalls 18*e*, 18*f* at its lowest position during normal usage. FIGS. 7 and 10 show the fulcrum 33 disposed between the first and second container sidewalls 18*e*, 18*f* and well-below the upper edges 18*e*1, 18*f*1. The preceding discussion explains the elevated position of the fulcrum 33 at or slightly above the upper edges 18*e*1, 18*f*1 when the nail clipper 10 is disposed in the open position and the maximally lowered position of the fulcrum 33 when the nail clipper 10 is disposed in the closed position.

It is important to note that when the nail clipper 10 is disposed in the open position, as soon as the user begins to depress the lever 32 downward in the direction of arrow 50*b*, the fulcrum 33 is immediately urged slightly below the upper edges 18*e*1, 18*f*1. The fulcrum 33 remains below the upper edges 18*e*1, 18*f*1 during cutting of the nail 8 (i.e., during the entire transition of the nail clipper 10 from the open position to the closed position).

This provides an important and unexpected benefit, not previously available with any prior art dual parallel opposing blade type of nail clipper. A prior art lever (not shown) of prior art dual parallel opposing blade types of nail clippers is able to rotate around a center longitudinal axis of the prior art center rod (not shown) during actual use (i.e., during cutting). It is important to note that, when cutting, considerable force must be applied to the prior art lever. Because of the possibility of rotation, the prior art lever can inadvertently rotate around the center longitudinal axis of the prior art center rod. This is proportionately more likely to occur as increasingly greater force is applied to the prior art lever by the user. This can cause the prior art nail clipper to inadvertently become dislodged, possibly resulting in the prior art cutting edges striking the user and possibly cutting or causing other injury to the user.

By way of contrast the nail clipper 10 prevents this type of rotation from occurring during use. As soon as the lever 32 of the nail clipper 10 is even slightly depressed, at the beginning of the transition from the open position to the closed position, the fulcrum 33 is immediately urged below the upper edges 18*e*1, 18*f*1 and, thereby, between the opposing first and second container sidewalls 18*e*, 18*f*. This occurs because it is preferable that the design of the nail clipper 10 dispose the plane of the top planar surface 20*d* of the upper frame member 20 proximate the center rod 24 at or near the top of the upper edges 18*e*1, 18*e*2 of the opposing container sidewalls 18*e*, 18*f*. Therefore, any depression of the lever 32 when the nail clipper 10 is disposed in the open position lowers the fulcrum 33 below the upper edges 18*e*1, 18*e*2 which secures the fulcrum 33 of the lever 32 between the upper edges 18*e*1, 18*f*1, thereby preventing rotation of the lever 32 around the center longitudinal axis 13 of the center rod 24 from occurring.

The position of the lever 32, after the fulcrum 33 is urged below the upper edges 18*e*1, 18*f*1, maintains a center longitudinal axis of the lever 32 (not shown) in parallel alignment with respect to the longitudinal center axis 11 (FIGS. 1 and 2) of the nail clipper 10. It is never desired that the lever 32 of the nail clipper 10 be able to rotate around the center longitudinal axis 13 of the center rod 24 during transition from the open position to the closed position. Urging the fulcrum 33 of the lever 32 below the upper edges 18*e*1, 18*f*1, and between the opposing first and second container sidewalls 18*e*, 18*f*, helps to prevent rotation of the lever 32 from occurring during any portion of the transition from the open position to the closed position and, oppositely, from the closed position to the open position. This helps prevent unintended rotation of the lever 32 around the center longitudinal axis 13 of the center rod 24 and it significantly reduces the potential for accidental movement of the nail clipper 10 from occurring during use. Accordingly, the nail clipper 10 helps prevent injury from occurring to the user.

It is also important to note that as the depth of cut into the nail 8 progresses, the downward force that must be applied to the lever 32 is also proportionally increasing until the nail clipper 10 has been urged into the fully closed position, at which time the downward force is subsequently relaxed. As the applied force upon the lever 32 during use progressively increases, the risk of unwanted rotation by the lever 32 around the center longitudinal axis 13 of the center rod 24 also increases. It should also be noted that only the slightest force is initially required to urge the end 32*n* of the lever 32 downward. This is because there is no significant resistance provided by the nail 8 to downward movement of the lever 32 until after the lever 32 has been urged in the direction of arrow 50*b* sufficiently far to bring both of the cutting edges 12*a*, 14*a* into contact with opposite sides (i.e., the top and bottom surfaces) of the nail 8. Further downward movement by the lever 32 commences actual cutting of the nail 8 (i.e., penetration of the cutting edges 12*a*, 14*a* into the nail 8) which significantly increases resistance to further downward motion by the lever 32.

Therefore, a significant increase in a magnitude of force that is applied to the lever 32 by the user does not occur until actual cutting of the nail 8 commences. This means that it is easy for the user to initially urge the end 32*n* of the lever 32 downward enough to lower the fulcrum 33 sufficiently far below the upper edges 18*e*1, 18*f*1 to adequately retain the fulcrum 33 between the opposing first and second container sidewalls 18*e*, 18*f* before the user must substantially increase the force that is being applied to the lever 32.

Therefore, after the actual cut of the nail 8 has begun and as the depth of cut into the nail 8 is progressing, the fulcrum 33 is also descending progressively further below the upper edges 18*e*1, 18*f*1 and progressively deeper between the opposing first and second container sidewalls 18*e*, 18*f*.

Therefore, as increasing force is progressively being applied to the lever 32 urging it further downward, an increasing ability to retain the center longitudinal axis of the lever 32 in parallel alignment with respect to the longitudinal center axis 11 of the nail clipper 10 is also occurring due to a progressive lowering of the fulcrum 33 between the first and second container sidewalls 18*e*, 18*f*. The increasing strength provided by the lower portions of the first and second container sidewalls 18*e*, 18*f* (as the fulcrum 33 descends lower) is better able to resist any rotational movement (around the center longitudinal axis 13) that may inadvertently be applied to the end 32*n* of the lever 32 by the user.

Therefore, the nail clipper 10 provides proportionately increasing capability and resistance to help prevent unwanted rotation of the lever 32 around the center longitudinal axis 13 of the center rod 24 in proportion to increasing force that is applied to the lever 32 by the user as the depth of cut is progressing. This, in turn, provides a progressively increasing margin of safety when it is needed most during use, which is when the greatest force is being applied to the lever 32.

Therefore, the nail clipper 10 provides a maximum margin of safety for the user when the potential for injury is at its greatest, and free and easy rotation around the center longitudinal axis 13 of the center rod 24 by the lever 32 when the potential for injury is at its lowest. This rotation is necessary at times when it is desired to urge the nail clipper 10 into the storage position (See FIGS. 5 and 8 and related description, below.) or from the storage position into the open position. Accordingly, the nail clipper 10 provides an optimum engineering design satisfying ease of use and enhanced safety during use not previously available with any prior art dual parallel opposing blade type of nail clipper.

The disclosed means for preventing rotation of the lever 32 around the center longitudinal axis 13 of the center rod 24 is new for dual parallel opposing blade types of nail clippers, and it provides an important new safety improvement for the nail clipper 10.

Another benefit provided by the nail clipper 10 is that less force is required to urge lever 32 in the direction of arrow 50*b* because the lever 32 is prevented from rotating around the center longitudinal axis 13 of the center rod 24. As such only a downward force vector occurs eliminating the wasted force that an additional horizontal force vector would incur. An offset in the lever 32 would create the horizontal force vector. This is a new benefit, not available with any relevant prior art device.

Referring now primarily to FIGS. 5 and 8 the nail clipper 10 is disposed in the rest position with FIG. 5 showing a right-side view and FIG. 8 showing a front elevational view. The rest position is used for storage or transportation of the nail clipper 10. The nail clipper 10 is especially compact when it is disposed in the rest position and, therefore, occupies minimum space. This is particularly useful when storing the nail clipper 10 in a drawer, placing it on a countertop, a shelf, in a medicine cabinet, or inside a travel bag, container or suitcase.

To urge the nail clipper 10 from the open position, as shown in FIG. 1, into to the rest position, as shown in FIGS. 5 and 8, the end 32*n* of the lever 32 is grasped and is rotated 180 degrees around the center longitudinal axis 13 of the center rod 24, as shown by the arc of arrow 50 in FIG. 1. After rotation, a front surface 32*k* of the U-shaped recessed area 32*c* is disposed maximally close to the rear wall 19. The end 32*n* of the lever 32 is then lifted and rotated around a center longitudinal axis of the pin 34 as shown by the arc of arrow 50*a* (FIG. 1), urging the end 32*n* toward the distal end 20*a* of the upper frame member 20, until the end 32*n* of the lever 32 comes to rest on the top planar surface 20*d* proximate the distal end 20*a* the upper frame member 20, as shown in FIG. 5.

When the lever 32 is disposed as shown in FIG. 5, the nail clipper 10 is disposed in the rest position. In the rest position, the lever 32 is disposed upside down, as compared to its general position in FIG. 1. In the rest position, the center longitudinal axis of the lever 32 also aligns with the center longitudinal axis 11 of the nail clipper 10.

The U-shaped recessed area 32*c* includes a pair of upper corners 32*p* (FIG. 1) that are in alignment with one-another. When the nail clipper 10 is disposed in the rest position, the upper corners 32*p* are inverted. After the lever 32 has been pivoted along the arc of arrow 50, the lever 32 then pivots along the arc of arrow 50*a* around the center longitudinal axis of the pin 34 which urges the nail clipper 10 into the rest position. As the lever 32 is urged along the arc of arrow 50*a* the upper corners 32*p* urge the upper frame member 20 downward and then relax the downward pressure which allows some upward motion by the upper frame member 20 to occur again.

As the lever 32 is urged along the arc of arrow 50*a*, the upper frame member 20 reaches its lowest position approximately when the front surface 32*k* of the U-shaped recessed area 32*c* is disposed closest to the lower frame member 18. The distance from the center longitudinal axis of the pin 34 to the front surface 32*k* of the U-shaped recessed area 32*c* is limited to ensure that when the lever 32 is urged along the arc of arrow 50*a*, the upper frame member 20 is not urged lower than the position the upper frame member 20 attains when the nail clipper 10 is disposed in the closed position. In general, distance from the center longitudinal axis of the pin 34 to the front surface 32*k* of the U-shaped recessed area 32*c* is sufficiently minimized which, in turn, minimizes the amount the upper frame member 20 is lowered when the lever 32 is urged along the arc of arrow 50*a*.

In the rest position, as shown in FIGS. 5 and 8, the upper corners 32*p* are disposed on the top planar surface 20*d* of the upper frame member 20. In the rest position the upper frame member 20 is maintained by the upper corners 32*p* at an elevation that is slightly below the upper edges 18*e*1, 18*f*1 of the first and second container sidewalls 18*e*, 18*f*. In other words, the upper frame member 20 is somewhat lower when the nail clipper 10 is disposed in the rest position than when the nail clipper 10 is disposed in the open position. Accordingly, when the nail clipper 10 is disposed in the rest position, the upper frame member 20 is applying a slight, but still sufficient upward force to the upper corners 32*p*. This slight upward force, in turn, causes the lever 32 to pivot around the center longitudinal axis of the pin 34 which, in turn, causes the end 32*n* of the lever 32 to apply a slight downward force upon the top planar surface 20*d* proximate the distal end 20*a* of the upper frame member 20. This downward force exerted by the end 32*n* of the lever 32 onto the upper planar surface 20*d* helps maintain the center longitudinal axis of the lever 32 in parallel alignment with respect to the longitudinal center axis 11 of the nail clipper 10 when the nail clipper 10 is disposed in the rest position.

Additionally, it is important to note that when the nail clipper 10 is disposed in the rest position, as mentioned above, the upper corners 32*p* are both disposed slightly below the upper edges 18*e*1, 18*f*1. The upper corners 32*p*, being disposed below the upper edges 18*e*1, 18*f*1, help to prevent side-to-side motion of the U-shaped recessed area 32*c* from occurring whenever the nail clipper 10 is disposed in the rest position. Preventing side-to-side motion of the U-shaped recessed area 32*c* from occurring maintains the center longitudinal axis of the lever 32 in parallel alignment with respect to the longitudinal center axis 11 of the nail clipper 10 whenever the nail clipper 10 is disposed in the rest position. Therefore, once urged into the rest position, the nail clipper 10 remains in the rest position, as shown in FIG. 5, until the end 32*n* of the lever 32 is again grasped and urged fully in a direction opposite that of arrow 50*a*. To release the nail clipper 10 from the rest position, the end 32*n* of the lever 32 is grasped, lifted and urged fully in the opposite direction of arrow 50*a*. The lever 32 is then rotated 180 degrees around the center longitudinal axis 13 of the center rod 24 in an opposite direction as shown by the arc of arrow 50 until the nail clipper 10 is again disposed in the open position, as shown in FIGS. 1, 3 and 6.

The nail clipper's 10 ability to remain in the rest position provides an advantage over prior art dual parallel opposing blade types of nail clippers because, by way of contrast, the prior art lever is free to rotate around the prior art center rod when the prior art device is disposed in the prior art rest position. Unintentional rotation of the prior art lever occurs easily which expands the overall size of the prior art nail clipper. This is undesirable for transit or storage. However, the lever 32, and therefore the nail clipper 10, will remain in the rest position after being urged into the rest position unless deliberately urged out of the rest position.

It is also important to note that parallel alignment of the center longitudinal axis of the lever 32 with respect to the center longitudinal axis 11 of the nail clipper 10 is maintained throughout the duration of movement by the lever 32 along the arc of arrow 50*a* as well as when movement by the lever 32 is occurring in the opposite direction of arrow 50*a*. Therefore, whenever the center longitudinal axis of the lever 32 aligns with the center longitudinal axis 11 of the nail clipper 10, as soon as the end 32*n* of the lever 32 is either raised or lowered, the center longitudinal axis of the lever 32 is maintained in parallel alignment with the center longitudinal axis 11 of the nail clipper 10. During normal use, the end 32*n* of the lever 32 is not urged upward or downward unless the center longitudinal axis of the lever 32 is in parallel alignment with the center longitudinal axis 11 of the nail clipper 10. Urging the end 32*n* of the lever 32 upward or downward only occurs, during normal use, when either placing the nail clipper 10 into the rest position, removing the nail clipper 10 from the rest position or when actual cutting of the nail 8 (i.e., transition of the nail clipper 10 from the open to the closed position) is occurring. Therefore, as soon as a force is applied to the end 32*n* of the lever 32 of the nail clipper 10 during normal use, initial upward or downward displacement by the end 32*n* of the lever 32 secures and maintains the lever 32 in parallel alignment with respect to the center longitudinal axis 11 of the nail clipper 10.

Therefore, the nail clipper 10 provides an improvement in safety previously unavailable with all prior art dual parallel opposing blade types of nail clippers. In particular, during normal use (i.e., when the longitudinal axis of the lever 32 is disposed in parallel alignment with the center longitudinal axis 11 of the nail clipper 10), any displacement of the end 32*n* of the lever 32 away from its normal or quiescent state as occurs when the nail clipper 10 is disposed in the open position or after the lever 32 has been rotated 180 degrees in the direction of arc arrow 50 either upward or downward secures and maintains the lever 32 in parallel alignment with the center longitudinal axis 11 of the nail clipper 10. Therefore, the lever 32 cannot rotate around the center longitudinal axis 13 of the center rod 24 whenever force is applied to the end 32*n* of the lever 32 in either an upward or downward direction sufficient to vertically displace the end 32*n* of the lever 32. The lever 32 is maintained in alignment even if a slight horizontal force is applied to the end 32*n* of the lever 32 after initial vertical (up or down) displacement of the end 32*n* of the lever 32 has occurred.

This significantly reduces the likelihood of unintentional displacement of the nail clipper 10 during use which might otherwise accidentally impact and cause injury to the user. It also ensures that whenever force is normally applied to the end 32*n* of the lever 32 in either an upward or downward direction that the direction of force aligns vertically with respect to the center longitudinal axis 11 of the nail clipper 10. If, by way of contrast during the application of force by the user to the end 32*n* of the lever 32, the lever 32 were to rotate away from an initial position of parallel alignment with respect to the center longitudinal axis 11 of the nail clipper 10 (Note, This is a condition that cannot occur with the nail clipper 10 but which is discussed only to provide contrast between the improvements provided by the nail clipper 10 and operation of prior art dual parallel opposing blade types of nail clippers that fail to include such improvements), then the force subsequently applied to the end 32*n* of the lever 32 would include a vertical component (i.e., a vertical force vector) and also a horizontal component (i.e., a horizontal force vector). The horizontal force vector (i.e., a portion of the total force that is applied to the lever 32) increases in magnitude proportionate to the amount of displacement experienced by the end 32*n* of the lever 32 away from the center longitudinal axis 11 of the nail clipper 10.

The horizontal component of the force applied (i.e., the horizontal force vector) is not used to displace the end 32*n* of the lever 32 vertically, either upward or downward, as desired. Rather, the horizontal force vector is, in effect, wasted additional force that is applied to the lever 32 by the user. In other words, the user must apply more force to the end 32*n* of the lever 32 whenever it is displaced away from the center longitudinal axis 11 in order to create the same magnitude of vertical force (i.e., the same vertical force vector) than is required whenever the center longitudinal axis of the lever 32 is in alignment with the center longitudinal axis 11 of the nail clipper 10 and all of the force applied to the end 32*n* of the lever 32 is utilized as the vertical force vector (i.e., when there is no horizontal force vector produced). Ensuring that the center longitudinal axis of the lever 32 is maintained in alignment with the center longitudinal axis 11 of the nail clipper 10 during the application of force by the user to the end 32*n* of the lever 32 prevents displacement of the lever 32, which prevents creation of the horizontal force vector, which minimizes the force that must be applied to the end 32*n* of the lever 32 to urge the nail clipper 10 from the open position into the closed position (i.e., especially when cutting the nail 8) or to urge the nail clipper 10 into or out of the rest position.

Therefore, the nail clipper 10 provides an important safety improvement by preventing accidental sudden rotation by the lever 32 around the center longitudinal axis 13 of the center rod 24 and possible displacement of the nail clipper 10 with an increasing risk of causing injury to the user. Additionally, the nail clipper 10 also provides an important improvement in utility by decreasing (i.e., minimizing) the amount of force that has to be applied to the nail clipper 10. Minimizing the magnitude of force applied also lessens the likelihood of slippage by the user, which further promotes safe usage of the nail clipper 10. Both of these important, and surprising, improvements are the result of maintaining the longitudinal axis of the lever 32 in alignment with the center longitudinal axis 11 of the nail clipper 10 whenever the end 32*n* of the lever 32 is raised or lowered during normal usage.

It is also especially important to note that the opposing first and second container sidewalls 18*e*, 18*f* not only contain the nail clipping 8*a*, as important as that is, they are also used to prevent rotation of the lever 32 during normal use around the center longitudinal axis 13 of the center rod 24 and, accordingly, to provide the additional improvement in safety and the further additional improvement in minimizing the magnitude of force that is required.

Although generally not preferred, the nail clipper 10 can be modified in ways not shown to further decrease cost. For example, the opposing first and second container sidewalls 18*e*, 18*f* could be eliminated. Doing so would also eliminate the benefits that arise from ensuring that the longitudinal axis of the lever 32 remains in parallel alignment with respect to the center longitudinal axis 11 of the nail clipper 10. Vertical movement of the lever 32 disposes the fulcrum 33 or some portion of the U-shaped recessed area 32*c* below the upper edges 18*e*1, 18*f*1, which maintains alignment. Therefore, elimination of the first and second container sidewalls 18*e*, 18*f* would eliminate these improvements, as well. However, numerous other advantages and benefits not currently available with any prior art dual parallel opposing blade type of nail clipper would still be provided by the less expensive version of the nail clipper 10.

It is, of course, understood by those possessing skill in the mechanical arts, that changing the position of the fulcrum 33 relative to the length of the upper portion 32*a* of the lever 32 will result in a corresponding change in a mechanical advantage provided by the lever 32. Also as desired, numerous changes in the construction of the lever 32 are possible and are discussed in greater detail, hereinafter. However, it is important to briefly mention now, that by modifying a position and or a shape of the fulcrum 33 to provide the modified fulcrum 33*a* (See FIGS. 13A, 22, 24, 25 and 60) and/or changes in mechanical advantage can be included to provide a modified version of the nail clipper 10 that requires less force to operate (i.e., a greater mechanical advantage providing a softer feeling version) or, if desired, to require a greater force to operate (i.e., a lesser mechanical advantage providing a firmer feeling version).

Similarly, the contour of the modified fulcrum 33*a* can be further modified to include a progressive curvature rather than a single line of contact, as provided by the fulcrum 33 and by the modified fulcrum 33*a*. The progressive curvature would cause contact between the further modified fulcrum and the top planar surface 20*d* to progressively move along the top planar surface 20*d* as the lever 32 that includes the further modified fulcrum is progressively depressed. Accordingly, the further modified fulcrum would act as a variable mechanical advantage type of cam surface that provides a variable mechanical advantage during use. The variable mechanical advantage could include any desired progressive increase or decrease in mechanical advantage as the lever 32 (that includes the further modified fulcrum) is progressively depressed. Preferably, the further modified fulcrum that includes the variable cam would be designed to provide less downward movement and thereby increasingly greater mechanical advantage for the lever 32 as the nail clipper 10 is progressively urged closer toward the closed position. Rounding of the fulcrum 33 may also be used to modify the "feel" of the nail clipper 10 during use.

This may be useful and used to provide a progressively greater (or lesser, if desired for some reason) mechanical advantage as the depth of cut into the nail 8 progresses, thereby helping to overcome increasing resistance to the cut as the nail clipper 10 is progressively urged from the open position closer toward the closed position. Accordingly, the nail clipper 10 can, by inclusion of the further modified fulcrum, provide an especially smooth cut from start to finish without the need for significantly increasing the magnitude of force that must be applied by the user to complete the cut through the nail 8.

While many users may prefer a softer feel or a cam-type of further modified fulcrum, decreasing the amount of force that must be applied to the end 32*n* of the lever 32 may also be especially desirable for cutting especially thick or unusually hard nails 8, which certain people have. For example, toenail fungus can significantly thicken nails. As desired, the distance between the cutting edges 12*a*, 14*a* or 52*a*, 54*a* is a variable that can be changed for different versions of the nail clipper 10. After complete benefit from reading the instant disclosure and preceding description and review of the drawing figures other desired modifications to the fulcrum 33 or to the modified fulcrum 33*a* or to the further modified fulcrum will become possible to those having ordinary skill in the art.

If the nail clipper 10 is disposed in the rest position and it is desired to return the nail clipper 10 to the fully open position for use, the end 32*n* of the lever 32 is grasped and raised in the direction opposite to arrow 50*a*. After it has been fully rotated around the center longitudinal axis of the pin 34, the end 32*n* of the lever 32 is then rotated horizontally around the center longitudinal axis 13 of the center rod 24 in a direction opposite that of arrow 50 until the lever 32 is again disposed as shown in FIG. 1, with the longitudinal axis of the lever 32 in parallel alignment with respect to the center longitudinal axis 11 of the nail clipper 10, at which time the nail clipper 10 is again disposed in the open position and again ready for use.

FIG. 13 is an enlarged exploded view in perspective of the modified two-piece center rod 124, for replacement use of the center rod 24, as desired, of the nail clipper of FIG. 1. The modified two-piece center rod 124 includes a lower rod portion, identified in general by the reference numeral 128, that, during manufacture of the nail clipper 10, is cooperatively urged together into a bottom of the modified two-piece center rod 124 and, when fully urged together, the lower rod portion 128 preferably locks (i.e., latches) with the modified two-piece center rod 124 in the fully inserted position, which prevents inadvertent separation and removal of the modified two-piece center rod 124 and the accompanying lower rod portion 128 from the nail clipper 10.

An upper rod portion 126 of the modified two-piece center rod 124 includes a generally U-shaped loop portion 126*a* at an upper end, thereof. A main body portion, as identified by bracket 126*b*, extends downward from the U-shaped loop portion 126*a* so that the overall length of the modified two-piece center rod 124 is approximately the same as the overall length of the center rod 24. The main body portion 126*b* includes two spaced-apart longitudinal members 126*c*, 126*d* that extend downward from opposite ends of the U-shaped loop portion 126*a*. A pair of enlarged solid cylindrical segments 126*e*, 126*f* are each respectively attached to a bottom end of one of the two spaced-apart longitudinal members 126*c*, 126*d*. Each of the two spaced-apart longitudinal members 126*c*, 126*d* includes an interior wall 126*g*, 126*h* that extend the length of the main body portion 126*b*. A gap exists between the longitudinal members 126*c*, 126*d* along the length of the interior walls 126*g*, 126*h*. A pair of curved protrusions 126*j*, 126*k* extend inward from the interior walls 126*g*, 126*h*. The interior walls 126*g*, 126*h* also extend over the surface to the curved protrusions 126*j*, 126*k*. The shortest distance between the interior walls 126*g*, 126*h* (i.e., between the gap) occurs between opposing peaks of the curved protrusions 126*j*, 126*k*.

The lower rod portion 128 includes an enlarged base, identified in general by the reference numeral 128*a*. The enlarged base 128*a* includes a pair of enlarged solid extensions 128*b*, 128*c* that protrude from opposite sides of the enlarged base 128*a*. An opposite upper end of the lower rod portion 128 includes a nose section, identified by bracket 128*d*. A top of the nose section 128*d* preferably includes an upper concave curvature 128*e* that, after assembly, is disposed under a center portion of the pin 34. If desired, the upper concave curvature 128*e* corresponds, generally, with the curvature of the pin 34. However, after assembly, the pin 34 may or may not make physical contact with the upper concave curvature 128*e* of the nose section 128*d*. This is because the position of the modified two-piece center rod 124 does not change relative to the bottom frame member 18 after assembly as the upper frame member 20 supplies an upward force to the lever 32 which, in turn, maintains upward pressure on the modified center rod 124 (or on the center rod 24).

Proceeding downward, the nose section 128*d* progressively tapers outward to an opposing pair of edges 128*j*, 128*k*. The edges 128*j*, 128*k* are preferably at the greatest width of the lower rod portion 128. The taper of the nose section 128*d* allows for easy initial insertion of the lower rod portion 128 into the gap at the bottom of the modified two-piece center rod 124 between the cylindrical segments 126*e*, 126*f* during assembly of the nail clipper 10.

A pair of inward concave curvatures 128*f*, 128*g* extend downward from the edges 128*j*, 128*k* to a pair of lower edges 128*m*, 128*n*. A mid portion, identified by bracket 128*h*, extends downward from the lower edges 128*m*, 128*n* to a top of the enlarged base 128*a*.

Preferably the center rod 24 and/or the modified two-piece center rod 124 and/or the lower rod portion 128 are formed of a polymer or other non-metallic material. If desired, the center rod 24 and/or the modified two-piece center rod 124 and/or the lower rod portion 128 can be formed of a metal or any desired sufficiently durable material.

To assemble the nail clipper 10, the blades 12, 14 are preferably molded into the upper and lower frame members 20, 18 of the nail clipper 10 or are later inserted into the modified dual parallel opposing blade embedded member nail clipper 10*a* as later discussed (See FIG. 33). If modified discreet upper and lower frame members are used (i.e., if a two-piece modified frame is utilized), the distal ends of the discreet upper and lower frame members are joined together using any preferred method, such as using the clip 702 (FIGS. 27, 27A, 28 and 28A), or by adhesive, double-stick tape, welding, fasteners or any other preferred means. If discreet upper and lower frame members are used to form the modified frame, it is possible to mold the blades 12, 14 in the discreet frame members or to urge the blades 12, 14 into openings 13*a*, 13*b* (See FIG. 33 and accompanying description) provided in the frame 16. After the blades 12, 14 are installed or molded (with discreet frame members) in position the cutting edges 12*a*, 14*a* are then aligned, the upper blade cutting edge 12*a* over the lower blade cutting edge 14*a*. Once aligned, the distal ends of the discreet upper and lower frame members are secured by adhesive, welding the clip 702 or other fastener or by any preferred means. By providing low cost blades 12, 14, lever 32, center rod 24 (or modified center rod 124) and especially low cost discreet frame members that can be quickly and inexpensively secured together while ensuring that the cutting edges 12*a*, 14*a* are nearly perfectly aligned, an especially low cost embodiment of the invention is provided. If the blades 12, 14 are inserted into the openings 13*a*, 13*b* (i.e., if they are not molded in position), the blades 12, 14 are inserted into the openings 13*a*, 13*b* that are provided in the upper and lower frame members 20, 18 at any desired point during assembly. This is possible whether the frame 16 is of one-piece construction or if two-piece discreet frame members based on a variation of the modified dual parallel opposing blade embedded member nail clipper 10*a* are utilized.

Referring now to FIG. 12, during manufacture of the nail clipper 10 if the center rod 24 is utilized, the upper end 24*b* of the center rod 24 is inserted through the lower center rod hole 18*p* (FIG. 5) provided in the lower segment 18*m* (FIG. 8) of the lower frame member 18, then through the center hole 22 of the lower blade 14, then through the upper center rod hole 18*n* provided in the upper segment 18*k* of the lower frame member 18. The upper end 24*b* is urged across an air gap between the lower frame member 18 and the upper frame member 20 and through the lower center rod hole 20*p* provided in the lower segment 20*m* of the upper frame member 20, through the center hole 22 of the upper blade 12, and through the upper center rod hole 20*n* provided in the upper segment 20*k* of the upper frame member 20.

During assembly, the upper frame member 20 is urged downward an amount sufficient for the upper end 24*b* to extend above the top planar surface 20*d* of the upper frame member 20 a desired amount. The U-shaped area 32*c* of the lever 32 is placed on the top planar surface 20*d* with the upper end 24*b* disposed in the U-shaped area 32*c*. The pin 34 is inserted through one of the aligned pin openings 32*d* or 32*e*, through the pin aperture 24*c* of the center rod 24, and into a remaining one of the aligned pin openings 32*d*, 32*e*. Pressure is relaxed which allows the upper frame member 20 to move upward and tension the lever 32 and the center rod 24. The center rod 24 and the lever 32 are now secured in position to a remainder of the nail clipper 10. Friction between the pin 34 and the aligned pin openings 32*d*, 32*e* secures the pin 34 in proper position.

Referring now again to FIG. 13, during manufacture of the nail clipper 10 if the modified two-piece center rod 124 is utilized, the upper rod portion 126 of the modified center rod 124 is inserted through the lower center rod hole 18*p*, then through the center hole 22 of the lower blade 14, then through the upper center rod hole 18*n*. The upper rod portion 126 is urged across the air gap between the lower frame member 18 and the upper frame member 20 and through the lower center rod hole 20*p*, through the center hole 22 of the upper blade 12, and through the upper center rod hole 20*n*. The upper frame member 20 is urged downward an amount sufficient for the U-shaped loop portion 126*a* to extend above the top planar surface 20*d* of the upper frame member 20. The U-shaped area 32*c* of the lever 32 is placed on the top planar surface 20*d* with the U-shaped loop portion 126*a* disposed in the U-shaped area 32*c*. The pin 34 is inserted through one of the aligned pin openings 32*d* or 32*e*, through the gap under the U-shaped loop portion 126*a*, and into a remaining one of the aligned pin openings 32*d*, 32*e*. Pressure is relaxed which allows the upper frame member 20 to move upward and tension the lever 32 and the modified two-piece center rod 124. The modified center rod 124 is temporarily secured in position. The pin 34 is secured in position by friction.

To complete assembly of the nail clipper 10 utilizing the modified two-piece center rod 124, the nose section 128*d* is placed in the gap between the cylindrical segments 126*e*, 126*f* and urged upward until the concave curvatures 128*g*, 128*f* are disposed over the curved protrusions 126*k* and the 126*j*, respectively. Additional force is required to overcome increasing resistance in order to urge the lower rod portion 128 fully upward into the modified center rod 124 until the curved protrusions 126*k*, 126*j* are disposed in the concave curvatures 128*g*, 128*f*. This latches, or locks the lower rod portion 128 to the modified two-piece center rod 124 which prevents disassembly of the nail clipper 10. The enlarged base 128*a* fills the gap between the cylindrical segments 126*e*, 126*f* to provide a smooth modified enlarged head of the fully assembled modified two-piece center rod 124. The modified enlarged head consists of the cylindrical segments 126*e*, 126*f* of the modified two-piece center rod 124, the enlarged solid extensions 128*b*, 128*c* and a remaining portion of the enlarged base 128*a* of the lower rod portion 128 that is disposed between the enlarged solid extensions 128*b*, 128*c*.

Continuing to refer to FIG. 13 and referring now also to FIG. 13A, is shown the embedded pin lever 32*a*1. The embedded pin lever 32*a*1 is identical to the lever 32 previously described, except the embedded pin lever 32*a*1 includes the embedded pin 34*a*1. Additionally, the embedded pin lever 32*a*1 preferably does not include the aligned pin openings 32*d*, 32*e*. The embedded pin 34*a*1 is preferably molded into opposing sides of the U-shaped recessed area 32*c* during manufacture of the embedded pin lever 32*a*1, which would eliminate the need for the aligned pin openings 32*d*, 32*e*.

Therefore, the aligned pin openings 32*d*, 32*e* are not necessary as the embedded pin 34*a*1 becomes an integral part of an assembly that includes the embedded pin lever 32*a*1 and the embedded pin 34*a*1. Elimination of the aligned pin openings 32*d*, 32*e* provides a cleaner appearance as the exterior surface of the U-shaped recessed area 32*c* of the embedded pin lever 32*a*1 is smooth and because the openings for the aligned pin openings 32*d*, 32*e* have preferably been eliminated and therefore, are not visible.

If desired, the embedded pin lever 32*a*1 can also include the embedded member 32*b* of the lever 32 (See FIG. 22), or any variation, thereof, to provide increased structural strength for the embedded pin lever 32*a*1.

Use of the embedded pin lever 32*a*1 requires use of the modified two-piece center rod 124 or a variation, thereof. When the embedded pin lever 32*a*1 is used, the cylindrical segments 126*e*, 126*f* of the modified two-piece center rod 124 are sized to ensure that when the cylindrical segments 126*e*, 126*f* are urged toward each other and the interior walls 126*g*, 126*h* of the cylindrical segments 126*e*, 126*f* make contact with each other, that a maximum outside diameter across any portion of the touching cylindrical segments 126*e*, 126*f* is less than the inside diameter of the center hole 22 of the blades 12, 14 or any other opening of the nail clipper 10 (or any version) through which the modified two-piece center rod 124 must pass. When the embedded pin lever 32*a*1 is used, the cylindrical segments 126*e*, 126*f* may be made somewhat smaller than when the lever 32 is used. This is because when the embedded pin lever 32*a*1 is used the cylindrical segments 126*e*, 126*f*, must be pinched together during manufacture and pass through the center hole 22 of both blades 12, 14 (and through other openings). However, when the (regular) lever 32 is used, the cylindrical segments 126*e*, 126*f* do not have to pass through the center holes 22 or other openings as the smaller diameter upper rod portion 126 and the smaller diameter main body portion 126*b* can instead be inserted from the bottom of the nail clipper 10 upwards, as described earlier, during assembly.

Therefore, during assembly of the nail clipper 10 when utilizing the modified two-piece center rod 124 and the embedded pin lever 32*a*1, the modified two-piece center rod 124, absent the lower rod portion 128, is placed over the embedded pin 34*a*1 and urged downward as far as it will go until an underside of the U-shaped loop portion 126*a* is resting on top of the embedded pin 34*a*1. The cylindrical segments 126*e*, 126*f* are then grasped and pinched together. The embedded pin lever 32*a*1 is placed atop the upper frame member 20 with the pinched-together cylindrical segments 126*e*, 126*f* of the upper rod portion 126 disposed above and in alignment with the center hole 22 of the upper blade 12.

The embedded pin lever 32*a*1 along with the upper rod portion 126 are urged downward until the cylindrical segments 126*e*, 126*f* emerge below the bottom surface 20*c* of the upper frame member 20. The cylindrical segments 126*e*, 126*f* are again pinched together and the embedded pin lever 32*a*1 along with the upper rod portion 126 are urged downward until the cylindrical segments 126*e*, 126*f* pass through and emerge below the bottom planar surface 18*c* of the lower frame member 18. The position of the upper rod portion 126 is maintained while the nose section 128*d* of the lower rod portion 128 is placed between the cylindrical segments 126*e*, 126*f* and urged upward until the enlarged base 128*a* of the lower rod portion 128 is flush with and disposed between the cylindrical segments 126*e*, 126*f*.

The pair of concave curvatures 128*f*, 128*g* of the lower rod portion 128 each engage with one of the pair of curved protrusions 126*j*, 126*k* sufficient to secure the lower rod portion 128 in a position of cooperative engagement with the upper rod portion 126 and thereby complete assembly of the modified two-piece center rod 124. This helps to prevent disassembly of the nail clipper 10 after assembly has been completed.

The lower rod portion 128 also urges the cylindrical segments 126*e*, 126*f* sufficiently far apart to maintain position of the cylindrical segments 126*e*, 126*f* under the bottom planar surface 18*c* of the lower frame member 18 and, accordingly, prevent further upward motion of the modified two-piece center rod 124 with respect to the lower frame member 18 during use. The enlarged base 128*a* disposed between the cylindrical segments 126*e*, 126*f* also creates an attractive finished appearance for a bottom of the modified two-piece center rod 124 assembly that includes the upper rod portion 126 and the lower rod portion 128 properly inserted, as described above.

Referring now to FIG. 33, is shown an enlarged front view of the modified dual parallel opposing blade embedded member nail clipper 10*a*, hereinafter referred to as "the modified opening nail clipper 10*a*". The modified opening nail clipper 10*a* is shown with the blades 12, 14, the lever 32, the center rod 24, and the pin 34 removed to better reveal the difference between the modified opening nail clipper 10*a* and the nail clipper 10.

With the modified opening nail clipper 10*a*, the blades 12, 14 are not molded into the upper and lower frame members 20, 18. During molding of the upper and lower frame members 20, 18, a mold member (not shown) extends into the upper and lower frame members 20, 18 where the horizontal portions 30 of the blades 12, 14 are to be later inserted. After forming the upper and lower frame members 20, 18, the mold member is removed providing the upper opening 13*a* beginning at the front end 20*b* and extending into the upper frame member 20 and providing the lower opening 13*b* beginning at the front end 18*b* and extending into the lower frame member 18.

At any desired point during manufacture, the horizontal portions 30 of the blades 12, 14 (or the modified blades 52, 54) are urged into the upper and lower openings 13*a*, 13*b*, respectively. The upper and lower openings 13*a*, 13*b* are preferably sized to create friction between the interior of the upper and lower openings 13*a*, 13*b* and the exterior of horizontal portions 30 of the blades 12, 14 as the horizontal portions 30 are urged into the upper and lower openings 13*a*, 13*b*. The friction secures the blades 12, 14 in position. After insertion, some of the polymer (or other non-metallic material used to form the upper and lower frame members 20, 18) may flow into the securing holes 26 and/or into the side indentations 28 to additionally help secure the blades 12, 14 in position. Heat produced by the friction during insertion of the blades 12, 14 into the upper and lower openings 13*a*, 13*b* may temporarily increase the rate of flow of the surrounding polymer into the securing holes 26 and/or the side indentations 28, thereby further helping to secure the blades 12, 14 in position.

Accordingly, the upper and lower openings 13*a*, 13*b* are illustrative of an alternate method for embedding the blades 12, 14 (or the modified blades 52, 54) into the modified opening nail clipper 10*a* during manufacture.

Referring now to FIG. 19 is shown the second modified dual parallel opposing blade embedded member nail clipper 200, hereinafter referred to as "the second modified nail clipper 200." The second modified nail clipper 200 is substantially identical to the nail clipper 10, except for modifications involving the shorter center rod 224 that is provided with the second modified nail clipper 200. The shorter center rod 224 includes the modified enlarged head 224*a* that bears directly upon the top blade surface 14*f* of the inverted lower blade 14. If desired (as shown), polymer surrounds the modified enlarged head 224*a*. It may be possible to include the shorter center rod 224 as an extension (i.e., as a vertical elongated protrusion) of the second modified lower frame member 218 during molding of the second modified nail clipper 200. The shorter center rod 224 would then be formed (i.e., molded) as an integral part of the second modified lower frame member 218. If molded as an integral part of the second modified lower frame member 218, the modified enlarged head 224*a* would be eliminated the upward second compressive force would be conveyed through the vertical elongated protrusion or extension to the second modified lower frame member 218 and thereby to the bottom blade surface 14*b*. If desired, and if the shorter center rod 224 is used, it can be formed of a metal or other sufficiently durable material and molded in place passing through the center hole 22 of the lower blade 14 during molding of the second modified lower frame member 218.

Referring now to FIG. 20 is shown the third modified dual parallel opposing blade embedded member nail clipper 300, hereinafter referred to as "the third modified nail clipper 300." The third modified nail clipper 300 is substantially identical to the second modified nail clipper 200, except for the lower frame opening 302 that is provided in a bottom of the third modified lower frame member 318. This allows insertion of the shorter center rod 224 into the lower frame opening 302 and upward into the third modified nail clipper 300 which may improve ease of manufacturing and lower assembly cost.

Referring now to FIG. 21 is shown the fourth modified dual parallel opposing blade embedded member nail clipper 400, hereinafter referred to as "the fourth modified nail clipper 400." The fourth modified nail clipper 400 is similar to the nail clipper 10 except for changes affecting the fourth modified upper frame member 420. The shorter center rod 224 of the second modified nail clipper 200 or of the third modified nail clipper 300 may be used with the fourth modified nail clipper 400. A portion of the fourth modified upper frame member 420 disposed above the top blade surface 12*f* of the horizontal portion 30 of the upper blade 12 has been removed in the area 420*a*, leaving the top blade surface 12*f* exposed. As a result, the fulcrum 33 of the lever 32 bears down directly upon the top blade surface 12*f* of the upper blade 12. The first compressive force, supplied by the fulcrum 33 of the lever 32 during use, urges the upper blade 12 downward. As the upper blade 12 is urged downward, the upper blade 12 urges a remainder of the fourth modified upper frame member 420 downward.

The modifications shown in FIGS. 19-21 also greatly reduce the amount of shear experienced by the frame 16 and, thereby, provide many of the benefits previously and subsequently described, herein.

Referring now to FIG. 22 is shown the optional reinforcing embedded member 32*b* in dashed lines. The reinforcing embedded member 32*b*, if included, is preferably molded into the lever 32, and, thereby, embedded in the lever 32. A forward portion 32*b*1 of the reinforcing embedded member 32*b* is disposed under a pair of first and second aligned pin openings 32*d*, 32*e* to increase strength and prevent damage to the U-shaped recessed area 32*c* when the lever 32 is urged downward during cutting of the nail 8. The U-shaped recessed area 32*c* extends forward of the upper portion 32*a* of the lever 32, as shown in FIG. 22 by bracket 32*c*. The reinforcing embedded member 32*b* includes any preferred size or shape as long as it is generally contained within an interior of the lever 32 for optimum appearance. Use of the optional embedded member 32*b* contained (i.e., molded) within a polymer exterior of the lever 32 allows for greater variety in sculpting the overall shape, appearance and functioning (by including the rounded or cam fulcrum 33 previously discussed) of the lever 32 while providing nearly the same strength as would occur if the lever 32 were, instead, formed entirely of a metal. The reinforcing embedded member 32*b* can extend as far up the upper portion 32*a* of the lever 32, as desired. The reinforcing embedded member 32*b* is formed of any desired material, including any metal or alloy or desired non-metallic material. It is preferred, but not mandatory, that as much of the lever 32 is formed of a polymer or other non-metallic material, as possible. If desired, the lever 32 could be formed entirely of a metal.

Referring now also to FIG. 24 is shown in perspective the first modified lever 32*f* with the modified fulcrum 33*a* that may be used instead of the lever 32 with the nail clipper 10 or any similar embodiment of the invention, as desired. The first modified lever 32*f* is shown with an optional carrying hole 32*g* for attachment to a key chain (not shown) or hanging where desired. The carrying hole 32*g* can also be included with the lever 32, if desired. The first modified lever 32*f*, as shown in FIG. 24, is preferably formed entirely of plastic. The first modified lever 32*f* includes an additional thickness of plastic proximate the modified fulcrum 33*a* to provide additional strength and rigidity in this area. The first modified lever 32*f* also includes a second additional thickness of plastic proximate a mid-portion 32*h* to provide additional strength and rigidity in this area. Additional optional components that significantly help improve the process and end-result of cutting the nail 8 are also included in the first modified lever 32*f* and are later described in greater detail.

Referring now to FIG. 25, the second modified lever 32*f*1 is shown that includes the optional metallic (or formed of any desired material) embedded reinforcing elongated member 32*j* embedded therein. The elongated member 32*j* is shown in dashed lines. A lower portion of the elongated member 32*j* is disposed below the first and second aligned pin openings 32*d*, 32*e* for increased support and strength during use. The elongated member 32*j* is included in the second modified lever 32*f*1, as necessary, to provide additional strength, rigidity and durability to the second modified lever 32*f*1. It is also possible to include a further modified embedded member (not shown) in a variation made to the axially pivoting lever 1132. The axially pivoting lever 1132 is described later.

Referring now momentarily to FIGS. 14, 15, 17 and 23 additional detail of the modified blades 52, 54 is shown. FIG. 17 shows a partial view taken along line 17-17 of FIG. 15 showing the curvature of the modified cutting edges 52*a*, 54*a*. Additionally, the cutting edges 52*a*, 54*a* are shown disposed along a center of the thickness of the modified blades 52, 54, illustrating the cross-sectional profile of image 14*d*1 of FIG. 14. Any of the cutting edges 12*a*, 14*a*, 52*a*, 54*a* can include any desired cross-sectional shape.

FIG. 23 is an enlarged top view of the fifth modified dual parallel opposing blade embedded member nail clipper 500, hereinafter referred to as "the fifth modified nail clipper 500." The lever 32 and the center rod 24 (or the modified two-piece center rod 124) have been removed for improved clarity of construction. The fifth modified nail clipper 500 is identical to the nail clipper 10 (and view shown in FIG. 2) except the fifth modified nail clipper 500 also includes the curved modified blades 52, 54 of FIGS. 15 and 17 instead of the blades 12, 14, and the fifth modified nail clipper 500 includes the curved modified safety bumper 39*a* that better corresponds with the curvature of the modified blades 52, 54 but which is otherwise similar to the safety bumper 39 described before. The lower modified blade 54 is not visible in FIG. 23 because it is inverted and disposed directly below the upper modified blade 52. The curved modified blades 52, 54 are expected to be preferred for many embodiments of the invention due to the benefits provided by the curvature of the modified cutting edges 52*a*, 54*a*, as previously described. However, the blades 12, 14 may be easier or less expensive to manufacture than the modified blades 52, 54 and may also be used in any similar alternate embodiment of the invention, as desired.

Referring now to FIG. 26 is shown the sixth modified dual parallel opposing blade embedded member nail clipper 600, hereinafter referred to as "the sixth modified nail clipper 600." The sixth modified nail clipper 600 is similar to the nail clipper 10 and the cross-sectional view shown in FIG. 9. However, the sixth modified nail clipper 600 includes the modified U-shaped upper member 620 that includes a generally inverted cross-sectional U-shape and an opposing pair of vertical members 602, 604 that are integrally formed with the modified U-shaped upper member 620 during molding (or by any other preferred manufacturing method).

The vertical members 602, 604 extend the overall or maximum vertical height (i.e., thickness) of the modified U-shaped upper member 620 as compared to the upper frame member 20. If desired, the position of a modified top planar surface 620*d* of the modified U-shaped upper member 620 can be disposed at a greater elevation above a modified lower frame member 618 than with the nail clipper 10 because at least a lower portion of the vertical members 602, 604 would be disposed between an opposing pair of modified container sidewalls 618*e*, 618*f*, which would help to ensure that the modified U-shaped upper member 620 remains properly aligned with respect to the modified lower frame member 618 (i.e., between the modified container sidewalls 618*e*, 618*f*) as the modified U-shaped upper member 620 is urged up and down during use. This can be used to increase the distance between the cutting edges 12*a*, 14*a* (not shown) of the blades 12, 14 when the sixth modified nail clipper 600 is disposed in the open position. This would allow for insertion of a thicker example of the nail 8 for cutting, such as would occur if toenail fungus significantly increased the thickness of the nail 8.

Modified ledges 636*a*, 636*b* are optionally included in the modified lower frame member 618. A pair of lower ends 602*a*, 604*a* of the vertical members 602, 604 preferably begin to contact the top surfaces of the modified ledges 636*a*, 636*b* when the sixth modified nail clipper 600 is disposed in the closed position, thereby providing the benefits previously described for the ledges 36*a*, 36*b*.

Referring now to FIG. 27, 27A and FIG. 28, 28A the modified spring clip nail clipper 700, is shown. The modified spring clip nail clipper 700 is a seventh type of a modified nail clipper that is constructed in a manner consistent with the cardinal teachings of the invention.

To illustrate an especially simple and low cost embodiment of the invention, the modified spring clip nail clipper 700 does not include sidewalls. Therefore, the modified spring clip nail clipper 700 would not be able to capture any nail clippings 8*a*, therein. If capture of the nail clippings 8*a* is desired it is, of course, possible to include further modified sidewalls (not shown) attached to either a lower clip frame member 718 or attached to an upper clip frame member 720 or partially attached to both the lower clip frame member 718 and the upper clip frame member 720 (i.e., to include half [or a portion] of the further modified sidewalls extending upward from the lower clip frame member 718 and a remaining half [or a remaining portion] of the further modified sidewalls extending downward from the upper clip frame member 720 so that the upper and lower clip frame members 720, 718 overlap each other or make contact in the closed position). Similar modification to the upper and lower clip frame members 720, 718 to include the further modified sidewalls is possible for various embodiments of the invention including certain embodiments identified by reference numerals 10, 100, 200, 300, 400, 500, 600, 700, 800, 900, 1000, 1100, 1200, 1300, 1400, 1500, 1600, 1700, 2000 and other variations, thereof. To further simplify design and possibly further lower cost, the modified spring clip nail clipper 700 does not include any version of a safety bumper. If desired, the modified spring clip nail clipper 700 could, of course, also include the safety bumper (See FIG. 2, safety bumper 39 and FIG. 23, curved modified safety bumper 39*a*).

The front portion of the modified spring clip nail clipper 700 is either identical or similar to any embodiment of the current invention as previously described. As preferred, the front portion can include any variation described herein or any possible variation of the current invention. The rear portion of the modified spring clip nail clipper 700 can also be further modified, as desired.

The modified spring clip nail clipper 700 includes the spring clip 702, as briefly mentioned earlier. The spring clip 702 provides an important first benefit and an unexpected important second benefit, as described below.

As shown, the lower clip frame member 718 includes a top planar surface 718*d*. To minimize cost, the lower clip frame member 718 does not include a further modified container sidewall (not shown); however, inclusion of any preferred type of the further modified container sidewall is possible for use with the modified spring clip nail clipper 700, as discussed above.

A generally spherical protrusion 706 extends upward from an upper planar upper surface 704 of the lower clip frame member 718. The upper clip frame member 720 includes a modified bottom surface 720*c* and a lower planar surface 708 (See FIGS. 27A and 28A). The lower planar surface 708 includes a spherical recess 710 into which the protrusion 706 is disposed when the lower planar surface 708 of the upper clip frame member 718 is placed atop the upper planar upper surface 704 of the lower clip frame member 718 (See FIGS. 27A and 28A).

The lower clip frame member 718 and the upper clip frame member 720, together, form the modified spring clip frame 716 of the modified spring clip nail clipper 700. After assembly, the modified spring clip frame 716 of the modified spring clip nail clipper 700 includes a U-shape when viewed from the side. If desired, the shape of the upper and lower clip frame members 720, 718 could be modified to include a V-shape or other desired shape when viewed from the side.

An upper arcuate recess 712 is provided in the upper clip frame member 720. A lower arcuate recess 714 is provided in the lower clip frame member 718. The width of the upper and lower arcuate recesses 712, 714 is variable and can be as wide as the upper and lower clip frame members 720, 718 or, if desired, the upper and lower arcuate recesses 712, 714 may include a lesser width that does not extend fully across the width of the upper and lower clip frame members 720, 718. Not having the upper and lower arcuate recesses 712, 714 visible when viewing the modified spring clip nail clipper 700 from the side may be deemed aesthetically preferable. The width of the upper and lower arcuate recesses 712, 714 are sized to accept the spring clip 702, therein.

During manufacture, the upper clip frame member 720 and the lower clip frame member 718 are manufactured as two separate component parts (pieces), preferably by molding. The upper clip frame member 720, when complete, is an assembly that also includes the upper blade 12 or the upper clip frame member 720 as an assembly could instead include the upper modified blade 52 (not shown in FIG. 27 or FIG. 28). The lower clip frame member 718, when complete, is an assembly that similarly includes the lower blade 14 or the lower clip frame member 718, as an assembly could instead include the lower modified blade 54 (not shown in FIG. 27 or FIG. 28) to match the upper modified blade 52, if the upper modified blade 52 is included in the upper clip frame member 720 as an assembly.

The upper clip frame member 720 is placed atop the lower clip frame member 718 while ensuring that the protrusion 706 is disposed inside the spherical recess 710, and while also ensuring that the plane of the lower planar surface 708 is disposed on top of the plane of the upper planar upper surface 704, as shown in FIG. 27. The spring clip 702 is then urged in the direction of arrow 715 (FIG. 27) so that an upper end 702*a* of the spring clip 702 and a lower end 702*b* of the spring clip 702 simultaneously enter and are urged fully into the upper arcuate recess 712 and into the lower arcuate recess 714, as shown in FIG. 27.

The first benefit provided by the spring clip 702 is that it quickly and inexpensively can be inserted, as described above, to secure the upper clip frame member 720 and the lower clip frame member 718 together. This decreases both the time and the cost of manufacture for the modified spring clip nail clipper 700. The second benefit simultaneously provided by the spring clip 702 is that it supplies a force, as described below, that helps urge the modified spring clip nail clipper 700 into the open position. This is useful in that it allows the use of different and possibly less flexible (i.e., having less hysteresis or less elastomeric properties) or less expensive grades of plastic (or other non-metallic material) for construction of the upper clip frame member 720 and the lower clip frame member 718 because hysteresis (i.e., inherent elasticity) of these components is not being significantly relied-upon to urge the modified spring clip nail clipper 700 into the open position. Therefore, a stiffer plastic, for example, could be utilized and may even be preferred, while still ensuring that the modified spring clip nail clipper 700 will be urged into the open position after pressure is released from the lever 32 by force supplied from the spring clip 702. This is described in greater detail, below.

Once inserted, the spring clip 702 supplies a compressive force urging a rear of the upper clip frame member 720 in the direction of arrow 722 and urging a rear of the lower clip frame member 718 in the direction of arrow 724. The center rod 24, the pin 34 and the lever 32 are then added to complete assembly of the modified spring clip nail clipper 700.

The compressive force supplied by the spring clip 702 urges and maintains the modified spring clip nail clipper 700 in the open position unless the lever 32 is depressed or unless the modified spring clip nail clipper 700 is disposed in the rest position (not shown). The spring clip 702 also maintains the upper and lower clip frame members 720, 718 together in a position of cooperation as shown in FIG. 27 and FIG. 28. The modified spring clip nail clipper 700 is disposed into the rest position in a manner similar to that as previously described for the nail clipper 10. When the modified spring clip nail clipper 700 is disposed as shown in FIG. 27, the modified spring clip nail clipper 700 is disposed in the open position.

During use, the lever 32 is depressed until the modified spring clip nail clipper 700 is disposed in the fully closed position (i.e., after having cut the nail 8), as shown in FIG. 28. As the lever 32 is being depressed in the direction of arrow 750, the upper clip frame member 720 and the lower clip frame member 718 pivot with respect to each other around the spherical recess 710 and around the spherical protrusion 706. Depressing the lever 32 progressively urges the upper end 702*a* of the spring clip 702 and the lower end 702*b* of the spring clip 702 further apart than when the modified spring clip nail clipper 700 is disposed in the open position. Therefore, during cutting the spring clip 702 supplies a progressively greater force in the direction of arrows 722 and 724 which, upon release of the lever 32, helps urge the modified spring clip nail clipper 700 back into the open position.

It is generally preferred to include a second spherical protrusion (not shown) beside the spherical protrusion 706 or to include the second spherical protrusion on the opposite assembly (i.e., to include the second spherical protrusion on the upper clip frame member 720), and to also include a second recess (not shown) beside the recess 710 or to include the second recess on the opposite assembly (i.e., to include the second recess on the lower clip frame member 718). This creates a pivot axis that extends between a center of the two spherical protrusions 706 which helps to ensure that a forward portion of the upper clip frame member 720 is disposed in a parallel spaced-apart relationship with respect to a forward portion of the lower clip frame member 718 when the two clip frame members 718, 720 are disposed as shown in FIG. 27. By including the (one) spherical protrusion 706 and the (one) recess 710 side-by-side on both the upper clip frame member 720 and also on the lower clip frame member 718 it is possible for the lower clip frame member 718 and the upper clip frame member 720 to be manufactured as identical component parts, which would significantly decrease manufacturing cost.

Also shown in dashed lines is an optional rear extension 726 that is attached to a rear of the lower clip frame member 718 and which extends upward. If desired, the optional rear extension 726 could be modified so that it was attached to a rear of the upper clip frame member 720 and oriented so it instead extended downward. As best seen by a comparison of FIG. 27 and FIG. 28, with emphasis on FIG. 28, the rear extension 726, if included, provides a covering that extends over the space between the upper planar surface 704 and the lower planar surface 708. This prevents inadvertent insertion of any skin or flesh between the upper planar surface 704 and the lower planar surface 708 when the modified spring clip nail clipper 700 is disposed in the closed position which could later result in pinching of the skin or flesh when the modified spring clip nail clipper 700 is returned to the open position.

Referring now also to FIG. 30 is shown an enlarged cross-sectional view taken through the center rod 24 and looking toward the rear of the eighth modified dual parallel opposing blade embedded member nail clipper 800, hereinafter referred to as "the eighth modified nail clipper 800." The eighth modified nail clipper 800 is disposed in the open position.

The eighth modified nail clipper 800 is similar to the nail clipper 10 except that certain of the component parts of the eighth modified nail clipper 800 are inverted in their positioning with respect to the nail clipper 10. See also FIG. 31 which includes an enlarged full (i.e., complete) bottom view of the eighth modified nail clipper 800.

The eighth modified nail clipper 800 includes the inverted upper frame member 820 that includes the pair of first and second spaced-apart inverted sidewalls 820*e*, 820*f* that are an integral part of the inverted upper frame member 820. Preferably, the eighth modified nail clipper 800 is molded from a desired polymer and the inverted sidewalls 820*e*, 820*f* are molded to become integral with respect to the inverted upper frame member 820. Therefore, the inverted sidewalls 820*e*, 820*f* extend downward from the inverted upper frame member 820 and provide a substantial increase in strength and stiffness of the inverted upper frame member 820. The upper blade 12 is included in the inverted upper frame member 820 and the lower blade 14 is included in the inverted lower frame member 818. Only the horizontal portions 30 of the blades 12, 14 are visible in FIG. 30.

During depression of the lever 32, the fulcrum 33 (not shown in FIG. 30 or FIG. 31) of the lever 32 bears down upon a modified top planar surface 820*d* of the inverted upper frame member 820. The downward force applied to the modified top planar surface 820*d* applies a downward compressive force to the plastic of the inverted upper frame member 820 above the horizontal portion 30 of the upper blade 12 that is transferred through the plastic to the horizontal portion 30 of the upper blade 12. The downward compressive force prevents the upper blade 12 and the inverted upper frame member 820 from being urged away (i.e., upward) from the inverted lower frame member 818.

As the lever 32 is depressed, the pin 34 urges (displaces) the center rod 24 upward as the U-shaped recessed area 32*c* of the lever 32 is raised. This is different than operation of the nail clipper 10 where the center rod 24 of the nail clipper 10 does not move upward during use (i.e., cutting of the nail 8). The enlarged head 24*a* of the center rod 24 applies an upward compressive force to a modified bottom planar surface 818*c* of the inverted lower frame member 818, which applies an upward compressive force to the plastic under the horizontal portion 30 of the lower blade 14 and transfers the upward compressive force to the lower blade 14. The inverted lower frame member 818 is urged upward in response to the upward compressive force until the eighth modified nail clipper 800 is disposed in the closed position. When the eighth modified nail clipper 800 is disposed in the closed position the cutting edges 12*a*, 14*a* abut (i.e., contact) one-another and/or a modified top planar surface 818*d* of the inverted lower frame member 818 makes contact with one or a pair of inverted ledges 836*a*, 836*b* that are optionally included in the inverted sidewalls 820*e*, 820*f* of the inverted upper frame member 820. If a smoother bottom surface is desired, the enlarged head 24*a* can be embedded into the inverted lower frame member 818 consistent with the teachings of FIG. 19 or 20 to provide the smoother bottom surface.

FIG. 31 shows how the inverted lower frame member 818 is attached (i.e., molded) to an inverted rear wall 819 at the rear of the eighth modified nail clipper 800. A remaining portion of the inverted rear wall 819 is molded (i.e., formed) integrally with the inverted upper frame member 820. A rear (or distal end) of the inverted sidewalls 820*e*, 820*f* are also molded to the inverted rear wall 819. The inverted sidewalls 820*e*, 820*f* increase the stiffness of the inverted upper frame member 820. Therefore, during use the inverted upper frame member 820 experiences very little flexing. As a result, and opposite to that of the nail clipper 10, the inverted lower frame member 818 experiences most of the flexing as the lower blade 14 of the inverted lower frame member 818 is urged upward until the eighth modified nail clipper 800 is disposed in the closed position. Because of the added stiffness provided by the inverted sidewalls 820*e*, 820*f*, it may be possible to shorten the horizontal portion 30 of the upper blade 12 as much as desired.

By way of comparison, during use of the nail clipper 10 the upper frame member 20 experiences almost all of the flexing that occurs as the upper frame member 20 is urged downward toward the lower frame member 18. As the upper frame member 20 is urged downward it descends deeper between the first and second container sidewalls 18*e*, 18*f*. By way of contrast, during use of the eighth modified nail clipper 800, the inverted lower frame member 818 experiences the greater portion of flexing and is urged upward toward the inverted upper frame member 820. As the inverted lower frame member 818 is urged upward it progressively rises deeper between the spaced-apart inverted sidewalls 820*e*, 820*f* of the inverted upper frame member 820.

The eighth modified nail clipper 800 illustrates how certain embodiments can be inverted and still adhere to the cardinal teachings of all embodiments of the current invention that include the embedded horizontal portions 30 of at least one of the opposing blades 12, 14 in vertical alignment with at least one of the opposing forces that are simultaneously applied to the upper and lower frame members 20, 18. Therefore, every embodiment of the instant invention significantly reduces the amount of shear that is experienced by the upper and lower frame members 20, 18 which, in turn, allows for the use of polymer or other non-metallic material for construction of the frame 16 (i.e., the greater portion of the upper and lower frame members 20, 18). Alternative methods for embedding other members to provide a similar benefit as the horizontal portion 30 are also described later.

Referring now to FIGS. 32, 32A and 32B is shown in FIG. 32 an enlarged cross-sectional view taken through the center rod 24 and looking toward the rear of the ninth modified dual parallel opposing blade embedded member nail clipper 900, hereinafter referred to as "the ninth modified nail clipper 900." The ninth modified nail clipper 900 includes the floating upper frame member 920 and the floating lower frame member 918 that are each attached at their respective distal ends to a top and a bottom, respectively, of the modified vertical floating rear wall 919. FIG. 32 is a view taken in cross-section through the center rod 24 and looking rearward. FIG. 32A is an enlarged top view of the ninth modified nail clipper 900 of FIG. 32 in an open position after its assembly is complete. FIG. 32B is a smaller scale bottom view of the ninth modified nail clipper 900 of FIG. 32.

The ninth modified nail clipper 900 includes the pair of first and second spaced-apart floating container sidewalls 919*e*, 919*f* that are an integral part of the floating rear wall 919 (i.e., the floating container sidewalls 919*e*, 919*f* are attached at their distal ends to the floating rear wall 919). The floating container sidewalls 919*e*, 919*f* extend forward from the floating rear wall 919. The floating upper frame member 920 and the floating lower frame member 918 are preferably disposed (at least partially) between the floating container sidewalls 919*e*, 919*f* when the ninth modified nail clipper 900 is disposed in the open position, as shown in FIGS. 32, 32A and 32B.

Referring momentarily to FIG. 32A, a pair of first gaps 902*a*, 902*b* extend along the longitudinal length of the floating upper frame member 920 on each side, thereof. The first gaps 902*a*, 902*b* begin proximate a top of the floating rear wall 919 where the floating upper frame member 920 is attached to the floating rear wall 919. The first gaps 902*a*, 902*b* extend forward up to the front of the of the floating upper frame member 920.

Referring momentarily to FIG. 32B, a pair of second gaps 904*a*, 904*b* extend along the longitudinal length of the floating lower frame member 918 on each side thereof. The second gaps 904*a*, 904*b* begin proximate a bottom of the floating rear wall 919 where the floating lower frame member 918 is attached to the floating rear wall 919. The second gaps 904*a*, 904*b* extend forward up to the front of the of the floating lower frame member 918 and up to the front of the floating container sidewalls 919*e*, 919*f*.

The floating upper and lower frame members 920, 918 and the floating sidewalls 919*e*, 919*f* are, therefore, each attached at their respective distal ends to the floating rear wall 919. The floating upper frame member 920 is urged downward in the direction of arrow 902 (FIG. 32) when the lever 32 is depressed and upward in the direction of arrow 904 (FIG. 32) when the lever 32 is released. The floating lower frame member 918 is urged upward in the direction of arrow 904 when the lever 32 is depressed and downward in the direction of arrow 902 when the lever is released. Therefore, the floating upper and lower frame members 920, 918 flex up or down relative to the floating sidewalls 919*e*, 919*f* during use.

During use, the fulcrum 33 (not shown) of the lever 32 applies a downward compressive force to a floating top planar surface 920*d* the floating upper frame member 920 which is urged downward in response to that force. Upward movement by the U-shaped recessed area 32*c* of the lever 32 and by the pin 34 also urges the center rod 24 upward as the floating upper frame member 920 is being urged downward. As the center rod 24 is urged upward, a compressive force is applied by the enlarged head 24*a* of the center rod 24 to a bottom planar surface 918*c* of the floating lower frame member 918 which urges the floating lower frame member 918 upward until the ninth modified nail clipper 900 is disposed in the closed position.

The floating container sidewalls 919*e*, 919*f* do not flex relative to the floating rear wall 919 as the floating upper and lower frame members 920, 918 are urged toward each other (or away from each other) because no vertical compressive force is applied to the floating sidewalls 919*e*, 919*f* during use.

It is possible to create a frame assembly of the ninth modified nail clipper 900, in which the frame assembly includes the floating rear wall 919, the floating upper and lower frame members 920, 918 (with or without the blades 12, 14) and including the optional floating container sidewalls 919*e*, 919*f* as an integral one-piece molded component. The blades 12, 14 may be attached later or included during molding of the floating upper and lower frame members 920, 918 and the floating rear wall 919, as desired. Similarly, the frame 16 of the nail clipper 10 or most embodiments, thereof, that include a version of the one-piece frame 16, can be similarly molded as a one-piece component.

The floating upper and lower frame members 920, 918 of the ninth modified nail clipper 900 are equally flexible with respect to the floating rear wall 919. Accordingly, the ninth modified nail clipper 900 illustrates yet another embodiment of the invention. If desired, the lower frame member 918 of the ninth modified nail clipper 900 may include or omit the optional safety bumper. If the safety bumper is omitted, the frame assembly of the ninth modified nail clipper 900 would include horizontal symmetry with respect to a horizontal plane that passed through a center of the floating container sidewalls 919*e*, 919*f*. This would permit rotation of the frame assembly right-side-up or upside-down during assembly of the ninth modified nail clipper 900. In other words, the frame assembly that included the floating upper frame member 920, the floating lower frame member 918, and the floating rear wall 919 would be identical (i.e., a mirror-image) with respect to a horizontal line passing through the center of the frame assembly. Therefore, whichever of the floating upper and lower frame members 920, 918 was disposed on top after attachment of the center rod 24, the pin 34 and the lever 32 (i.e., whichever one was in contact with the lever 32) would become the floating upper frame member 920. Therefore, the ninth modified nail clipper 900 simplifies assembly and reduces the cost of manufacturing. Flexibility of the floating upper frame member 920 with respect to the floating rear wall 919 is the same as the flexibility of the floating lower frame member 918 with respect to the floating rear wall 919. If desired, either of the floating upper or lower frame members 920, 918 can be modified so that one is stiffer or more flexible than the other.

Referring now to FIG. 34 is view in perspective of the tenth modified dual parallel opposing blade embedded member nail clipper 1000, hereinafter referred to as "the tenth modified nail clipper 1000." FIG. 35 is an enlarged bottom view of the tenth modified nail clipper 1000 of FIG. 34.

The tenth modified nail clipper 1000 includes the pair of spaced-apart gaps 1002, 1004 that extend longitudinally along a top, a rear and a portion of a bottom of the tenth modified nail clipper 1000. The gaps 1002, 1004 help provide an increased level of flexibility of the tenth modified upper frame member 1020 and the tenth modified lower frame member 1018 with respect to a tenth modified rear wall 1019. An optional pair of spaced-apart tenth container sidewalls 1018*e*, 1018*f* that are attached to the tenth modified lower frame member 1018, if included, help contain the nail clippings 8*a*, therein, as do all embodiments that include any version of the sidewalls if sufficiently high. The tenth container sidewalls 1018*e*, 1018*f* are attached to the tenth modified lower frame member 1018 along the longitudinal length of the tenth modified lower frame member 1018 from a front wall, as shown by dashed line 1019*a* (FIG. 35), of the tenth modified rear wall 1019 and extending forward to a front end 1018*b* of the tenth modified lower frame member 1018. Attachment of the tenth container sidewalls 1018*e*, 1018*f* causes the tenth modified lower frame member 1018 to be stiffer (less flexible) along the longitudinal length of the tenth modified lower frame member 1018 than is the tenth modified upper frame member 1020 along its longitudinal length. However, the tenth modified lower frame member 1018 is able to flex in the vicinity of the front wall 1019*a* of the tenth modified rear wall 1019. Certain of the embodiments disclosed, herein, teach different ways of affecting flexibility.

Referring now to FIG. 37 is shown a view in perspective of the axially pivoting dual parallel opposing blade embedded member nail clipper 1100, hereinafter referred to as "the axially pivoting nail clipper 1100," disposed in an open position. Please additionally refer to FIGS. 38 to 48. FIG. 38 is a side view of the axially pivoting nail clipper 1100 of FIG. 37 in the open position. FIG. 39 is a side view of the axially pivoting nail clipper 1100 disposed in a closed position. FIG. 40 is a side view of the axially pivoting nail clipper 1100 in a rest, storage or transit position. FIG. 41 is a cross-sectional view of the axially pivoting nail clipper 1100 taken along line 41-41 of FIG. 38. FIG. 42 is a front view of the axially pivoting nail clipper 1100 of FIG. 37 in the open position. FIG. 43 is a cross-sectional view of the axially pivoting nail clipper 1100 taken along line 43-43 of FIG. 39 with the axially pivoting nail clipper 1100 disposed in the closed position. FIG. 44 is a view in perspective of the axially pivoting lever 1132 of the axially pivoting nail clipper 1100 of FIG. 37. FIG. 45 is a front view of the axially pivoting nail clipper 1100 of FIG. 37 in the closed position. See also the side view of FIG. 39. FIG. 46 is a front view of the axially pivoting nail clipper 1100 of FIG. 37 in the rest or storage position. See also the side view of FIG. 40. FIG. 47 is a top view of the axially pivoting nail clipper 1100 of FIG. 37. FIG. 48 is a bottom view of the axially pivoting nail clipper 1100 of FIG. 37.

Referring now to FIGS. 37, 38, 41, 42, 47 and 48 which show the axially pivoting nail clipper 1100 disposed in the open position and also to FIG. 44. The axially pivoting nail clipper 1100 includes the axially pivoting lever 1132 which pivots around the horizontal axis 1111. The axially pivoting lever 1132 is only able to pivot about the horizontal axis 1111 in either of two directions, as shown by double-ended arrow 1110. Its name reflects this limited range of motion, as the axially pivoting nail clipper 1100 does not include the center rod 24.

The axially pivoting nail clipper 1100 includes an eleventh modified lower frame member 1118. The eleventh modified lower frame member 1118 includes a vertical pair of spaced-apart eleventh container walls 1118*e*, 1118*f*. The eleventh modified lower frame member 1118 includes a bottom planar surface 1118*c* (See FIG. 41). An eleventh modified upper frame member 1120 is disposed between the eleventh container walls 1118*e*, 1118*f*.

The axially pivoting lever 1132 includes a pair of lever protrusions 1132*a*1, 1132*a*2 (FIG. 44) disposed in opposite distal ends of a spaced-apart pair of lever extensions 1132*b*, 1132*c*. The lever protrusions 1132*a*1, 1132*a*2 extend inward from each of their respective lever extensions 1132*b*, 1132*c*.

At an upper end of the lever extensions 1132*b*, 1132*c*, where they are attached to a remainder of the axially pivoting lever 1132, an angled plane 1106 extends across the axially pivoting lever 1132 between each of the lever extensions 1132*b*, 1132*c*. The angled plane 1106 includes a lower edge 1108. The lower edge 1108 is in contact with a top planar surface 1120*d* of the eleventh modified upper frame member 1120 when the axially pivoting nail clipper 1100 is disposed in the open position. When the axially pivoting lever 1132 is depressed, the lower edge 1108 applies a downward compressive force to the top planar surface 1120*d* of the eleventh modified upper frame member 1120. The lower edge 1108 remains in contact with the top planar surface 1120*d* beginning with the open position, continuing during cutting of the nail 8, and continuing when the axially pivoting nail clipper 1100 is disposed in the closed position. As the axially pivoting lever 1132 is progressively depressed, the line of contact between the lower edge 1108 and the top planar surface 1120*d* moves slightly rearward.

The horizontal portion 30 of the upper blade 12 extends rearward in the eleventh modified upper frame member 1120 underneath all possible contact locations by the lower edge 1108 upon the top planar surface 1120*d*. Therefore, the downward compressive force is primarily experienced as a compressive force by the eleventh modified upper frame member 1120.

During cutting of the nail 8 the force applied to the eleventh modified upper frame member 1120 is in vertical alignment with at least some portion of the horizontal portion 30 of the upper blade 12. This applies equally if the modified upper blade 52 is used instead of the upper blade 12.

It is possible to eliminate the lower blade 14 (and to eliminate the lower modified blade 54) from certain single blade versions of the invention that include only the upper blade 12 (or the upper modified blade 52). Two such alternate embodiments are described in greater detail, hereinafter. It is important to note at this time that the force that is applied during cutting of the nail 8 to at least the eleventh modified upper frame member 1120 is always in vertical alignment with at least a portion of the horizontal portion 30 of the upper blade 12 (or 52) that is included. If only the one upper blade 12 (or 52) is included, then the force applied to the upper frame member that includes the one upper blade 12 (or 52) during cutting is applied to the upper frame member in vertical alignment with at least some portion of the horizontal portion 30 of the upper blade 12. The application of force in vertical alignment with some portion of the horizontal portion 30 (or other discreet member as described in greater detail, hereinafter) of at least one blade 12, 14 (or modified blade 52, 54) is a cardinal teaching common to every embodiment of the current invention. Similarly, during cutting of the nail 8 when the lower blade 14 (or 54) is included, an opposing direction force is preferably applied to the lower frame member in vertical alignment with at least some portion of the horizontal portion 30 of the lower blade 14 (or 54). If desired, the additional stiffness provided to the eleventh modified lower frame member 1118 by the eleventh container sidewalls 1118*e*, 1118*f* may allow for shortening of the horizontal portion 30 of the lower blade 14 (or 54).

As the axially pivoting lever 1132 is depressed, a substantial portion of the downward compressive force is transferred through the (preferably) polymer or other non-metallic material of the eleventh modified upper frame member 1120 and to the horizontal portion 30 of the upper blade 12. Accordingly, as the axially pivoting lever 1132 is progressively depressed, the upper blade 12 is urged in a downward direction toward the lower blade 14. Downward movement by the upper blade 12, in combination with the force applied to the eleventh modified upper frame member 1120 by the lower edge 1108, the eleventh modified upper frame member 1120 is urged downward, as required, during cutting of the nail 8.

The user, by holding the axially pivoting nail clipper 1100 supplies an opposing force that resists downward displacement of the eleventh modified lower frame member 1118 as the eleventh modified upper frame member 1120 is urged toward the eleventh modified lower frame member 1118 by the lower edge 1108 of the axially pivoting lever 1132 during cutting of the nail 8.

The nail 8 is, of course, inserted between the opposing cutting edges 12*a*, 14*a* after grasping the axially pivoting nail clipper 1100 and prior to depressing the axially pivoting lever 1132. If desired, the axially pivoting nail clipper 1100 could be placed on a flat secure surface, such as on a table (not shown) near an edge of the table. The nail 8 is then inserted between the cutting edges 12*a*, 14*a* and the axially pivoting lever 1132 is depressed until the axially pivoting nail clipper 1100 is urged into the closed position, as shown in FIGS. 39, 43 and 45. Cutting of the nail 8 with the axially pivoting nail clipper 1100 (or with any other embodiment) is accomplished in a manner similar to that as previously described for the nail clipper 10. Refer to FIGS. 3 and 4 and to the preceding detailed description of the nail clipper 10 for more information regarding usage of the axially pivoting nail clipper 1100 or other embodiment, as disclosed herein. However, because the axially pivoting nail clipper 1100 does not include the center rod 24 of the nail clipper 10, the center rod 24 is not there to interfere with the entry of the nail clipping 8*a* into an interior of the axially pivoting nail clipper 1100. There is a slight possibility that the nail clipping 8*a* may impact the center rod 24 and be ejected out of the nail clipper 10 on rare occasions. The axially pivoting nail clipper 1100 allows for easier entry of the nail clippings 8*a* and may be able to capture a greater percentage of nail clippings 8*a* in its interior.

Accordingly, the eleventh modified upper frame member 1120 experiences less shear (and greater compressive force) which allows for its manufacture substantially from a polymer or other non-metallic material. Similarly, the eleventh modified lower frame member 1118 experiences less shear (and greater compressive force) which allows for its manufacture from a polymer or other non-metallic material. Furthermore, the horizontal portion 30 of the blades 12, 14 increase stiffness and ability of the eleventh modified upper frame member 1120 and, if included, the eleventh modified lower frame member 1118 to withstand whatever level of shear is experienced during cutting of the nail 8.

After assembly of the axially pivoting nail clipper 1100, the lever extensions 1132*b*, 1132*c* extend down from the axially pivoting lever 1132 and over a portion of an exterior of the spaced apart pair of eleventh container sidewalls 1118*e*, 1118*f*. The eleventh container sidewalls 1118*e*, 1118*f* are each attached at a bottom thereof along their longitudinal length to opposite sides of the eleventh modified lower frame member 1118 by molding. Therefore, the eleventh container sidewalls 1118*e*, 1118*f* are integral with respect to the eleventh lower frame member 1118.

Continuing to refer to FIGS. 37 to 47, the nail recesses 41*a*, 41*b* are optionally included in the eleventh container sidewalls 1118*e*, 1118*f*, as desired. An eleventh rear wall 1119 is disposed at a rear of the axially pivoting nail clipper 1100 to complete a container for capture of the nail clippings 8*a*. A rear of the eleventh container sidewalls 1118*e*, 1118*f*, a rear of the eleventh modified upper frame member 1120 and a rear of the eleventh modified lower frame member 1118 are attached to the eleventh rear wall 1119, preferably by molding as integral component parts, thereof. An eleventh modified safety bumper 1139 is optionally included with the axially pivoting nail clipper 1100 to help prevent injury from excessive insertion of the nail 8 between the cutting edges 12*a*, 14*a*.

A pair of aligned holes 1112 are provided in each of the eleventh container sidewalls 1118*e*, 1118*f*. Each of the pair of lever protrusions 1132*a*1, 1132*a*2 is disposed in a corresponding one of the aligned holes 1112. During manufacture of the axially pivoting nail clipper 1100, the eleventh container sidewalls 1118*e*, 1118*f* are momentarily urged inward toward each other slightly and/or the lever extensions 1132*b*, 1132*c* are momentarily urged away from each other an amount sufficient to permit insertion of each of the pair of lever protrusions 1132*a*1, 1132*a*2 into a corresponding one of the aligned holes 1112. The inherent elasticity (i.e., hysteresis) of the eleventh container sidewalls 1118*e*, 1118*f* and/or the lever extensions 1132*b*, 1132*c* helps to return these component parts sufficiently close to their original positions to ensure that the lever protrusions 1132*a*1, 1132*a*2 will each remain in a corresponding one of the aligned holes 1112. If necessary, a momentary outward force urging the eleventh container sidewalls 1118*e*, 1118*f* further apart could also be applied. The outward force applied would be sufficient so that, upon its release, the eleventh container sidewalls 1118*e*, 1118*f* would be restored at or sufficiently close to their vertical positions with respect to the plane of the eleventh modified lower frame member 1118.

It is also possible, as desired, to eliminate the pair of lever protrusions 1132*a*1, 1132*a*2 from the distal ends of the lever extensions 1132*b*, 1132*c* and to instead include a cylindrical opening (not shown) at each of the distal ends of the pair of lever extensions 1132*b*, 1132*c* to provide a modified pair of lever extensions (not shown). A pair of outwardly facing cylindrical protrusions (not shown) would also be included (i.e., molded) in and protruding from an exterior surface of each of the eleventh container sidewalls 1118*e*, 1118*f* to provide a pair of modified eleventh container sidewalls (not shown). During assembly, the modified pair of lever extensions would be urged momentarily outward and the cylindrical opening at each distal end of the modified lever extensions would be placed over each of the outwardly facing cylindrical protrusions of the modified eleventh container sidewalls. Hysteresis (i.e., elasticity) of the modified lever extensions or other means could be utilized to return the modified pair of lever extensions to or sufficiently close to their original positions.

Therefore, as the axially pivoting lever 1132 is urged in either direction as shown by arrow 1110, the lever protrusions 1132*a*1, 1132*a*2 rotate within their respective aligned holes 1112 a corresponding amount. As the axially pivoting lever 1132 is urged downward toward the eleventh modified upper frame member 1120 during use (i.e., when cutting the nail 8), the lever protrusions 1132*a*1, 1132*a*2 bear upward within the aligned holes 112 to provide an upward force to each of the eleventh container sidewalls 1118*e*, 1118*f*. The upward force occurs primarily along a longitudinal length of the eleventh container sidewalls 1118*e*, 1118*f* that is in vertical alignment with respect to a portion of the horizontal portion 30 of the lower blade 14. The upward force is transferred through the eleventh container sidewalls 1118*e*, 1118*f* and to the eleventh modified lower frame member 1118 which, in turn, helps to prevent unwanted downward movement by the eleventh modified lower frame member 1118 with respect to the eleventh modified upper frame member 1120. A significant portion of the upward force is experienced as an upward compressive force that is transferred through the eleventh modified lower frame member 1118 to the horizontal portion 30 of the lower blade 14.

Referring now in particular to FIGS. 39, 43 and 45 the axially pivoting nail clipper 1100 is disposed in the closed position. The lower edge 1108 and the angled plane 1106 of the axially pivoting lever 1132 progressively descends into a pair of spaced-apart aligned recesses 1102, 1104 that are provided in a top of each of the eleventh container sidewalls 1118*e*, 1118*f*. The aligned recesses 1102, 1104 allow for the axially pivoting lever 1132 to be urged sufficiently downward toward the eleventh modified upper frame member 1120 to place the axially pivoting nail clipper 1100 in the closed position.

The aligned recesses 1102, 1104 and/or a top edge of the eleventh container sidewalls 1118*e*, 1118*f* also provide a limit stop which prevents the axially pivoting lever 1132 from being excessively urged downward beyond the closed position for the axially pivoting nail clipper 1100. Therefore, the ledges 36*a*, 36*b* of the nail clipper 10 are unnecessary with the axially pivoting nail clipper 1100, though they could be included if desired for any particular reason.

To place the axially pivoting nail clipper 1100 in the rest or transit position, as shown in FIGS. 40 and 46, beginning with the axially pivoting nail clipper 1100 disposed in the open position, the axially pivoting lever 1132 is urged according to a left portion of arrow 1110 in a direction that initially urges the axially pivoting lever 1132 away from the eleventh modified upper frame member 1120. The lever protrusions 1132*a*1, 1132*a*2 rotate within their respective aligned holes 1112 around the center longitudinal horizontal axis 1111 until the axially pivoting lever 1132 is disposed as shown in FIG. 40. This places the axially pivoting nail clipper 1100 in the rest or transit position, also referred to herein as the storage position.

Friction between an exterior surface of the eleventh container sidewalls 1118*e*, 1118*f* and an interior surface of the lever extensions 1132*b*, 1132*c* helps to retain the axially pivoting lever 1132 in the position shown in FIG. 40. Friction is controlled by selectively increasing and/or decreasing a thickness of the eleventh container sidewalls 1118*e*, 1118*f*. Increasing thickness increases friction.

The thickness of the eleventh container sidewalls 1118*e*, 1118*f* is controlled to permit easy motion by the axially pivoting lever 1132 between the open and closed positions of the axially pivoting nail clipper 1100 by keeping the thickness of the eleventh container sidewalls 1118*e*, 1118*f* sufficiently thin along the arc traversed in either direction by the axially pivoting lever 1132 between the open and closed positions.

The thickness of the eleventh container sidewalls 1118*e*, 1118*f* is progressively increased to provide an increased level of friction as the axially pivoting lever 1132 is urged toward the rest or transit position. Ideally, just prior to reaching the rest or transit position, the thickness of the eleventh container sidewalls 1118*e*, 1118*f* is decreased over a short distance to latch (i.e., help secure) the axially pivoting lever 1132 in the rest or transit position at or just prior to the moment the axially pivoting lever 1132 reaches the rest or transit position.

The ability to vary mold thickness parameters in order to affect thickness of the eleventh container sidewalls 1118*e*, 1118*f* and, accordingly, vary friction of the pivoting lever 1132 along its entire length of arc (per arrow 1110) and to be able to latch the axially pivoting lever 1132 in the rest position by controlling the thickness profile of the eleventh container sidewalls 1118*e*, 1118*f* is an unexpected benefit that is not known or available with similar relevant dual parallel opposing blade types of prior art nail clippers.

To urge the axially pivoting nail clipper 1100 from the rest or transit position into the open position, the end of the axially pivoting lever 1132 is grasped and the axially pivoting lever 1132 is urged in the opposite direction (as occurred when placing the axially pivoting nail clipper 1100 in the rest or transit position) until the axially pivoting nail clipper 1100 is disposed in the open position. The axially pivoting nail clipper 1100 is then ready for use. The axially pivoting nail clipper 1100 allows for quick and easy transition between the open position and the rest or transit (i.e., storage) position.

Accordingly, the axially pivoting nail clipper 1100 provides both ease and simplicity of use along with certain significant benefits that are not available with the prior art devices.

Referring now to FIG. 49 is shown a view in perspective of the modified dual parallel opposing blade embedded member axially pivoting nail clipper 1200, and hereinafter referred to as "the modified axially pivoting nail clipper 1200" disposed in an open position. The modified axially pivoting nail clipper 1200 is similar to the axially pivoting nail clipper 1100 except for the differences described herein. Therefore, additional drawing figures other than FIG. 49 are not required to understand the differences.

The modified axially pivoting nail clipper 1200 includes a twelfth modified upper frame member 1220 that includes a top planar surface 1220*d* that is disposed further (i.e., higher) above a twelfth modified lower frame member 1218 than the axially pivoting nail clipper 1100. The twelfth modified upper frame member 1220 may be fabricated so it is thicker than the eleventh modified upper frame member 1120 of the axially pivoting nail clipper 1100. If desired, the twelfth modified upper frame member 1220 may be fabricated to include the vertical members 602, 604 of the sixth modified nail clipper 600 on opposite sides, thereof, which would make the twelfth modified upper frame member 1220 appear thicker. A rear of the twelfth modified upper frame member 1220 is attached to a twelfth modified rear member 1219.

The twelfth modified upper frame member 1220 is disposed between a vertical pair of spaced-apart twelfth container sidewalls 1218*e*, 1218*f*. A rear of each of the twelfth container sidewalls 1218*e*, 1218*f* is attached to the twelfth modified rear member 1219. A lower longitudinal end of each of the twelfth container sidewalls 1218*e*, 1218*f* is attached to the twelfth modified lower frame member 1218. The twelfth container sidewalls 1218*e*, 1218*f* stiffen the twelfth modified lower frame member 1218. Therefore, it is the twelfth modified upper frame member 1220 that does most of the flexing during use when the modified axially pivoting nail clipper 1200 is urged into the closed position.

The twelfth container sidewalls 1218*e*, 1218*f* of the modified axially pivoting nail clipper 1200 do not include the aligned recesses 1102, 1104 of the axially pivoting nail clipper 1100. This is because the increased elevation of the top planar surface 1220*d* of the modified axially pivoting nail clipper 1200 allows lowering of the axially pivoting lever 1132 downward (as shown by the right-most portion of arrow 1110) to occur until the modified axially pivoting nail clipper 1200 is disposed in the closed position. When the modified axially pivoting nail clipper 1200 is disposed in the closed position, the lower edge 1108 of the angled plane 1106 is disposed at, or slightly above, an upper surface of the twelfth container sidewalls 1218*e*, 1218*f*, thereby obviating the need for the aligned recesses 1102, 1104 of the axially pivoting nail clipper 1100. Additionally, the modified axially pivoting nail clipper 1200 does not need to include the ledges 36*a*, 36*b* of the nail clipper 10 because contact by the lower edge 1108 of the angled plane 1106 upon the top edges of the twelfth container sidewalls 1218*e*, 1218*f* prevent further excessive downward depression of the axially pivoting lever 1132.

A possible additional advantage provided by the modified axially pivoting nail clipper 1200 is that it is possible, because of the increased distance between the twelfth modified lower frame member 1218 and the twelfth modified upper frame member 1220 when the modified axially pivoting nail clipper 1200 is disposed in the open position, to dispose the cutting edges 12*a*, 14*a*, of the blades 12, 14 even further apart. This is useful in allowing insertion of extra thick versions of the nail 8 between the cutting edges 12*a*, 14*a*.

It is possible to modify the modified axially pivoting nail clipper 1200 by removing the axially pivoting lever 1132 and instead, including the center rod 24 (i.e., a longer version), the lever 32 and the pin 34, as desired. The center rod 24 would pass through corresponding aligned openings provided through the twelfth modified upper frame member 1220 and through the twelfth modified lower frame member 1218, similar to those of the nail clipper 10. This proposed modification is further illustrative of the flexibility provided by the instant invention and it would provide another embodiment of the invention with yet another different appearance and functionality that some people may prefer. One such embodiment that includes the modified blades 52, 54 is shown in FIG. 49A, and described below.

Referring now momentarily to FIG. 49A is shown a view in perspective of the raised dual parallel opposing blade embedded member nail clipper 1200*a*, hereinafter referred to as "the raised nail clipper 1200*a*." The raised nail clipper 1200*a* is similar to the modified axially pivoting nail clipper 1200 of FIG. 49. However, the raised nail clipper 1200*a* instead includes the modified rotating lever 1132*a* that cooperates with the proper length center rod 24*a*1. As shown, the raised nail clipper 1200*a* includes the curved opposing modified blades 52, 54. The raised nail clipper 1200*a* helps illustrate that different configurations using different types of levers are possible for various embodiments of the invention and that either straight or curved blades (12, 14, 52, 54) can be included in any embodiment of the invention.

As shown the raised nail clipper 1200*a* includes an altered twelfth modified upper frame member 1220*a* that is similar to the twelfth modified upper frame member 1220 of the modified axially pivoting nail clipper 1200, however the altered twelfth modified upper frame member 1220*a* includes an opening for the proper length center rod 24*a*1 to pass through and engage with the modified rotating lever 1132*a*. An altered twelfth modified lower frame member 1218*a* is included and is similar to the twelfth modified lower frame member 1218, however the altered twelfth modified lower frame member 1218*a* includes an opening for a lower portion of the proper length center rod 24*a*1 to pass through. Alternately, the proper length center rod 24*a*1 could be further modified, if desired, so that the lower portion of the proper length center rod 24*a*1 is molded to an upper surface of the altered twelfth modified lower frame member 1218*a* and extends upward therefrom as an integral component part of the altered twelfth modified lower frame member 1218*a*. See FIG. 64 and a detailed description hereinafter noting, in particular, the related discussion appertaining to a shortened lower portion 2106 of the rotating center rod 2100. These further teachings may be applied, as desired, to the proper length center rod 24*a*1 or to any other version of the center rod 24 as desired.

Additionally, the sidewalls (not identified by reference numerals) of the altered twelfth modified lower frame member 1218*a* do not include the aligned openings therein that the twelfth container sidewalls 1218*e*, 1218*f* of the modified axially pivoting nail clipper 1200 include, because the axially pivoting lever 1132 is not used with the raised nail clipper 1200*a*. Accordingly, the raised nail clipper 1200*a* further illustrates that a modified and higher version of the upper frame member 20 of the nail clipper 10 (in this example, the altered twelfth modified upper frame member 1220*a*) can be used in any version of the nail clipper 10 that includes any preferred variation of the center rod 24, as desired.

Referring now to FIGS. 50-53 is shown the first single blade embedded member nail clipper 1300, hereinafter referred to as "the first single blade nail clipper 1300." FIG. 50 is a view in perspective, FIG. 51 is a side view in the open position, FIG. 52 is a side view in the closed position, and FIG. 53 is a side view in the rest or storage (transit) position. Please also refer to the various drawing figures appertaining specifically to the nail clipper 10 (FIGS. 1-17, 29, 36 and closely related FIGS. 18 and 33. as the first single blade nail clipper 1300 includes considerable structure in common with the nail clipper 10. Also shown on FIGS. 50 and 51 is the optional file 1398. The file 1398 may optionally be included in any desired embodiment, whether single or dual blade.

The first single blade nail clipper 1300 includes a thirteenth modified upper frame member 1320 that includes the upper blade 12 embedded therein. The upper blade 12 includes the horizontal portion 30 embedded sufficiently far into the thirteenth modified upper frame member 1320 to ensure that the downward force applied by the fulcrum 33 is above at least some portion of the horizontal portion 30 of the upper blade 12.

The thirteenth modified upper frame member 1320 is substantially similar to the upper frame member 20 of the nail clipper 10. A thirteenth modified lower frame member 1318 includes an attached opposing pair of thirteenth modified container sidewalls 1318*e*, 1318*f*. A rear or distal end of the thirteenth modified upper frame member 1320, a rear or distal end of the thirteenth modified container sidewalls 1318*e*, 1318*f*, and a rear or distal end of a remainder of the thirteenth modified lower frame member 1318 are attached to a thirteenth modified rear wall 1319, thereby forming a container for containment of one or more of the nail clippings 8*a*.

The first single blade nail clipper 1300 does not include the opposing lower blade 14 (or the modified lower blade 54). Instead, the thirteenth modified lower frame member 1318 includes a truncated front end 1318*b*. As shown, the truncated front end 1318*b* does not include any version of the safety bumper 39, however, the truncated front end 1318*b* could be modified to include a version of the safety bumper 39, as desired.

The truncated front end 1318*b* includes an upper planar surface, identified in general by the reference numeral 1395, that extends a small amount forward and rearward of the upper cutting edge 12*a* of the upper blade 12 when the first single blade nail clipper 1300 is disposed in the closed position. See FIG. 52. Therefore, when the first single blade nail clipper 1300 is urged into the closed position, the upper cutting edge 12*a* of the upper blade 12 is in contact with (i.e., it abuts) the upper planar surface 1395 along the longitudinal length of the upper cutting edge 12*a* of the upper blade 12 (or along the longitudinal length of the upper cutting edge 52*a* of the modified upper blade 52). Therefore, the upper cutting edge 12*a* is parallel with respect to the upper planar surface 1395 when the first single blade nail clipper 1300 is disposed in the closed position. The upper cutting edge 12*a* is also parallel with respect to the upper planar surface 1395 when the first single blade nail clipper 1300 is disposed in the open position, as well as during any intermediate position between the open position and the closed position.

An optional embedded hardened planar surface 1399 is shown in dashed lines. If included, the hardened planar surface 1399 is either embedded into a recess provided in the upper planar surface 1395 (as shown) or the hardened planar surface 1399 is attached on top of the upper planar surface 1395 (not shown). The hardened planar surface 1399 is formed of any desired material that is harder than the plastic (or other non-metallic material) used to form the thirteenth modified lower frame member 1318. Steel, ceramic or any other sufficiently hard material can be used to form the hardened planar surface 1399. The hardened planar surface 1399 includes any desired thickness. A length of the hardened planar surface 1399 is preferably equal to or slightly greater than an overall width (i.e., the longitudinal length) of the upper cutting edge 12*a*. A width of the hardened planar surface 1399 is sufficient to ensure that the upper cutting edge 12*a* is in contact with the hardened planar surface 1399 when the first single blade nail clipper 1300 is disposed in the closed position or to ensure that the modified cutting edge 52*a* is in contact with the hardened planar surface 1399.

The hardened planar surface 1399 is secured in position by friction or by adhesive, or by any other preferred means, for example, by including a dovetail perimeter with the hardened planar surface 1399 and by molding the hardened planar surface 1399 in position within the upper planar surface 1395. Because the hardened planar surface 1399 is sufficiently hard it is better able to withstand repeated impacts from the upper cutting edge 12*a* during use. Therefore, inclusion of the optional hardened planar surface 1399 is anticipated to increase the useful life of the first single blade nail clipper 1300. The first single blade nail clipper 1300 provides a lower cost version of the invention. Therefore, for certain versions of the first single blade nail clipper 1300, the hardened planar surface 1399 may be omitted when a shorter useful life (for any single-blade version of the invention) is acceptable and even lower cost is desired.

If the modified upper blade 52 is used instead of the upper blade 12 with the first single blade nail clipper 1300 the shape of the truncated front end 1318*b* and the shape of the optional hardened planar surface 1399 (if included) are modified to correspond with the curvature of the modified upper blade 52.

Beginning at the truncated front end 1318*b* and extending rearward into the thirteenth modified lower frame member 1318 a desired amount beyond (i.e., rearward) from the enlarged head 24*a* of the center rod 24, a stiffening plate 1396 is embedded into the thirteenth modified lower frame member 1318. The stiffening plate 1396 functions similar to the horizontal portion 30 of the lower blade 14 of the nail clipper 10 by strengthening and stiffening the thirteenth modified lower frame member 1318, decreasing an amount of shear experienced by the thirteenth modified lower frame member 1318 in this area while simultaneously increasing the ability of the thirteenth modified lower frame member 1318 to withstand shear in this area (i.e., along the length of the stiffening plate 1396).

The stiffening plate 1396 is preferably molded into the thirteenth modified lower frame member 1318. However, the stiffening plate 1396 may be inserted into an opening (not shown) that is provided in a front end of the truncated front end 1318*b* in a manner similar to the way that the lower blade 14 may be inserted (i.e., embedded) into the lower opening 13*b* of the modified opening nail clipper 10*a*, as shown in FIG. 33 and previously described. The same option for insertion of the upper blade 12 is also available.

Because the enlarged head 24*a* is disposed in vertical alignment under the stiffening plate 1396, an upward force applied by the enlarged head 24*a* to a bottom planar surface 1318*c* of the thirteenth modified lower frame member 1318 is experienced largely as a compressive force attempting to urge upward and compress the plastic (or other non-metallic material) that the thirteenth modified lower frame member 1318 is formed of. A portion of the compressive force is transferred upward through the plastic to the stiffening plate 1396, which is able to withstand the upward compressive force and any remaining shear force that is experienced by a forward portion of the thirteenth modified lower frame member 1318.

Additionally, the stiffening plate 1396 is also preferably extended forward so that a front portion or a front edge of the stiffening plate 1396 is disposed under and in vertical alignment with the upper cutting edge 12*a* when the first single blade nail clipper 1300 is disposed in the closed position or as close as possible to being in vertical alignment. Accordingly, the stiffening plate 1396 decreases in magnitude a downward shear force supplied by the upper cutting edge 12*a* that is experienced by the thirteenth modified lower frame member 1318 during cutting of the nail 8 by converting some of the downward shear force into a compressive force that is transferred to a forward portion of an upper surface of the stiffening plate 1396. The stiffening plate 1396 is similar in construction to the horizontal portion 30 of the blades 12, 14, however, the length, width and thickness of the stiffening plate 1396 may be varied, as desired, to provide the desired mechanical support. The center rod 24 passes through an opening provided in the stiffening plate 1396. If desired, the enlarged head 24*a* can be embedded into the thirteenth modified lower frame member 1318.

Accordingly, the first single blade nail clipper 1300 includes the horizontal portion 30 of the upper blade 12 (or the horizontal portion 30 of the modified upper blade 52) embedded in the thirteenth modified upper frame member 1320 which decreases a magnitude of shear experienced by the thirteenth modified upper frame member 1320 during use. All embodiments of the invention other than the inverted variations include an improvement to the upper blade 12 (or to the modified upper blade 52) whereby the upper blade 12 (or the modified upper blade 52) includes the horizontal portion 30 or include an alternate type of embedded member in at least one frame member and wherein the cutting force applied to the upper frame member 20 or to any embodiment or modification, thereof, occurs in vertical alignment with at least a portion of the horizontal portion 30 of the upper blade 12 (or the modified upper blade 52) or with the alternate type of embedded member. This is cardinal to all embodiments of the invention, whether single blade or dual parallel opposing blade variations.

Because certain embodiments of the invention include horizontal symmetry and can be manufactured with either side upward (see FIG. 32), and because certain single blade embodiments can also be similarly used upside-down, it is understood that when only one blade is included, that blade is referred to as the upper blade 12 or as the upper modified blade 52. Therefore, all embodiments of the invention, whether single blade or dual parallel opposing blade embodiments, include the upper blade 12 (or the upper modified blade 52) and all embodiments include the embedded horizontal portion 30 of the upper blade 12 (or of the modified upper blade 52) or an alternate type of at least one embedded member.

Single blade versions of the invention, such as the first single blade nail clipper 1300 and other single blade embodiments, preferably also include the stiffening plate 1396 for the reasons described hereinabove. However, it may be possible to provide sufficient structural integrity to the thirteenth modified lower frame member 1318 by sufficiently increasing thickness of the thirteenth modified lower frame member 1318 and/or by reliance on the thirteenth modified container sidewalls 1318*e*, 1318*f* (or modification to the thirteenth modified container sidewalls 1318*e*, 1318*f*) in order to provide sufficient structural integrity to the thirteenth modified lower frame member 1318 to permit fabrication of the first single blade nail clipper 1300 or any other single blade version without inclusion of the embedded stiffening plate 1396. If desired, the optional safety ledges 36*a*, 36*b* (36*a* is only shown) may be included or other means, as previously described, to prevent damage from excessive pressure to the lever after reaching a closed position.

Referring again to the nail clipper 10 and to other dual parallel opposing blade embodiments of the invention that also include the improvement to the lower blade 14 or to the modified lower blade 54 of the attached horizontal portion 30 that is embedded into the lower frame member 18 and wherein the cutting force that is applied to the lower frame member 18 occurs in vertical alignment with at least a portion of the horizontal portion 30 of the lower blade 14 (or the modified upper blade 54) the above teaching of reliance upon the container sidewalls 18*e*, 18*f* can be used to shorten the horizontal portion of the lower blade 14. Accordingly, for certain dual parallel opposing blade embodiments of the invention that include the upper blade 12 (or the modified upper blade 52) and the attached and embedded horizontal portion 30 of the upper blade 12 (or the modified upper blade 52) consistent with the cardinal teaching of the invention, an additional modification may be made to the lower frame member 18 (of any dual parallel opposing blade version) to increase the lower frame member's 18 strength and stiffness by increasing the lower frame member's 18 thickness and/or by inclusion of the opposing container sidewalls 18*e*, 18*f* or by further modification to the opposing container sidewalls 18*e*, 18*f* with reliance on the opposing container sidewalls 18*e*, 18*f* to increase the overall stiffness of a further modified version (not shown) of the lower frame member 18 sufficient for the further modified version of the lower frame member 18 to withstand the upward cutting force applied, thereto, without use of the longer horizontal portion 30 of the lower blade 14 or use of the horizontal portion 30 of the modified lower blade 54. Instead, a non-embedded lower blade (not shown) or a shortened lower blade (not shown) that includes a shorter horizontal portion 30, though not preferred could be included, if desired, instead of the lower blade 14 or the modified lower blade 54.

Therefore, all versions of the invention must minimally include the upper blade 12 (or the modified upper blade 52) or any blade disclosed herein and the attached horizontal portion 30 or include the alternative type of at least one embedded member embedded into or attached to the upper frame member 20 (or embedded into any variation of the invention that includes a type of frame member) that flexes during use.

It is to be understood that any of the teachings herein can be applied to any embodiment, as desired. For example, the variations as shown in FIGS. 19-21 may be included with the first single blade nail clipper 1300, as desired. Similarly, later disclosed teachings can be selectively applied to earlier disclosed embodiments.

Referring now to FIGS. 54 to 57 the second single blade embedded member nail clipper 1400, hereinafter referred to as "the second single blade nail clipper 1400" is shown. FIG. 54 is a view in perspective, FIG. 55 is a side view in the open position, FIG. 56 is a side view in the closed position after cutting of the nail 8 has been accomplished thereby leaving the nail clipping 8*a* disposed within an interior of the second single blade nail clipper 1400, and FIG. 57 is a side view in the rest or storage (transit) position. Please also refer to the various drawing figures appertaining to the first single blade nail clipper 1300 and also to the various drawing figures appertaining to the axially pivoting nail clipper 1100 as the second single blade nail clipper 1400 includes considerable structure in common with the first single blade nail clipper 1300 and the axially pivoting nail clipper 1100.

The second single blade nail clipper 1400 is similar to the first single blade nail clipper 1300, except the second single blade nail clipper 1400 includes the axially pivoting lever 1132 of the axially pivoting nail clipper 1100 and a few other differences. Therefore, an opposing pair of fourteenth sidewalls 1418*e*, 1418*f* that are attached to a fourteenth modified lower frame member 1418 include a pair of second spaced-apart aligned recesses 1402, 1404, respectively, that permit the angled plane 1106 and the lower edge 1108 of the axially pivoting lever 1132 to descend sufficiently far to urge the second single blade nail clipper 1400 into the closed position. Also, the fourteenth sidewalls 1418*e*, 1418*f* include the pair of aligned holes 1112 for placement of the pair of lever protrusions 1132*a*1, 1132*a*2, therein.

The second single blade nail clipper 1400 includes the truncated front end 1318*b* and the upper planar surface 1395 of the first single blade nail clipper 1300. The second single blade nail clipper 1400 may also optionally include the hardened planar surface 1399 of the first single blade nail clipper 1300, as desired.

The second single blade nail clipper 1400 includes a fourteenth modified upper frame member 1420 that includes a fourteenth modified top planar surface 1420*d* that the lower edge 1108 of the axially pivoting lever 1132 bears down upon. The second single blade nail clipper 1400 also includes a fourteenth modified rear wall 1419 to which the fourteenth modified upper and lower frame members 1420, 1418 are attached. The second single blade nail clipper 1400 includes a longer stiffening plate 1496 than the stiffening plate 1396 of the first single blade nail clipper 1300 to ensure that the longer stiffening plate 1496 is in vertical alignment with the downward force applied by the lower edge 1108.

It is to be understood that any of the elements described in any disclosed embodiment can be modified or adapted, as desired, and used in combination with other elements described in other embodiments to provide additional variations of the invention that are neither shown nor described, herein. Therefore, certain possible further modifications, not shown or described herein, will similarly become obvious to those having ordinary skill in the art after having had benefit of the full instant disclosure. Therefore, other possible modifications based on desired combinations of the teachings herein, or upon further modification of these teachings are anticipated as being within the scope and spirit of the current invention.

It is important to appreciate that the upper and lower frame members 20, 18 (including modifications, thereto, as found in all other embodiments) experience decreased shear because of the horizontal portions 30 or inclusion of the alternate type of at least one embedded member in at least one of the frame members as described in greater detail below and their vertically aligned positions with respect to the forces that are applied to at least one of the frame members during cutting of the nail 8. Additionally, it is also important to note that whatever remaining shear force is still experienced by the frame members during use, they are able to withstand the remaining level of shear. This important improvement allows for the use of plastic or other non-metallic materials for the upper and lower frame members 20, 18 (i.e., the frame 16) of the nail clipper 10 and for all other embodiments, disclosed herein or arising as a result of further modification based on the teachings, herein.

Referring now to FIG. 58A is shown a side view of a first dual parallel opposing blade discreet embedded member nail clipper 1500, hereinafter referred to as "the first embedded member nail clipper 1500" disposed in an open position.

The first embedded member nail clipper 1500 is intended to illustrate a possible modification of the teachings, herein. The embedded shortened upper blade 1512 is molded or otherwise inserted into a fifteenth modified upper frame member 1520. The embedded shortened lower blade 1514 is molded or otherwise inserted into or attached to a fifteenth modified lower frame member 1518.

The first embedded member nail clipper 1500 includes the lever 32 that includes the fulcrum 33 which supplies a downward force to the fifteenth modified upper frame member 1520. Line 1501 passes through the fulcrum 33 and illustrates a first vertical line, along which the downward force is applied to a top surface of the fifteenth modified upper frame member 1520 during cutting of the nail 8. Line 1502 passes through a center longitudinal axis of the center rod 24 and illustrates a second vertical line, along which an upward force is applied to a bottom surface of the fifteenth modified lower frame member 1518 during cutting of the nail 8 by the enlarged head 24*a* of the center rod 24.

A first upper embedded member 1530*a* is embedded proximate a front of the fifteenth modified upper frame member 1520 and extending rearward. The first upper embedded member 1530*a*, as shown, is disposed above a portion of a shortened horizontal portion 1512*a* of the shortened upper blade 1512. The first upper embedded member 1530*a* begins forward of the line 1502 and it extends further rearward than the line 1501. A second upper embedded member 1530*b* is embedded proximate the front of the fifteenth modified upper frame member 1520 and is disposed under the shortened horizontal portion 1512*a* of the shortened blade 1512. The second upper embedded member 1530*b* also begins forward of the line 1502 and it also extends further rearward than the line 1501. Therefore, a portion of each of the first and second upper embedded members 1530*a*, 1530*b* are in vertical alignment with both the downward force and the upward force during cutting of the nail 8. The first upper embedded member 1530*a* can be included with the shortened blade 1512 without inclusion of the second upper embedded member 1530*b*. Similarly, the second upper embedded member 1530*b* can be included with the shortened blade 1512 without inclusion of the first upper embedded member 1530*a*.

A lower embedded member 1530*c* is embedded proximate a front of the fifteenth modified lower frame member 1518 and extending rearward. The lower embedded member 1530*c*, as shown, is disposed below a portion of a shortened lower horizontal portion 1514*a* of a shortened lower blade 1514. The lower embedded member 1530*c* begins forward of the line 1502 and it extends further rearward than the line 1501. Only the one (i.e., the lower embedded member 1530*c*) is shown as being disposed in the fifteenth modified lower frame member 1518. However, additional lower embedded members 1530*c* (not shown) may also be included. As shown, the shortened horizontal portion 1512*a* and the shortened lower horizontal portion 1514*a* are not disposed in alignment with either the line 1502 or the line 1501. Therefore, the shortened horizontal portion 1512*a* and the shortened lower horizontal portion 1514*a* do not provide the benefits of the horizontal portions 30, previously discussed.

To be of maximum benefit, a portion of at least one of the upper embedded members 1530*a*, 1530*b* is in vertical alignment with a portion of the shortened horizontal portion 1512*a*. If included, a portion of the lower embedded member 1530*c* is in vertical alignment with a portion of the shortened lower horizontal portion 1514*a*.

The first upper embedded member 1530*a* and/or the second upper embedded member 1530*b* and/or the lower embedded member 1530*c* duplicate certain of the essential benefits provided by the horizontal portion 30 of the blades 12, 14. In particular a portion of the upper and lower embedded members 1530*a*, 1530*b*, 1530*c* are disposed in vertical alignment with the cutting forces, as represented by the lines 1501 and 1502. This provides similar stiffening of the fifteenth modified lower and upper frame members 1518, 1520 which helps them to better withstand shear force and other forces during use. Additionally, the upper and lower embedded members 1530*a*, 1530*b*, 1530*c* help to convert a portion of the downward and the upward forces applied to the fifteenth modified lower and upper frame members 1518, 1520 into a compressive force that is transferred to the shortened lower blade 1514 and/or to the shortened upper blade 1512, thereby decreasing an amount of shear experienced by the fifteenth modified lower and upper frame members 1518, 1520.

However, use of the horizontal portion 30 attached to the blades 12, 14 (or 52, 54) is preferred because the horizontal portion 30 provides a better anchoring and increased strength for the blades 12, 14 (52, 54) and a better transfer of the downward and upward forces to the cutting edges 12*a*, 14*a* (52*a*, 54*a*) of the blades 12, 14 (52, 54) than occurs with the shortened blades 1512, 1514.

The upper and lower embedded members 1530*a*, 1530*b*, 1530*c* illustrate use of the alternate type of at least one embedded member that provides an alternate means for decreasing a magnitude of shear force that is experienced while simultaneously increasing an ability to withstand shear. Other alternate types of embedded members are described below.

The upper and lower embedded members 1530*a*, 1530*b*, 1530*c* along with the shortened upper and lower blades 1512, 1524 are shown to illustrate a possible modification consistent with the cardinal teachings of the invention, that the horizontal portion 30 acts as an embedded member to stiffen, strengthen the upper and lower frame members to better withstand the forces experienced during use and also to lessen a magnitude of shear force that is experienced during use, thereby permitting the use of a polymer (i.e., a plastic) or other non-metallic material for the remainder (or bulk) of the frame members for any embodiment of the invention. If included, a pair of fifteenth spaced-apart sidewalls 1518*e*, 1518*f* (1518*f* is not shown) may be used to supply sufficient stiffening and resistance to shear for the fifteenth modified lower frame member 1518 to allow for omission of the lower embedded member 1530*c*.

Referring now to FIG. 58B is shown a side view of the second dual parallel opposing blade discreet embedded member nail clipper 1600, hereinafter referred to as "the second embedded member nail clipper 1600" disposed in an open position. The purpose of illustrating the second embedded member nail clipper 1600 is similar to that of the first embedded member nail clipper 1500, however the second embedded member nail clipper 1600 illustrates use of a third upper embedded member 1604 and a second lower embedded member 1605. The third upper embedded member 1604 and the second lower embedded member 1605 are more centrally located within a respective sixteenth upper frame member 1620 and a respective sixteenth lower frame member 1618, which improves strength.

As shown, the second embedded member nail clipper 1600 includes the shortened upper wrap-around blade 1612 and the shortened lower wrap-around blade 1614. Additional teaching regarding the wrap-around blades 1612, 1614 is found in the priority references, disclosed in the first paragraph of the instant specification and included herein by way of reference. However, a wrap-around portion 1612*a*, 1614*a* of each of the wrap-around blades 1612, 1614 is so short that the wrap-around portions 1612*a*, 1614*a* do not extend in vertical alignment with either line 1502 or line 1501. Therefore, the wrap-around portions 1612*a*, 1614*a* do not by themselves sufficiently stiffen or reinforce the sixteenth upper and lower frame members 1620, 1618 to allow the sixteenth upper and lower frame members 1620, 1618 to be formed of plastic (i.e., a polymer).

To be of maximum benefit, a portion of the third upper embedded member 1604 and the second lower embedded member 1605 is in vertical alignment with a portion of the wrap-around portions 1612*a*, 1614*a*. A portion of the third upper embedded member 1604 and a portion of the second lower embedded member 1605 are in vertical alignment with the line 1501 and the line 1502. Therefore, the third upper embedded member 1604 and the second lower embedded member 1605 provide benefits similar to those provided by the upper and lower embedded members 1530*a*, 1530*b*, 1530*c* of the first embedded member nail clipper 1500. However, the third upper embedded member 1604 and the second lower embedded member 1605 are not as effective as the horizontal portions 30 because the third upper embedded member 1604 and the second lower embedded member 1605 are not attached to (i.e., integrally formed with respect to) the wrap-around blades 1612, 1614.

The shortened blades 1512, 1514, the wrap-around blades 1612, 1614, and the upper and lower embedded members 1530*a*, 1530*b*, 1530*c*, 1604, 1605 are preferably formed of steel, however other sufficiently hard materials such as a ceramic material may also be used. The shortened blades 1512, 1514, the wrap-around blades 1612, 1614, and the upper and lower embedded members 1530*a*, 1530*b*, 1530*c*, 1604, 1605 are always formed of a dissimilar material as compared to the material that is used to form the fifteenth and sixteenth lower and upper frame members 1520, 1518, 1620, 1618. This is consistent with earlier teachings regarding materials used to form the blades 12, 14, 52, 54, and the attached horizontal portions 30 as compared to materials used to form the frame 16 of the nail clipper 10 (or when compared to the frame 16 of any other embodiment of the invention).

Referring now to FIGS. 59, 59A and 59B is shown a partial view of the seventeenth upper frame member 1720 of the third discreet embedded member nail clipper 1700. A U-shaped embedded member, identified in general by the reference numeral 1702, is embedded into a front portion of the seventeenth upper frame member 1720. The U-shaped embedded member is preferably formed of a metal. A front 1702*a* of the U-shaped embedded member 1702 is flush with a front end 1720*b* of the seventeenth upper frame member 1720. A seventeenth lever 1732 includes a seventeenth fulcrum 1733. The seventeenth lever 1732 and the seventeenth fulcrum 1733 are shown in dashed lines in FIG. 59A. The shortened upper blade 1512 of the first embedded member nail clipper 1500 is shown in a spaced-apart orientation and prior to its insertion in the U-shaped embedded member 1702 of the third embedded member nail clipper 1700.

Referring to FIG. 59B, the U-shaped embedded member 1702 includes a horizontal planar member 1702*h*, a pair of spaced-apart vertical walls 1702*w*1, 1702*w*2 attached longitudinally to opposing sides of the horizontal planar member 1702*h* and a pair of short horizontal members 1702*s*1, 1702*s*2 are each respectively attached to the vertical walls 1702*w*1, 1702*w*2 and which extend inward, toward each other. If desired, the horizontal members 1702*s*1, 1702*s*2 could be lengthened to connect, thereby providing a rectangular cross-sectional shape for the U-shaped embedded member 1702. If desired, the U-shaped embedded member 1702 could be urged into a larger opening provided in the front end 1720*b* of the seventeenth upper frame member 1720. The vertical walls 1702*w*1, 1702*w*2 add considerable stiffness to the U-shaped embedded member 1702 along a vertical direction. The U-shaped embedded member 1702 includes a center rod hole 1722 through which the center rod 24 (not shown) is inserted. If desired, the U-shaped embedded member 1702 and the shortened upper blade 12 can be used in embodiments of the invention that omit the center rod 24 and which use any version of the axially pivoting lever 1132. If the axially pivoting lever 1132 is used, the center rod hole 1722 can be included or omitted, as desired.

During assembly, the shortened horizontal portion 1512*a* is urged a desired distance in the direction of arrow 1710 (FIG. 59, FIG. 59A) into the space between the short horizontal members 1702*s*1, 1702*s*2 and the horizontal planar member 1702*h*. As shown, the shortened horizontal portion 1512*a* of the shortened upper blade 1512 does not extend sufficiently far into the U-shaped embedded member 1702 to sufficiently stiffen the seventeenth upper frame member 1720 or to sufficiently reduce shear. However, the shortened horizontal portion 1512*a* could be lengthened, if desired, to include any desired overall length.

To illustrate another possible embodiment of the invention based on the teachings, the U-shaped embedded member 1702 extends into the seventeenth upper frame member 1720 an amount sufficient so that a portion of the U-shaped embedded member 1702 is disposed in vertical alignment under the downward force applied by the seventeenth fulcrum 1733 and so a remaining portion of the U-shaped embedded member 1702 extends beyond a vertical line where the downward force is applied. Therefore, the U-shaped embedded member 1702 provides the necessary stiffness and increased strength to the seventeenth upper frame member 1720 to withstand whatever shear and other forces are experienced by the front portion of the seventeenth upper frame member 1720 during cutting of the nail 8. In addition, a portion of the horizontal planar member 1702*h* being disposed under the seventeenth fulcrum 1733 of the seventeenth lever 1732, is able to experience some of the force applied to the seventeenth upper frame member 1720 as a compressive force that is transferred down through the plastic of the seventeenth upper frame member 1720 and to the horizontal planar member 1702*h*. In response to the downward force applied to an upper surface of the seventeenth upper frame member 1720, the front end of the seventeenth upper frame member 1720 experiences a decreased level of shear and is safely urged downward during cutting without experiencing excessive shear or stress. As the front end 1720*b* of the seventeenth upper frame member 1720 is urged in a downward direction a remaining rear portion of the seventeenth upper frame member 1720 is also safely urged (i.e., flexes) in a downward direction.

Although not shown, use of the U-shaped embedded member 1702 could also be included in a seventeenth lower frame member (not shown) with the shortened lower blade 1514 being inserted in a second inverted U-shaped embedded member (not shown) that is included in the seventeenth lower frame member. The shortened horizontal portion 1514*a* of the shortened lower blade 1514, if included, could similarly not extend sufficiently far into the second inverted U-shaped embedded member to sufficiently stiffen and strengthen the seventeenth lower frame member or sufficiently reduce shear.

However if included, the second inverted U-shaped embedded member would similarly extend into the seventeenth lower frame member an amount sufficient so that a portion of the second inverted U-shaped embedded member is disposed in vertical alignment above the upward force applied by the enlarged head 24*a* (not shown) of the center rod 24 (not shown) with a remaining portion of the second inverted U-shaped embedded member extending rearward beyond the vertical alignment.

Therefore, the U-shaped embedded member 1702 and the second inverted U-shaped embedded member securely retain the shortened upper and lower blades 1512, 1514 and provide sufficient added strength and stiffness to the seventeenth upper frame member 1720 and the seventeenth lower frame member to withstand the forces experienced during cutting of the nail 8. The U-shaped embedded member 1702 extends beyond the seventeenth fulcrum 1733 (i.e., in vertical alignment with the forces applied during cutting). Additionally, the U-shaped embedded member 1702 and the second inverted the U-shaped embedded member allow for fast and easy insertion of the shortened upper and lower blades 1512, 1514 during manufacture. Friction or other securing means are used to retain the shortened upper and lower blades 1512, 1514 in the U-shaped embedded member 1702 and in the second inverted U-shaped embedded member.

An additional provided benefit is that the U-shaped embedded member 1702 and the second inverted U-shaped embedded member can be used to allow for pulling of the shortened upper and lower blades 1512, 1514 out of the U-shaped embedded member 1702 and, if included, out of the second inverted U-shaped embedded member and for the insertion of a replacement version of shortened upper and/or lower blades 1512, 1514 in the U-shaped embedded member 1702 and in the second inverted U-shaped embedded member when the shortened upper and lower blades 1512, 1514 become dull or are damaged.

If desired, the U-shaped embedded member 1702, if sufficiently long, could also be used with the upper blade 12 or the modified upper blade 52 as alternate means for blade insertion after the seventeenth upper frame member 1720 has been manufactured. It could also be used to change between different modified upper blades 52, having different curvatures, to customize the curvature of cut during manufacture of the third discreet embedded member nail clipper 1700. Such use is described later and further illustrated in FIGS. 65 through 67.

Referring now to FIG. 60 is shown the integral pin lever 1832. The integral pin lever 1832 includes an integral pin embedded member 1836 that is molded into the plastic body of the integral pin lever 1832. The integral pin embedded member 1836 includes an integral pin 1838 that is formed integral with the integral pin embedded member 1836. The integral pin embedded member 1836, including the integral pin 1838, is formed of a metal or any sufficiently strong material. The integral pin embedded member 1836 strengthens the integral pin lever 1832 (as previously described for the embedded member 32*b* or for the embedded reinforcing elongated member 32*j*). The integral pin embedded member 1836, because it includes the integral pin 1838, eliminates the need of having to insert the pin 34 during manufacture.

Referring now to FIG. 60A the PRIOR ART center rod 1824 is shown that includes an open side 1824*a* and an upper notch 1824*b*. If desired, the PRIOR ART center rod 1824 and the integral pin lever 1832 may be used with the nail clipper 10. During assembly, the PRIOR ART center rod 1824 is inserted and the upper frame member 20 is sufficiently depressed to allow insertion of the integral pin 1838 through the open side 1824*a* and then upward and into the upper notch 1824*b*, where the integral pin 1838 is retained after the upper frame member 20 is released. If desired, the PRIOR ART center rod 1824 can be omitted and the modified two-piece center rod 124 along with the lower rod portion 128 can, instead, be used with the integral pin lever 1832 in a manner as has been previously described.

Referring now to FIG. 61 is shown a perspective view of the modified embedded member blade 1900. The modified embedded member blade 1900 illustrates further possible design variability in the embedding of stiffening members (i.e., alternate types of embedded members) into the upper and/or lower frame members 20, 18 of the nail clipper 10 or any other version, thereof.

Although considerable variation is possible, as shown the modified embedded member blade 1900 includes a first cylindrical member 1902, a second cylindrical member 1904, a third cylindrical member 1906 and a fourth cylindrical member 1908 that are each attached at one end, thereof, to a vertical cutting blade portion, identified in general by the reference numeral 1910, of the modified embedded member blade 1900.

The third cylindrical member 1906, as shown, may include an optional lengthening segment, as identified by bracket 1906*a*. If the lengthening segment 1906*a* is omitted, an end of the (shortened) third cylindrical member 1906 that is then disposed closest to the cutting blade portion 1910 is shown in dashed lines. If the lengthening segment 1906*a* is included, it provides an integral extension of the third cylindrical member 1906 that increases the overall longitudinal length of the third cylindrical member 1906. When included as part of the third cylindrical member 1906 an end of the lengthening segment 1906*a* that is closest to the cutting blade portion 1910 is attached to the cutting blade portion 1910 and an opposite end of the lengthening segment 1906*a* that is furthest away from the cutting blade portion 1910 is attached to a remainder of the third cylindrical member 1906. When the third cylindrical member 1906 includes the lengthening segment 1906*a*, the third cylindrical member 1906 extends from the cutting blade portion 1910 to which it is attached and the overall length of the third cylindrical member 1906 is as shown by bracket 1930*b*.

If desired, the lengthening segment 1906*a* can be omitted from the third cylindrical member 1906. If the lengthening segment 1906*a* is omitted from the third cylindrical member 1906, then the third cylindrical member 1906 is not attached to the cutting blade portion 1910.

If desired, it is possible for more than one of the cylindrical members 1902-1908 to not be attached to the cutting blade portion 1910. However, at least one of the cylindrical members 1902-1908, or the horizontal portion 30 or a modified narrower version of the horizontal portion 30, or another horizontally extending member must be attached to the cutting blade portion 1910 in order to provide means for securing the modified embedded member blade 1900 (or a further modified version of the modified embedded member blade—not shown) to each respective upper and/or lower frame member 20, 18.

Any of the first cylindrical member 1902, the second cylindrical member 1904, the third cylindrical member 1906 and the fourth cylindrical member 1908 can be solid or hollow, as desired. While a cylindrical cross-sectional shape is illustrated, it is to be understood that the cross-sectional shape of the cylindrical members 1902-1908 can be modified to include any desired cross sectional shape, including triangular, rectangular, square, oval, polygonal, or any desired complex cross-sectional shape.

Preferably, the cylindrical members 1902-1908 are formed of steel, however they can be formed of any desired material. Preferably, the cylindrical members 1902-1908 are formed as integral components parts (i.e., as horizontal extensions) of the cutting blade portion 1910 of the modified embedded member blade 1900. Therefore, the cylindrical members 1902-1908 are preferably formed of the same material as is a remainder of the modified embedded member blade 1900.

The first cylindrical member 1902, the second cylindrical member 1904, the third cylindrical member 1906 and the fourth cylindrical member 1908 are generally disposed on a plane. During manufacture, at least a portion and preferably as much as possible of the first cylindrical member 1902, the second cylindrical member 1904, the third cylindrical member 1906 and the fourth cylindrical member 1908 are embedded into the upper and/or lower frame members 20, 18 as previously described for the horizontal portions 30 of the blades 12, 14, 52, 54.

The longitudinal length of the first cylindrical member 1902 is shown by bracket 1930. The longitudinal length of the fourth cylindrical member 1908 is the same as the longitudinal length of the first cylindrical member 1902. Therefore, the longitudinal length of the fourth cylindrical member 1908 is also shown by bracket 1930. For illustrative purposes, the length of the first cylindrical member 1902 and the fourth cylindrical member 1908 is the same as the length of the horizontal portion 30 of the blades 12, 14, 52, 54.

Therefore, the first cylindrical member 1902 and the fourth cylindrical member 1908 will extend into the upper and lower frame members 20, 18 (not shown) sufficiently far to ensure that any force applied to the upper and/or to the lower frame members 20, 18 of a further altered version (not shown) of the nail clipper 10 that includes an opposing pair of the modified embedded member blades 1900 (or that are included in an alternate embodiment of the invention) will minimally include a portion, thereof, that is in vertical alignment with a portion of the first cylindrical member 1902 and the fourth cylindrical member 1908, regardless of the overall length of the second and third cylindrical members 1904, 1906. Accordingly, the first cylindrical member 1902 and the fourth cylindrical member 1908 will stiffen, reinforce and strengthen the respective upper or lower frame members 20; 18 to enable the upper or lower frame members 20, 18 to withstand the forces applied, thereto, during use.

Additionally, a portion of the first cylindrical member 1902 and a portion of the fourth cylindrical member 1908 are disposed under and/or above (i.e., in vertical alignment with respect to) the forces that are applied to the upper or lower frame members 20, 18 during cutting of the nail 8. Therefore, the first cylindrical member 1902 and the fourth cylindrical member 1908 each convert at least some of the force that is applied to each of the upper or lower frame members 20, 18 into a compressive force.

Accordingly, the first cylindrical member 1902 and the fourth cylindrical member 1908 lessen the magnitude of shear force that is experienced by the upper or lower frame members 20, 18. By way of contrast, the horizontal portions 30 if included, being planar, are more effective in lessening shear and in increasing the transfer of force to the blades 12, 14, 52, 54 via compression, however any stiffening member that is embedded into the upper or lower frame members 20, 18 and which is in vertical alignment with a force applied to the upper or lower frame member(s) 20, 18 will be effective at reducing shear to some degree. Therefore, while a planar type of embedded member (such as the horizontal portions 30) is generally preferred, it is understood that an embedded member consistent with the teachings herein can include any desired length and width dimension and/or any desired cross-sectional shape.

Additionally, either the first cylindrical member 1902 or the fourth cylindrical member 1908 (or both) satisfy the inventive requirement to include an embedded member in at least one of the upper or lower frame members such that a portion of the embedded member is in vertical alignment with the forces applied to the frame members during cutting of the nail 8. Similarly, the third cylindrical member 1906 (whether the lengthening segment 1906*a* is included or not) also satisfies the inventive requirement of including an embedded member in the upper or lower frame member(s) that includes a portion of the embedded member that is in vertical alignment with the forces applied to the upper or lower frame member(s) 20, 18 during cutting of the nail 8.

It is useful to note that the overall longitudinal length of the embedded member(s) or the cylindrical members 1902-1908 included in the upper frame member 20 does not have to match exactly the overall longitudinal length of the embedded member(s) or the cylindrical members 1902-1908 included in the lower frame member 18, as long as at least one of the included embedded members or at least one of the cylindrical members 1902-1908 is disposed in vertical alignment with respect to the force that is applied to at least one frame member or an alternate type of embedded is included in at least one of the frame members. This is also true with regard to the horizontal portion 30 of the blades 12, 14, 52, 54.

However, it is generally preferred for cost of manufacturing considerations to utilize the same length for the embedded members or the horizontal portion 30 or the cylindrical members 1902-1908 for both the upper and lower frame members 20, 18. Being of equal length provides symmetry which allows the upper and lower blades 12, 14 or the modified blades 52, 54 or the modified embedded member blades 1900 to be identical for certain embodiments of the invention, thereby lessening parts inventory and decreasing the cost of manufacture by increasing the quantity of (identical) parts that are used.

The second cylindrical member 1904 includes a longitudinal length identified by reference bracket 1930*a* that is shorter than the length of bracket 1930. Accordingly, the second cylindrical member 1904 does not extend sufficiently far into the upper or lower frame members 20, 18 to ensure that a portion of the second cylindrical member 1904 will be in vertical alignment with the forces applied to the upper or lower frame members 20, 18 during cutting of the nail 8. This is permissible as long as at least one other embedded member, whether one of the remaining cylindrical members 1902, 1906, 1908, or whether an additional or a different horizontal member (not shown) is included in the modified embedded member blade 1900 that extends sufficiently far, or as long as at least one other discreet member 1604, 1605, 1530*a*, 1530*b*, or 1530*c* (or the third cylindrical member 1906 with or without the lengthening segment 1906*a*) is embedded in the respective upper or lower frame member 20, 18 and is in vertical alignment with the applied force or forces that are applied to at least one of the frame members 20, 18 during cutting. Accordingly, the second cylindrical member 1904 illustrates the possible inclusion of a shorter embedded member.

Though attachment is generally preferred, the embedded member that extends sufficiently far into the frame member 20, 18 does not have to be attached to the cutting blade portion 1910 of the modified embedded member blade 1900 (or attached to the blades 12, 14, 52, 54). This concept is illustrated by inclusion of the third cylindrical member 1906 without inclusion of the lengthening segment 1906*a* and without attachment of the third cylindrical member 1906 to the cutting blade portion 1910.

Referring now in particular to the third cylindrical member 1906, it includes a longitudinal length that is longer than necessary and is embedded as far as desired into one or both of the frame members 20, 18. The third cylindrical member 1906, by itself, satisfies the requirement that any version of the invention include an embedded member that includes a portion, thereof, that is disposed in vertical alignment with a force applied to at least one of the frame members 20, 18 during cutting of the nail 8. Therefore, the third cylindrical member 1906 alone or in combination with the first cylindrical member 1902 and/or the fourth cylindrical member 1908 also satisfies this requirement.

The third cylindrical member 1906 illustrates how, if desired, a longitudinal length greater than that which is necessary for proper operation is possible for one (or more) of the embedded members. Therefore, the use of one or more embedded members that extend further than necessary into at least one of the frame members 20, 18 (i.e., which extend a desired amount further rearward beyond a vertical line where the application of a cutting force occurs), is/are possible. By this teaching the horizontal portions 30 may also be extended by any desired amount.

An optional horizontal connecting member 1912 extends between the second cylindrical member 1904 and the first cylindrical member 1902. The horizontal connecting member 1912 is attached at one end, thereof, to the second cylindrical member 1904 and is attached at a remaining opposite end, thereof, to the first cylindrical member 1902. The horizontal connecting member 1912 is an interconnecting type of embedded member. Accordingly, the horizontal connecting member 1912 illustrates that one or more interconnecting members may be included in the modified embedded member blade 1900. As shown, the horizontal connecting member 1912 is perpendicular with respect to the cylindrical members 1902-1908; however, the horizontal connecting member 1912 could be connected at any desired angle to any of the cylindrical members 1902-1908. The horizontal connecting member 1912 increases structural strength of the modified embedded member blade 1900. The horizontal connecting member 1912 also helps to retain the modified embedded member blade 1900 in the frame member 20, 18 in which it is disposed (i.e., if molded in place).

Additionally, while the horizontal connecting member 1912 and the cylindrical members 1902-1908 are all disposed on the same plane it is understood that further modification could alter the shape or contour of any of these component parts (i.e., the horizontal connecting member 1912 and the cylindrical members 1902-1908) to extend beyond the plane they currently occupy to any desired degree or amount. It is understood that combinations of different cross-sectional shapes for any of these component parts (i.e., the horizontal connecting member 1912 and the cylindrical members 1902-1908) is also possible.

For example, the horizontal connecting member 1912 includes a generally square or rectangular cross-sectional shape, as shown, and it thereby illustrates inclusion of different cross-sectional shapes (profiles) in an embedded member portion of the modified embedded member blade 1900. It is also possible to increase the dimensions of the horizontal connecting member 1912 to any desired size. For example, the horizontal connecting member 1912 could be increased in size to act as an interconnecting planar member, if desired, that extended across a portion of as many of the cylindrical members 1902-1908, as desired.

If an embodiment of the invention utilizing the modified embedded member blade 1900 also includes the center rod 24 (or any variation, thereof) then sufficient spacing and clearance between the second cylindrical member 1904 and the third cylindrical member 1906 is provided to accommodate passage of the center rod 24. Alternately, the center hole 22 could be included, for example in the interconnecting planar member if included, to accommodate passage of the center rod 24. Similar openings are, of course, provided in the upper and lower frame members 20, 18 to accommodate passage of the center rod 24 whenever the center rod 24 is included.

Referring now to FIG. 62 is shown in perspective the concealed lever nail clipper 2000, disposed in an open position. The concealed lever nail clipper 2000 is similar in structure and operation to the nail clipper 10, therefore this description focuses on the differences. Refer also to FIG. 63 which shows a side view of the concealed lever nail clipper 2000 disposed in a rest or transit position.

The concealed lever nail clipper 2000 includes a twentieth modified upper frame member 2020 and a twentieth modified lower frame member 2018. The concealed lever nail clipper 2000 includes a spaced apart pair of twentieth modified container sidewalls 2018*e*, 2018*f* that are each molded as an integral vertical extension of the twentieth modified lower frame member 2018. Consistent with this and other embodiments of the invention, the twentieth modified upper and lower frame members 2020, 2018 are substantially formed (i.e., preferably molded) of a desired plastic or other non-metallic material.

It is important to understand that the concealed lever nail clipper 2000, as well as any embodiment of the invention, may also include any preferred method to increase strength, modify elasticity or modify any structural or mechanical attribute of the twentieth modified upper and/or lower frame members 2020, 2018. For example, a quantity of reinforcing strands or fibers of any desired material, density and length, as shown in squiggly lines and identified in general by reference numeral 2007, may be included within the plastic or other non-metallic material that is used to form either or both of the twentieth modified upper and lower frame members 2020, 2018 or any other component. The reinforcing strands or fibers 2007 can be formed of fiberglass, for example, or other desired material, metallic or otherwise.

It is also possible to specifically include the reinforcing strands or fibers 2007 in certain areas, such as in the twentieth modified upper frame member 2020 beginning at a twentieth modified front end 2020*b* of the twentieth modified upper frame member 2020 and extending rearward to a twentieth modified fulcrum 2033 (i.e., where the cutting forces are applied) to provide improved stiffness in this general area. If desired, the reinforcing strands or fibers 2007 could be eliminated from other areas of the twentieth modified upper frame member 2020 to improve elasticity. Multiple different types of the reinforcing strands or fibers 2007 (i.e., made of different materials) can be used simultaneously, where desired, in any component part or any portion of any component part of any version of the invention to provide any desired characteristic, such as increased stiffness and increased resistance to shear.

If sufficient resistance to shear is provided by the reinforcing strands or fibers 2007 it may be possible to rely on the reinforcing strands or fibers 2007 to provide a similar benefit of converting some of the shear force experienced by the twentieth modified upper frame member 2020 (and/or the twentieth modified lower frame member 2018) into compressive force that is otherwise provided by the horizontal portion 30. In such instance with sufficient benefit provided by inclusion of the reinforcing strands or fibers 2007, a twentieth modified horizontal member 2030 the horizontal portion 30 need not extend rearward into the twentieth modified upper and lower frame members 2020, 2018 far enough to ensure that the horizontal portion 30 is disposed in vertical alignment with the forces applied to the twentieth modified upper and lower frame members 2020, 2018 during cutting of the nail 8. Though the use of reinforcing strands or fibers 2007 is described for the concealed lever nail clipper 2000, the use and benefit of the reinforcing strands or fibers 2007 can be applied to any preferred embodiment of the invention. The reinforcing strands or fibers 2007 teach yet another type of embedded member that improves resistance to shear and which also helps convert some shear into compression.

Also, any desired additive or combination of additives could similarly be included in the plastic or non-metallic material to modify the characteristics (properties) of the twentieth modified upper and lower frame members 2020, 2018 or other component part of any embodiment of the invention.

Any additive for use (i.e., inclusion) in the plastic or inclusion in another type of non-metallic material to either increase strength, improve elasticity or modify a structural or mechanical attribute of the twentieth modified upper and lower frame members 2020, 2018 can similarly be utilized to further modify the concealed lever nail clipper 2000 or to further modify any previously described embodiment or other possible embodiment of the invention.

The concealed lever nail clipper 2000 includes a twentieth modified lever 2032 that preferably includes a slight curvature along a main longitudinal length, thereof. The amount of curvature included, if any, is a variable and it is selected to correspond with a curvature (if any) of an upper edge 2018*e*1 of a first of the twentieth modified container sidewalls 2018*e* and to correspond with a curvature (if any) of an upper edge 2018*f*1 of a second of the twentieth modified container sidewalls 2018*f*. The curvature of the twentieth modified lever 2032 is discussed in greater detail, hereinafter.

The first of the twentieth modified container sidewalls 2018*e* includes a first curved portion 2004. The first curved portion 2004 includes an area where plastic (or other non-metallic material used) has been removed from a front of the first of the twentieth modified container sidewalls 2018*e*.

The second of the twentieth modified container sidewalls 2018*f* includes a second curved portion 2006. The second curved portion 2006 includes an area where plastic (or other non-metallic material used) has been removed from a front of the second of the twentieth modified container sidewalls 2018*f*. The first and second curved portions 2004, 2006 are preferably identical in placement and contour for aesthetic and functional purposes.

The first and second curved portions 2004, 2006 are included to allow urging of the concealed lever nail clipper 2000 into or out of the rest or transit (i.e., storage) position. The concealed lever nail clipper 2000, as shown in FIG. 62 is in the open position, ready for use. To urge the concealed lever nail clipper 2000 into the rest (storage) position, as shown in FIG. 63, a distal end 2032*b* of the twentieth modified lever 2032 is grasped and is urged upward a short distance in the direction of arrow 2001 into a partially raised position. As the distal end 2032*b* is raised, a twentieth U-shaped recessed area 2032*c* of the twentieth modified lever 2032 pivots around the pin 34 an amount sufficient to raise the twentieth U-shaped recessed area 2032*c* above an upper surface of the first and second curved portions 2004, 2006.

While continuing to hold the twentieth modified lever 2032 in the partially raised position, the distal end 2032*b* of the twentieth modified lever 2032 is then rotated around the center longitudinal axis of the center rod 24 one-hundred and eighty degrees, as shown by arrow 2002. The distal end 2032*b* of the twentieth modified lever 2032 is then urged in the direction of arrow 2003 (i.e., in parallel alignment with the body of the concealed lever nail clipper 2000) a sufficient amount to dispose the twentieth modified lever 2032 in the rest position, as shown in FIG. 63.

As shown in FIG. 63, when viewed from the side the curvature of the twentieth modified lever 2032 corresponds with the curvature of the upper edge 2018*e*1 of the first of the twentieth modified container sidewalls 2018*e* and with the curvature of the upper edge 2018*f*1 of the second of the twentieth modified container sidewalls 2018*f*. Preferably, the twentieth modified container sidewalls 2018*e*, 2018*f* each vertically extend upward an amount sufficient so that the upper edges 2018*e*1, 2018*f*1 are at the same elevation above a top of the twentieth modified upper frame member 2020 as is a bottom surface 2032*a* of the twentieth modified lever 2032 when the concealed lever nail clipper 2000 is disposed in the rest position. In the rest position, the bottom surface 2032*a* of the twentieth modified lever 2032 is inverted and, as shown in FIG. 63, the bottom surface 2032*a* is flush with the upper edges 2018*e*1, 2018*f*1. This provides a compact, neat appearance for the concealed lever nail clipper 2000 when it is disposed in the rest position.

The additional vertical elevation of the twentieth modified container sidewalls 2018*e*, 2018*f* are an improvement that helps provide several significant benefits and further advantages.

Because the main longitudinal length of the twentieth modified lever 2032 is disposed between the inside surfaces of the twentieth modified container sidewalls 2018*e*, 2018*f*, the twentieth modified lever 2032 cannot inadvertently rotate out of the rest position. The extended height of the twentieth modified container sidewalls 2018*e*, 2018*f* maintain the twentieth modified lever 2032 in the rest position until the distal end 2032*b* of the twentieth modified lever 2032 is grasped and is urged in the direction of arrow 2001. This helps maintain the concealed lever nail clipper 2000 in the rest position which provides for more compact storage. It is also useful to note that the distal end 2032*b* of the twentieth modified lever 2032 preferably includes a planar surface that is generally disposed on the same plane (or on a similar plane) as is a bottom of the concealed lever nail clipper 2000 when it is disposed in the open position, as shown in FIG. 62. However, when the concealed lever nail clipper 2000 is disposed in the rest position, as shown in FIG. 63, the planar surface of the distal end 2032*b* is then disposed at an angle that allows for a user to easily grasp and engage an edge at the distal end 2032*b* for urging it in the direction as shown by arrow 2001.

Continuing in reverse sequence and opposite direction as was used to urge the concealed lever nail clipper 2000 into the rest position, the concealed nail clipper 2000 is urged from the rest position into the open position (as shown in FIG. 62) for further use.

Another advantage provided by the extended height (elevation) of the twentieth modified container sidewalls 2018*e*, 2018*f* is that the twentieth modified container sidewalls 2018*e*, 2018*f* further help to maintain the twentieth modified lever 2032 in longitudinal alignment with a center longitudinal axis of the concealed lever nail clipper 2000 during cutting of the nail 8. As is plainly visible in FIG. 62 when the concealed lever nail clipper 2000 is disposed in the open position the twentieth modified lever 2032 cannot rotate around the center longitudinal axis of the center rod 24. When cutting of the nail 8 occurs, the distal end 2032*b* is urged downward, toward the twentieth modified upper frame member 2020. This only increases the amount of the twentieth modified lever 2032 that is disposed between the twentieth modified container sidewalls 2018*e*, 2018*f* which, in turn, further helps to maintain longitudinal alignment. Therefore, the twentieth modified lever 2032 is maintained in alignment with the center longitudinal axis of the concealed lever nail clipper 2000 throughout cutting of the nail 8, beginning when the concealed lever nail clipper 2000 is disposed in the open position and continuing through when the concealed lever nail clipper 2000 is disposed in the closed position. Therefore, the twentieth modified lever 2032 of the concealed lever nail clipper 2000 cannot be inadvertently rotated around the center longitudinal axis of the center rod 24 when considerable force is applied to the twentieth modified lever 2032 during cutting of the nail 8. Accordingly, by ensuring alignment of the twentieth modified lever 2032 with the center longitudinal axis of the concealed lever nail clipper 2000, the raised twentieth modified container sidewalls 2018*e*, 2018*f* provide enhanced safety during use, as well as the ability to retain the concealed lever nail clipper 2000 in the rest position.

A further additional benefit provided by the increased height of the twentieth modified container sidewalls 2018*e*, 2018*f* is that they provide increased stiffness (i.e., decreased flexibility) to the twentieth modified lower frame member 2018 in a vertical direction. This, in turn, results in less reliance on any stiffening members. This is described in greater detail, below.

As shown, a twentieth modified enlarged head 2024*a* of the center rod 24 is disposed in a recessed area provided in a bottom of the twentieth modified lower frame member 2018. See also FIG. 20. This provides a smoother generally flat bottom surface for the twentieth modified lower frame member 2018 of the concealed lever nail clipper 2000.

As shown in FIG. 63, the horizontal portion 30 of the upper blade 12 extends sufficiently far toward a rear of the concealed lever nail clipper 2000 to ensure that at least a portion of the horizontal portion 30 is disposed under a vertical line that corresponds with a location where a downward cutting force is applied to a top planar surface of the twentieth modified upper frame member 2020 by the twentieth modified fulcrum 2033 of the twentieth modified lever 2032 during cutting of the nail 8, thereby sufficiently stiffening (and strengthening) the twentieth modified upper frame member 2020 and also helping to reduce a magnitude of shear experienced by the twentieth modified upper frame member 2020 during use. Therefore, the construction and use of the horizontal portion 30 of the upper blade 12 is as previously described.

A twentieth modified lower blade 2014 includes the twentieth modified horizontal portion 2030 that is shorter in length than the horizontal portion 30 of the upper blade 12. However, it is important to note that the twentieth modified horizontal portion 2030 also extends sufficiently far to ensure that at least a portion of the twentieth modified horizontal portion 2030 is disposed in vertical alignment with an opposing force that is applied to the twentieth modified lower frame member 2018 by the twentieth modified enlarged head 2024*a* of the center rod 24. This illustrates that the length of the horizontal portion 30 can be different in the twentieth modified upper frame member 2020 as compared to the length of the twentieth modified horizontal portion 2030 in the twentieth modified lower frame member 2018. The option to vary (modify) the length of the horizontal portion 30 exists for many embodiments of the invention.

Additionally, the extended height and, if desired an optionally increased thickness of the twentieth modified container sidewalls 2018*e*, 2018*f* provide increased rigidity and thereby, increase resistance to flexing by the twentieth modified lower frame member 2018 in the vertical direction. This lessens and may even eliminate for certain embodiments of the invention any necessity that any portion of the twentieth modified horizontal portion 2030 of the twentieth modified lower blade 2014 need extend rearward past the twentieth modified enlarged head 2024*a*. However, it is necessary that at least one frame member (in this example, the twentieth modified upper frame member 2020) must be able to flex enough to permit the concealed lever nail clipper 2000 (or any version of the invention) to be urged into the closed position. Therefore, it is necessary that at least the one frame member (in this example, the twentieth modified upper frame member 2020) that flexes also include the horizontal portion 30 which extends sufficiently far rearward to ensure that at least a portion of the horizontal portion 30 is in vertical alignment with a force applied to the twentieth modified upper frame member 2020 (i.e., the frame member that does the majority of flexing). Alternately the frame member that flexes (i.e., the twentieth modified upper frame member 2020 in this example) can include one of the discreet embedded members 1530*a*, 1530*b*, 1530*c*, or the U-shaped embedded member 1702 or include one of the disclosed alternative embedded members or include the reinforcing strands or fibers 2007 (instead of the horizontal portion 30) to increase strength and lessen shear force experienced by the twentieth modified upper frame member 2020 providing that the embedded member 1530*a*, 1530*b*, 1530*c*, 1702 used similarly extends so that a portion, thereof, is in vertical alignment with the force applied.

Referring now momentarily to FIG. 64, is shown in perspective an enlarged exploded view of the two-piece rotating center rod 2100 hereinafter referred to as the "rotating center rod 2100". The rotating center rod 2100 includes a lower portion, identified in general by the reference numeral 2102 and an upper portion, identified in general by the reference numeral 2104. According to a first embodiment of the rotating center rod 2100, the lower portion 2102 includes a preferred version of the enlarged head 24*a*.

During assembly the pin 34 or the integral pin 1838 (both not shown in FIG. 64) are inserted in the bottom of the upper portion 2104 and urged upward toward a U-shaped top of the upper portion 2104. The bottom of the upper portion 2104 includes a pair of outwardly extending protrusions 2104*a* and 2104*b* that each include an upper surface attached thereto. The outwardly extending protrusions 2104*a*, 2104*b* are urged together and the upper portion 2104 is urged downward in the direction of arrow 2110 after having first urged the lower portion 2102 upward into position during assembly. The outwardly extending protrusions 2104*a*, 2104*b* enter into a cylindrical opening 2112 disposed at a top of the lower portion 2102. The upper portion 2104 is urged downward until the upper surfaces of the outwardly extending protrusions 2104*a*, 2104*b* are disposed below an inner recessed lip 2108 provided in the lower portion 2102. The recessed lip 2108 extends around the inside circumference of the cylindrical opening 2112.

The outwardly extending protrusions 2104*a*, 2104*b* then expand by hysteresis (i.e., their inherent elasticity) so that the upper surfaces of the outwardly extending protrusions 2104*a*, 2104*b* are disposed under the recessed lip 2108. Accordingly, the upper portion 2104 is able to rotate in either direction around a center longitudinal axis of the lower portion 2102, as shown by arrow 2114. This facilitates rotation of the lever 32 (not shown) in the direction of arrow 2114 which is useful when urging the nail clipper 10 into or out of the rest position.

According to a second embodiment of the rotating center rod 2100, the lower portion 2102 is shortened as shown by dashed line 2106, and a lower portion that includes the enlarged head 24*a* is eliminated. Instead, the shortened lower portion 2102 is molded as an integral part of the lower frame member 18 (of any preferred embodiment of the invention). When the shortened lower portion 2102 is molded as an integral part of the lower frame member 18, the shortened lower portion 2102 extends upward. As the shortened lower portion 2102 is molded as an integral part of the lower frame member 18 it is unable to rotate around its own center longitudinal axis. However, because the upper portion 2104 is able to rotate around the center longitudinal axis of the lower portion 2102, the lever 32 (or the integral pin lever 1832) is thereby able to rotate around the center longitudinal axis of the shortened lower portion 2102 which allows urging of any version of the nail clipper that includes the shortened lower portion 2102 molded to the lower frame member 18 into the rest position.

Referring momentarily again to FIG. 50 and FIG. 51, the optional file opening 1397 is shown in dashed lines. The optional file opening 1397 is formed in the thirteenth modified lower frame member 1318 of the first single blade nail clipper 1300. The optional file 1398 is shown in dashed lines inside the opening 1397. The file 1398 includes a file surface 1398*a* that is able to smooth a surface of the nail 8 by removing (i.e., abrading or otherwise removing) material from the nail 8. If the opening 1397 and the file 1398 are included, the file 1398 is normally disposed in the opening 1397 where friction secures it in place. An exposed end of the file 1398 is grasped and the file 1398 is urged out of the opening 1397 when filing of the nail 8 is deemed to be necessary. Together, the first single blade nail clipper 1300 and the file 1398 cooperate to provide a smooth finish cut edge for the nail 8. Being able to store the file 1398 in the first single blade nail clipper 1300 ensures that the file 1398 will always be available for use along with the first single blade nail clipper 1300 to complete the process of cutting the nail 8. As the optional inclusion of the opening 1397 and the file 1398 have been fully described in FIGS. 50 and 51, they are not shown in FIGS. 52 and 53. The opening 1397 and the file 1398 can be optionally included in various embodiments of the invention, as desired, whether single or dual opposing blade versions.

If optionally included in any embodiment, the opening 1397 for the file 1398 as well as the file 1398 can also be part of the engineering calculus in determining flexibility or stiffness as it will have an effect on the flexibility or stiffness, as shown, of the thirteenth modified lower frame member 1318.

Referring now to FIG. 11A is shown a perspective view of the modified abrasive blade, identified in general by the reference numeral 2200. The abrasive blade 2200, as shown, includes the curved cutting edges 52*a*, 54*a*, however the teachings of the abrasive blade 2200 are equally applicable for use with the upper and lower blades 12, 14 that include the straight cutting edges 12*a*, 14*a*. Other than as noted below, the abrasive blade 2200 is identical to the upper and lower blades 12, 14 or to the modified blades 52, 54. Therefore, certain of the previous reference numerals for the upper and lower blades 12, 14 are also included in the current drawing figure, but are not again described The abrasive blade 2200 includes an abrasive surface, identified in general by the reference numeral 2202. The abrasive surface 2202 is disposed along as much of an outside vertical surface 2204 of the abrasive blade 2200, as desired. The outside vertical surface 2204 includes an exterior surface portion of the vertical plane 12*g*, 14*g* on a side, thereof, that is disposed maximally away from the rear sidewall 12*e*, 14*e* of the upper and lower blades 12, 14. During cutting, the outside vertical surface 2204 faces away from the frame 16 of the nail clipper 10 and toward the nail 8. The abrasive surface 2202 is disposed above the cutting edge 12*a*, 14*a*, 52*a*, 54*a*. Ideally, the abrasive surface 2202 begins as close as possible to the cutting edge 12*a*, 14*a*, 52*a*, 54*a* and maximally extends from side to side. The reason for this is discussed below.

A preferred type of the abrasive surface 2202 includes a file-like surface similar to that of the file surface 1398*a* of the file 1398. The abrasive surface 2202 includes a series of ridges and/or points or other sufficiently abrasive pattern on its surface for smoothing or removing material from the nail 8. It is generally preferred that the outside vertical surface 2204 include an etching pattern (chemical or laser or otherwise) or a machined pattern or a stamped pattern thereon that replicates or approximates the cutting (i.e., abrasive) action of the file 1398. Because the abrasive blade 2200, like the upper and lower blades 12, 14, is preferably made of steel or of a desired metal or alloy, the abrasive surface 2202 when formed into the vertical surface 2204 is sufficiently durable.

It is also possible to include a coating of sufficiently abrasive material for the abrasive surface 2202. For example, any sufficiently hard material such as diamond dust, small sand, grit, or metallic particles, or any other sufficiently fine and sufficiently hard material can be adhered by any preferred means to the vertical surface 2204 to provide the abrasive surface 2202.

The abrasive surface 2202 need only be harder than the hardness of the nail 8 to function effectively. Therefore, the abrasive surface 2202 does not need to include a hardness rating that is especially high, although it can include any desired ROCKWELL TM scale of hardness rating or value on any other scale for determining hardness. The abrasive surface 2202 includes any desired coarseness or fineness. Therefore, the abrasive surface 2202 provides any desired degree or rate of abrasion.

Any alternative desired treatment of the outside vertical surface 2204 that provides the abrasive surface 2202 is also possible. For example if desired, a small planar section of sandpaper or emery board or other abrasive thin sheet material of a preferred grit could be attached (i.e., adhered) to the outside vertical surface 2204 to provide the abrasive surface 2202.

The purpose of the abrasive surface 2202 is to automatically file the nail 8 during cutting of the nail 8. The abrasive surface 2202 is especially effective at filing the nail 8 during cutting because as the cutting edge 12*a*, 14*a* progressively descends into the nail 8 the nail clipping 8*a* is retained in position until the cut is completed. This has been previously described. The nail clipping 8*a*, which is still attached to the nail 8 until it is finally severed, provides a barrier that maintains the cutting edge 12*a*, 14*a*, 52*a*, 54*a* in position and which also helps apply an inward force that urges (i.e., helps to maintain) the abrasive surface 2202 firmly against the nail 8 along the location of a newly cut surface that is progressively being made deeper into the nail 8. At the moment the cut is completed, the abrasive surface 2202 descends further into the nail 8 to complete filing of the newly cut nail 8. By having the abrasive surface 2202 begin as close (i.e., as low) to the cutting edge 12*a*, 14*a* as possible and maximally extend from side-to-side across the width of the outside vertical surface 2204, this helps ensure maximum contact between the abrasive surface 2202 and the newly cut surface of the nail 8, thereby sanding (i.e., filing and smoothing) as much of the newly cut surface of the nail 8 as possible.

Therefore, the abrasive blade 2200 represents a significant improvement to prior art parallel cut nail clipper blades because it automatically files the nail 8 as it cuts the nail 8. As such, the abrasive surface 2202 is an element of a cutting blade for use with the nail clipper 10 (or any embodiment, thereof), not previously known. The abrasive blade 2200 can be used with any version of the invention, whether single blade or dual blade. If used with a dual blade embodiment, the abrasive blade 2200 can be included to replace both the upper and lower blades 12, 14, 52, 54 by utilizing two of the abrasive blades 2200. Though generally not preferred if used with a dual blade embodiment (because the use of two of the abrasive blades 2200 is then preferred), the abrasive blade 2200 may be included to replace only the upper blade 12 or alternately, the lower blade 14 if desired for some reason.

The abrasive surface 2202 is also readily adapted for inclusion on an exterior surface of any desired prior art nail clipper blade above a prior art cutting edge for any prior art type of parallel cutting nail clipper. Therefore, the abrasive surface 2202 is an improvement that is also adaptable for use with prior art nail clipper blades.

The abrasive surface 2202 of the abrasive blade 2200 is also available to provide a further benefit. After the nail 8 has been cut, if the user desires an even smoother cut surface than is provided by cutting of the nail 8 with the abrasive blade 2200, the abrasive surface 2202 can be used as a small conventional type of file to additionally file the exterior cut surface of the nail 8. The newly cut surface of the nail 8 is held against the abrasive surface 2202 and the nail 8 is gently urged back and forth while maintaining pressure against the abrasive surface 2202. If desired, the nail clipper 10 (that includes the abrasive blade 2200) is gently urged back and forth while maintaining contact of the abrasive surface 2202 upon the newly cut surface of the nail 8. The abrasive blade 2200 can, accordingly, be used as a small conventional type of file when desired, and as an automatic file that operates whenever the nail 8 is being cut.

Referring now again momentarily to FIG. 24 is shown an optional magnifying lens 32*mg* formed of glass or sufficiently transparent plastic disposed in an opening 32*mo* provided through the first modified lever 32*f*. The magnifying lens 32*mg* preferably includes a double convex type of lens used in a traditional magnifying glass (not shown) or any preferred optical device or arrangement of lenses that is capable of magnifying an image. During use, the magnifying lens 32*mg* is held over the nail 8 for closer inspection by providing an enlarged view of a portion of the nail 8. Small "hangnails" or areas where cutting of the nail 8 is uneven can be better observed and then corrected by subsequent cutting or filing where desired. Therefore, the magnifying lens 32*mg* provides an important improvement not previously available with prior art nail clippers.

The teaching is to optionally provide a magnified image that will allow for better trimming (cutting) of the nail 8. Therefore, if desired, the functionality of the magnifying lens 32*mg* could instead be accomplished by use of an electronic image capture technology by including a small display screen 32*ds* connected to a computer chip 32*cs*. An optical sensor 32*os*, similar to a type of light sensitive array used in a prior art digital camera is included where desired. As shown, the optical sensor 32*os* is disposed on a side of the first modified lever 32*f* that is opposite the side of the display screen 32*d*. This preferred positioning better replicates the traditional "feel" of viewing an object through a prior art version of the magnifying glass. If desired, a memory chip 32*mc* could also be optionally included for storage of a quantity of captured images. A port 32*cp* of any preferred configuration or communication protocol could be used to access the captured images. This would allow for more detailed remote viewing of the captured images on an external monitor which could be useful in further trimming of the nail 8 or to better determine if an infection or other condition may be present proximate the nail 8.

The computer chip 32*cs*, the display screen 32*ds*, the optical sensor 32*os* and the memory chip 32*mc* may be powered by a battery 32*eb* that is contained in an opening in the first modified lever 32*f*. The battery 32*eb* could be disposed behind a removable cover 32*rc* which would then allow periodic replacement of the battery 32*eb*. If desired, the battery 32*eb* could be embedded in the first modified lever 32*f* if a non-replaceable version of the battery 3*eb* is desired.

Alternately, a small solar panel 32*sp* could be included instead of the battery 32*eb* or in addition to the battery 32*eb*. The solar panel 32*sp* is attached to the first modified lever 32*f* (where desired) and is used to power the computer chip 32*cs* and the display screen 32*ds* if the battery 32*eb* is eliminated. If the battery 32*eb* is included, the solar panel 32*sp* is used to charge the battery 32*eb*. Electrical wiring interconnecting the solar panel 32*sp*, the computer chip 32*cs*, the display screen 32*ds*, the optical sensor 32*os*, the port 32*cp* and the memory chip 32*mc* are shown in dashed lines. However, it is to be understood that these components could all be included, along with all electrical interconnections, in an electronic assembly that includes a larger integrated circuit or a closer placing of components in closer proximity to each other. The electronic assembly could be placed where desired in the first modified lever 32*f* or, if the magnified lens 32*mg* is eliminated, the electronic assembly could be placed in the opening 32*mo* or in a modified opening.

The magnifying lens 32*mg* or, if included, the display screen 32*ds* provides a magnified image. During use, the first modified lever 32*f* (or any version of the lever 32 or any version of the axially pivoting lever 1132) is opened and the magnifying lens 32*mg* or the optical sensor 32*os* is placed a desired distance above the nail 8 to provide a desired degree of magnification. If the image is to be saved in the memory chip 32*mc* a save button 32*sb* could be included that is depressed to save the image to the memory chip 32*mc*. Wiring from the computer chip 32*cs* to the save button 32*sb* is also shown in dashed lines. If desired, the save button 32*sb* may also be included even if the memory chip 32*mc* is eliminated and function, instead, as an on-off button. If the memory chip 32*mc* is included the save button 32*sb* could function as the on-off button if a more extended period of time is used to cycle the electronic image capture technology on or off and a shorted depression period of time could be used to save an image to the memory chip 32*mc*. Alternately, the location of the save button 32*sb* could be moved and its functioning changed so that the save button 32*sb* (or an optional position sensor—not shown) includes a signal that automatically powers off the electronic image capture technology of nail clipper 10 when the nail clipper 10 is disposed in the rest (i.e., storage or transit) position and which automatically powers on the electronic image capture technology for use when the nail clipper 10 is disposed in the open through the closed positions. If the saved image is to be retrieved, electrical connection via the port 32*cp* communicates with the computer chip 32*cs* to obtain and download the image (or images) stored in the memory chip 32*mc*.

The magnifying lens 32*mg* contributes to better cutting of the nail 8 and is an important improvement to cutting of the nail 8 that is unavailable with prior art nail clippers. The ability to mold plastic allows for the inclusion of the magnifying lens 32*mg* or the electronic image capture technology at low cost. However, the use of plastic in prior art dual parallel opposing blade types of nail clippers that does not include the horizontal portion 30 or other version of the embedded member 32*b* in vertical alignment with an applied cutting force has precluded molding the frame 16 from plastic and, thereby precluded the inclusion of the many additional heretobefore unknown innovative benefits and advantages described throughout this specification. Therefore, the current invention teaches a low cost way of using plastic, instead of steel, for the frame 16 and it is this teaching that then allows for many of the novel inventive further improvements and advances, as disclosed herein.

If desired, any embodiment of the invention may also include the magnifying lens 32*mg* or the electronic image capture technology located elsewhere on the device, for example, in the frame 16. Alternately, a frame extension (not shown) that protrudes from the rear wall 19 of the frame 16 could be optionally included with the nail clipper 10 (or other version) to house the magnifying lens 32*mg* or to house the electronic image capture technology components, as desired. Depending on the capability of the electronic image capture technology additional uses and benefits may also be provided.

If the center rod 24 is included, then the blades 12, 14 or the modified blades 52, 54 or any embedded member 1530*a*, 1530*b*, 1530*c*, 1604, 1605 must include the opening provided by the center hole 22 for the center rod 24 (or any version, thereof) to pass through. However, if the axially pivoting lever 1132 (or any version, thereof) is instead included, then inclusion of the center hole 22 in the blades 12, 14 or in the modified blades 52, 54 is optional.

Referring now to FIG. 65 is shown a perspective view of the safety blade 2300. Please refer also to FIG. 65A, which shows two of the safety blades 2300 in a closed position, with the cutting edges abutting one-another and absent any supporting [frame] structure. Please refer also to FIG. 66 which shows a bottom view of the safety blade 2300. Please refer also to FIGS. 66A and 66*b* which each, respectively, show a similar bottom view of the modified first safety blade 2300*a* and of the modified second safety blade 2300*b*.

The safety blade 2300 includes a first radius of cut 2300*d* that extends across a cutting edge (the location of which is also shown by reference numeral 2300*d*). As shown, the first radius of cut 2300*d* includes only a slight curvature (i.e., a large radius), thereto.

The modified first safety blade 2300*a* includes a second radius of cut 2300*e* that extends across a cutting edge (the location of which is also shown by reference numeral 2300*e*). The second radius of cut 2300*e* includes a sharper curvature (i.e., a shorter radius) than that of the safety blade 2300.

The modified second safety blade 2300*b* includes a third radius of cut 2300*f* that extends across a cutting edge (the location of which is also shown by reference numeral 2300*f*). The third radius of cut 2300*f* includes an even sharper curvature (i.e., an even shorter radius) than that of the modified first safety blade 2300*a*.

The modified first safety blade 2300*a* and the modified second safety blade 2300*b* are identical to the safety blade 2300 except for the shorter radius of the second radius of cut 2300*e* and the even shorter radius of the third radius of cut 2300*f*, as compared to the radius of cut 2300*d* of the safety blade 2300.

The safety blade 2300, as shown, is largely identical to the modified blades 52, 54, however the safety blade includes as an improvement, thereof, a first recess 2302 and a second recess 2304 that are disposed on lower opposite corners of the vertical plane 12*g*, 14*g* immediately adjacent to the cutting edge (as also shown by reference numeral 2300*d*). While the size of the first and second recesses 2302, 2304 is a design variable that is varied as desired, a small size of approximately one-sixteenth of an inch wide by one-thirty-second of an inch high is preferred for certain versions of the safety blade 2300.

Referring now in particular to the front view of FIG. 65A, when two of the safety blades 2300 (or any version, thereof 2300*a*, 2300*b*) are used (with a dual blade version of the invention), and when the nail clipper 10 (or other embodiment) is disposed in the closed position the first recess 2302 of an upper one of the safety blades 2300 aligns over the second recess 2304 of a lower one of the safety blades 2300 to create a first safety gap, identified in general by the reference numeral 2306. On an opposite side, the second recess 2304 of the upper one of the safety blades 2300 aligns over the first recess 2302 of the lower one of the safety blades 2300 to create a second safety gap, identified in general by the reference numeral 2308. Using the above-mentioned dimensions the first and second safety gaps 2306, 2308 would provide a square opening when the nail clipper 10 is disposed in the closed position of approximately one-sixteenth of an inch.

During cutting of the nail 8 when either side of the safety blades 2300 is urged fully to one side of the nail 8, at least a portion of one of four vertical edges 2310, 2312, 2314, 2316 contacts a fleshy part of the finger 9 that is on opposite sides of the nail 8. As the nail clipper 10 (or other embodiment) is urged into the closed position, contact with any of the vertical edges 2310-2314 limits how much of the fleshy part can be disposed in the first and second safety gaps 2306, 2308. Therefore, either one or both of the first and second safety gaps 2306, 2308 provide an area for a small amount of the fleshy part of the finger 9 to be disposed when the nail clipper 10 is finally urged fully into the closed position.

The first and second safety gaps 2306, 2308 help prevent cutting of the fleshy part of the finger 9 during use. While all users can potentially benefit from this improvement, it is especially helpful to the elderly, those with arthritis or other deficits that impair fine motor control, and those who are vision-impaired. The safety blade 2300 thereby satisfies yet another object of the invention, to provide a safety improvement that makes cutting of the finger 9 less likely to occur when cutting the nail 8. As such, many users may wish to cut their nails 8 in the dark, something that could not be performed with as the current degree of safety as existed prior to this improvement.

It is, of course, to be understood that for single blade embodiments of the invention only one of the safety blades 2300, the modified first safety blades 2300*a* or the modified second safety blades 2300*b* are utilized. For single blade versions, the dimensions of the first and second safety gaps 2306, 2308 are varied, as desired to provide the ideal level of safety and ease of use.

The first and second recesses 2302, 2304 and the first and second safety gaps 2306, 2308 of the safety blade 2300 (or of the modified first safety blade 2300*a* and the modified second safety blade 2300*b*) can also be included in further modified versions of either the blades 12, 14, or the modified blades 52, 54, or the abrasive blade 2200 as well as any other possible embodiment or variation, thereof. The first and second recesses 2302, 2304 and the first and second safety gaps 2306, 2308 are an improvement that can also be included with prior art nail clipper blades (not shown).

The different curvatures of the safety blade 2300 compared to the modified first safety blade 2300*a* and further compared to the modified second safety blade 2300*b* illustrate how the invention can be tailored to provide a desired curvature to the nail 8 after it has been cut. Ideally, only one or as few as possible cuts of the nail 8 as possible are preferred to fully cut the nail 8 and to provide a desired curvature of the cut of the nail 8. The desired curvature can vary from nail 8 to nail 8 of the same person and between different people, some of whom may prefer a longer or a shorter radius of curvature to their cut nail 8.

When attempting to cut a greater width of the nail 8 with each cut, the first and second safety gaps 2306, 2308 of the safety blade 2300, or of the modified first safety blade 2300*a*, or the modified second safety blade 2300*b* provide an important added margin of safety that better allows full-width or near full-width cutting of the nail 8 with either the first radius of cut 2300*d*, the second radius of cut 2300*e*, or the third radius of cut 2300*f*.

It is therefore, desirable to provide a method of helping a user to create a customized version of the nail clipper 10 for subsequent manufacture and delivery to the user that provides a desired finished curvature of cut or which helps the user to select at least one of the nail clippers 10 that has already been manufactured and which includes the desired curvature.

Referring now to FIG. 67 is shown a view in perspective of a method 3000 for providing (i.e., manufacturing or selecting or obtaining at retail) a customized nail clipper (as described immediately above) using the mobile computing device 3003 and a software application 3022 disposed in the mobile computing device 3003 (or alternately by accessing via the mobile computing device 3003 a modified version of the software application 3022 that is primarily located in a remote server and in communication with the mobile computing device 3003). Access to (i.e., enabling of) the software application 3022 is accomplished by a user-activated menu selection via one or more depressions of button 3022 and/or by any other manually accomplished input, such as by one or more menu selections accomplished by depressing a location on a display 3005 screen and/or by voice input or by any other known way of running the software application 3022.

A pinky 3002 that includes a pinky nail 3002*a* is shown. An image of the pinky 3005 and an image of the pinky nail 3006 is shown on the display 3005. A radius of the pinky nail 3008, as determined by the software application 3022 is shown on the display 3005. The radius of the pinky nail 3008 is determined by the software application 3022 analyzing the curvature of the image of the pinky nail 3006. By simple comparison or other software means, the software application 3022 determines the radius of the pinky nail 3008. If desired, the software application 3022 can also assign and indicate on the display 3005 a manufacturing number that corresponds with the radius of the pinky nail 3008. For example, a "Number 5" curvature may be the best match available. Therefore, the user knows that any custom manufactured version of the invention will require a "Number 5" blade to provide a desired curvature for the user's pinky nail 3002*a*. As described, the software application 3022 operates best if the pinky nail 3002*a* includes a desired finished curvature. However, the software application 3022 can also include an optional subroutine that provides a modified image of the pinky nail (not shown) that is different than the actual curvature of the pinky nail 3002*a*. In this manner, the user can "see" what their pinky nail 3002*a* might look like with different curvatures of cut and thereby purchase a curvature that optimizes appearance of the pinky nail 3002*a* regardless of its current curvature. By allowing the pinky nail 3002*a* to grow, if necessary, the user can visually determine an optimum appearance, purchase a customized version of the invention with any desired curvature of cut, and later cut the pinky nail 3002*a* to achieve that appearance. Therefore, the image of the pinky nail 3006 and/or the radius of the pinky nail 3008 as shown on the display 3005 can indicate a current actual curvature of the pinky nail 3002*a* or either or both images can be representative of a possible curvature that the user is considering.

An image of a ring finger 3010, an image of a nail of the ring finger 3012, an image of a wedding band 3011, and a calculated ring finger nail radius of cut 3014 are also shown on the display 3005. A partial view of a middle finger 3016, an index finger 3018, and a thumb 3020 are also shown. By zooming in or out images of as many or as few of the nails 3006, 3012 of the hand (or of a foot), as desired, and their curvatures of cut are shown on the display 3005. The benefits described by use of the method 3000 for customized cutting of the pinky nail 3002*a* apply to cutting of any the nails 3002*a*, 3012 of any of the fingers or toes of the hands and/or feet. Therefore, the image of the nail of the ring finger 3012 and/or the radius of the ring finger nail 3014 can be indicative of the actual (current) image of the ring finger nail 3012 or the ring finger nail radius 3014, or of any possible shape that the user may be considering.

As shown, the radius of the ring finger nail 3014 is flatter (i.e., has a longer radius) than the shown radius of the pinky nail 3008. Therefore, a different blade number, perhaps a "Number 3" blade could be assigned to optimally match the curvature of the radius of the ring finger nail 3014.

Accordingly, two different curvatures of cut require the purchase of two different customized versions of the invention (i.e., the nail clipper 10) to cut these two nails 3002*a*, 3012. The number of customized versions of the invention to cut all the fingers of the hands and/or feet vary from one that is selected to include an average curvature of cut that can be used with all of the nails 8 to two or more. It is possible that as many as five customized versions can be required for either hand or for either foot, however it is likely that the same customized device can be used to cut more than one of the nails 8.

Ideally, the software application 3022 will allow the user to select any available body style (i.e., any of the embodiments shown or any embodiment that is currently available, whether a single or a dual blade version. Ideally, the software application 3022 will also allow the user to select for inclusion in the selected body style any of the blades 12, 14, 52, 54, 1512, 1514, 1612, 1614, 1712, 1900, 2200, 2300, 2300*a*, 2300*b*. It is possible to provide further modified blades (not shown) that include combinations of the teachings, herein, in which the further modified include certain of the elements illustrated or described for any of the blades 12, 14, 52, 54, 1512, 1514, 1612, 1614, 1712, 1900, 2200, 2300, 2300*a*, 2300*b* or which could include further modifications only now obvious to those of ordinary skill after first having had full benefit of the instant disclosure.

Ideally, the software application 3022 will also allow the user to select any desired color or combination of colors, possibly also allowing custom printing to further customize their version of the nail clipper 10 through greater personalization. While any embodiment of the invention is possible for customization, the modified dual parallel opposing blade embedded member nail clipper 10*a* allows for easy insertion of the desired blades 12, 14, 52, 54, 1512, 1514, 1612, 1614, 1712, 1900, 2200, 2300, 2300*a*, 2300*b* into the upper and lower openings 13*a* 13*b*.

After the user has selected one or more desired customized versions of the nail clipper 10 (or other version) numerous other options may be provided. For example, the user may accomplish payment by entry of credit card or debit card information or may accomplish payment by any other available means. The customized products will then be manufactured and shipped as a set directly to the user or to a retail outlet of the user's choice, or elsewhere, as may be selected by the user. It is also possible that certain of the customized products may be available in inventory and selected from inventory for shipment.

It is also possible for the software application 3022 to determine if the customized devices are available at any retail outlet stores near the user or if any standard product offerings that are available at nearby retail outlets may satisfy the user's needs. The software application 3022 may ask the user (on the display 3005) if the user is interested in making a purchase at a nearby store or ordering product online from any affiliated online business that offers product for sale. Obtaining product sooner, even if not exactly inclusive of every custom feature, may have added value to the user. Ideally, the software application 3022 in cooperation with the mobile computing device 3003 allows for custom manufacture of a desired version of the nail clipper 10 (or any other single or dual blade embodiment, thereof) or provides guidance to the user where a similar product can be purchased, whether directing the user to a nearby retail outlet or to an online business.

With regard to the benefits provided by the nail clipper 10 or other embodiment, thereof, because the frame 16 is molded from a polymer (or other non-metallic material) a significant increase in flexibility of appearance of design is provided by the current invention. If desired, the frame 16 could include additional portions (not shown) added wherever desired that could significantly change the appearance of any version of the invention. For example, other embodiments that continue to include (i.e., embody) the cardinal teachings herein could be made to resemble any desired model of an automobile by the addition of any of a variety of additional features, such as miniature molded wheels and molded tires, a molded windshield, molded headlights, molded taillights, a molded trunk, etc., which could appeal to a wide spectrum of adults and children. Refer momentarily again to FIG. 49, where a pair of optional molded headlights 1200*mh* are shown in dashed lines and a pair of optional molded wheels 1200*mw* are also shown in dashed lines. The headlights 1200*mh* may include LED lights that are molded in place. Similarly, one or more optional LED viewing lights 1200*v*1 (dashed lines) can be molded or otherwise attached where desired to direct light toward, and thereby illuminate, the cutting edges 12*a*, 14*a* when energized. The save button 32*sb*, the battery 32*eb* and the electrical wiring, described above, could be included to supply current to illuminate the headlights 1200*mh* and/or the viewing lights 1200*v*1, on demand. If used in this manner the electronic image capture technology components could be eliminated or included as well, as may be desired. The optional viewing lights 1200*v*1 are used to illuminate the nail 8 during cutting, which would facilitate cutting of the nail 8 under many dimly illuminated conditions, and possibly even permit safe and effective cutting in greater darkness. It is important to clearly see the nail 8 during cutting. Because the blades of all dual parallel opposing blade types of nail clippers partially obscure the nail 8 during cutting, the viewing lights 1200*v*1 provide increased clarity of view which, in turn, provides for a smoother and more accurate cutting of the nail 8. If desired, depression of the axially pivoting lever 1132 (or any other version of the lever 32 for any other embodiment) could activate the LED viewing lights 1200*v*1 as such depression would occur when cutting of the nail 8 is desired. If desired, any desired optional molded caricature or sculpted image 1200*cc*, shown in dashed lines can be included anywhere desired. The caricature or sculpted image 1200*cc* can include a cartoon or movie caricature or an image of a cartoon or movie superhero, a sports or celebrity figure, a product logo, or a team logo, raised lettering or any other desired molded or sculpted representation. The caricature or sculpted image 1200*cc* can be molded as an optional additional part attached anywhere desired to the modified axially pivoting nail clipper 1200 or to any other version of the invention. These optional enhancements may increase appeal for children and also for select adults.

If desired, the invention can be manufactured to include resemblance of almost any desired animate or inanimate object. The preceding proposed additional optional enhancements are also believed to be novel when compared to prior art dual opposing blade or parallel cut single blade types of nail clippers. Additionally, the light emitted from the headlights 1200*mh* or from the viewing lights 1200*v*1 could be used for other illumination or signaling purposes, as desired. If desired, one or more of the headlights 1200*mh* could be further modified to include a laser light.

It is also possible to further modify the center rod 24 of the nail clipper 10 to produce an integral center rod (not shown). With the integral center rod a lower end of the center rod is formed (i.e., molded) as an integral component part of the lower frame member 18. The integral center rod reduces parts inventory by eliminating the center rod 24 and the integral center rod shortens the time of assembly by not having to insert and properly orient the center rod 24 before insertion of the pin 34 is accomplished.

The numerous teachings and options described herein can be combined in many ways. It is not possible to describe all possible combinations of all of the elements disclosed, herein. It is to be understood that after having had benefit of this disclosure by a person of ordinary skill in the art, the various teachings, herein, can be selectively combined in any preferred manner or combination without departing from the teachings or scope of the invention.

The invention has been shown, described, and illustrated in substantial detail with reference to the presently preferred embodiments. It will be understood by those skilled in this art that other and further changes and modifications may be made without departing from the spirit and scope of the invention which is defined by the claims appended hereto.

What is claimed is:

1. A single blade nail clipper, comprising:

(a) a parallel cutting blade that, during use in cutting a nail, is capable of making a cut simultaneously across a length of the nail that is in contact with a cutting edge of the cutting blade and wherein the nail clipper includes a frame and wherein the frame includes an upper frame member and a lower frame member that are each formed primarily of a plastic or other non-metallic material; and (b) a stiffening member attached to the upper frame member wherein the stiffening member is formed of a dissimilar metallic material than a remainder of the material used to form the upper frame member, and wherein said stiffening member increases a stiffness of the frame member to which it is attached sufficient to permit the frame member to withstand a cutting force that is applied to the frame member during a cutting of a nail by the nail clipper.

2. The single blade nail clipper of claim 1 wherein said upper frame member and said lower frame member are formed or molded together to provide a one-piece frame of the nail clipper.

3. The single blade nail clipper of claim 1 wherein said upper frame member and said lower frame member are formed or molded as separate component parts that are secured together.

4. The single blade nail clipper of claim 1 wherein at least a portion of said stiffening member is embedded into said upper frame member.

5. The single blade nail clipper of claim 1 wherein at least a portion of said stiffening member is in vertical alignment with a force that is applied by a user during a cutting of the nail to the upper frame member.

6. The single blade nail clipper of claim 1 wherein at least a portion of said stiffening member is embedded into said upper frame member proximate a front of said upper frame member and wherein a force that is applied to the upper frame member during a cutting of the nail is in vertical alignment with at least a portion of said stiffening member.

7. The single blade nail clipper of claim 6 wherein said stiffening member includes a horizontal portion, and wherein said horizontal portion is attached at one end, thereof, to an upper end of said cutting blade, and wherein said horizontal portion is disposed on a generally horizontal plane, and wherein said cutting blade is generally disposed on a plane of said cutting blade, and wherein said plane of said cutting blade is disposed at an angle with respect to said horizontal plane.

8. The single blade nail clipper of claim 1 wherein said stiffening member includes any preferred thickness or any preferred width or any preferred length.

9. The single blade nail clipper of claim 1 wherein said upper frame member or said lower frame member or both said upper frame member and said lower frame member include a sidewall that is attached thereto as an integral part thereof.

10. The single blade nail clipper of claim 1 wherein said lower frame member includes a planar surface, and wherein a plane of said planar surface is parallel with respect to a plane of said cutting edge when said nail clipper is disposed in an open position and when said nail clipper is disposed in a closed position, and wherein when said nail clipper is disposed in said closed position said cutting edge is in contact with said planar surface.

11. The single blade nail clipper of claim 1 wherein said lower frame member includes a planar surface, and wherein said planar surface includes a hardened planar surface attached thereto, and wherein a plane of said hardened planar surface is parallel with respect to a plane of said cutting edge when said nail clipper is disposed in an open position and when said nail clipper is disposed in a closed position, and wherein when said nail clipper is disposed in said closed position said cutting edge is in contact with said hardened planar surface.

12. A dual blade nail clipper, comprising:

(a) a pair of parallel cutting blades wherein each of the cutting blades include a cutting edge attached thereto, wherein the cutting edges face toward each other and are parallel with respect to each other when the nail clipper is disposed in an open position and when the nail clipper is disposed in a closed position, wherein during use the cutting edges make a cut across a length of a top of a nail and simultaneously across a length of a bottom of the nail that is in contact with the cutting edges of the cutting blades and wherein the nail clipper includes a frame and wherein the frame includes an upper frame member and a lower frame member that are each formed primarily of a plastic or other non-metallic material; and (b) at least one stiffening member attached to the upper frame member or attached to the lower frame member, wherein the stiffening member is formed of a dissimilar metallic material than a remainder of the material used to form the upper frame member or the lower frame member, and wherein the stiffening member increases a stiffness of the frame member to which it is attached sufficient to permit the frame member to withstand a cutting force that is applied to the frame member during a cutting of a nail by the nail clipper.

13. The dual blade nail clipper of claim 12 wherein said upper frame member and said lower frame member are formed together by any preferred means or are molded together to provide a one-piece frame of the nail clipper.

14. The dual blade nail clipper of claim 12 wherein said upper frame member and said lower frame member are individually formed by any preferred means or are molded as separate component parts wherein said individually formed upper and lower frame members or said separate component parts are secured together.

15. The dual blade nail clipper of claim 12 wherein at least a portion of said stiffening member is embedded into said upper frame member or is embedded into said lower frame member.

16. The dual blade nail clipper of claim 12 wherein at least a portion of said stiffening member is in vertical alignment with a force that is applied to said upper frame member by a user or to said lower frame member by the user during a cutting of the nail.

17. The dual blade nail clipper of claim 12 wherein at least a portion of said stiffening member is embedded into said upper frame member proximate a front of said upper frame member and wherein a force that is applied to the upper frame member during a cutting of the nail is in vertical alignment with at least a portion of said stiffening member, or wherein at least a portion of said stiffening member is embedded into said lower frame member proximate a front of said lower frame member and wherein a force that is applied to said lower frame member during a cutting of the nail is in vertical alignment with at least a portion of said stiffening member.

18. The dual blade nail clipper of claim 17 wherein said stiffening member includes a horizontal portion, and wherein said horizontal portion is attached at one end, thereof, to an upper end of said cutting blade, and wherein said horizontal portion is disposed on a generally horizontal plane, and wherein said cutting blade is generally disposed on a plane of said cutting blade, and wherein said plane of said cutting blade is disposed at an angle with respect to said horizontal plane.

19. The dual blade nail clipper of claim 12 wherein said stiffening member includes any preferred thickness or any preferred width or any preferred length.

20. The dual blade nail clipper of claim 12 wherein said upper frame member or said lower frame member or both said upper frame member and said lower frame member include a sidewall that is attached thereto as an integral part thereof, and wherein said upper frame member and said lower frame member are generally disposed on a horizontal plane, and wherein said sidewall extends from said upper frame member or from said lower frame member in a generally vertical direction.

21. The dual blade nail clipper of claim 12 wherein said lower frame member includes a pair of spaced-apart sidewalls that are disposed on opposite sides of said lower frame member and wherein said pair of sidewalls are formed substantially of a desired plastic or other non-metallic material, and wherein said pair of sidewalls are formed as an integral part of said lower frame member and wherein said pair of sidewalls extend vertically from said lower frame member in an upward direction an amount sufficient for an upper edge of each of said pair of sidewalls to at least reach a bottom surface of said upper frame member when the nail clipper is disposed in the closed position.

22. The dual blade nail clipper of claim 12 wherein said lower frame member includes a pair of spaced-apart sidewalls that are disposed on opposite sides of said lower frame member and wherein said pair of sidewalls are formed substantially of a desired plastic or other non-metallic material, and wherein said pair of sidewalls are formed as an integral part of said lower frame member and wherein each of said pair of sidewalls extend vertically from said lower frame member in an upward direction an amount sufficient for at least a portion of an upper edge of each of said pair of sidewalls to extend above an upper surface of said upper frame member when the nail clipper is disposed in the open position.

23. The dual blade nail clipper of claim 12 wherein said lower frame member includes a pair of spaced-apart sidewalls that are disposed on opposite sides of said lower frame member and wherein said pair of sidewalls are formed substantially of a desired plastic or other non-metallic material, and wherein said pair of sidewalls are formed as an integral part of said lower frame member and wherein said pair of sidewalls extend vertically from said lower frame member in an upward direction an amount sufficient for at least a portion of an upper edge of each of said pair of sidewalls to correspond in elevation with at least a portion of an upper surface of said upper frame member when the nail clipper is disposed in the open position and wherein, as the upper frame member is urged toward the lower frame member during a cutting of the nail, a portion of a lever of the nail clipper is urged below a line that extends between the upper edge of each of the pair of sidewalls an amount sufficient to help retain the lever in longitudinal alignment with a longitudinal axis of the nail clipper.

24. The dual blade nail clipper of claim 12 wherein said lower frame member includes a pair of spaced-apart sidewalls that are disposed on opposite sides of said lower frame member and wherein said pair of sidewalls are formed substantially of a desired plastic or other non-metallic material, and wherein said pair of sidewalls are formed as an integral part of said lower frame member and wherein each of said pair of sidewalls extend vertically from said lower frame member in an upward direction an amount sufficient for at least a portion of an upper edge of each of said pair of sidewalls to extend above an upper surface of said upper frame member when the nail clipper is disposed in the open position, and wherein the nail clipper includes a lever and a rest position, and wherein when said lever of the nail clipper is disposed in the rest position, a portion of said lever is disposed above said upper surface of said upper frame member and between a portion of said upper edges of said pair of sidewalls.

25. The dual blade nail clipper of claim 12 including a lever and a center rod, wherein the lever is cooperatively engaged with said center rod.

26. The dual blade nail clipper of claim 25 wherein said lever is able to pivot around a longitudinal axis of said center rod, and including means for maintaining said lever in longitudinal alignment with the frame when the nail clipper is disposed in the open position and a distal end of said lever is urged toward said upper frame member or when the nail clipper is disposed in a rest position.

27. The dual blade nail clipper of claim 25 wherein said lever includes a member embedded therein, and wherein said member is formed of a dissimilar material than a remainder of said lever, and wherein said member improves the structural integrity of said lever.

28. The dual blade nail clipper of claim 25 wherein said center rod is formed of a plastic or other non-metallic material.

29. The dual blade nail clipper of claim 25 wherein said center rod includes a center rod assembly that is formed of at least two component parts.

30. The dual blade nail clipper of claim 29 wherein said one of said component parts of said center rod is able to rotate around a center longitudinal axis of said center rod assembly with respect to a remaining one of said component parts of said center rod.

31. The dual blade nail clipper of claim 25 wherein said center rod is formed as an integral component part of said lower frame member.

32. The dual blade nail clipper of claim 12 including a lever and wherein said lower frame member includes a pair of spaced-apart sidewalls that are disposed on opposite sides of said lower frame member and wherein said pair of sidewalls are formed substantially of a desired plastic or other non-metallic material, and wherein said pair of sidewalls are formed as an integral part of said lower frame member and wherein each of said pair of sidewalls extend vertically from said lower frame member in an upward direction, and wherein said lever is cooperatively attached to said pair of sidewalls and is able to pivot about an axis passing through said pair of sidewalls.

33. The dual blade nail clipper of claim 32 wherein said lever is able to pivot around said axis an amount sufficient to urge the nail clipper from the open position into the closed position.

34. The dual blade nail clipper of claim 32 wherein said lever is able to pivot around said axis an amount sufficient to urge the nail clipper from the open position into a rest position.

35. A dual blade nail clipper, comprising:

(a) a pair of parallel cutting blades wherein each of the cutting blades include a cutting edge attached thereto, wherein the cutting edges face toward each other and are parallel with respect to each other when the nail clipper is disposed in an open position and when the nail clipper is disposed in a closed position, wherein during use the cutting edges make a cut across a length of a top of a nail and simultaneously across a length of a bottom of the nail that is in contact with the cutting edges of the cutting blades and wherein the nail clipper includes a frame and wherein the frame includes an upper frame member and a lower frame member that are each formed primarily of a plastic or other non-metallic material; and (b) wherein said upper frame member or said lower frame member or both said upper frame member and said lower frame member include a sidewall that is attached thereto as an integral part thereof, and wherein said upper frame member and said lower frame member are generally disposed in a horizontal manner, said sidewall extends from said upper frame member or from said lower frame member in a generally vertical direction; and wherein said sidewall extends the entire longitudinal length of said nail clipper.

36. A single blade nail clipper, comprising:

(a) a parallel cutting blade that, during use in cutting a nail, is capable of making a cut simultaneously across a length of the nail that is in contact with a cutting edge of the cutting blade and wherein the nail clipper includes a frame and wherein the frame includes an upper frame member and a lower frame member that are each formed primarily of a plastic or other non-metallic material, wherein said lower frame member includes a planar surface, and wherein a plane of said planar surface is parallel with respect to a plane of said cutting edge when said nail clipper is disposed in an open position and when said nail clipper is disposed in a closed position; and (b) wherein said upper frame member or said lower frame member or both said upper frame member and said lower frame member include a sidewall that is attached thereto as an integral part thereof, and wherein said upper frame member and said lower frame member are generally each disposed on a parallel, spaced-apart horizontal planes, and wherein said sidewall extends from said upper frame member or from said lower frame member along a plane that extends in a generally vertical direction with respect to the horizontal planes of the upper and lower frame members.

37. A single blade nail clipper, comprising:

(a) a parallel cutting blade that, during use in cutting a nail, is capable of making a cut simultaneously across a length of the nail that is in contact with a cutting edge of the cutting blade and wherein the nail clipper includes a frame and wherein the frame includes an upper frame member and a lower frame member that are each formed primarily of a plastic or other non-metallic material, wherein said lower frame member includes a planar surface, and wherein a plane of said planar surface is parallel with respect to a plane of said cutting edge when said nail clipper is disposed in an open position and when said nail clipper is disposed in a closed position; and (b) wherein said lower frame member includes a pair of spaced-apart sidewalls that are disposed on opposite sides of said lower frame member, and wherein said pair of sidewalls are formed as an integral part of said lower frame member and wherein each of said pair of sidewalls extend vertically from said lower frame member in an upward direction.

38. An improvement to a nail clipper of the type that includes at least one parallel cutting blade wherein the cutting blade makes a cut simultaneously across a length of a nail that is in contact with a cutting edge of the cutting blade and wherein the nail clipper includes a frame and wherein the frame includes an upper frame member and a lower frame member that are each formed primarily of a plastic or other non-metallic material, wherein the improvement comprises:

at least one stiffening member attached to the upper frame member or attached to the lower frame member or wherein said at least one stiffening member includes two stiffening members and wherein one of said two stiffening members is attached to the upper frame member and wherein a remaining one of said two stiffening members is attached the lower frame member of the nail clipper, wherein each of the stiffening members is formed of a dissimilar material than a remainder of the material used to form the upper frame member or the lower frame member, and wherein at least one of said stiffening members is formed of a metal, and wherein the stiffening member increases a stiffness of the frame member to which it is attached sufficient to permit said frame member to withstand a cutting force that is applied to said frame member during a cutting of a nail by the nail clipper.

39. The improvement of claim 38 wherein said stiffening member is disposed at a front end of the lower frame member or at a front end of the upper frame member or wherein when said stiffening member includes two stiffening members one of said two stiffening members is disposed at a front end of the lower frame member and said remaining one of said two stiffening members is disposed at a front end of the upper frame member, and wherein a force that is applied during a cutting of the nail to the lower frame member or to the upper frame member is in vertical alignment with at least a portion of at least one of said stiffening members.

40. The improvement of claim 38 wherein at least a portion of said stiffening member is embedded into said upper frame member or into said lower frame member or wherein when said stiffening member includes two stiffening members at least a portion of one of said two stiffening members is embedded into said upper frame member and at least a portion of said remaining one of said two stiffening members is embedded into said lower frame member.

41. The improvement of claim 38 wherein said stiffening member or either or both of said two stiffening members includes any preferred thickness or any preferred width or any preferred length, and wherein a force that is applied during a cutting of the nail to the lower frame member or applied to the upper frame member is in vertical alignment with at least a portion of at least one of the stiffening members that is embedded in the upper frame member or in the lower frame member.

42. The improvement of claim 38 wherein any of said stiffening members includes a horizontal portion that is attached to the cutting blade at an end of the cutting blade that is opposite to where the cutting edge is disposed.

43. The improvement of claim 42 wherein the cutting edge is disposed on a first plane and wherein said horizontal portion is disposed on a second plane, and wherein said first plane is disposed at an angle with respect to said second plane.

44. The improvement of claim 38 wherein said at least one cutting blade includes a pair of cutting blades, and wherein each of said pair of cutting blades includes one of said cutting edges, and wherein said cutting edges are parallel with respect to each other when the nail clipper is disposed in an open position and when the nail clipper is disposed in a closed position, and wherein said cutting edges face each other, and wherein a first of said cutting blades is attached to said upper frame member and wherein a second of said cutting blades is attached to said lower frame member, and wherein said first of said cutting blades and said second of said cutting blades each include a horizontal portion that is attached to said first and to said second of said cutting blades at an end of said first and said second of said cutting blades that is opposite to where said cutting edges are disposed, and wherein a force that is applied during a cutting of the nail to the upper frame member or to the lower frame member is in vertical alignment with at least a portion of said horizontal portion that is attached to the upper frame member or to the lower frame member.

45. The improvement of claim 38 wherein said at least one cutting blade includes a pair of cutting blades, and wherein each of said pair of cutting blades includes one of said cutting edges, and wherein said cutting edges are always parallel with respect to each other, and wherein said cutting edges face each other, and wherein a first of said cutting blades is attached to said upper frame member and wherein a second of said cutting blades is attached to said lower frame member, and wherein said first of said cutting blades and said second of said cutting blades each include a horizontal portion that is attached to said first and to said second of said cutting blades at an end of said first and said second of said cutting blades that is opposite to where said cutting edges are disposed, and wherein a force that is applied during a cutting of the nail to the upper frame member and to the lower frame member is in vertical alignment with at least a portion of said horizontal portion that is attached to the upper frame member, and wherein an opposing force that is applied during the cutting of the nail to the lower frame member is in vertical alignment with at least a portion of the horizontal portion that is attached to the lower frame member.

46. The improvement of claim 38 wherein any of said stiffening members includes at least one discreet member that is formed of said dissimilar material, and wherein said discreet member is not formed as an integral part of the cutting blade.

47. The improvement of claim 46 wherein a force that is applied during a cutting of the nail to the lower frame member or to the upper frame member is in vertical alignment with at least a portion of said at least one discreet member.

48. The improvement of claim 46 wherein said at least one discreet member is formed of a metal.

49. The improvement of claim 38 wherein any of said stiffening members is formed of a metal.

50. An improvement to a parallel cutting blade for use in a nail clipper in which the parallel cutting blade includes a cutting edge that is disposed on a plane and wherein the parallel cutting blade makes a cut simultaneously across a portion of a nail that is disposed adjacent to the cutting edge of the parallel cutting blade during cutting of the nail, wherein the improvement comprises a blade portion that is disposed on a first plane and a horizontal portion that is disposed on a second plane, wherein the second plane is different than the first plane, and wherein the horizontal portion is attached at a first end thereof to the blade portion and wherein at least a portion of the horizontal portion is attached to or embedded in a frame member of the nail clipper, wherein the frame member is formed of a plastic or other non-metallic material, wherein the horizontal portion is formed of a dissimilar material than the frame member, and wherein the horizontal portion extends in a rearward direction away from the blade portion sufficiently far so that at least a portion of the horizontal portion extends rearward to at least an opening provided in the horizontal portion, the opening allowing passage of a center rod of the nail clipper there-through, wherein the center rod is operatively connected to a lever of the nail clipper.

51. An improvement to a parallel cutting blade for use in a nail clipper in which the parallel cutting blade includes a cutting edge that is disposed on a plane and wherein the parallel cutting blade makes a cut simultaneously across a portion of a nail that is disposed adjacent to the cutting edge of the parallel cutting blade during cutting of the nail, wherein the improvement comprises a blade portion that is disposed on a first plane and a horizontal portion that is disposed on a second plane, wherein the second plane is different than the first plane, and wherein the horizontal portion is attached at a first end thereof to the blade portion and wherein at least a portion of the horizontal portion is attached to or embedded in a frame member of the nail clipper, wherein the frame member is formed of a plastic or other non-metallic material, and wherein the horizontal portion extends in a rearward direction away from the blade portion sufficiently far so that at least a portion of the horizontal portion is in vertical alignment with a force that is applied to the frame member during a cutting of the nail.

52. A dual blade nail clipper, comprising:

(a) a pair of parallel cutting blades wherein each of the cutting blades include a cutting edge attached thereto, wherein the cutting edges face toward each other and are parallel with respect to each other when the nail clipper is disposed in an open position and when the nail clipper is disposed in a closed position, wherein during use the cutting edges make a cut across a length of a top of a nail and simultaneously across a length of a bottom of the nail that is in contact with the cutting edges of the cutting blades and wherein the nail clipper includes a frame and wherein the frame includes an upper frame member and a lower frame member that are each formed primarily of a plastic or other non-metallic material; and (b) wherein said lower frame member includes a pair of spaced-apart sidewalls that are disposed on opposite sides of said lower frame member and wherein said pair of sidewalls are formed substantially of a desired plastic or other non-metallic material, and wherein said pair of sidewalls are formed as an integral part of said lower frame member and wherein said pair of sidewalls extend vertically from said lower frame member in an upward direction and wherein said sidewalls extend the entire longitudinal length of said nail clipper.

* * * * *